US008427384B2

(12) United States Patent
Clymer et al.

(10) Patent No.: US 8,427,384 B2
(45) Date of Patent: Apr. 23, 2013

(54) COMMUNICATION SYSTEM WITH BROADBAND ANTENNA

(75) Inventors: Richard Clymer, Concord, NH (US); Frank Blanda, Nashua, NH (US)

(73) Assignee: Aerosat Corporation, Amherst, NH (US)

( * ) Notice: Subject to any disclaimer, the term of this patent is extended or adjusted under 35 U.S.C. 154(b) by 853 days.

(21) Appl. No.: 12/604,087

(22) Filed: Oct. 22, 2009

(65) Prior Publication Data

US 2010/0188304 A1 Jul. 29, 2010

Related U.S. Application Data

(63) Continuation-in-part of application No. PCT/US2008/076216, filed on Sep. 12, 2008.

(60) Provisional application No. 61/107,606, filed on Oct. 22, 2008, provisional application No. 61/108,237, filed on Oct. 24, 2008, provisional application No. 60/971,958, filed on Sep. 13, 2007, provisional application No. 60/973,112, filed on Sep. 17, 2007, provisional application No. 61/095,167, filed on Sep. 8, 2008.

(51) Int. Cl.
*H01Q 13/00* (2006.01)
*H01Q 19/06* (2006.01)

(52) U.S. Cl.
USPC ..... 343/776; 343/772; 343/786; 343/753

(58) Field of Classification Search ..... 343/711–714, 343/753, 772, 776, 786
See application file for complete search history.

(56) References Cited

U.S. PATENT DOCUMENTS

| | | | | |
|---|---|---|---|---|
| 390,350 | A | 2/1888 | Denton | |
| 2,718,592 | A * | 9/1955 | Smith | 343/778 |
| 2,764,757 | A * | 9/1956 | Rust et al. | 343/783 |
| 2,884,629 | A * | 4/1959 | Mason | 343/753 |
| 2,908,002 | A * | 10/1959 | Van Atta | 343/776 |

(Continued)

FOREIGN PATENT DOCUMENTS

| | | |
|---|---|---|
| CH | 664848 | 3/1988 |
| EP | 0 390 350 B1 | 2/1995 |

(Continued)

OTHER PUBLICATIONS

Written Opinion of the International Searching Authority, PCT/US2008/076216, Jan. 22, 2009.*

(Continued)

*Primary Examiner* — Douglas W Owens
*Assistant Examiner* — Jennifer F Hu
(74) *Attorney, Agent, or Firm* — Lando & Anastasi, LLP

(57) ABSTRACT

A communications system including an antenna array and electronics assembly that may be mounted on and in a vehicle. The communication system may generally comprise an external subassembly that is mounted on an exterior surface of the vehicle, and an internal subassembly that is located within the vehicle, the external and internal subassemblies being communicatively coupled to one another. The external subassembly may comprise the antenna array as well as mounting equipment and steering actuators to move the antenna array in azimuth, elevation and polarization (for example, to track a satellite or other signal source). The internal subassembly may comprise most of the electronics associated with the communication system.

32 Claims, 91 Drawing Sheets

U.S. PATENT DOCUMENTS

| | | | | | |
|---|---|---|---|---|---|
| 3,623,111 | A | * | 11/1971 | Provencher et al. | 343/727 |
| 4,228,410 | A | | 10/1980 | Goudey et al. | |
| 4,366,453 | A | | 12/1982 | Schwarz | |
| 4,498,061 | A | | 2/1985 | Morz et al. | |
| 4,673,943 | A | | 6/1987 | Hannan | |
| 4,827,269 | A | | 5/1989 | Shestag et al. | |
| 5,086,304 | A | * | 2/1992 | Collins | 343/778 |
| 5,166,698 | A | | 11/1992 | Ashbaugh et al. | |
| 5,359,338 | A | * | 10/1994 | Hatcher et al. | 343/778 |
| 5,973,647 | A | | 10/1999 | Barrett et al. | |
| 6,023,246 | A | | 2/2000 | Tannabe et al. | |
| 6,201,508 | B1 | | 3/2001 | Metzen et al. | |
| 6,807,396 | B2 | | 10/2004 | Horie et al. | |
| 6,950,073 | B2 | | 9/2005 | Clymer et al. | |
| 6,992,639 | B1 | | 1/2006 | Lier | |
| 7,423,604 | B2 | * | 9/2008 | Nagai | 343/776 |
| 2007/0001918 | A1 | | 1/2007 | Ebling et al. | |

FOREIGN PATENT DOCUMENTS

| | | | |
|---|---|---|---|
| GB | 2 108 770 | A | 5/1983 |
| GB | 2208969 | | 4/1989 |
| GB | 2 232 010 | A | 11/1990 |
| JP | 59-022403 | | 2/1984 |
| JP | 04-150501 | | 5/1992 |
| JP | 06-061900 | | 3/1994 |

OTHER PUBLICATIONS

Storkus, Walter L., "Design Techniques for Compact Monopulse Antenna Feeds for W-Band Radar Systems," IEEE MTT-S International Microwave Symposium—Digest, May 8-10, 1990, XP010004571 Dallas (US), pp. 805-808.

* cited by examiner

COMMUNICATION SYSTEM WITH BROADBAND ANTENNA

CROSS-REFERENCE TO RELATED APPLICATIONS

This application claims priority under 35 U.S.C. §119(e) to U.S. Provisional Application No. 61/107,606, entitled "Communication System with Broadband Antenna" filed Oct. 22, 2008 and to U.S. Provisional Application No. 61/108,237 entitled "Communication System with Broadband Antenna" filed Oct. 24, 2008. This application is a continuation-in-part of, and claims priority to, PCT Application No. PCT/US08/76216 entitled "Communication System with Broadband Antenna" filed Sep. 12, 2008, which claims priority to U.S. Provisional Application No. 60/971,958 entitled "Communication System with Broadband Antenna" filed Sep. 13, 2007, and to U.S. Provisional Patent Application No. 60/973,112 entitled "Communication System with Broadband Antenna" filed Sep. 17, 2007, and to U.S. Provisional Patent Application No. 61/095,167 entitled "Communication System with Broadband Antenna" filed Sep. 8, 2008. Each of the above-identified application is incorporated herein by reference in its entirety.

BACKGROUND

1. Field of the Invention

The present invention relates to wireless communication systems, in particular, to an antenna and communications subsystem that may be used on passenger vehicles.

2. Discussion of Related Art

Many communication systems involve reception of an information signal from a satellite. Conventional systems have used many types of antennas to receive the signal from the satellite, such as Rotman lenses, Luneberg lenses, dish antennas or phased arrays. However, these systems may suffer from limited field of view or low efficiency that limit their ability to receive satellite signals. In particular, these conventional systems may lack the performance required to receive satellite signals where either the signal strength is low or noise is high, for example, signals from low elevation satellites.

In addition, many conventional systems do not include any or sufficient polarization correction and therefore cross-polarized signal noise may interfere with the desired signal, preventing the system from properly receiving the desired signal. Further, locating such systems on a fuselage of an aircraft for transmission or reception of signals poses a number of issues that must be addressed for such systems.

There is therefore a need for an improved communication system, including an improved antenna system, which may be able to receive weak signals or communication signals in adverse environments, and which can be located at least partly on the fuselage of an aircraft.

SUMMARY OF THE INVENTION

Aspects and embodiments are directed to a communications system including an antenna array and electronics assembly that may be mounted on and in a vehicle. The communication system may generally comprise an external subassembly that is mounted on an exterior surface of the vehicle, and an internal subassembly that is located within the vehicle, the external and internal subassemblies being communicatively coupled to one another. As discussed below, the external subassembly may comprise the antenna array as well as mounting equipment and steering actuators to move the antenna array in azimuth, elevation and polarization (for example, to track a satellite or other signal source). The internal subassembly may comprise most of the electronics associated with the communication system. Locating the internal subassembly within the vehicle may facilitate access to the electronics, and may protect the electronics from the environment exterior to the vehicle, as discussed in further detail below. Embodiments of the communication system provide numerous advantages over prior art systems, including being of relatively small size and weight (which may be particularly advantageous for a system mounted on an aircraft), and having excellent, broadband RF performance, as discussed further below.

According to one embodiment, an antenna array comprises a plurality of horn antenna elements, a corresponding plurality of dielectric lenses, each dielectric lens of the plurality of dielectric lenses being coupled to a respective horn antenna element of the plurality of horn antenna elements, and a waveguide feed network coupling the plurality of horn antenna elements to a common feed point, wherein the plurality of horn antenna elements and corresponding plurality of dielectric lenses are shaped and sized such that the antenna array is tapered at either end of the antenna array.

In one example, the plurality of horn antenna elements are arranged in one or more parallel rows, wherein, in examples where there are two or more rows, the parallel rows may be offset from one another along the length of the antenna array by one half the width of one of the plurality of horn antenna elements. In another example, the plurality of horn antenna elements may include an interior horn antenna element, a third horn antenna element, a second horn antenna element, and an end horn antenna element, wherein the third horn antenna element is smaller than the interior horn antenna element and is located closer to an end of the antenna array than the interior horn antenna element, wherein the second horn antenna element is smaller than the third horn antenna element and is located closer to the end of the antenna array than the third horn antenna element, and wherein the end horn antenna element is smaller than the second horn antenna element and is located at the end of the antenna array. In another example, the plurality of dielectric lenses elements may include an interior dielectric lens, a third dielectric lens, a second dielectric lens, and an end dielectric lens, wherein the interior dielectric lens is coupled to the interior horn antenna element, wherein the third dielectric lens is smaller than the interior dielectric lens and is coupled to the third horn antenna element, wherein the second dielectric lens is smaller than the third dielectric lens and is coupled to the second horn antenna element, and wherein the end dielectric lens is smaller than the second dielectric lens and is coupled to the end horn antenna element. The antenna array may further comprise a plurality of horn inserts, each one of the plurality of horn inserts being located within a respective one of the plurality of horn antenna elements. In one example, the horn inserts located within the end horn antenna element and the second horn antenna elements are made of a radar absorbent material. In another example, each dielectric lens is fastened to the respective horn antenna element with a fiberglass pin.

Another aspect is directed to a method of calibrating a vehicle-mounted antenna array. In one embodiment, the method comprises determining an RF center of a beam pattern of the antenna relative to a location of a position encoder mounted on the antenna array or gimbal assembly, calculating a first pitch offset and a first roll offset of the antenna array, gimbal assembly or other component of the external subsystem, relative to the location of the position encoder, and storing the calculated first pitch and roll offsets in a local memory device. In another embodiment, the method further comprises receiving data representative of a vehicle pitch and vehicle roll of a host vehicle upon which the antenna array is mounted, sensing with the position encoder, an antenna pitch and antenna roll, calculating an second pitch offset between the vehicle pitch and the antenna pitch, calculating a second roll offset between the vehicle roll and the antenna roll, and storing the calculated second pitch and roll offsets in the local memory device. In one example, method further comprises storing the calculated second pitch and roll offsets in a remote memory device. In another example, the method further comprises correcting the second pitch and roll offsets based on the first pitch and roll offsets, and storing the corrected second pitch and roll offsets in the local memory device. The method may further comprise storing the corrected second pitch and roll offsets in the remote memory device. In one example, the method further comprises receiving data representative of a vehicle heading of the host vehicle, pointing the antenna array at a selected satellite signal source, determining an antenna heading based on a signal lock with the selected satellite signal source, calculating a heading offset between the vehicle heading and the antenna heading, and storing the heading offset in the local memory device. The method may further comprise storing the heading offset in the remote memory device. In one example, receiving data representative of the vehicle pitch and vehicle roll of the host vehicle includes receiving the date from a navigation system in the host vehicle.

According to another embodiment, a communications system comprises a first sub-system comprising an antenna array configured to receive and transmit signals, a gimbal assembly configured to mount the antenna array a host platform and to move the antenna array in azimuth and elevation, a first memory device, and at least one position encoder mounted to the antenna array, and a second sub-system communicatively coupled to the first sub-system and comprising a second memory device, and a control unit configured to control movement of the antenna array in azimuth and elevation, wherein the at least one position encoder is configured to detect a pitch and roll of the antenna array relative to a factory-calibrated level position of the antenna array and to provide a first antenna data signal representative of the detected pitch and roll of the antenna array, wherein the first and second memory devices are communicatively coupled together and are configured to receive and store the antenna data signal. In one example, the first and second memory devices are further configured to store identifying information about the first and second sub-systems.

According to another embodiment, a vehicle-mounted communications system comprises an external sub-system mounted to an exterior surface of the vehicle, the external sub-system comprising an antenna array configured to receive and transmit signals, a gimbal assembly configured to mount the antenna array to the vehicle and to move the antenna array in azimuth and elevation, a local memory device, and at least one position encoder mounted to the antenna array, and an internal sub-system communicatively coupled to the first sub-system and comprising a control memory device, and a control unit configured to control movement of the antenna array in azimuth and elevation, wherein the control unit is configured to receive data representative of a pitch and roll of the vehicle upon which the antenna array is mounted, wherein the position encoder is configured to sense a pitch and roll of the antenna array, wherein the control unit is configured to calculate a pitch offset between the pitch of the vehicle and the pitch of the antenna and a roll offset between the roll of the vehicle and the roll of the antenna, and wherein the control memory device is configured to store the calculated pitch and roll offsets.

In one example, the local memory device is configured to store the calculated pitch and roll offsets. In another example, the local and control memory devices are further configured to store identifying information about the internal and external sub-systems.

Another aspect is directed to a communications system comprising an antenna array including a plurality of antenna elements each adapted to receive an information signal from a signal source, and a feed network coupling the plurality of antenna elements to a common feed point, and a polarization converter unit coupled to the common feed point, the polarization converter unit configured to compensate for polarization skew between the antenna array and the signal source. In one embodiment, the polarization converter unit comprises a rotary orthomode transducer configured to receive two orthogonally polarized component signals making up the information signal and to provide a polarization-corrected output signal, a drive system coupled to the rotary orthomode transducer configured to receive a control signal representative of a desired degree of rotation of the rotary orthomode transducer, and a motor configured to provide power to the drive system to rotate the rotary orthomode transducer to the desired degree of rotation.

In one example, the polarization converted unit is mounted to the antenna array. In another example, the plurality of antenna elements and the feed network are arranged to provide a cavity between the feed network and the plurality of antenna elements, wherein the polarization converter unit is mounted at least partially within the cavity. In another example, the plurality of antenna elements are horn antenna elements, and the feed network is a waveguide feed network.

According to one embodiment, an antenna array comprises a plurality of horn antenna elements, a corresponding plurality of dielectric lenses, each dielectric lens of the plurality of dielectric lenses being coupled to a respective horn antenna element of the plurality of horn antenna elements, and a waveguide feed network coupling the plurality of horn antenna elements to a common feed point, wherein each dielectric lens is a plano-convex lens having a planar side and an opposing convex side, wherein each dielectric lens comprises a plurality of impedance matching features formed proximate an interior surface of the convex side, and wherein an exterior surface of the convex side is smooth.

In one example, the plurality of impedance matching features includes a plurality of hollow tubes. In another example, each dielectric lens further comprises a plurality of impedance matching grooves extending from a surface of the planar side into an interior of the dielectric lens. The plurality of dielectric lenses may comprise, for example, a cross-linked polystyrene material or, for example, Rexolite™.

In another embodiment, an antenna array comprises a plurality of horn antenna elements configured to receive an information signal, a corresponding plurality of orthomode transducers, each respective orthomode transducer coupled to a respective horn antenna element and configured to split the information signal into a first component signal and second component signal, the first and second component signals being orthogonally polarized, and a waveguide feed network coupling the plurality of orthomode transducers to a common feed point, the waveguide feed network configured to sum the component signals from each orthomode transducer in both the E-plane and the H-plane.

In one example, the waveguide feed network comprises a first path to guide the first component signal and a second path to guide the second component signal, wherein the first path sums in the E-plane the first component signals received from each orthomode transducer, wherein the second path sums in the H-plane the second component signals received from each orthomode transducer, and wherein the waveguide feed network is configured to provide at the common feed point a first summed component signal and a second summed component signal. In another example, the plurality of orthomode transducers comprises a first orthomode transducer coupled to a first horn antenna element and a orthomode transducer coupled to a second horn antenna element, wherein the waveguide feed network includes a waveguide T-junction having a first input configured to receive the first component signal from the first orthomode transducer and a second input configured to receive the first component signal from the second orthomode transducer, and an output configured to provide an output signal corresponding to a weighted sum of the two first component signals, and wherein the waveguide T-junction comprises a tuning element configured to bias the waveguide T-junction to produce the weighted sum of the two first component signals.

Another aspect is directed to a communications system mountable on a vehicle. In one embodiment, the communications system comprises an external sub-system, mountable on an exterior surface of the vehicle, comprising an antenna array configured to receive and transmit information signals, and a gimbal assembly configured to mount the antenna array to the exterior surface of the vehicle and to move the antenna array in azimuth and elevation, and an internal sub-system, mountable within the vehicle, comprising a control unit and a transceiver, the internal sub-system communicatively coupled to the external sub-system and configured to provide power and control signals to the external sub-system, wherein the control unit is configured to provide the control signals to the gimbal assembly to control the movement of the antenna array in azimuth and elevation, wherein gimbal assembly comprises a mounting bracket configured to mount the external sub-system to the exterior surface of the vehicle, an antenna mounting bracket configured to mount the antenna array to the gimbal assembly.

In one example of the communications system the mounting bracket comprises a central portion and four feet connected to the central portion by four corresponding arm portions; and wherein each of the four feet is positioned outside of a rotational sweep of the antenna array. In another example, the external sub-system further comprises a rotary joint positioned inside the central portion of the mounting bracket, the rotary joint coupling the external sub-system to the internal sub-system. In another example, the antenna mounting bracket grips the antenna array at two locations along the length of the antenna array, neither point being at an end of the antenna array. In another example, the gimbal assembly comprises an elevation drive assembly configured to receive a control signal from the control unit and to rotate the antenna array in elevation responsive to the control signal. The elevation drive assembly may include a push-pull pulley system. In another example, the gimbal assembly further comprises a polarization converter unit mounted to the antenna array and configured to move the antenna array in polarization responsive to a polarization Still other aspects, embodiments, and advantages of these exemplary aspects and embodiments, are discussed in detail below. Moreover, it is to be understood that both the foregoing information and the following detailed description are merely illustrative examples of various aspects and embodiments, and are intended to provide an overview or framework for understanding the nature and character of various aspects and embodiments. Any embodiment disclosed herein may be combined with any other embodiment in any manner consistent with at least one of the objects, aims, and needs disclosed herein, and references to "an embodiment," "some embodiments," "an alternate embodiment," "various embodiments," "one embodiment" or the like are not necessarily mutually exclusive and are intended to indicate that a particular feature, structure, or characteristic described in connection with the embodiment may be included in at least one embodiment. The appearances of such terms herein are not necessarily all referring to the same embodiment. The accompanying drawings are included to provide illustration and a further understanding of the various aspects and embodiments, and are incorporated in and constitute a part of this specification.

BRIEF DESCRIPTION OF THE DRAWINGS

Various aspects of at least one embodiment are discussed below with reference to the accompanying figures, which are not intended to be drawn to scale. Where technical features in the figures or detailed description are followed by references signs, the reference signs have been included for the sole purpose of increasing the intelligibility of the figures and detailed description. In the figures, each identical or nearly identical component that is illustrated in various figures is represented by a like numeral. For purposes of clarity, not every component may be labeled in every figure. The figures are provided for the purposes of illustration and explanation and are not intended as a definition of the limits of the invention. In the figures.

DETAILED DESCRIPTION

Figure 1:
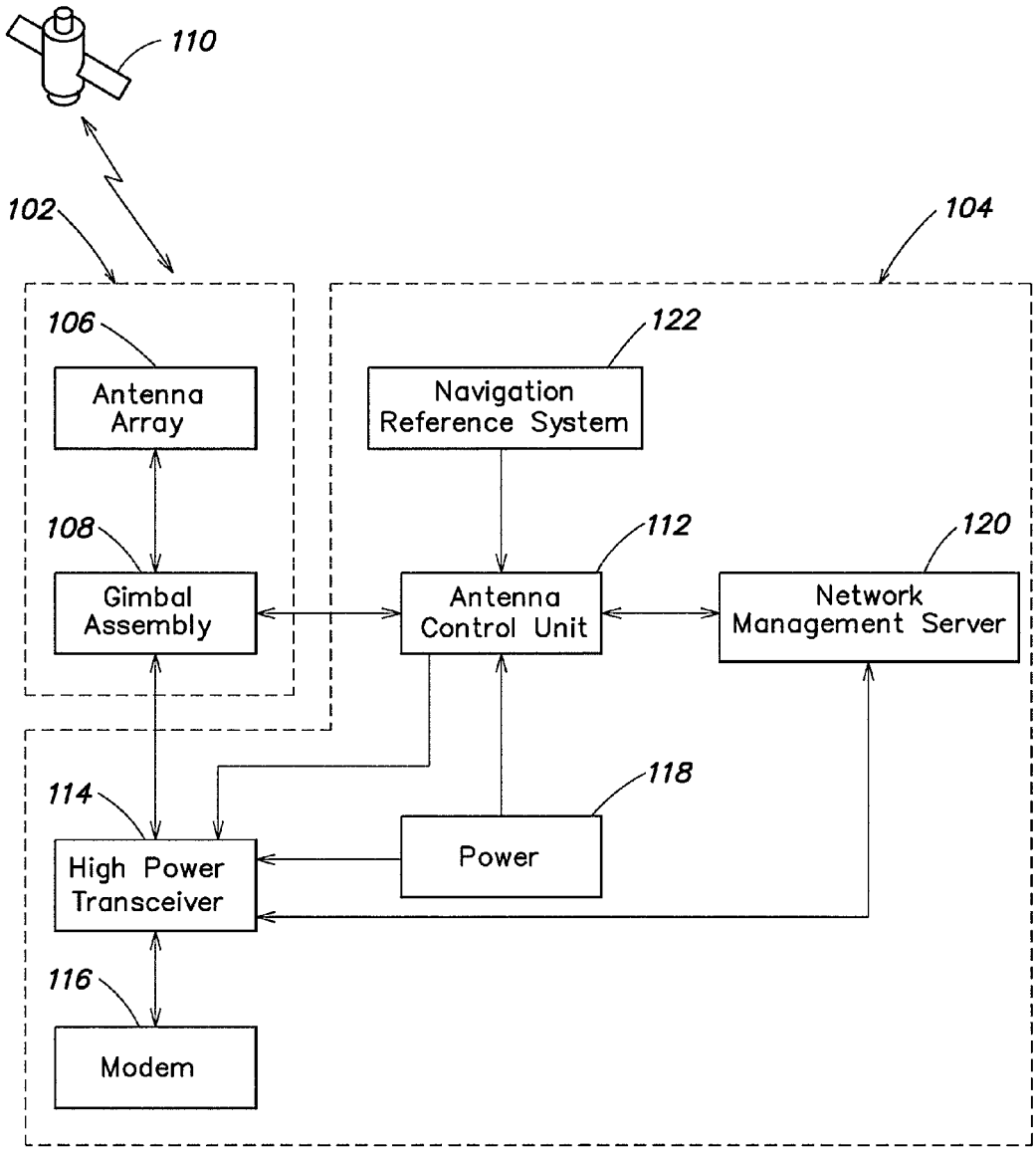
FIG. 1 is a functional block diagram of one example of a communications system according to aspects of the invention.

Aspects and embodiments are directed to a communication system including an antenna array and electronics subassembly that may be mounted on and in a vehicle. The communication system may generally comprise an external subassembly that is mounted on an exterior surface of the vehicle, and an internal subassembly that is located within the vehicle, the external and internal subassemblies being communicatively coupled to one another. As discussed below, the external subassembly may comprise the antenna array as well as mounting equipment and steering actuators to move the antenna array in azimuth, elevation and polarization (for example, to track a satellite or other signal source). The internal subassembly may comprise most of the electronics associated with the communication system. Locating the internal subassembly within the vehicle may facilitate access to the electronics, and may protect the electronics from the environment exterior to the vehicle, as discussed in further detail below. Embodiments of the communication system provide numerous advantages over prior art systems, including being of relatively small size and weight (which may be particularly advantageous for a system mounted on an aircraft), and having excellent, broadband RF performance, as discussed further below.

It is to be appreciated that embodiments of the methods and apparatuses discussed herein are not limited in application to the details of construction and the arrangement of components set forth in the following description or illustrated in the accompanying drawings. The methods and apparatuses are capable of implementation in other embodiments and of being practiced or of being carried out in various ways. Examples of specific implementations are provided herein for illustrative purposes only and are not intended to be limiting. In particular, acts, elements and features discussed in connection with any one or more embodiments are not intended to be excluded from a similar role in any other embodiments. Also, the phraseology and terminology used herein is for the purpose of description and should not be regarded as limiting. Any references to embodiments or elements or acts of the systems and methods herein referred to in the singular may also embrace embodiments including a plurality of these elements, and any references in plural to any embodiment or element or act herein may also embrace embodiments including only a single element. References in the singular or plural form are not intended to limit the presently disclosed systems or methods, their components, acts, or elements. The use herein of "including," "comprising," "having," "containing," "involving," and variations thereof is meant to encompass the items listed thereafter and equivalents thereof as well as additional items. References to "or" may be construed as inclusive so that any terms described using "or" may indicate any of a single, more than one, and all of the described terms. Any references to front and back, left and right, top and bottom, and upper and lower are intended for convenience of description, not to limit the present systems and methods or their components to any one positional or spatial orientation.

Referring to FIG. 1, there is illustrated a block diagram of one example of a communications system including an external sub-system 102 and an internal sub-system 104. The external sub-system 102 comprises an antenna array 106 and a gimbal assembly 108, each of which is discussed in detail below. The antenna array 106 receives communications signals from a signal source 110 and also transmits signals to one or more destinations, as discussed further below. The gimbal assembly 108 may transfer control and radio frequency signals to and from the antenna array 106 and to and from an antenna control unit and high power transceiver, as discussed further below. Signals may also be transferred to and from a modem 116, for example. The internal sub-system 104 may be coupled to the external sub-system 102 via cables and other transmission media (such as waveguide) that carry power, data and control signals. The internal sub-system 104 may comprise a majority of the electronics of the communications system to process the signals to be transmitted and received by the antenna array 106. In one example, the internal sub-system 104 includes an antenna control unit 112 that communicates with the gimbal assembly 108 to control the antenna array 106. For example, the antenna control unit 112 may provide control signals to the gimbal assembly 108 to point the antenna array correctly in azimuth and elevation to receive a desired signal from the signal source 110. The antenna control unit 112 may also communicate with various other components of the internal sub-system 104, as discussed further below. A high power transceiver 114 receives and processes signals received by the antenna array 106 and may output these signals via a modem 116. Modem 116 may operate in a manner known to those skilled in the art. The high power transceiver 114 may also supply signals to the gimbal assembly 108 to be transferred to the antenna array 106, and processes signals to be transmitted by the antenna array 106.

According to one embodiment, the internal sub-system 104 also comprises a power supply 118 that provides power to the various components of the internal sub-system 104 as well as to the external sub-system 102. It is to be appreciated that the power supply 118 may include a dedicated power supply that is part of the internal sub-system 104, or may include any necessary components to convert and supply power from the host vehicle's power supply to the components of the internal sub-system that require power. The internal sub-system 104 may further comprise a network management server 120. An inertial navigation reference system 122, which may be part of the internal sub-system 104 or separate therefrom and in communication therewith, may provide navigation data from the vehicle in which the communication system is installed, as discussed further below.

Figure 2:
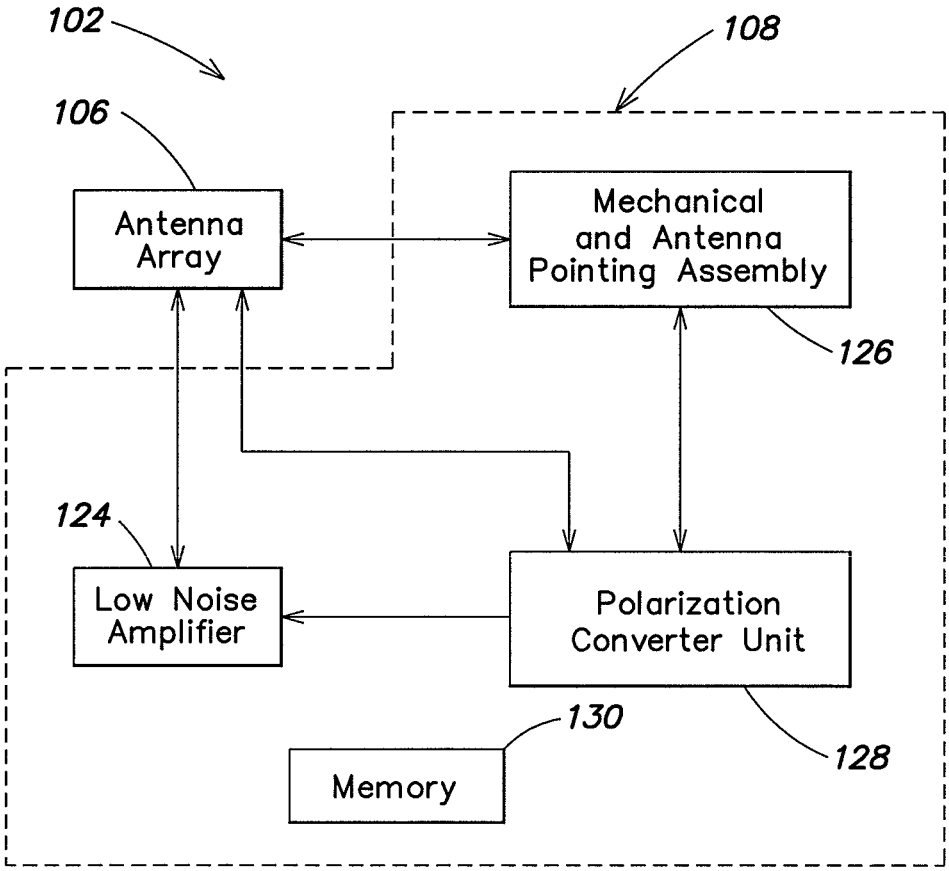
FIG. 2 is a functional block diagram illustrating one example of an external sub-system according to aspects of the invention.

Referring to FIG. 2, in one embodiment, the gimbal assembly 108 includes a low noise amplifier 124 which, for signal-to-noise considerations, should be placed as close to the antenna array as possible and therefore is included in the external sub-system 102 rather than in the internal sub-system 104. In one example, the gimbal assembly 108 further comprises a mechanical and antenna pointing assembly 126 which may include a tilt sensor (not illustrated in FIG. 2) used to sense angular position of the external sub-system 102, and a polarization converter unit 128 used to adjust for polarization skew between the antenna array 106 and a signal source 110, as discussed further below. The gimbal assembly 108 may further include a memory device 130 that can include data specific to the external sub-system 102, as discussed further below.

Figure 3:
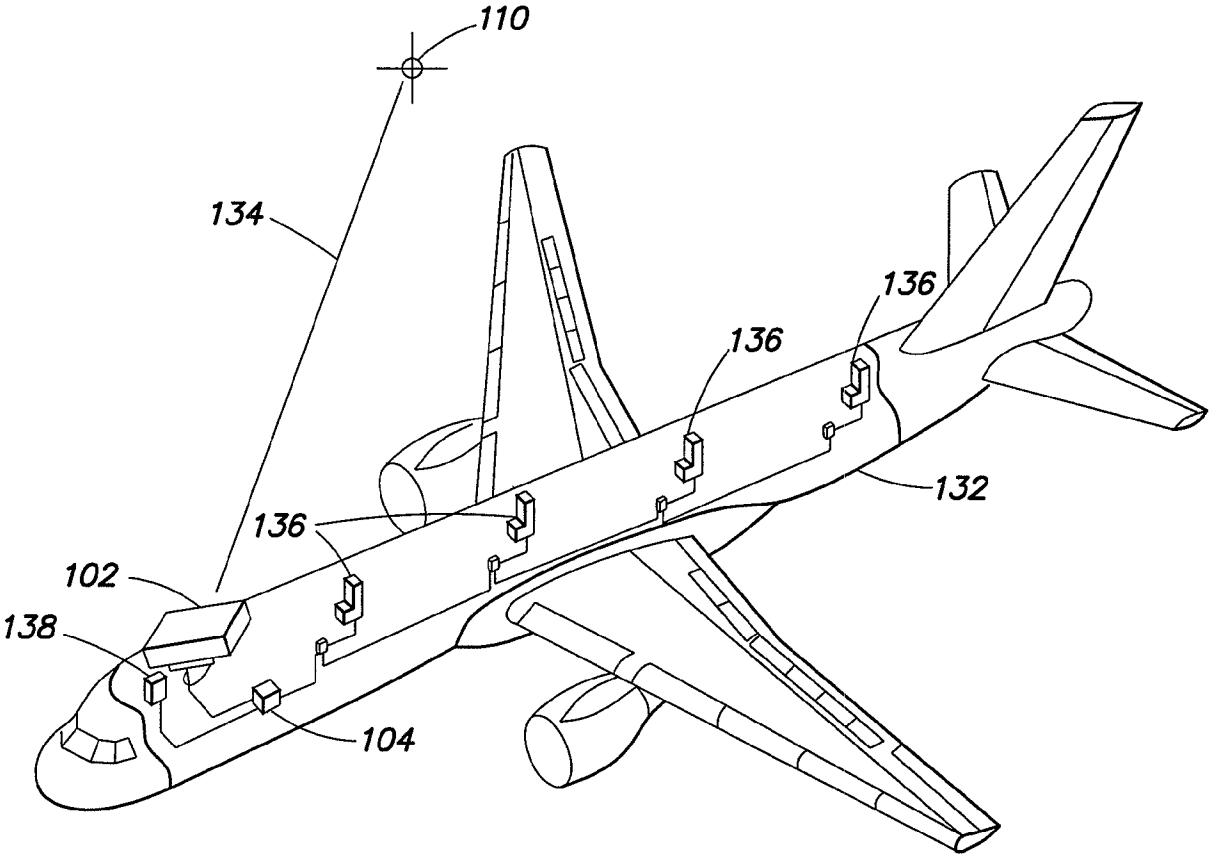
FIG. 3 is an illustration of an aircraft showing a portion of a communications system mounted in and on the aircraft in accordance with aspects of the invention.

According to one embodiment, the communication system is mounted on and in a vehicle, such as an aircraft or automobile. Referring to FIG. 3, there is illustrated an example of an aircraft 132 equipped with a communications system according to aspects of the invention. It is to be appreciated that although the following discussion of aspects and embodiments of the communications system may refer primarily to a system installed on an aircraft, the invention is not so limited and embodiments of the communications system may be installed on a variety of different vehicles, including ships, trains, automobiles and aircraft, as well as on stationary platforms, such as commercial or residential buildings. The external sub-system 102 may be mounted to the aircraft 132 at any suitable location. The location of mounting of the external sub-system 102 on the aircraft 132 (or other vehicle) may be selected by considering various factors, such as, for example, aerodynamic considerations, weight balance, ease of installation and/or maintenance of the system, Federal Aviation Administration (FAA) requirements, interference with other components, and field of view of the antenna array. As discussed above, the external sub-system 102 includes an antenna array 106 (See FIG. 1) that receives an information signal of interest 134 from a signal source 110. The signal source 110 may be another vehicle, a satellite, a fixed or stationary platform, such as a base station, tower or broadcasting station, or any other type of information signal source. The information signal 134 may be any communication signal, including but not limited to, TV signals, signals encoded (digitally or otherwise) with maintenance, positional or other information, voice or audio transmissions, data transmissions, etc. In one example, the system forms parts of a communications network that can be used to send information about the system itself or about components of the aircraft 132 (e.g., operating information, required maintenance information, etc.) to a remote server or control/maintenance facility to provide remote monitoring of the system and/or the aircraft.

As known to those familiar with the operation of satellites in many regions of the world, there exists a variety of satellites operating frequencies resulting in broad bands of frequency operations. Direct Broadcast satellites, for example, may receive signals at frequencies of approximately 14.0 GHz-14.5 GHz, while the satellite may send down signals in a range of frequencies from approximately 10.7 GHz-12.75 GHz. Table 1 below illustrates some of the variables, in addition to frequency, that exist for reception of direct broadcast signals, which are accommodated by the antenna assembly and system of the present invention. The signal source 110 may include any of these, or other, types of satellites.

TABLE 1

| Service Region | Service Provider | Satellites | Satellite Longitude | Polarization | Primary Conditional Access | Digital Broadcast Format |
|---|---|---|---|---|---|---|
| Canada | ExpressVu | Nimiq | 268.8°E | Circular | Nagravision | DVB |
| CONUS | DIRECTV | DBS 1/2/3 | 259.9°E | Circular | Videoguard | DSS |
| Europe | TPS Tele + Digitale Stream | Hot Bird 1-4 | 13.0°E | Linear | Viaccess | DVB |
| Europe | Sky Digital | Astra 2A | 28.2°E | Linear | Mediaguard | DVB |
| Europe | Canal Plus | Astra 1E-1G | 19.2°E | Linear | Viaccess& Mediaguard | DVB |
| Japan | Sky PerfecTV | JCSAT-4A | 124.0°E 128.0°E | Linear | Multi-access | DVB |
| Latin America | DIRECTV GLA | Galaxy 8-i | 265.0°E | Circular | Videoguard | DSS |
| Malaysia | Astro | Measat 1/2 | 91.5°E | Linear | Cryptoworks | DVB |
| Middle East | ADD | Nilesat 101/102 | 353.0°E | Linear | Irdeto | DVB |

Still referring to FIG. 3, the communication system may include or may be coupled to a plurality of passenger interfaces, such as seatback display units 136, associated headphones and a selection panel to provide individual channel selection, Internet access, and the like to each passenger. Alternatively, for example live video may also be distributed to all passengers for shared viewing through a plurality of screens placed periodically in the passenger area of the aircraft. Signals may be provided between the internal sub-system 104 and the passenger interfaces either wirelessly or using cables. Further, the communications system may also include a system control/display station 138 that may be located, for example, in the cabin area for use by, for example, a flight attendant on a commercial airline to control the overall system and such that no direct human interaction with the external subassembly is needed except for servicing and repair. In one example, the communication system may be used as a front end of a terrestrial or satellite video reception system on a moving vehicle such as the aircraft of FIG. 3. The satellite video reception system can be used to provide to any number of passengers within the vehicle with live programming such as, for example, news, weather, sports, network programming, movies and the like.

Figure 4:
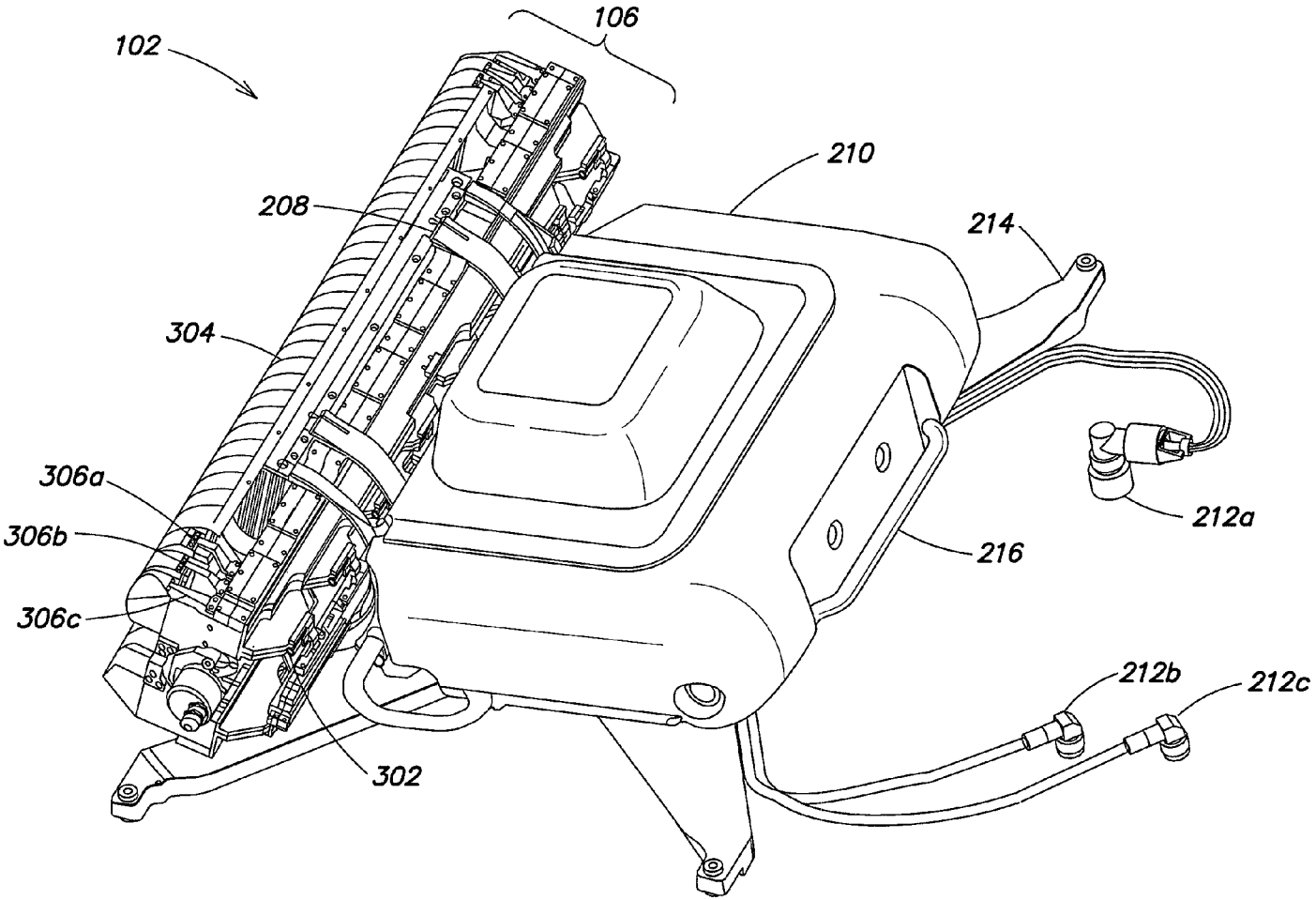
FIG. 4 is a perspective view of one example of an external sub-system according to aspects of the invention.

Referring to FIG. 4, there is illustrated in perspective view one embodiment of an external sub-system 102. As discussed above, the external sub-system 102 comprises the antenna array 106 that is adapted to receive signals from the signal source (110 in FIG. 1) and to transmit signals. As discussed further below, the antenna array 106 includes a plurality of antenna elements (not shown) coupled to a feed network 302. In one example, these antenna elements are horn antennas and the feed network 302 is a waveguide feed network. In one embodiment, each of the antenna elements may be coupled to a respective lens 304 configured to improve the gain of the respective antenna element, as discussed further below. Retaining clips 306*a*, 306*b* and 306*c* may be used to fasten the lenses 304 to the respective antenna elements, as also discussed below. According to one embodiment, the antenna array 106, by virtue of the construction and arrangement of the feed network 302 and antenna elements, and optionally lenses 304, forms a substantially rigid structure with only a base mode structural natural frequency. From a structural oscillation point of view, the antenna array 106 may therefore act as a single unit, rather than an array of multiple individual units. An advantage of such a substantially rigid structure for the antenna array 106 may include minimal oscillation of the antenna array which could otherwise adversely affect the performance and pointing accuracy of the antenna array. In one example, the base mode structure natural frequency of the antenna array 106 is about 20 Hertz (Hz).

The antenna array 106 may be mounted to the gimbal assembly 108 using an antenna mounting bracket 208. As illustrated in FIG. 4, in one embodiment, the antenna mounting bracket 208 grips the antenna array 106 not at the ends of the antenna array, but rather at points closer to the center of the antenna array. These grip points of the antenna mounting bracket may be substantially symmetrically spaced from the length-wise center of the antenna array 106. Gripping the antenna array 106 at interior points along its length, rather than at the ends, may further reduce unwanted structural oscillation of the antenna array.

Still referring to FIG. 4, in at least some embodiments, a substantial portion of the external sub-system 102 may be covered by a cover 210. The cover 210 may provide environmental protection for at least some of the components of the external sub-system 102. Cables 212*a*, 212*b* and 212*c* may be used to carry data, power and control signals between the internal sub-system 104 and the external sub-system 102. It is to be appreciated that the communications system is not limited to the use of three sets of cables 212*a*, 212*b* and 212*c* as illustrated in FIG. 4, and any suitable number of cables may be used. The external sub-system 102 may be mounted to the vehicle using a mounting bracket 214 that can be fastened to the body of the vehicle (e.g., to the fuselage of aircraft 132). The external sub-system also includes a mounting bracket 214 that is used to mount the external sub-system to the host platform (e.g. aircraft 132), as discussed further below.

Figure 5A:
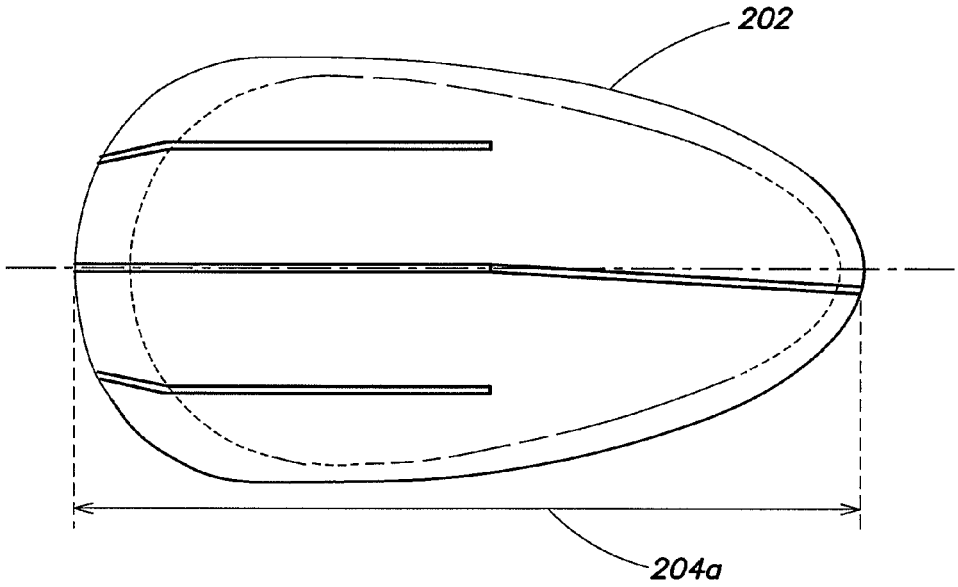
FIG. 5A is a plan view of one example of a radome according to aspects of the invention.
Figure 5B:
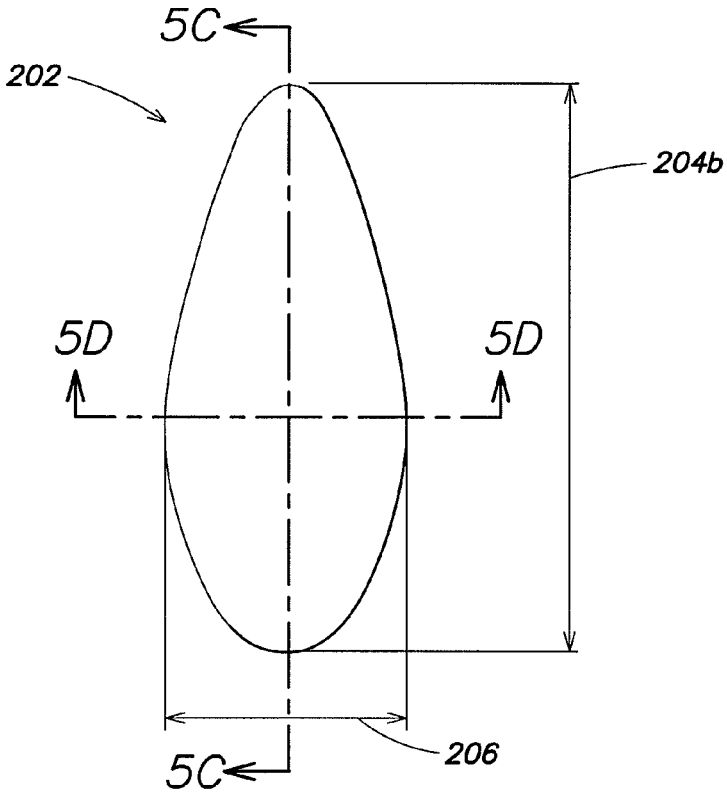
FIG. 5B is a plan view of another example of a radome according to aspects of the invention.
Figure 5C:
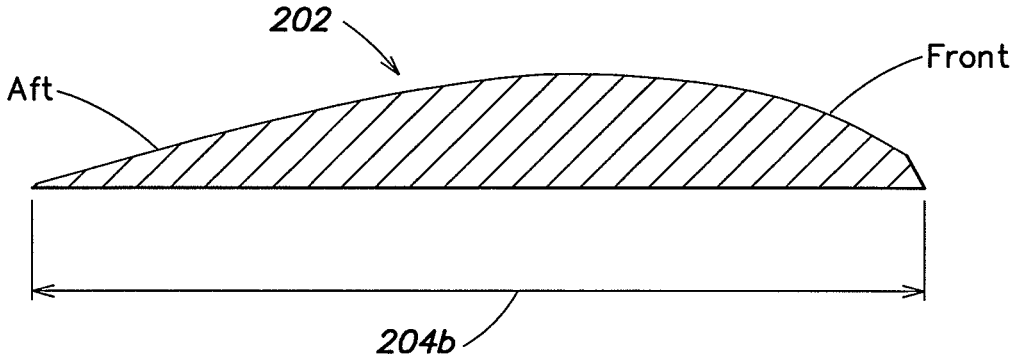
FIG. 5C is a cross-sectional view of the radome of FIG. 5B taken along line 5C-5C in FIG. 5B.
Figure 5D:
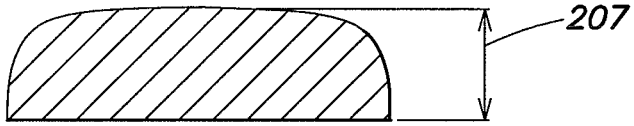
FIG. 5D is a cross-sectional view of the radome of FIG. 5B taken along line 5D-5D in FIG. 5B.

According to one embodiment, the external sub-system may be covered by a radome that may serve to reduce drag force generated by the external subassembly as the vehicle/aircraft 132 moves. An example of a radome 202 is illustrated in FIG. 5A. In one example, the radome 202 has a maximum height of about 9.5 inches and a length 204*a* of about 64.4 inches; however, it is to be appreciated that the size of the radome 202 in any given embodiment may depend on the size of the antenna array 106 and other components of the external sub-system 102. Another example of a radome 202 is illustrated in outline form in FIGS. 5B (top view), 5C (cross-section taken along line 5C-5C in FIG. 5B), and 5C (cross-section taken along line 5D-5D in FIG. 5B). In one example, the radome 202 has a length 204*b* of about 93 inches, a width 206 of about 40 inches, and a maximum height 207 of about 11.8 inches. In the example illustrated in FIGS. 5B-5D, the radome 202 has a greater length-to-height ratio than the example illustrated in FIG. 5A to reduce the slope to the trailing edge of the radome, and thereby to reduce high speed air flow on the aft portion of the radome. According to one example, the radome 202 is transmissive to radio frequency (RF) signals transmitted and/or received by the antenna array 106. The radome 202 may be made of materials known to those of skill in the art including, but not limited to, laminated plies of fibers such as quartz or glass, and resins such as epoxy, polyester, cyanate ester or bismaleamide. These or other materials may be used in combination with honeycomb or foam to form a highly transmissive, light-weight radome construction.

Figure 6:
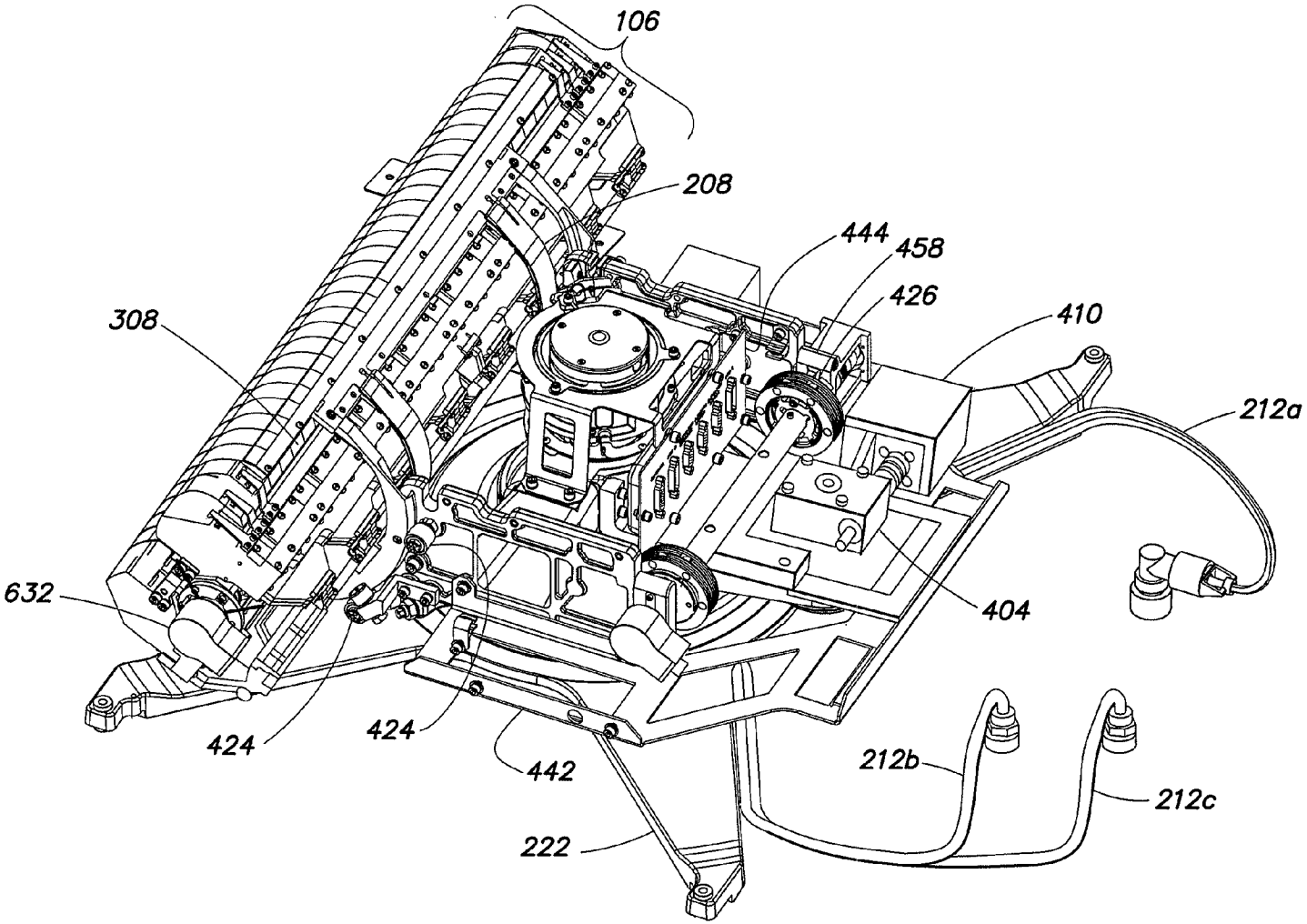
FIG. 6 is a perspective view of one example of an external sub-system without a cover, according to aspects of the invention.

Referring to FIG. 6, there is illustrated an example of the external sub-system 102 shown without the cover 210. Various components of the external sub-system 102 are discussed in more detail below with continuing reference to FIG. 6.

Figure 7:
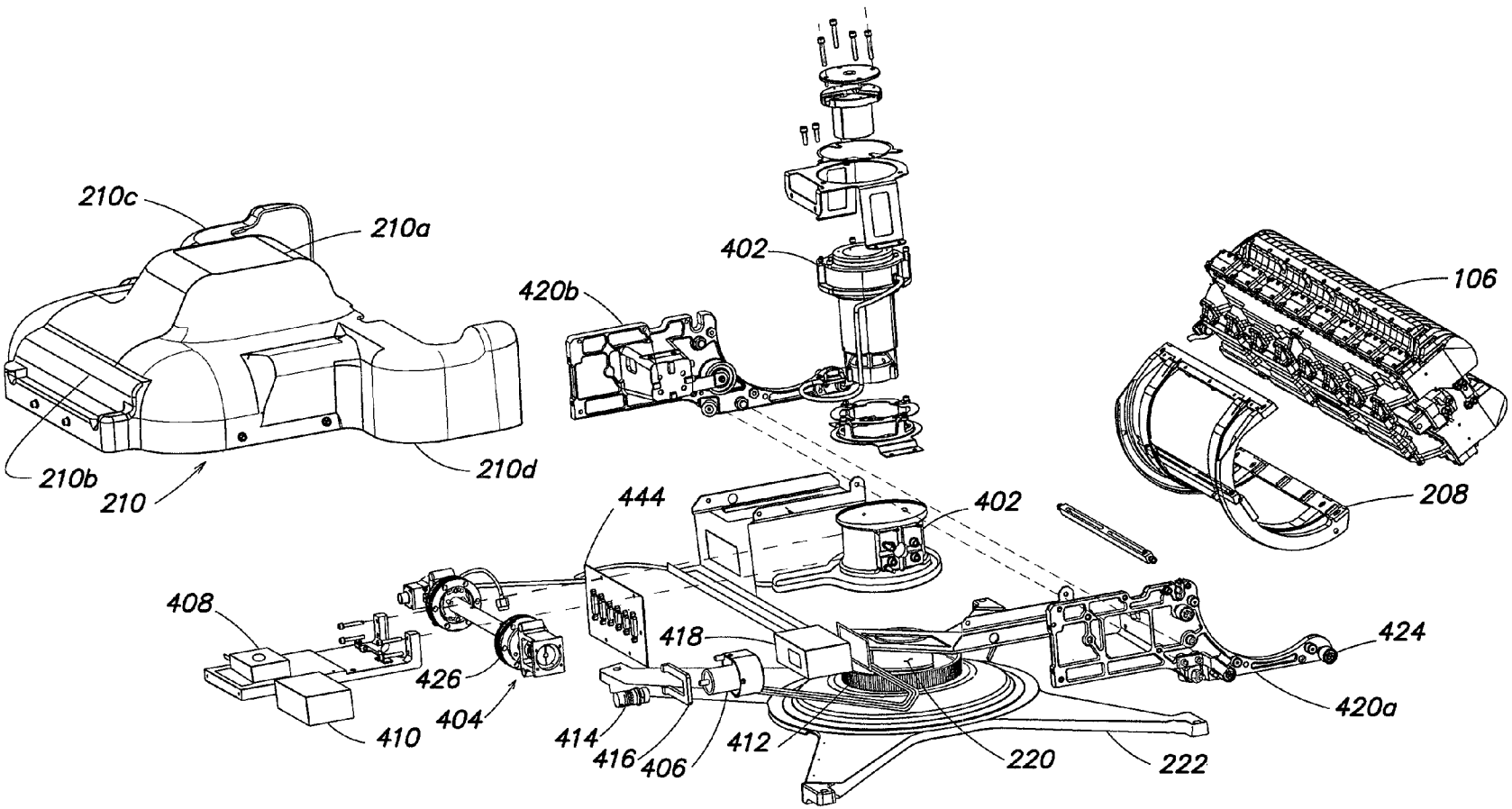
FIG. 7 is an exploded view of the external sub-system of FIG. 6.
Figure 8:
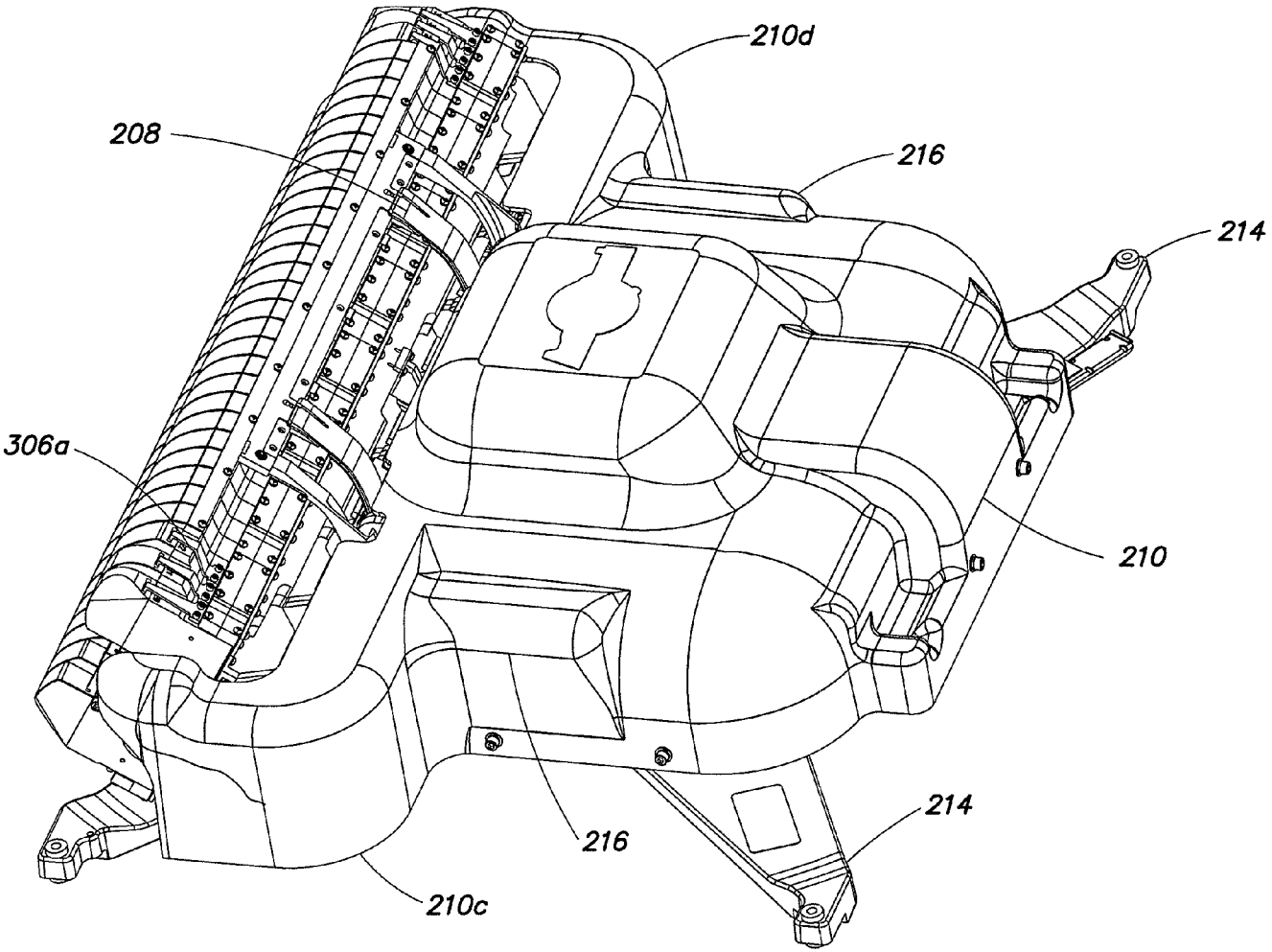
FIG. 8 is a perspective view of another example of the external sub-system showing an example of the cover according to aspects of the invention.

Referring to FIG. 7, there is illustrated a partial exploded view of the example of the external sub-system 102 shown in FIG. 6. In one example, the cover 210 comprises several parts, such as an upper portion 210*a*, a rear portion 210*b*, and two side portions 210*c* and 210*d* that may be fastened together to form the cover 210. It is to be appreciated, however, that the invention is not so limited and the cover 210 may comprise more or fewer than four parts and that the cover parts may be configured differently than illustrated in FIG. 7. In one example, the side portions 210*c* and 210*d* provide cable protection areas for cables running to/from the antenna array 106 and/or other parts of the external sub-system 102. In one example, the cover parts are fastened together using only fasteners such as screws or bolts. The number of fasteners may be a minimum needed to secure the cover so as to avoid unnecessary delay and complications in removing the cover when necessary to access the external sub-system 102 (e.g., to upgrade or repair components). In another example, an adhesive may be used, alone or in conjunction with fasteners, to secure the cover parts 210*a-d* together. However, in some applications, for example, where the external sub-system 102 is mounted on an aircraft 132, the use of adhesive may be undesirable as it may further complicate removal of the cover 210. In another example, the cover is formed as a unitary construction (i.e., one piece) rather than multiple pieces. The cover 210 may include handles 216, as shown for example in FIG. 4 and FIG. 8. FIG. 8 illustrates another example of the cover 210 mounted over a portion of the external sub-system 102.

Figure 9A:
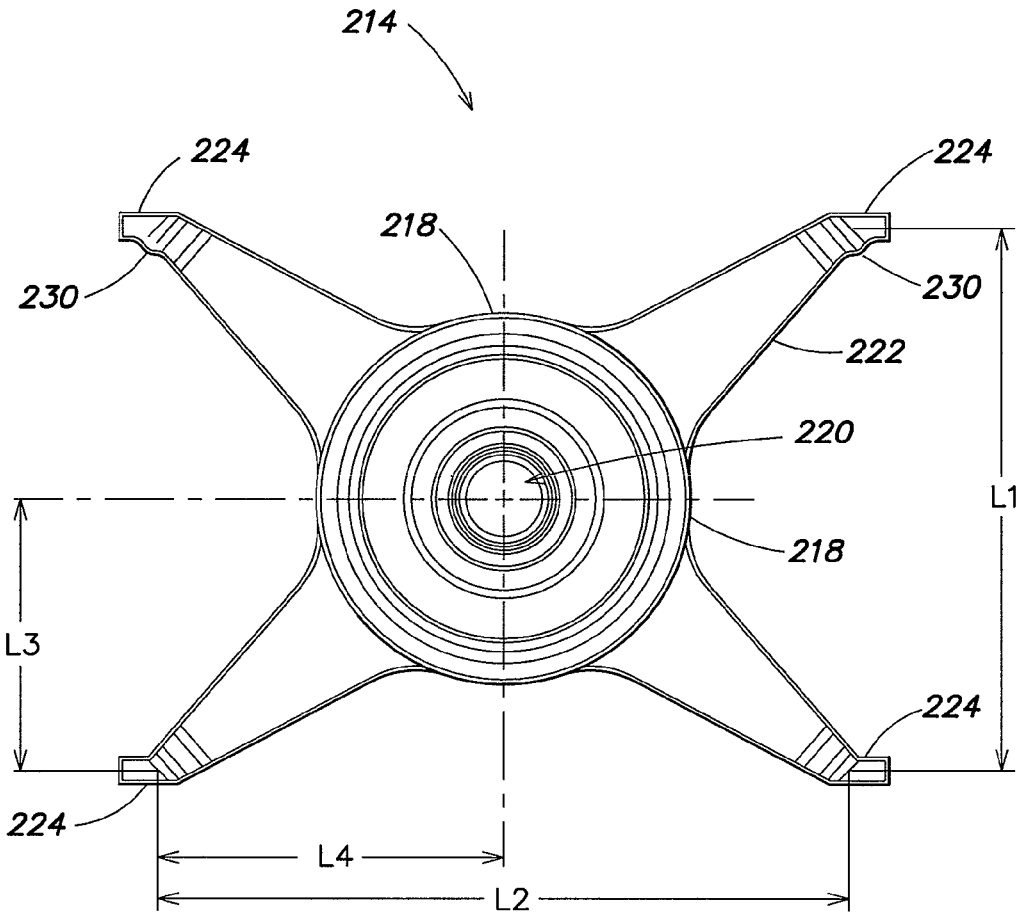
FIG. 9A is a plan view of one example of a mounting bracket for securing the external sub-system to a host platform, according to aspects of the invention.

As discussed above, the gimbal assembly 108, and external sub-system 102, may be organized to mount to a host vehicle (or other host platform) and therefore may include a mounting bracket 214. An example of the mounting bracket 214 is illustrated in FIG. 9A. In the example illustrated in FIG. 9A, the mounting bracket 214 includes a body portion 218 including a central portion 220 and four feet 224 at the ends of leg portions 222 that extend outward from the central portion 220. Cables that carry power, data and/or control signals between the external sub-system 102 and internal sub-system 104 may pass through the central portion 220, as discussed further below.

Figure 9B:
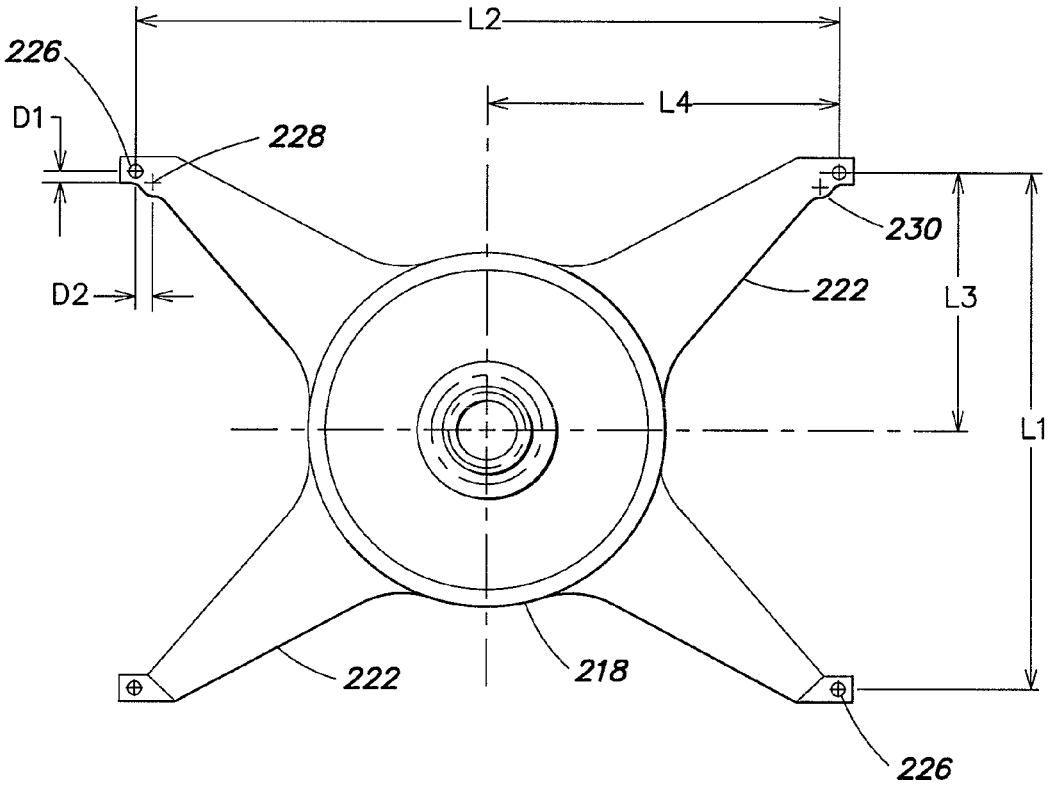
FIG. 9B is another plan view of an example of the mounting bracket according to aspects of the invention.

The mounting bracket 214 may be fastened to the vehicle by fasteners, such as screws or bolts, through the feet 224. Referring to FIG. 9B, in one example, each foot 224 is provided with a mounting hole 226 that may accommodate a fastener, such as a screw or bolt, for example. Thus, in one embodiment, the mounting bracket 214 may include a four-fastener attachment configuration to facilitate mounting of the external sub-system 102 to the host vehicle. Each attachment position may also include a vibration isolator to be located at each of the four mounting hole 226 fastener positions and may include commonly known elastomeric damping materials, for example. The fastener hole pattern may include a 27.250 inch by 20.000 inch pattern, for example. Thus, according to one embodiment, the mounting bracket 214 has a foot-to-foot span L1 in one dimension of about 20 inches, and a foot-to-foot span L2 in another dimension of about 25 inches. It is to be appreciated that these dimensions are examples only, not intended to be limiting, and that embodiments of the mounting bracket 214 may have varying dimensions, for example, depending on factors such as the size and/or configuration of the host platform, size and/or configuration of the external sub-system 102, and points of measurement of the dimensions. For example, the foot-to-foot span L2 may be measured from an edge of the feet 224 or center of the feet 224. In another example, the foot-to-foot span L2, measured as shown in FIG. 9B, is approximately 27.25 inches.

Still referring to FIGS. 9A and 9B, in one example, the mounting bracket 214 has a first center-to-foot distance L3 of approximately 10 inches, and a second center-to-foot spacing L4 of approximately 12.5 inches, as measured in FIG. 9A or approximately 13.625 inches as measured in FIG. 9B. As discussed above, the feet 224 may include mounting holes 226 that accommodate fasteners for attaching the mounting bracket 214 to the host platform. In one example, the mounting holes 226 have a diameter of approximately 0.406 inches; however, it is to be appreciated that the diameter of the mounting hole 226 may vary depending, for example, on the size and type of fastener used. In one embodiment two or more of the legs 222 include additional holes 228, which may be accommodated in a "bumped-out" portion 230 of the leg 222, as shown in FIG. 9B. In one example, the center-to-center distances, D1 and D2, between the mounting hole 226 and the hole 228 (as shown in FIG. 9B), are approximately 0.63 inches (D1) and 0.82 inches (D2), respectively.

Figure 10A:
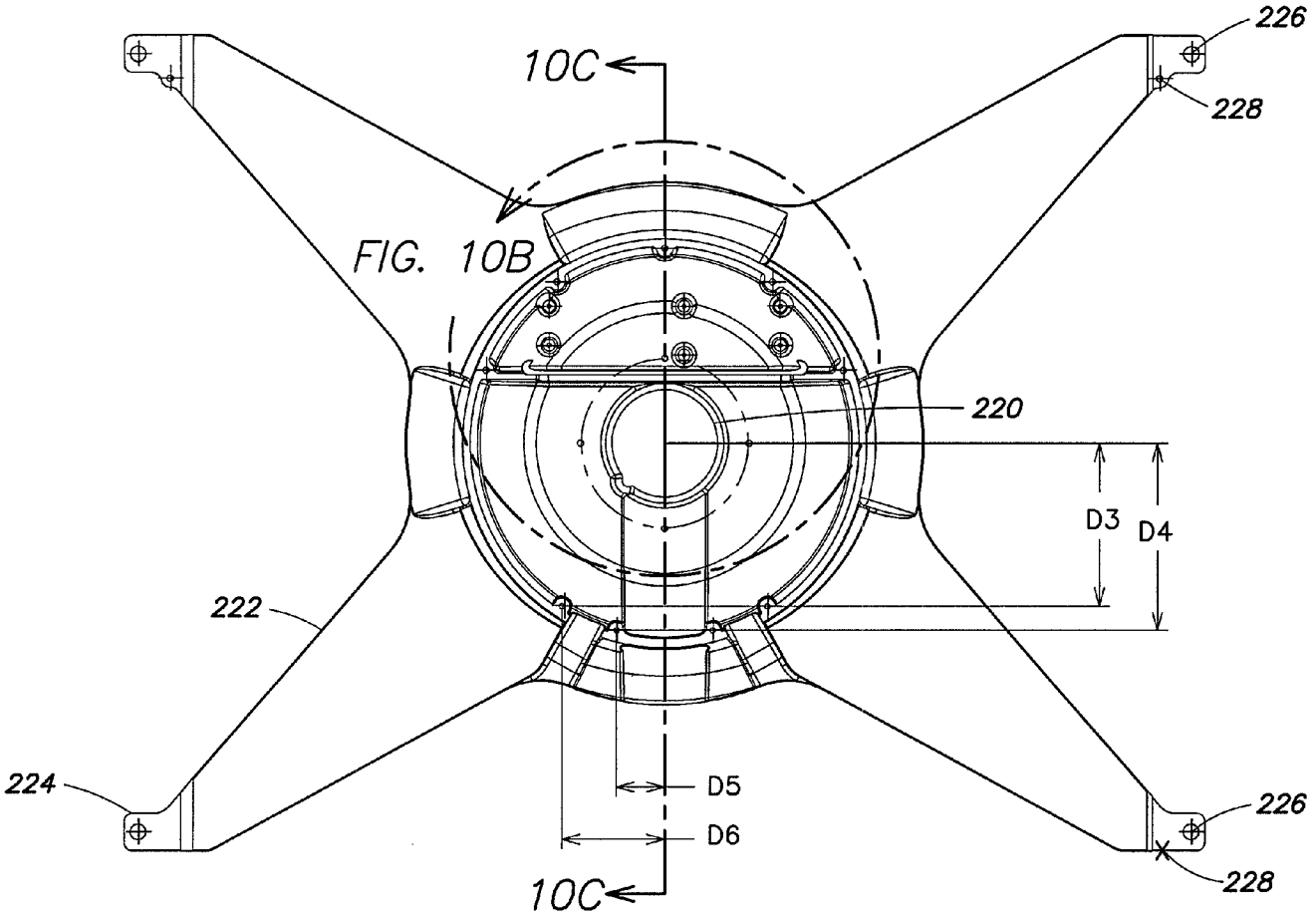
FIG. 10A is another plan view of an example of the mounting bracket according to aspects of the invention.
Figure 10B:
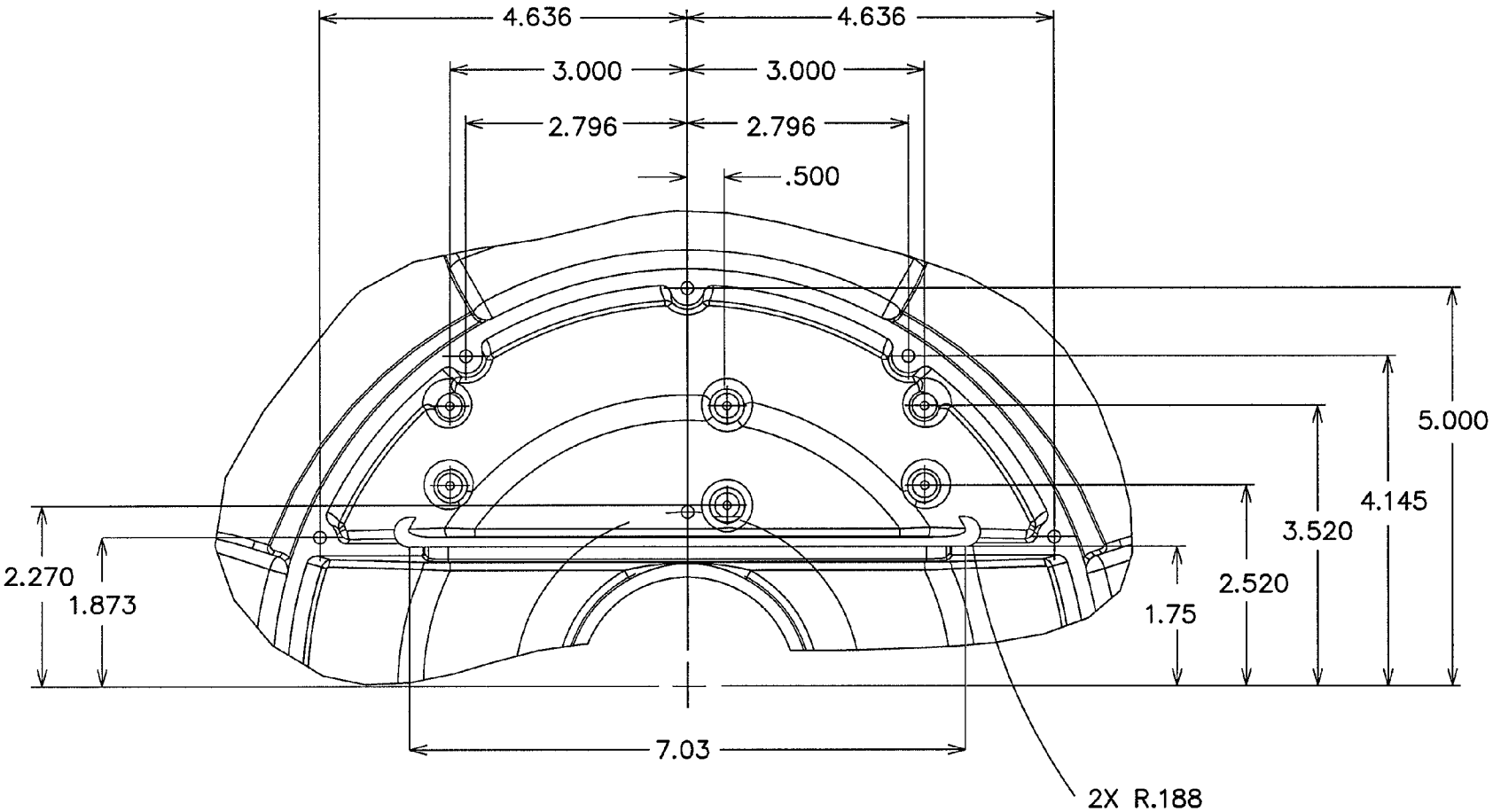
FIG. 10B is a sectional view of the portion of the mounting bracket of FIG. 10A contained within circle C1 in FIG. 10A.
Figure 10C:
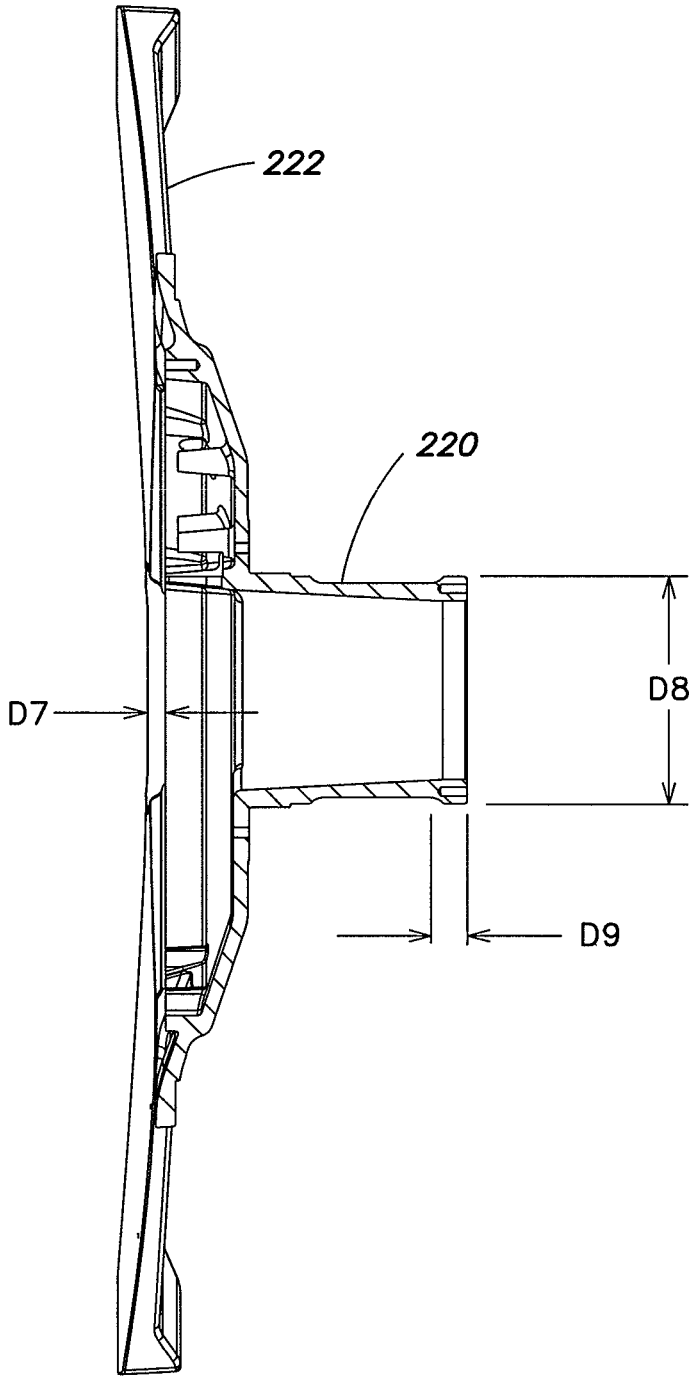
FIG. 10C is a cross-sectional view of the mounting bracket of FIG. 10A taken along line 10C-10C in FIG. 10A.

Another view of an embodiment of the mounting bracket 214 is illustrated in FIG. 10A, showing some additional example dimensions of the mounting bracket. In one example, the dimension D3 is approximately 4.170 inches. In another example, the dimension D4 is approximately 4.79 inches. In another example, the dimension D5 is approximately 1.247 inches, and in another example, the dimension D6 is approximately 2.667 inches. A more detailed view, showing some additional example dimensions, of the portion of the mounting bracket 214 contained within the circle line C1 is illustrated in FIG. 10B. FIG. 10C illustrates a cross-sectional view of an embodiment of the mounting bracket taken along line 10C-10C in FIG. 10A. In one example, the dimension D7 is approximately 0.385 inches, and in another example, the dimension D8 is approximately 6.996±0.004 inches. It is to be appreciated, however, that all of the dimensions given herein and shown in the Figures are examples only and not intended to be limiting.

Figure 10D:
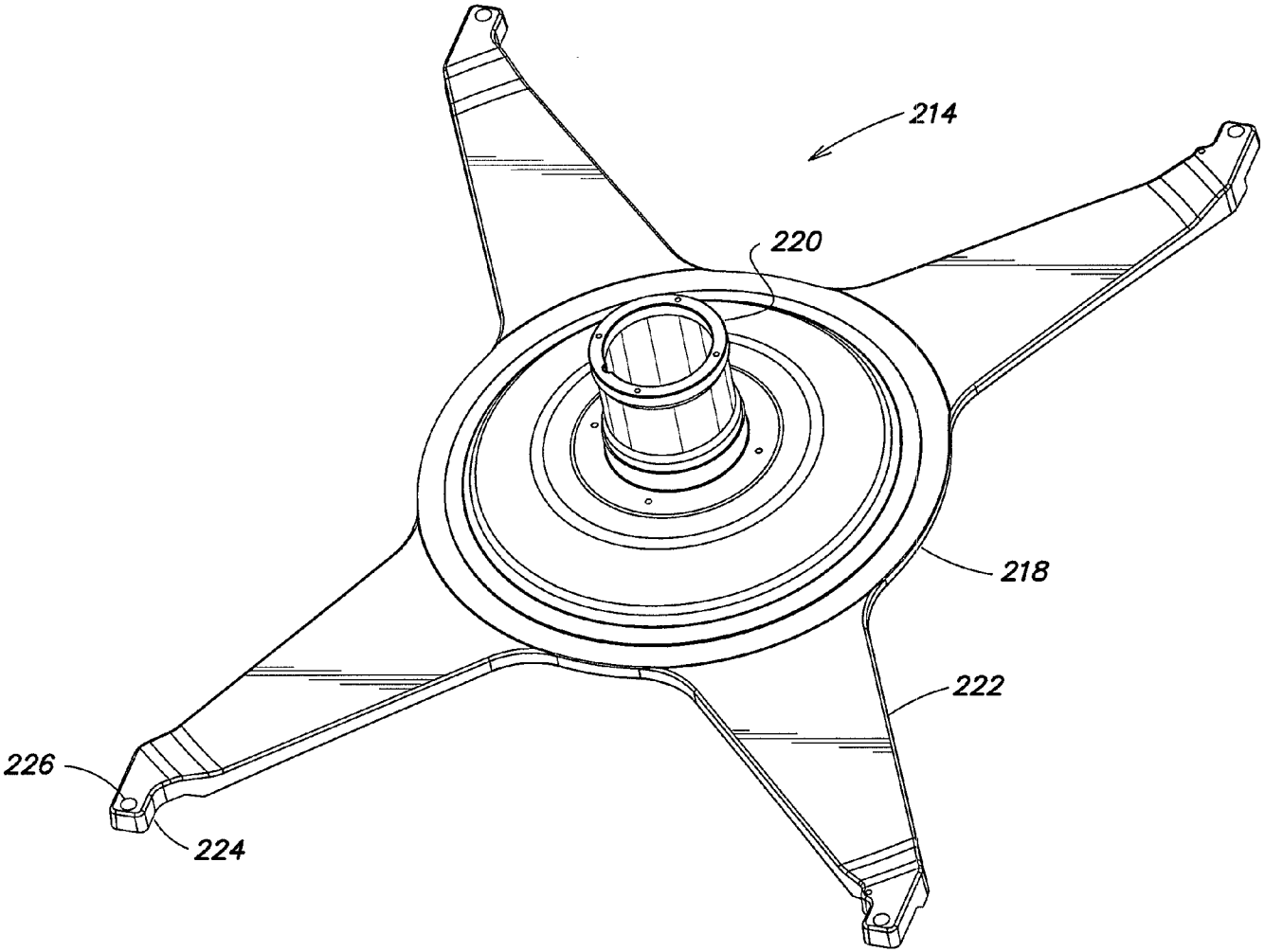
FIG. 10D is a perspective view of one example of the mounting bracket according to aspects of the invention.

A perspective view of one example of the mounting bracket 214 is illustrated in FIG. 10D. The mounting bracket 214 may be formed, for example, of metal such as aluminum, and optionally formed using casting and post machining operations. The mounting bracket 214 may also be optionally formed of composite materials such as fiberglass and epoxy resins or carbon fiber materials. The use of a mounting bracket 214 having a configuration similar to that illustrated in FIGS. 9A-10D may be advantageous in some applications because only four fasteners may required to securely mount the mounting bracket, and therefore the external sub-system 102, to the host platform, facilitating easy installation of the external sub-system on the host platform. In one example, the feet 224 may be positioned outside of the rotation sweep of the antenna array 106 such that the fasteners may be accessed regardless of the position of the antenna array. This configuration may facilitate installation, and particularly removal, of the mounting bracket 214, and thus of the external sub-system 102 under a variety of conditions and orientations of the antenna array 106.

Figure 11A:
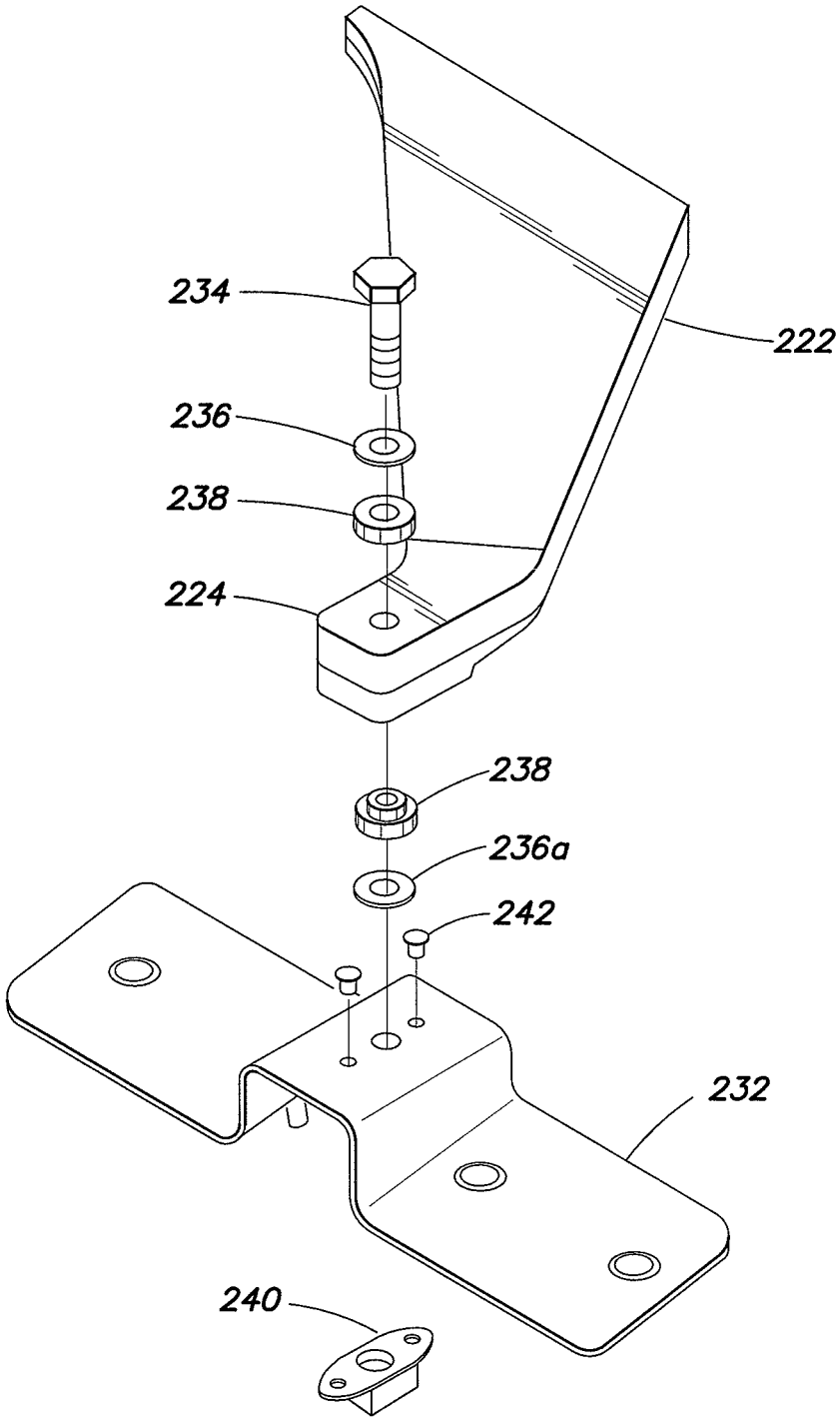
FIG. 11A is an exploded view of one example of a mounting position according to aspects of the invention.
Figure 11B:
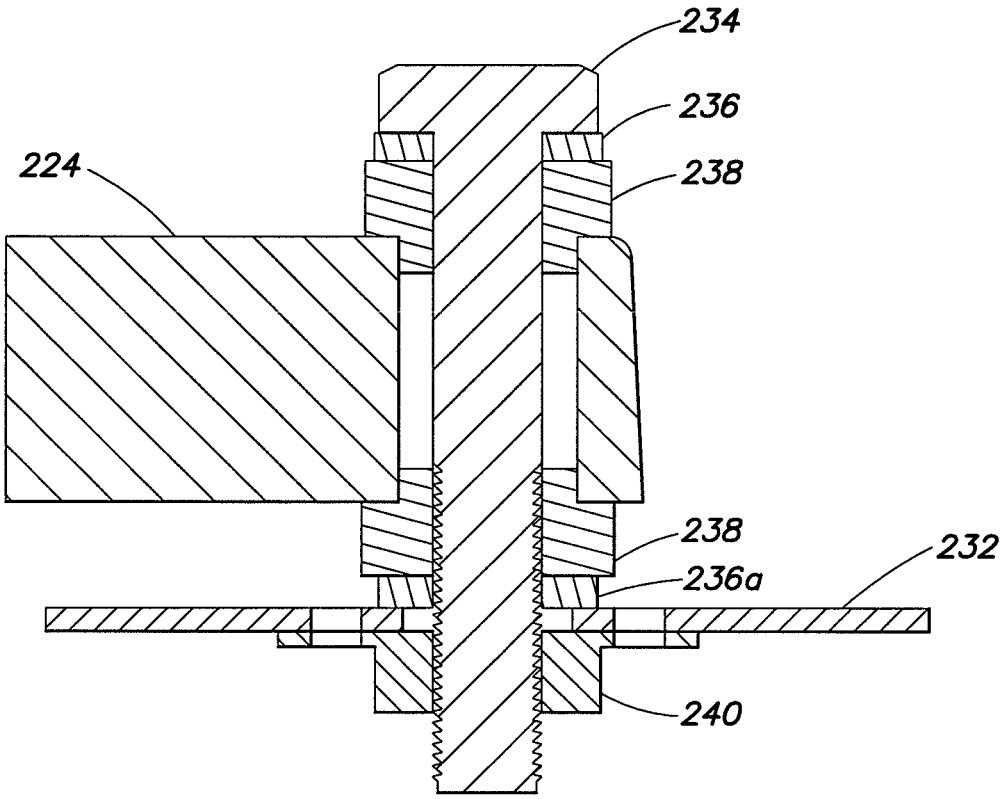
FIG. 11B is a cross-sectional view of the example of the mounting position corresponding to FIG. 11A.

According to one embodiment, the mounting bracket 214 is constructed to attach to the host vehicle using four attachment pads. An exploded view of one example of a portion of the mounting bracket 214 and an attachment pad 232 is illustrated in FIG. 11A. A cross-sectional view of one mounting location for the external sub-system 102 is illustrated in FIG. 11B. In one embodiment, the mounting bracket 214 mates to the attachment pad 232 using a bolt 234, a washer 236, bushings 238, and a floating anchor nut 240. Additional one or more washers 236*a* may be used for shimming. The floating anchor nut 240 may be attached to the attachment pad 232 using rivets 242.

According to one embodiment, at least portions of the external sub-system 102 (e.g., the antenna array 106 and at least some parts of the gimbal assembly 108) are moveable in any or all of elevation, azimuth and polarization to facilitate communication with the signal source 110 from a plurality of locations and orientations of the vehicle. Accordingly, the gimbal assembly 108 may be designed to accommodate such movement. According to one embodiment, the gimbal assembly 108 is constructed to rotate in the azimuth axis about an axis or rotation which coincides with the center of the mounting bracket 214. In one embodiment, the central portion 220 of the mounting bracket 214 may accommodate a hub feature, also called an azimuth assembly 402, which defines the center of azimuth rotation, and which is used to interconnect the gimbal assembly 108 to one or more bearings to enable rotation in the azimuth axis. The azimuth assembly 402 may include, for example, a rotary joint that may penetrate the vehicle shell (e.g., the shell of aircraft 132) to allow cables to pass through the vehicle shell between the internal sub-system 104 and the external sub-system 102. In one example, the azimuth assembly 402 may include the rotary joint and a slip ring, as discrete parts or as an integrated assembly 446. The axis of rotation also is coincident with the axis of rotation of the rotary joint and the slip ring, shown in FIG. 7, to allow radio frequency (RF) communication, power and control signals to travel, via the cables 212*a-c*, between the movable parts of the external sub-system 102 and a stationary host platform of the aircraft 132. The rotary joint and slip ring combination 446, or other device known to those of skill in the art, may enable the external sub-system 102 to rotate continuously in azimuth in either direction with respect to the host vehicle 132, thereby enabling the external subsystem to provide continuous hemispherical, or greater, coverage when used in combination with an azimuth motor. Without the rotary joint, or a similar device, the antenna array 106 would have to travel until it reached a stop then travel back again to keep cables from wrapping around each other. A gasket or other sealing device may be used to seal the connection between the central portion 220 of the mounting bracket 214 (or a cable carrier extending there-through) and the vehicle body, as a hole must be provided in the vehicle body to allow the cables to pass through to the internal sub-system 104.

According to one embodiment, the gimbal assembly 108 provides control signals to move the antenna array 106 over a range of angles in azimuth and elevation to perform beam-steering and signal tracking. Referring again to FIGS. 6 and 7, in one embodiment, the gimbal assembly 108 may control the azimuth and elevation angle of the antenna array 106, and thus may include an elevation motor drive 404 that drives an elevation motor 406 to move the antenna array 106 in elevation, and an azimuth motor drive 408 that drives an azimuth motor (housed within azimuth motor enclosure 410) to control and position the antenna array in azimuth. The antenna array 106 may be mounted to the gimbal assembly 108 by the antenna mounting bracket 208, as discussed further below, and the elevation motor 406 may move the antenna array in elevation angle with respect to the posts of the gimbal assembly over an elevation angle range of approximately −10.degree. to 90.degree. (or zenith). The gimbal assembly 108 may utilize the input data received from the internal sub-system 104 to control the elevation and azimuth motor drives 404, 408 and the gimbal assembly may provide pointing information to point the antenna array 106 correctly in azimuth and elevation to receive a desired signal from the information source 110, as discussed further below.

To move the antenna array 106 in azimuth, the azimuth motor drive 408 may be coupled to the azimuth hub assembly 402. In one example, the azimuth hub assembly 402 is coupled, via a wire 412, to an azimuth pulley 428 that encircles the central portion 220 of the mounting bracket 214. The azimuth motor drive 408 may also include control circuitry and may receive control signals from the antenna control unit 112 (see FIG. 1) and/or from the gimbal assembly 108 and actuate the azimuth motor to rotate the antenna array 106 in azimuth.

Figure 12:
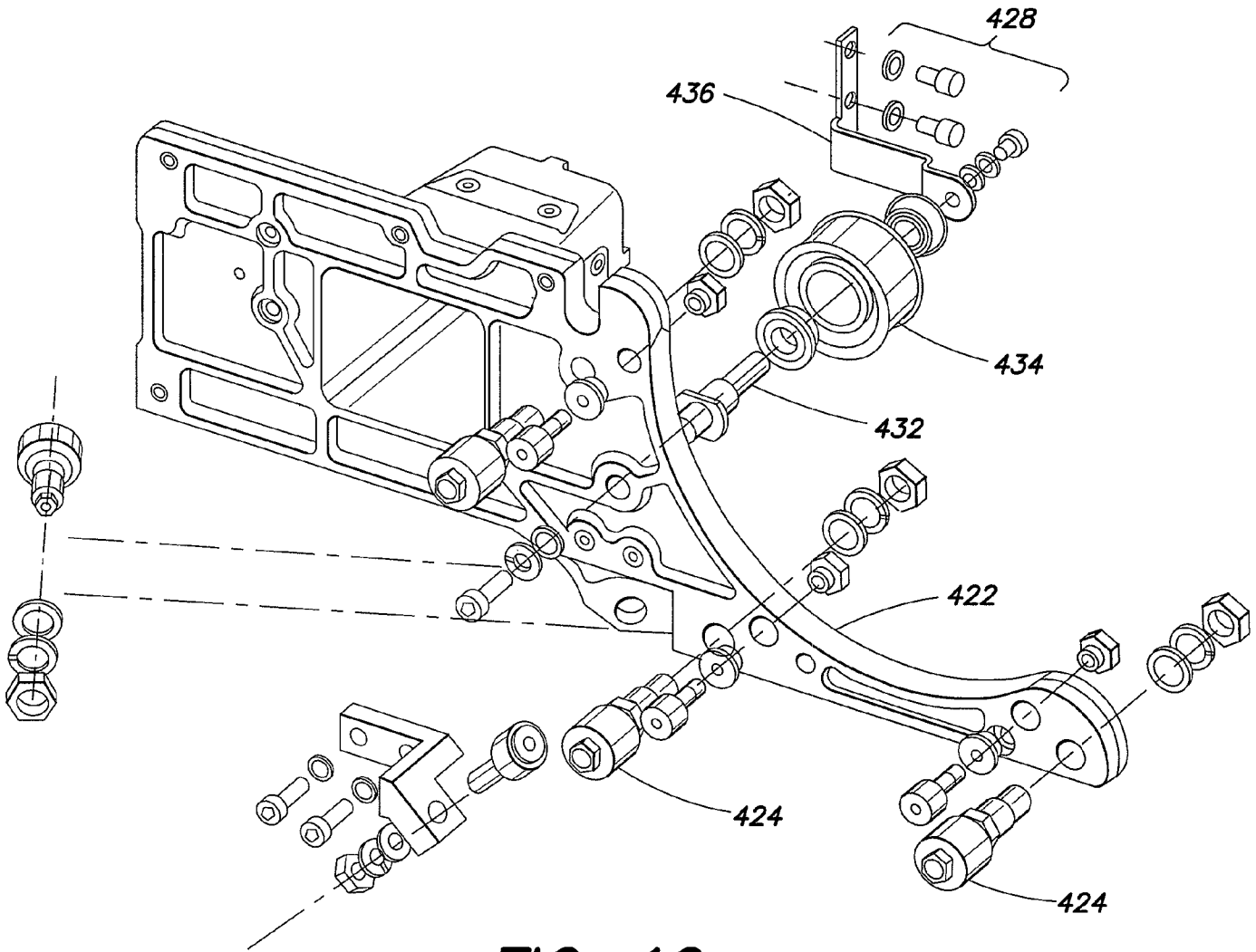
FIG. 12 is a partial exploded view of one example of an elevation drive according to aspects of the invention.

According to one embodiment, the elevation motor drive 404 is coupled via a flexible coupling 414 to the elevation motor 406. In one example, using flexible couplings, such as flexible coupling 414, to interconnect various components may add to the ease of manufacture of the external sub-system 102 by absorbing tilt and/or angle tolerances in connections and removing or reducing strain on the connections. The elevation motor 406 is mounted to an elevation motor support 416 and may be housed within housing 418. In the illustrated example, mechanical elevation drives 420*a* and 420*b* are coupled to the antenna mounting bracket 208 and are mounted to the azimuth hub assembly 402, thereby mechanically coupling the antenna array 106 to the azimuth drive system. As shown in FIG. 7, in one embodiment, the antenna mounting bracket 208 has a partial cylindrical shape, and the mechanical elevation drives 420*a*, 420*b* include arc-shaped side supports that support the curved antenna mounting bracket 208. Referring to FIG. 12, there is illustrated a partial exploded view of the right-side elevation drive 420*a*. It is to be appreciated that the left-side elevation drive 420*b* may be a substantial mirror image of the right-side elevation drive 420*a*. As shown in FIG. 12, the elevation drive 420*a* includes an arc-shaped side support 422 with rollers 424 that allow the antenna mounting bracket 208, and thus the antenna array 106 to move along the curved track, thereby allowing the antenna array 106 to rotate in elevation.

Figure 13:
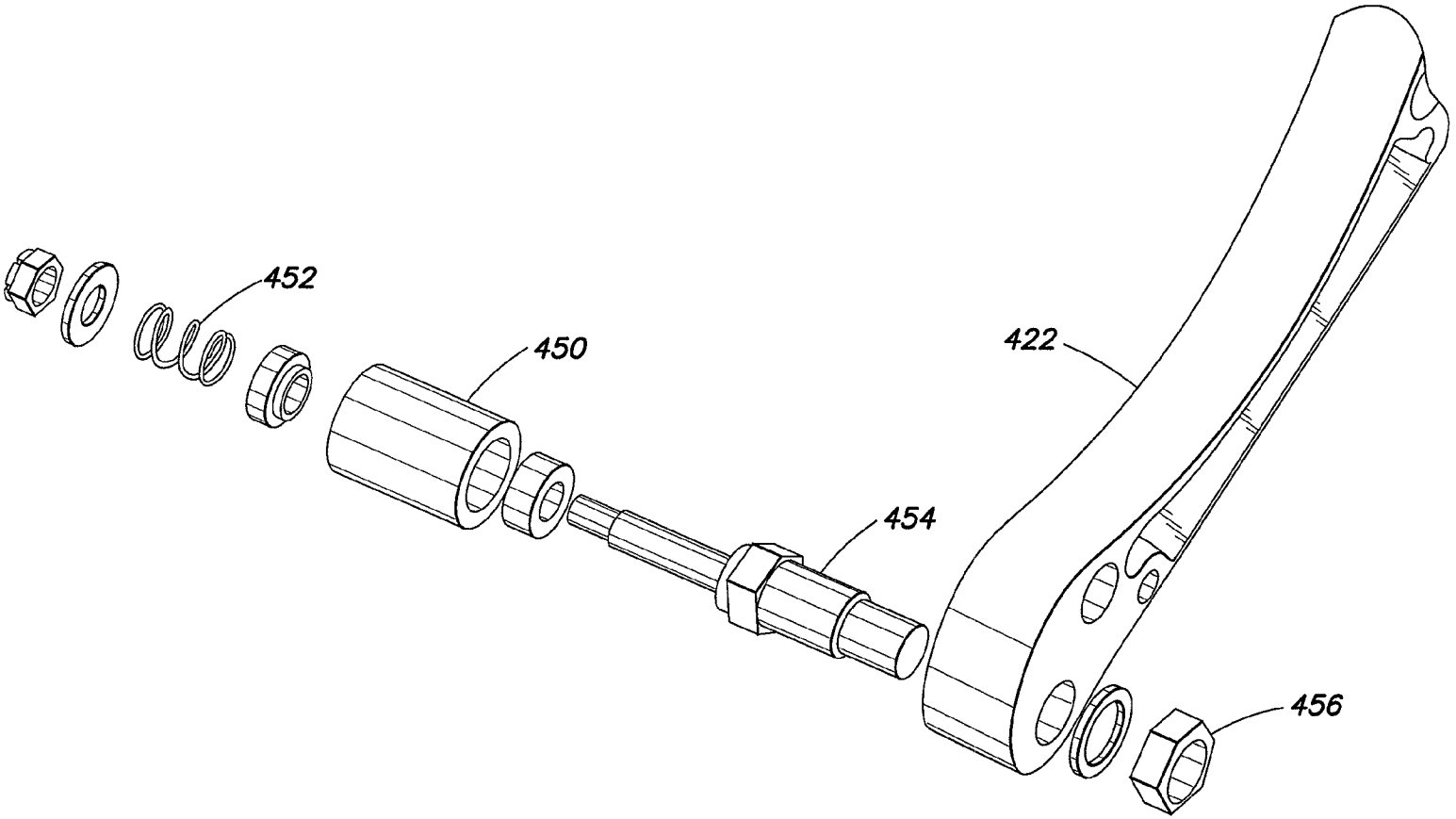
FIG. 13 is an exploded view of a portion of the elevation drive of FIG. 12 according to aspects of the invention.
Figure 14:
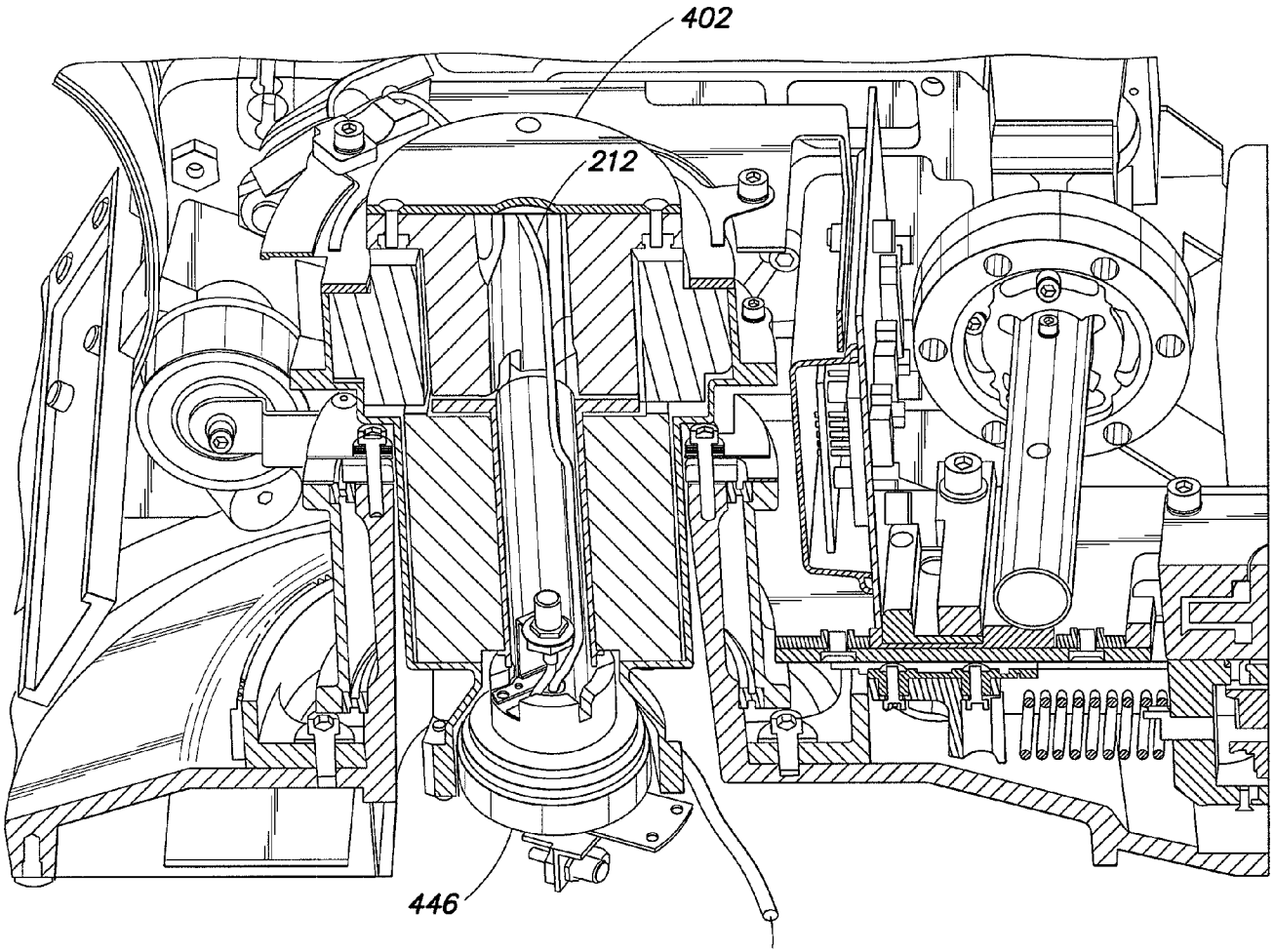
FIG. 14 is another view of a portion of an example of the external sub-system according to aspects of the invention.

Referring to FIG. 13, there is illustrated an exploded view of one example of a cam follower assembly coupled to the arc-shaped side support 422. The cam follower assembly includes a spherical cam 450 and a compression spring 452, along with a cam stern 454 and a retention fastener 456.

Figure 15:
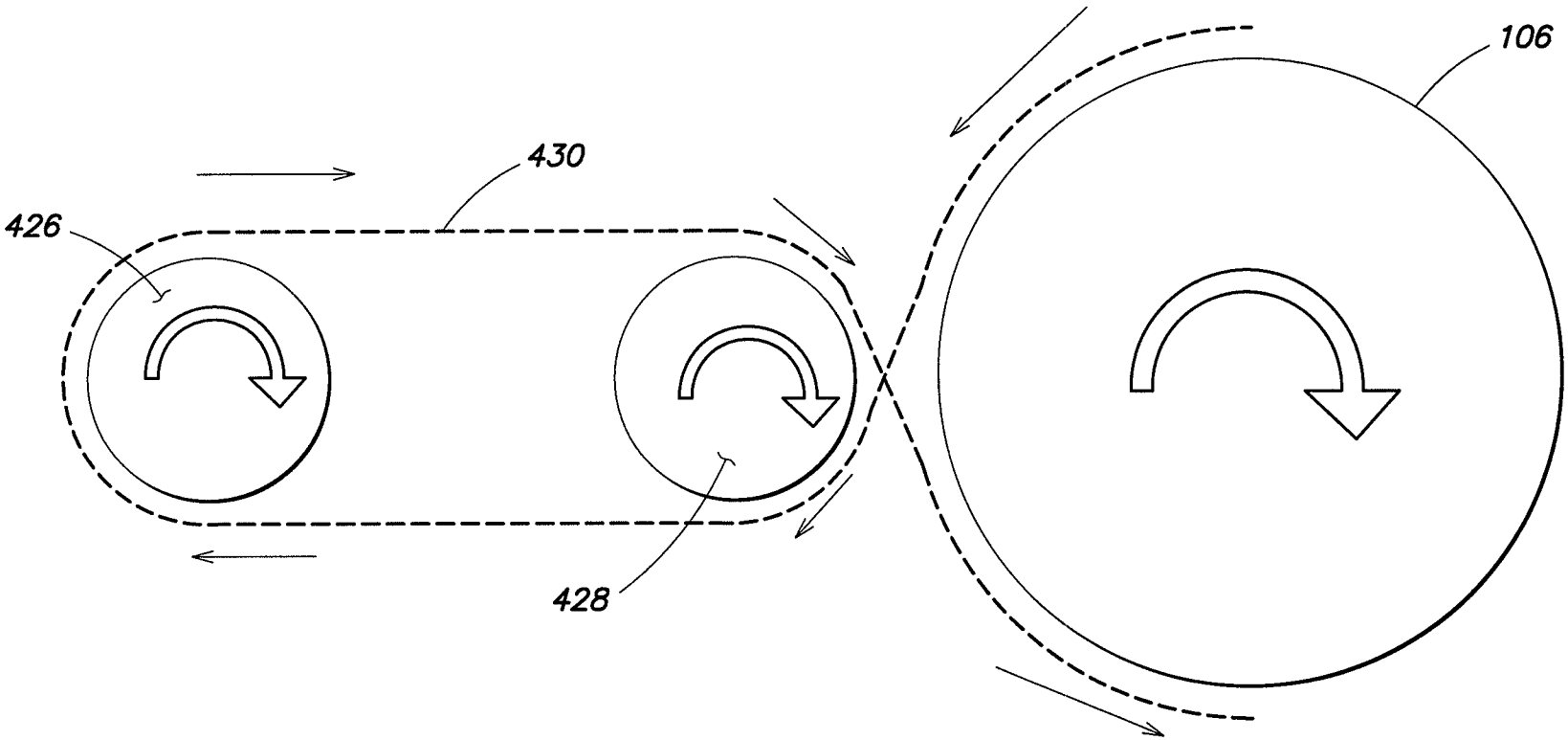
FIG. 15 is a functional diagram of one example of a pulley system that may be used to move the antenna array in elevation, according to aspects of the invention.

According to one embodiment, the elevation drive system uses a pulley system to move the antenna array 106 in elevation. An example of a push and pull pulley system is illustrated schematically in FIG. 15. The push and pull pulley system includes a drive sprocket 426 and an idler 428 coupled via a wire 430 in a continuous loop to the antenna array 106. Referring to FIGS. 6 and 7, there is illustrated an example the push and pull pulley system including the drive sprockets 426 in the elevation motor drive assembly 404 (see FIG. 7) and the idler 428 coupled to the elevation drive 420*a*. As shown in FIG. 12, the idler 428 may include a shaft 432, roller 434 and bracket 436. The elevation motor 406 in housing 418 may provide power to drive the pulley system to cause the antenna mounting bracket 208 to rotate on rollers 424 along the arc-shaped track formed by the side supports 422. The push and pull pulley system may thus effect movement of the antenna array 106 in elevation responsive to a control signal, as discussed further below. In one example, the antenna array may be moveable over an elevation angle range of approximately −10° to 90° (zenith). An advantage of configuring the pulley system as a push and pull system is that it may allow the use of a low-torque elevation motor. In addition, the antenna mounting bracket 208 may comprise relatively wide bands to provide a broad support for the antenna array 106 and distribute the load of the array over a large portion of the antenna mounting bracket. This feature may further facilitate use of a relatively small, low-torque elevation motor 406. In one embodiment, the elevation motor drive 404 also includes a clutch 458 located as indicated on FIG. 6.

Figure 16:
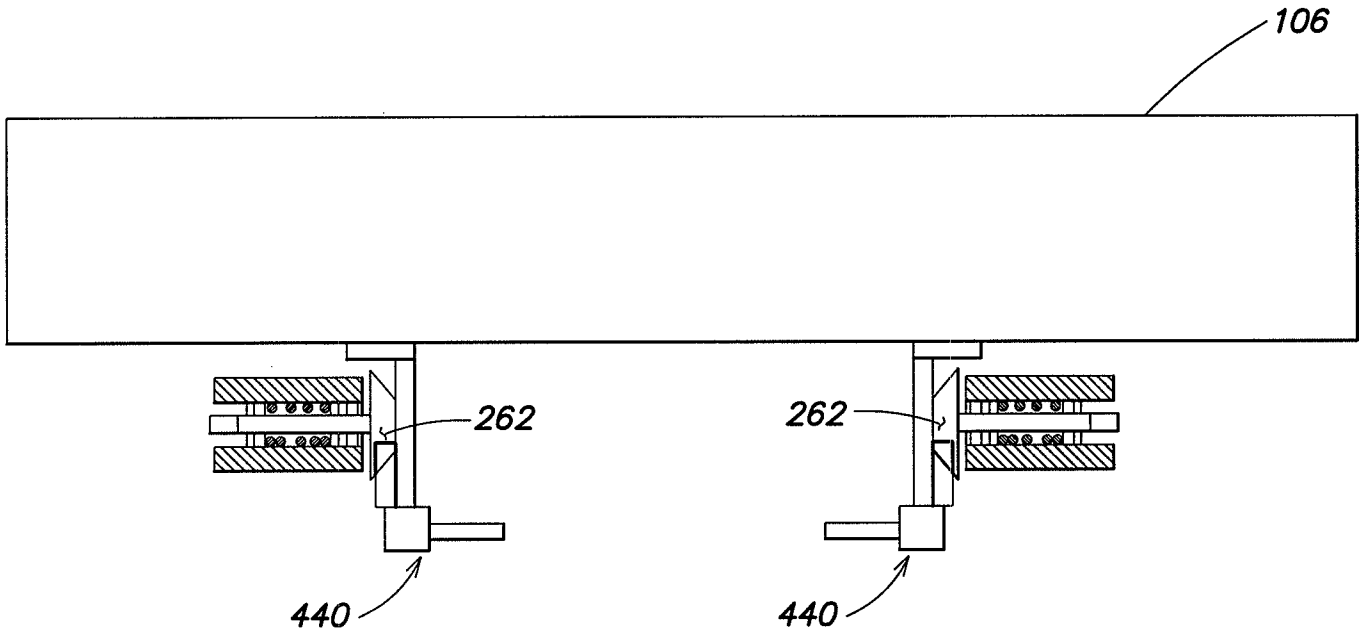
FIG. 16 is a schematic diagram illustrating the use of spring loaded cams to tune antenna array vibrations according to aspects of the invention.

Referring to FIG. 16, in one embodiment, the antenna mounting bracket 208 may include spring-loaded cams 262 which may be used to tune out high frequency vibrations of the antenna array 106. In one example, the spring loaded cams 262 are spring loaded wedge cams. In another example, registration of the antenna array on the arc of the antenna mounting bracket 208 may be maintained by wedge and standard cams 440. In addition, snubber wheels (not shown) may be provided on the antenna mounting bracket 208 to prevent rocking of the antenna array 106. The antenna array 106 may tend to rock back and forth as a result of its structural natural frequency. The snubber wheels may prevent this rocking, changing the rocking motion into a purely translational movement (i.e., up and down movement), which does not affect the pointing angle of the antenna array.

In one embodiment, the mounting bracket 214 is attached to the gimbal assembly 108 along a center of rotation normal to the azimuth plane. The structure of the gimbal assembly 108 supports the antenna assembly including the antenna array 106 and low-noise amplifiers, and may also support a polarization converter unit (PCU) 128, as discussed further below. The gimbal assembly 108 may include a frame 442 which may provide support for various components of the gimbal assembly 108 as well as providing handles or lifting points for the gimbal assembly. In one embodiment, the antenna assembly is mounted on one side of the aforementioned centerline of the mounting bracket 214 and gimbal assembly 108, and mounted on the opposite side of the centerline is the azimuth motor, the drive train of the azimuth motor drive 408, the elevation motor 406, the elevation motor drive mechanism 404, and a gimbal connector unit 444 along with its associated cabling. In this embodiment, the weight of the entire external sub-system 102 is distributed, to the extent possible, by locating equipment about the azimuth axis of rotation. In another embodiment, the slip ring and rotary joints each rotate concentric to the azimuth axis of rotation and are each located above the mounting bracket 214 and are supported by the structure of the gimbal assembly 108. Other embodiments of the system permit the distribution of electronics to be supported by the structure of the gimbal assembly 108, such as, but not limited to, the polarization control unit, for example, as discussed further below.

Figure 17:
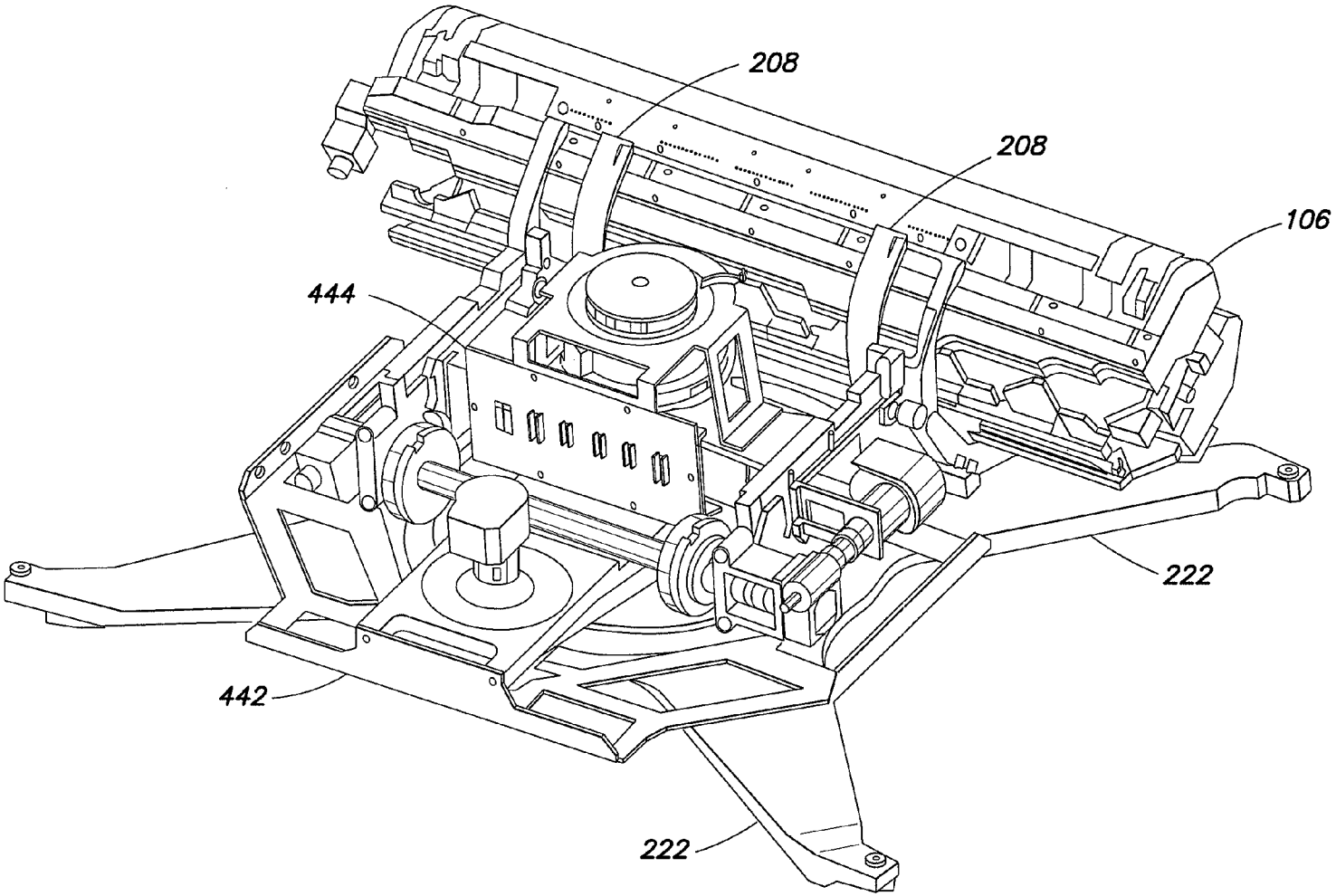
FIG. 17 is a perspective view of another example of an external sub-system according to aspects of the invention.

Referring again to FIGS. 6 and 7, and to FIG. 17 which illustrates another view of an example of the external sub-system 102, in one embodiment, the gimbal assembly 108 includes a gimbal connector unit 444 that provides connections between the various cables and components in the external sub-system 102 as well as to the antenna control unit 112 and/or other components of the internal sub-system 104. This gimbal connector unit 444 may receive connectorized cables and may replace the traditional cable harness used in many wiring situations, thereby greatly simplifying connecting components of the external sub-system 102 together and/or to the internal sub-system 104. With the gimbal connector unit 444, various components of the external sub-system 102 may include a connectorized cable such that it can be easily plugged into the gimbal connector unit 444. Thus, each component may be connected to, or disconnected from, the gimbal connector unit 444, and thus to other components of the system, without any need to change or interfere with the wiring of other components.

As discussed above, the gimbal assembly may transfer signals, via cables, between various components of the internal sub-system 104 and the antenna array and/or other components of the external sub-system 102. In one embodiment, the mounting bracket 214 is configured with cable routing troughs and clamps to provide an efficient mechanism for routing cables between the internal sub-system 104 (via the central portion 220 of the mounting bracket) and components of the external sub-system 102. The cable routing mechanism incorporated into the mounting bracket 214 may minimize holes in the host platform (e.g., in the fuselage of aircraft 132) and maintain a horizontal relationship of RF and control cabling, as discussed further below.

Figure 18:
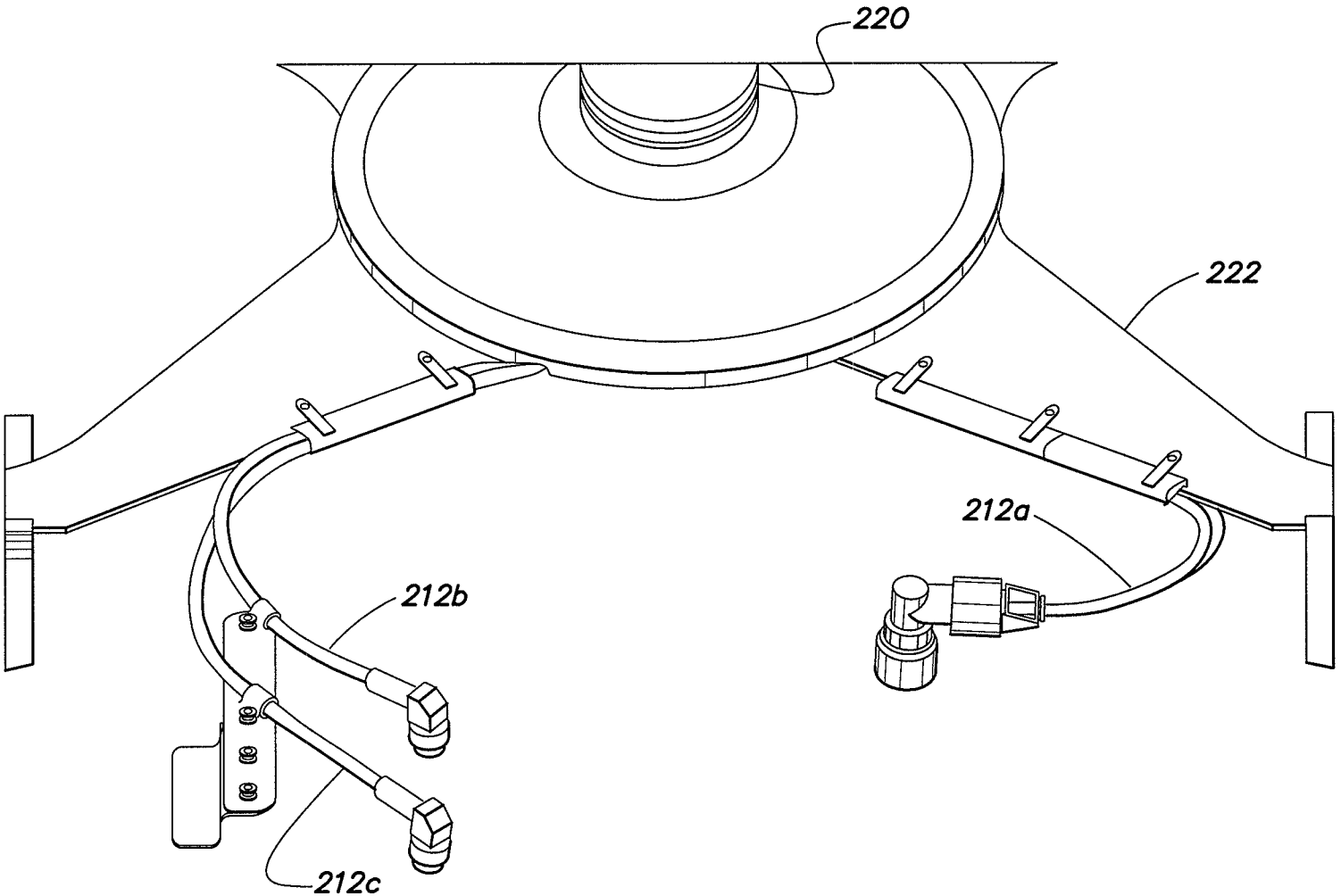
FIG. 18 is an illustration of a portion of an example of the mounting bracket showing supported cables according to aspects of the invention.
Figure 19A:
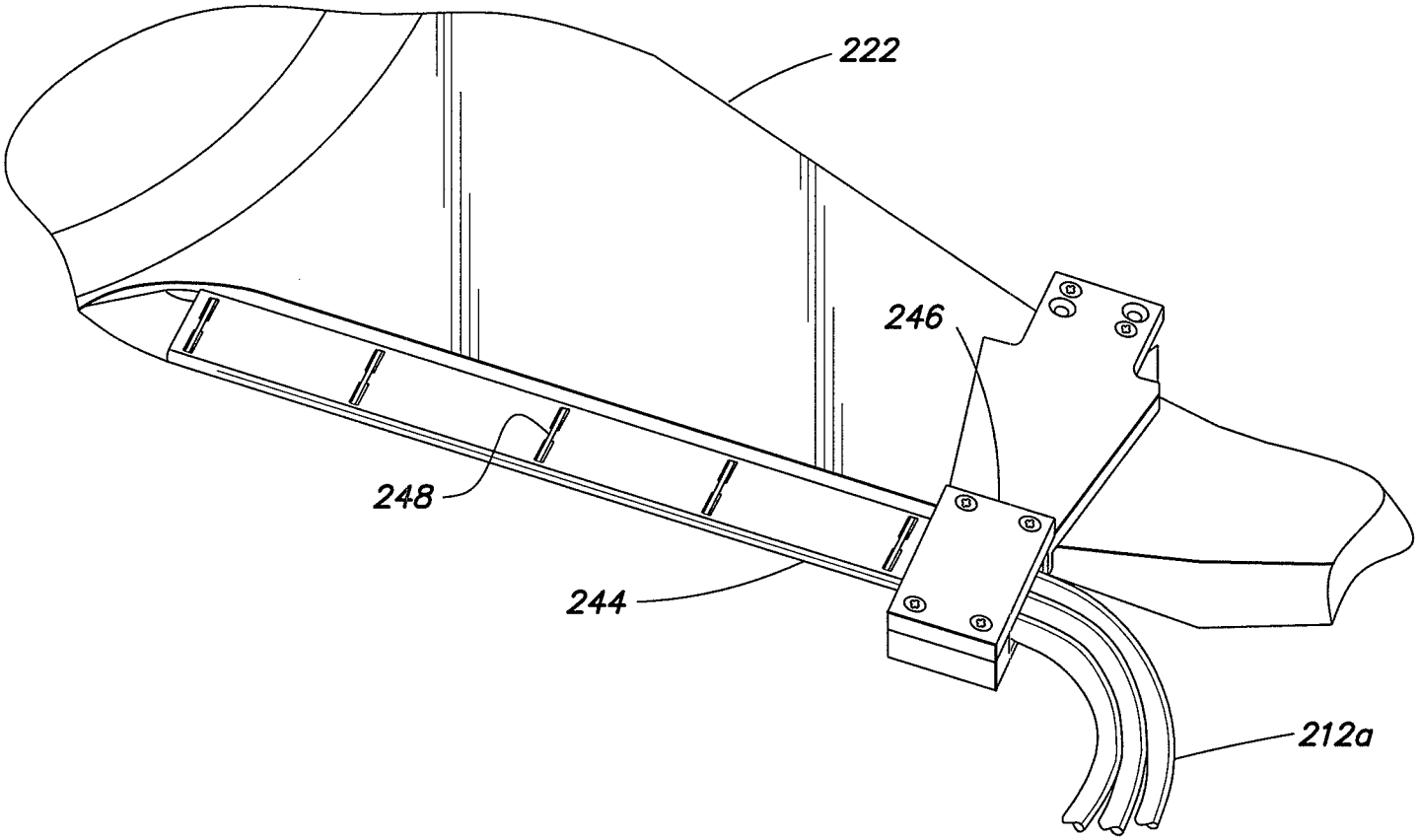
FIG. 19A is an illustration of a leg of the mounting bracket including cable supports according to aspects of the invention.

Referring to FIG. 18, there is illustrated a view of a portion of the mounting bracket 214 with cables 212*a*, 212*b* and 212*c* shown clamped to the leg portions 222 of the mounting bracket 214. As discussed above, it is to be appreciated that each of cables 212*a*, 212*b* and 212*c* may be a single cable or a group of cables. In the illustrated embodiment, the cables 212*a-c* are routed along the leg portions 222 of the mounting bracket 214 using covers or conduits 244 which are attached to the legs of the mounting bracket. It is to be appreciated that the conduit 244 may include one or more sides, and is not limited to surrounding the cables 212, but may cover or partially surround the cables. In one example, the conduit 244 is metal; however, it is to be appreciated that the conduits alternatively may be plastic or a composite material. FIG. 19A illustrates an enlarged view of one of the legs 222 of the mounting bracket 214 with a cable conduit 244 attached thereto. The conduits 244 may provide protection for the cables and maintain their rigidity and stability.

Figure 19B:
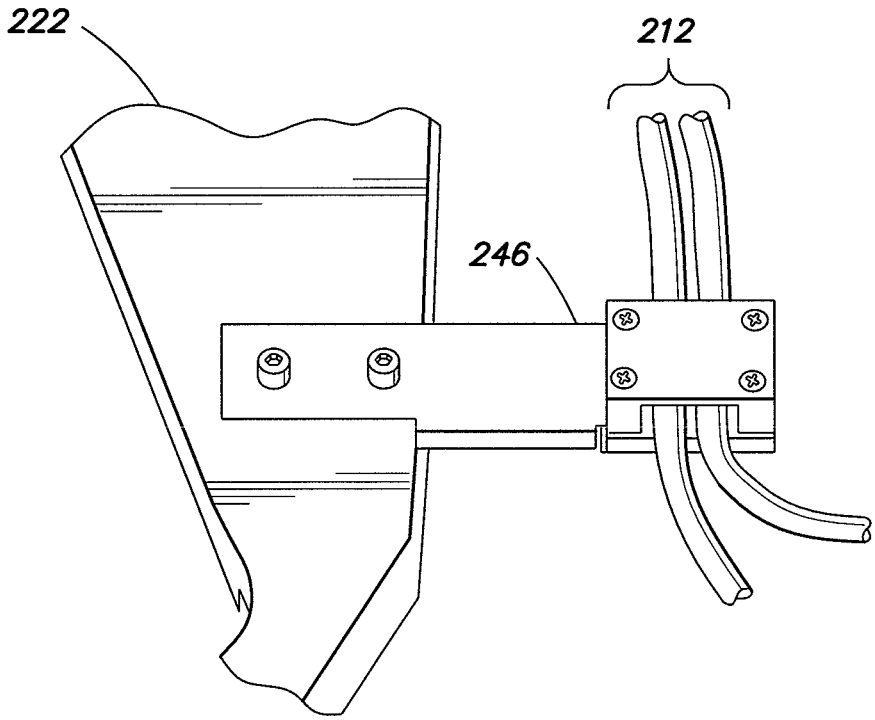
FIG. 19B is an illustration of a portion of the leg of the mounting bracket including another example of a cable support according to aspects of the invention.
Figure 19C:
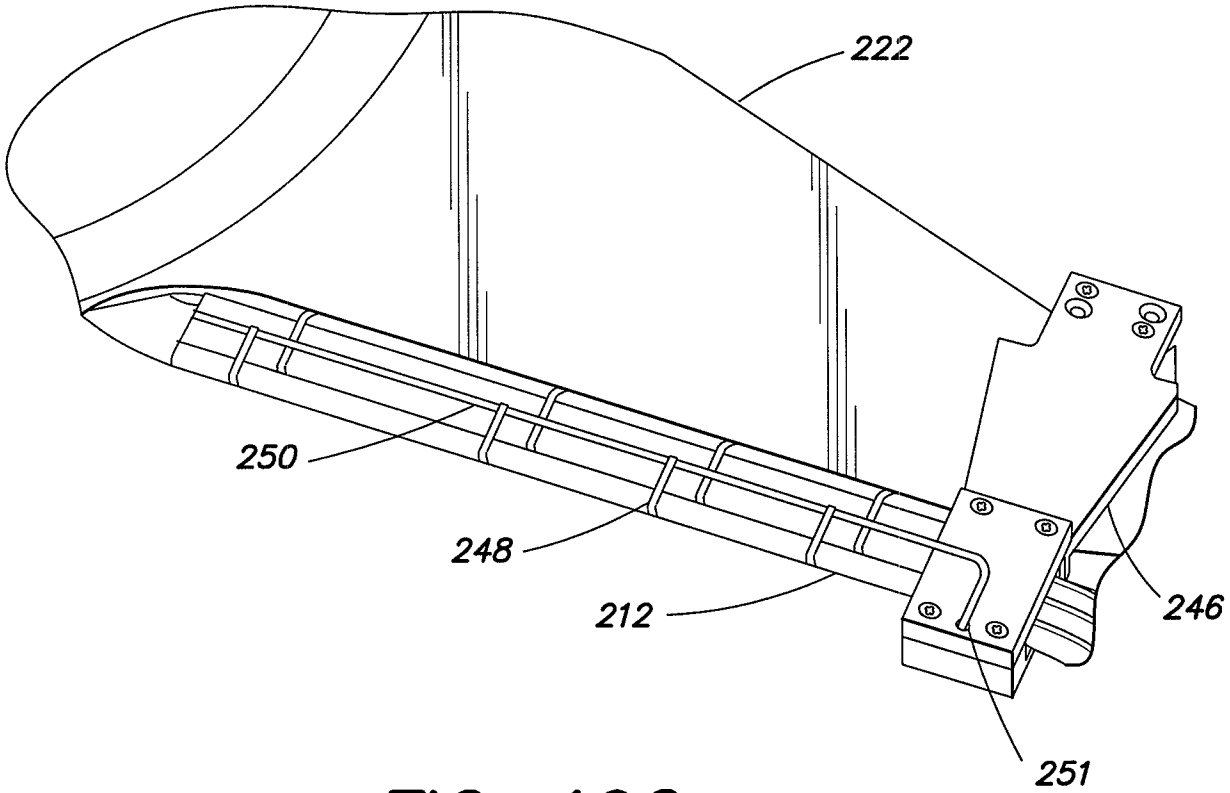
FIG. 19C is another illustration of portion of the leg of the mounting bracket including another example of a cable support according to aspects of the invention.

In one example, the conduit 244 is attached to the leg 222 using a clamp 246. In the example illustrated in FIG. 19A, the clamp 246 is clamped over the leg 222. In another example, the clamp 246 is screwed into the leg 222, as shown in FIG. 19B. As also illustrated in FIG. 19B, in applications where maintaining the rigidity of the cables and limiting movement of the cables 212 is less important, the cables 212 may be passed through and held by the clamp 246, without the need for the conduit 244. Clamps 246 may be spaced at various points along the length of the leg 222, as illustrated for example in FIG. 18. The clamp 246 may support the end of the conduit 244. In one example, the material and configuration of the clamps 246 are selected to provide a long-term consistent clamp over diverse environmental conditions. In one example, the cables 212 are help approximately 1 to 1.5 inches off the leg 222 of the mounting bracket 214, and the clamp is sufficiently rigid to not vibrate, even with movement of the host platform. The conduit 244 may be laced in with the cables 212 using bands 248, as shown in FIG. 19A, to provide additional rigidity and structural support. Rounded edges of the clamps may be used to prevent damage to the cables 212. Referring to FIG. 19C, according to another example, a support rod 250 is laced in with the cables 212 to stiffen the cable bundle and provide additional support. In one example, the clamp 246 includes a hole (indicated at reference position 251) to accommodate the end of the support rod 250. Those skilled in the art will recognize, given the benefit of this disclosure, that numerous variations on the configuration of the conduit 246 and the mechanism for attaching the conduit to the legs 222 of the mounting bracket 214 are possible, and are intended to be covered by this disclosure.

Figure 20A:
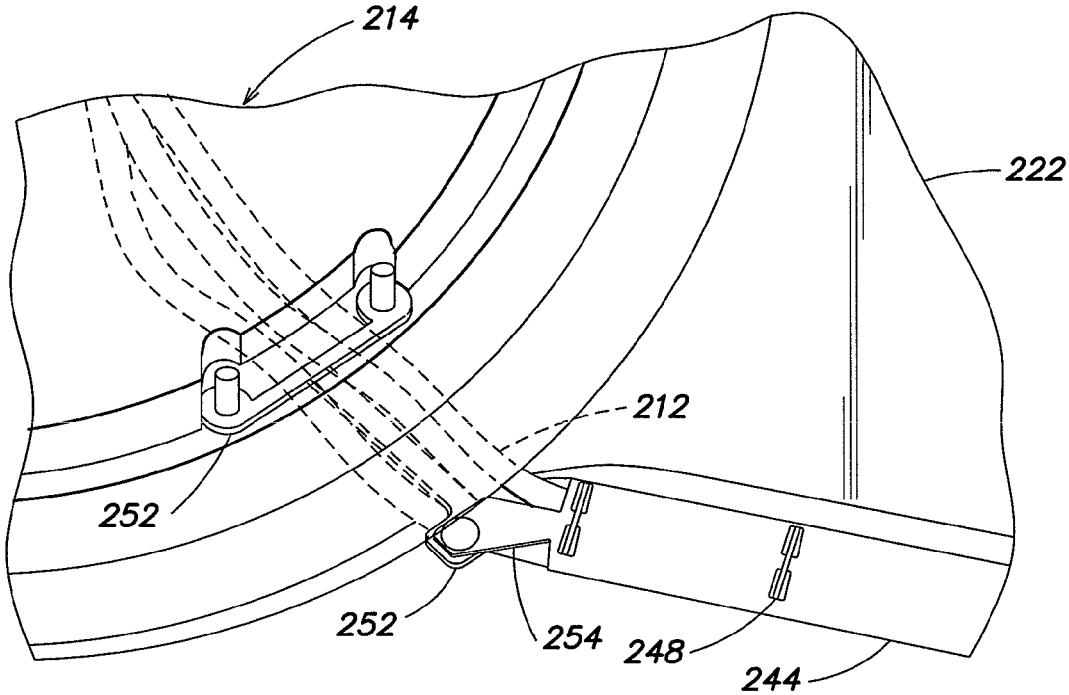
FIG. 20A is an illustration of a portion of the mounting bracket including an example of a cable support according to aspects of the invention.
Figure 20B:
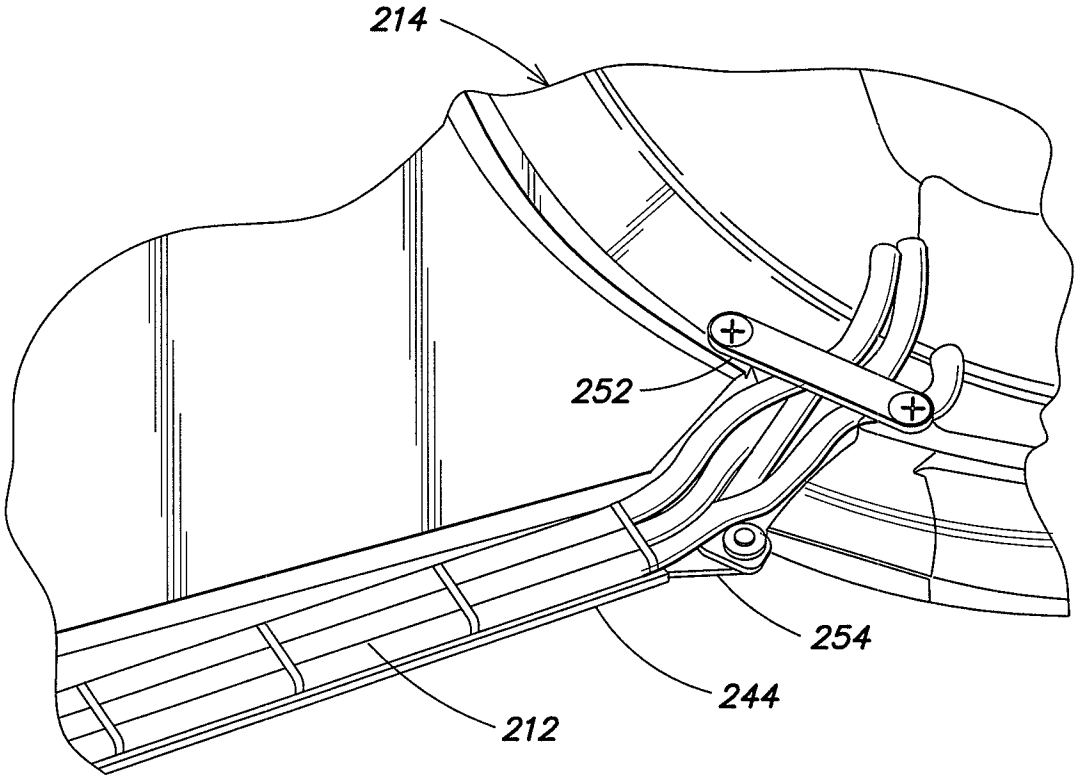
FIG. 20B is an illustration of the underside of a portion of the mounting bracket including a cable support according to aspects of the invention.

Referring to FIG. 20A, there is illustrated a portion of the mounting bracket 214 and cable support system, including the cable conduit 244, showing one example of attachment of an end of the conduit 244 to the mounting bracket. In one example, a bracket 252 that is attached to the mounting bracket 214 and to an end portion 254 of the conduit, to guide the cables 212 to and from the conduit 244. FIG. 20B illustrates the mounting bracket 214 from the underside of the mounting bracket 214. As shown in FIG. 20B, the cables 212 may be held under the bracket 252 to secure the cables to the underside of the mounting bracket 214.

Figure 21:
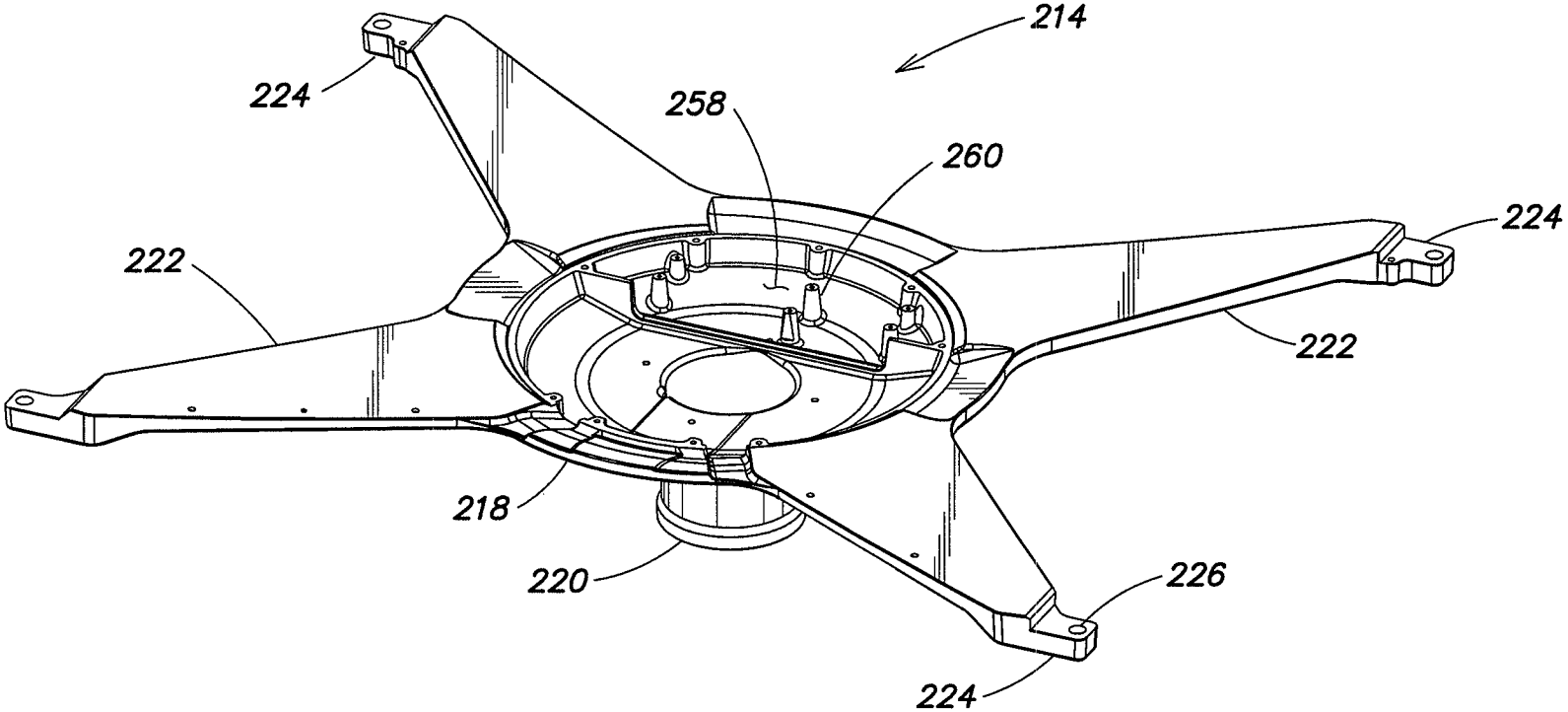
FIG. 21 is a diagram of one example of the underside of an example of the mounting bracket according to aspects of the invention.
Figure 22:
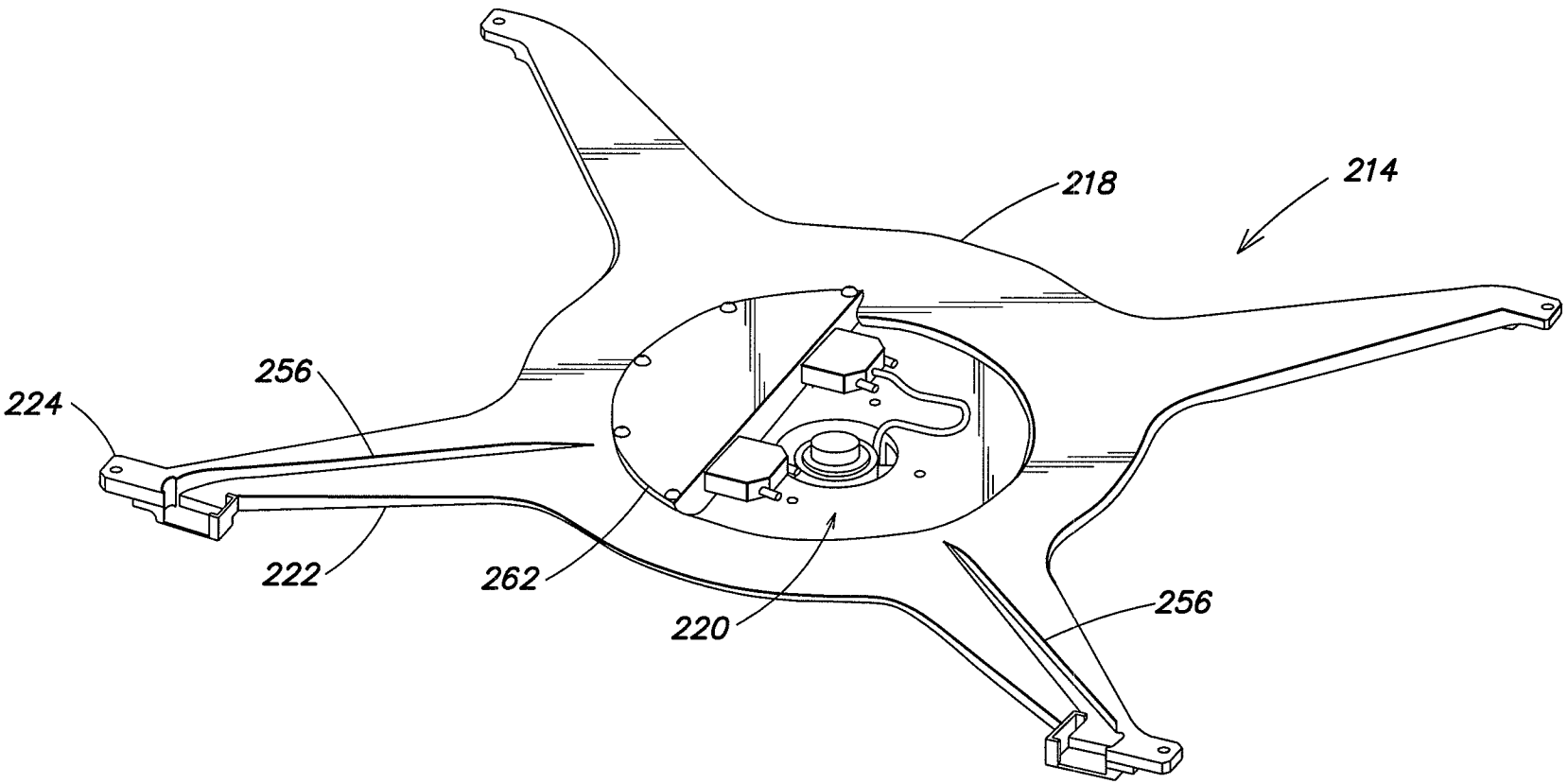
FIG. 22 is an illustration of another example of the underside of an example of the mounting bracket according to aspects of the invention.

According to one embodiment, the mounting bracket 214 may be formed with various grooves, indentations, channels, cavities and/or troughs to accommodate various components of the gimbal assembly 108 or external sub-system 102. Referring to FIG. 21, there is illustrated a view of the underside of one example of the mounting bracket 214, illustrating the body portion 218 comprising various indentations or integral cavities. In one example, the body portion 218 is configured to accommodate a gimbal measurement unit (not shown in FIG. 21) in an integral cavity portion 258. The gimbal measurement unit may be located in a housing 262 (as shown in FIG. 22) and fastened to the mounting bracket 214 via fastening points 260. Furthermore, the mounting bracket 214 may also contain one or more integral cavities, grooves or trough features, to contain and support the cables that may transfer control and radio frequency signals to the antenna and from the antenna control unit and high power transceiver.

Figure 23:
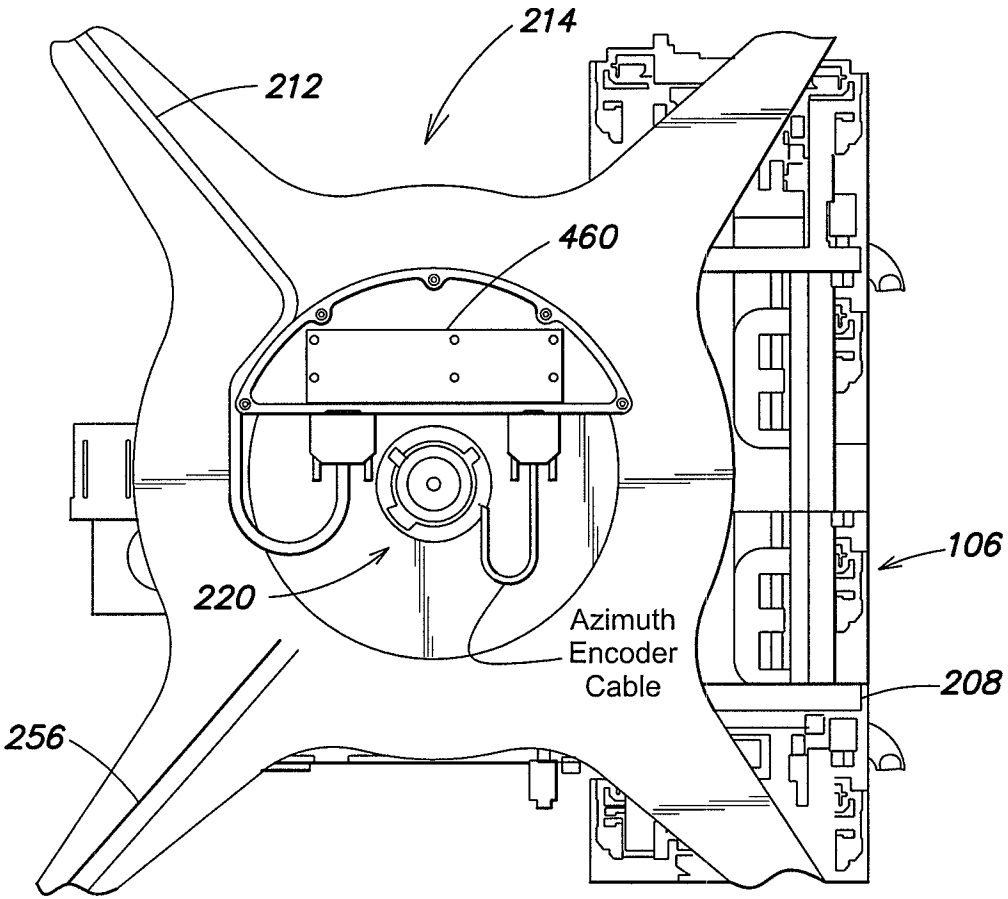
FIG. 23 is a plan view of another example of the underside of an example of the mounting bracket according to aspects of the invention.

Thus, referring to FIG. 23, according to one embodiment, at least some of the cables 212 may be positioned in grooves or troughs 256 formed on the legs 222 of the mounting bracket 214, rather than in the conduits attached to the legs as discussed above. FIG. 23 illustrates a plan view of the underside of one example of a mounting bracket 214 including grooves 256 running along at least some of the legs 222 of the mounting bracket. As shown in FIG. 23, cables 212 may be placed within, or partially within, the grooves 256. In some examples, the grooves 256 may be used instead of the conduits 244 discussed above. In other examples, a combination of grooves 256 and conduits 244 may be used to guide and support the various cables used in the external sub-system 102.

As also illustrated in FIG. 23, the gimbal assembly 108 may include a gimbal measurement unit 460 mounted to the mounting bracket 214, as discussed above. Cables 212 may connect the internal sub-system 104 to the gimbal measurement unit 460 via the central portion 220 of the mounting bracket, as discussed above. Operation of the gimbal measurement unit is discussed in more detail below.

As discussed above, according to one embodiment, the antenna array 106 comprises a plurality of antenna elements 308, such as horn antennas (see FIG. 6), coupled to a feed network 302, which in at least some embodiments is a waveguide network. Additionally, in some embodiments, each antenna element 308 may be coupled to a corresponding dielectric lens 304. The dielectric lenses 304 may serve to focus incoming or transmitted radiation to and from the antenna elements 308 and to enhance the gain of the antenna elements, as will be discussed in more detail below. The feed network 302 may be adapted based on the type and configuration of the antenna elements 308 used in the antenna array 106. In the example illustrated in FIGS. 4, 6 and 7, the feed network 302 is a custom sized and shaped waveguide feed network. An advantage of waveguide is that it is generally less lossy than other transmission media such as cable or microstrip. It may therefore be advantageous to use waveguide for the feed network 302 in applications where it may be desirable to reduce or minimize loss associated with the antenna array 106. However, it is to be appreciated that the feed network 302 may be constructed wholly or in part using transmission media other than waveguide. The feed network 302 will be described in more detail below.

Figure 24:
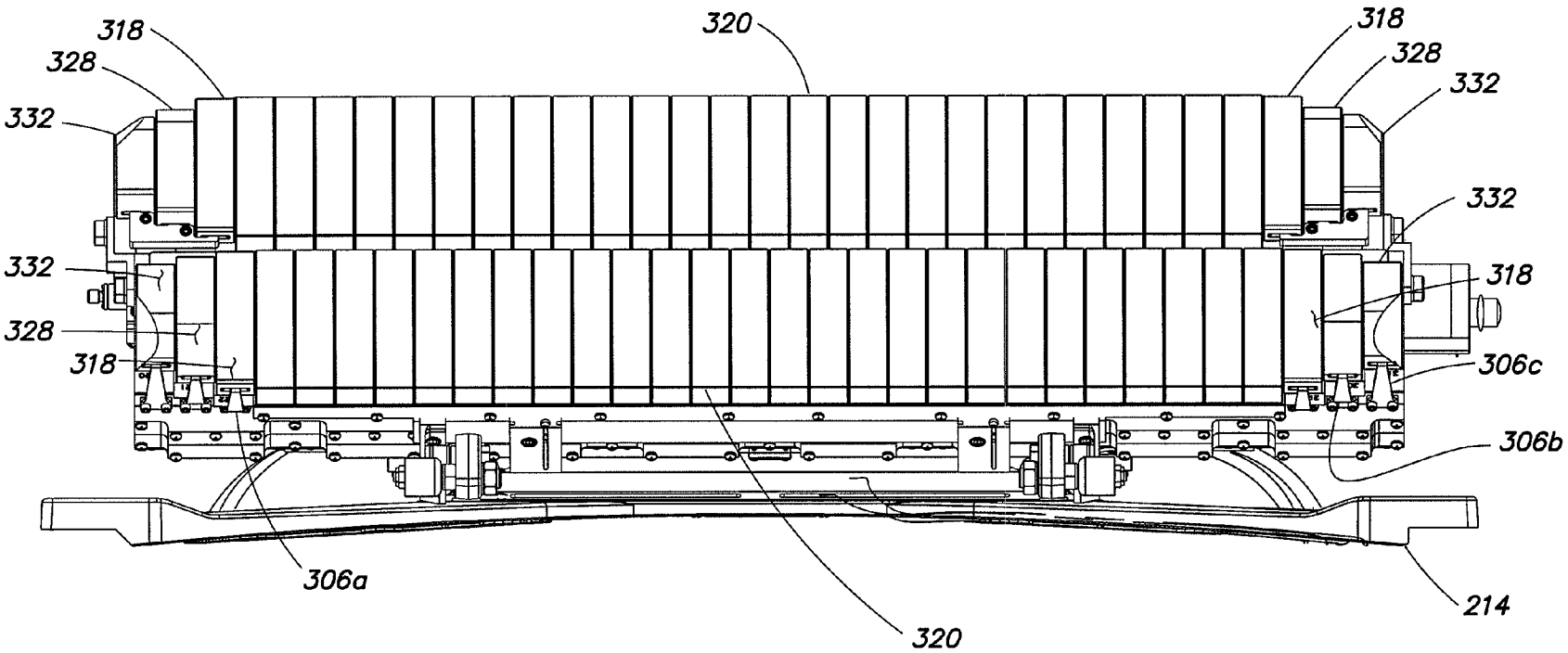
FIG. 24 is a front view of one example of an antenna array according to aspects of the invention.
Figure 25:
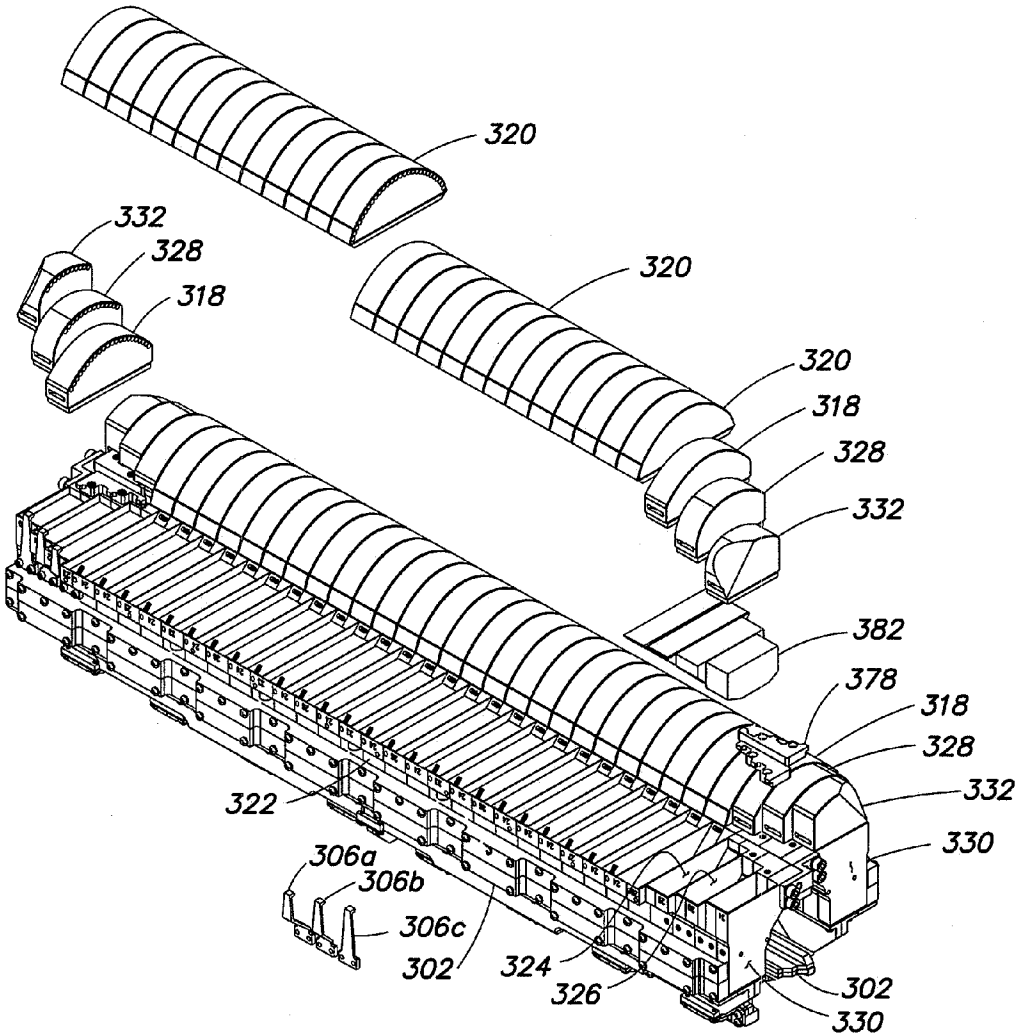
FIG. 25 is a partial exploded view of the antenna array of FIG. 24.

Referring to FIGS. 24 and 25, there are illustrated a front view (FIG. 24) and a partial exploded view (FIG. 25) of one example of the antenna array 106. In the illustrated example, the antenna array 106 comprises an array of 64 rectangular horn antennas disposed in two parallel rows (i.e., in a 2×32 configuration). However, it is to be appreciated that antenna array 106 may include any number of antenna elements each of which may be any type of suitable antenna, and that the antenna elements may be arranged in a number of parallel rows other than two. For example, an alternative antenna array may include eight circular or rectangular horn antennas in 2×4 or 1×8 configurations. In another example, the antenna array may include an integer number of rows of 32 antenna elements, the integer being from one to eight. Although in some applications it may be advantageous for the antenna elements to be antennas having a wide bandwidth, such as, for example, horn antennas, the invention is not limited to horn antennas and any suitable antenna may be used. Thus, although the following discussion will refer primarily to the illustrated example of a 2×32 array of rectangular horn antennas, it is to be understood that the discussion applies equally to other types and sizes of arrays, with modifications that may be apparent to those of skill in the art.

Figure 26:
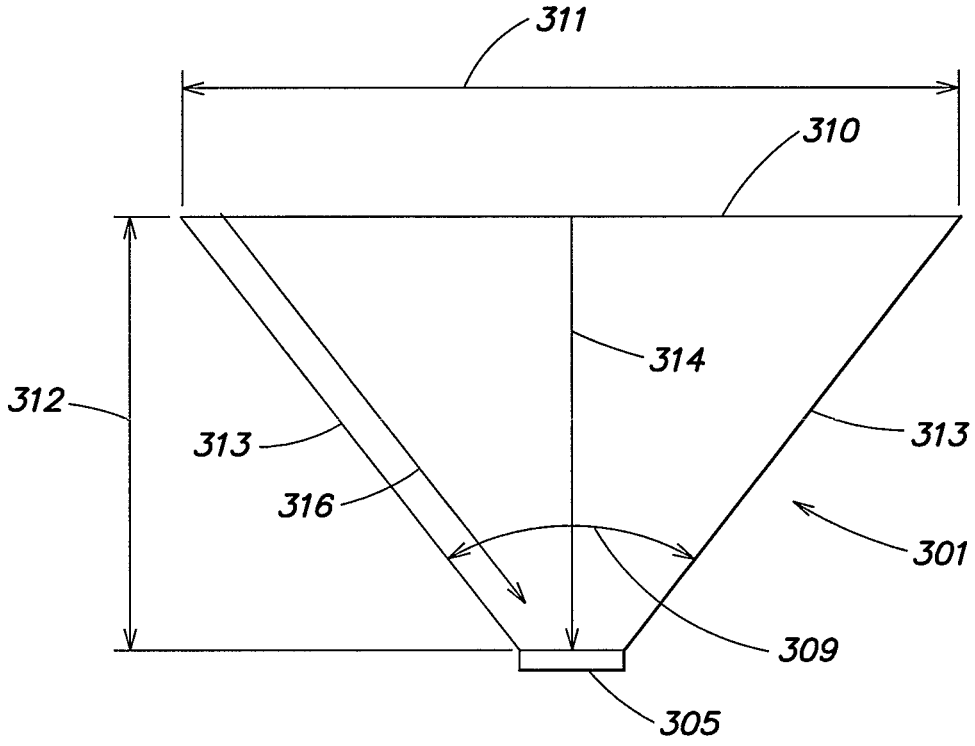
FIG. 26 is a cross-sectional diagram of one example of a horn antenna.

In general, each horn antenna element 308 may receive incoming electromagnetic radiation though an aperture 310 defined by the sides 313 of the antenna element, as shown in FIG. 26. The antenna element 308 may focus the received radiation to a feed point 305 at which the antenna element is coupled to the feed network 302 (not shown in FIG. 26). It is to be appreciated that while the antenna array 106 will be further discussed herein primarily in terms of receiving incoming radiation from an information source, the antenna array may also operate in a transmitting mode wherein the feed network 302 provides a signal to each antenna element 308, via the corresponding feed point 305, and the antenna array transmits the signal.

As discussed above, according to one embodiment, the external sub-system 102 may be mounted on a vehicle, such as an aircraft 132 as illustrated in FIG. 3. In this and similar applications, it may be desirable to reduce the height of the antenna array 106 (and that of the entire external sub-system 102) to minimize drag as the aircraft moves. Accordingly, low-profile antenna elements 308 may be presently preferred for such applications. Therefore, in one example, horn antenna elements 301 are constructed to have a relatively wide internal angle 309, resulting in a relatively wide aperture width 311, to provide a large aperture area while keeping the height 312 of the horn antenna element 301 relatively small. In one example, the horn antenna elements 301 are sized such that the horn-to-horn azimuthal spacing on the same row is about 1 wavelength at the highest transmit frequency. This sizing may help to keep the first grating lobe outside of visible space across the frequency band of operation, as discussed further below.

One result of the use of low-height, wide aperture horn antennas as the antenna elements 301 is that the antenna elements may have a lower gain than might be preferable. This lower gain results because, as shown in FIG. 26, there may be a significant path length difference between a first signal 314 vertically incident on the horn aperture 310, and a second signal 316 incident along the side 313 of the horn antenna element 301. This path length difference may result in significant phase difference between the first and second signals 314, 316, resulting in signal interference and lower overall gain. Therefore, according to one embodiment, a dielectric lens 304 is coupled to each horn antenna element 301 to improve the gain of the horn antenna element. The dielectric lens 304 may be mounted at the aperture 310 of the horn antenna element 301 to focus the RF energy at the feed point 305 of the horn antenna element. The dielectric lens 304 may serve to match the phase and path length of the signals incident at different angles on the horn antenna element 301, thereby increasing the gain of the antenna array 106.

Figure 27:
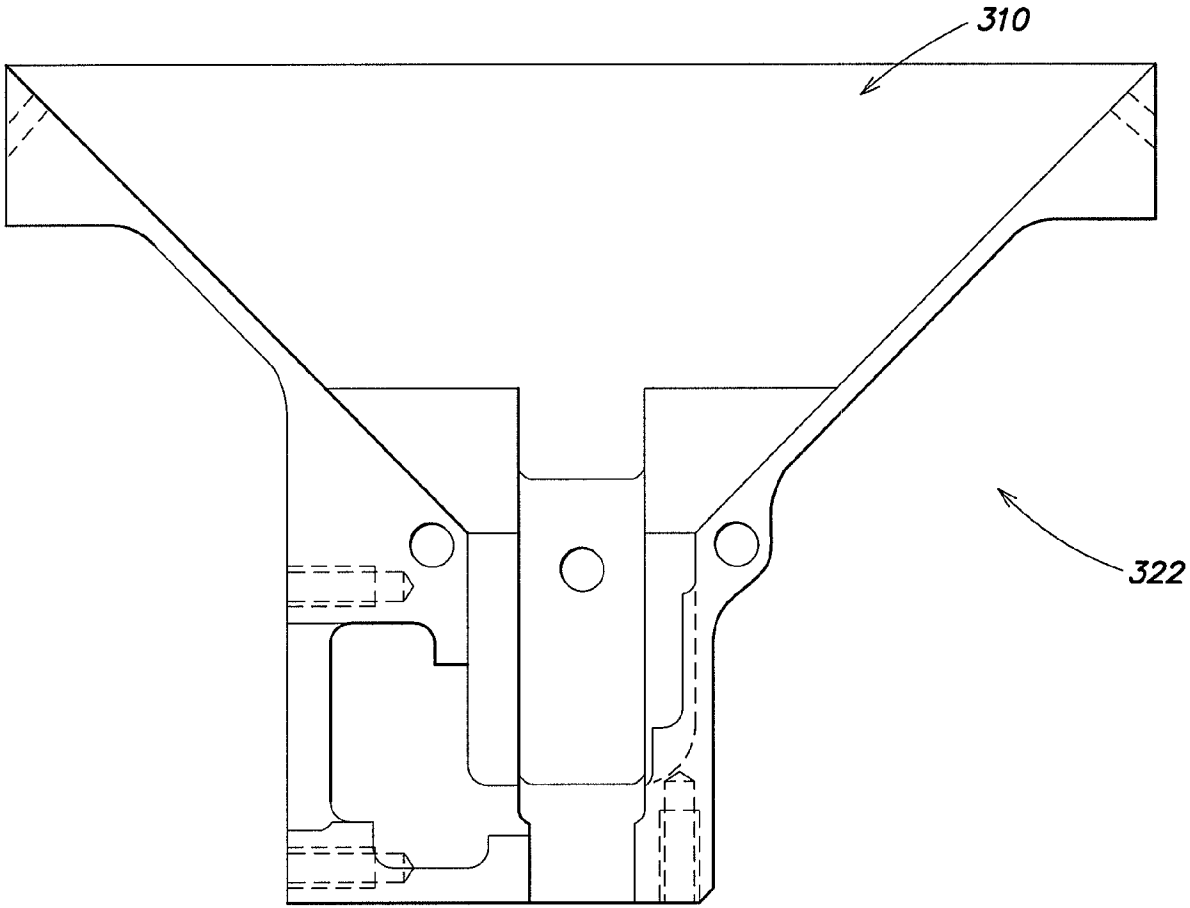
FIG. 27 is a side view of one example of an interior horn antenna element, according to aspects of the invention.
Figure 28:
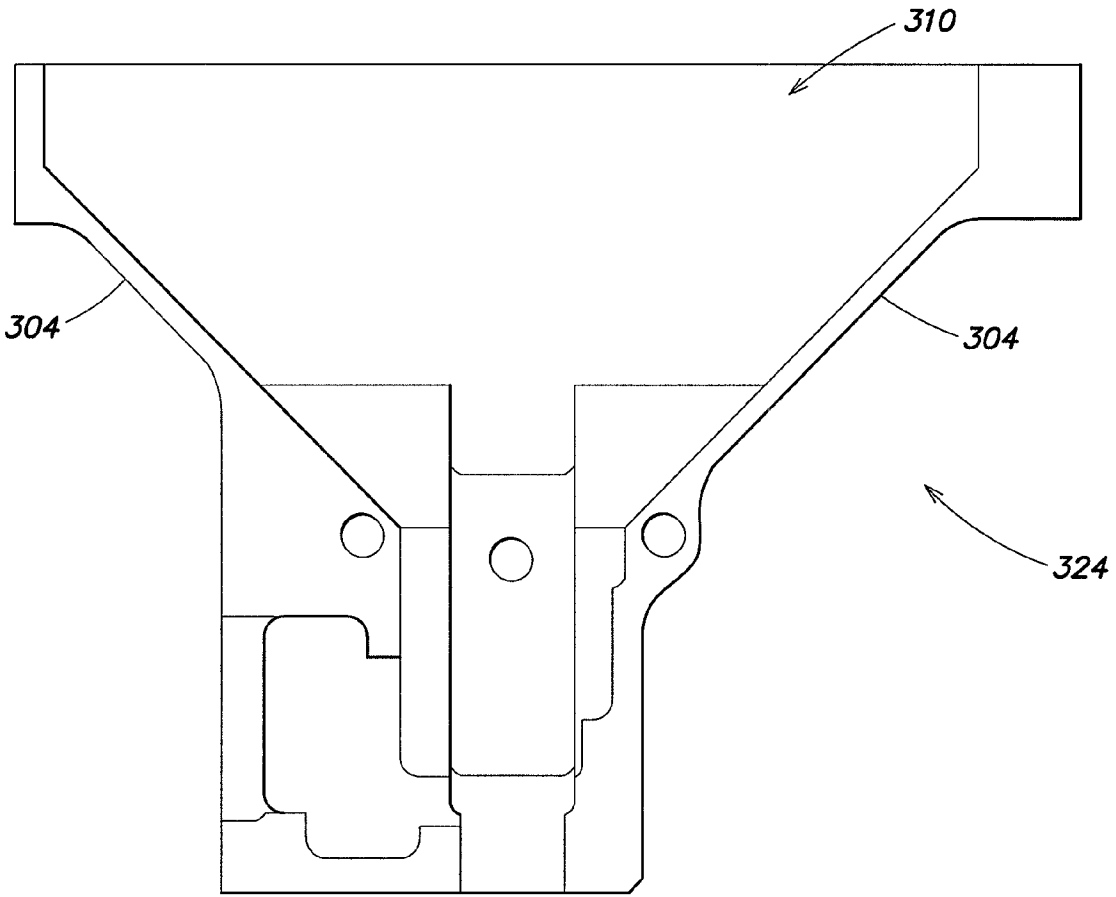
FIG. 28 is a side view of one example of a third horn antenna element, according to aspects of the invention.
Figure 29:
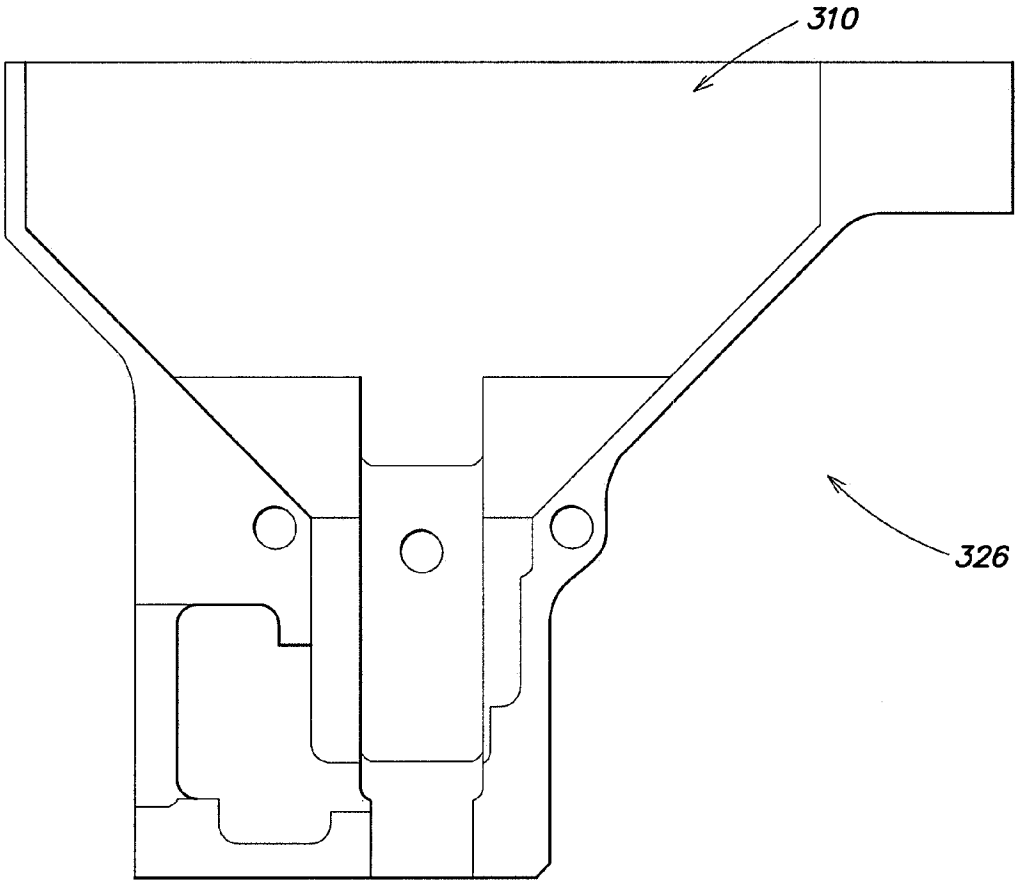
FIG. 29 is a side view of one example of a second horn antenna element, according to aspects of the invention.
Figure 30:
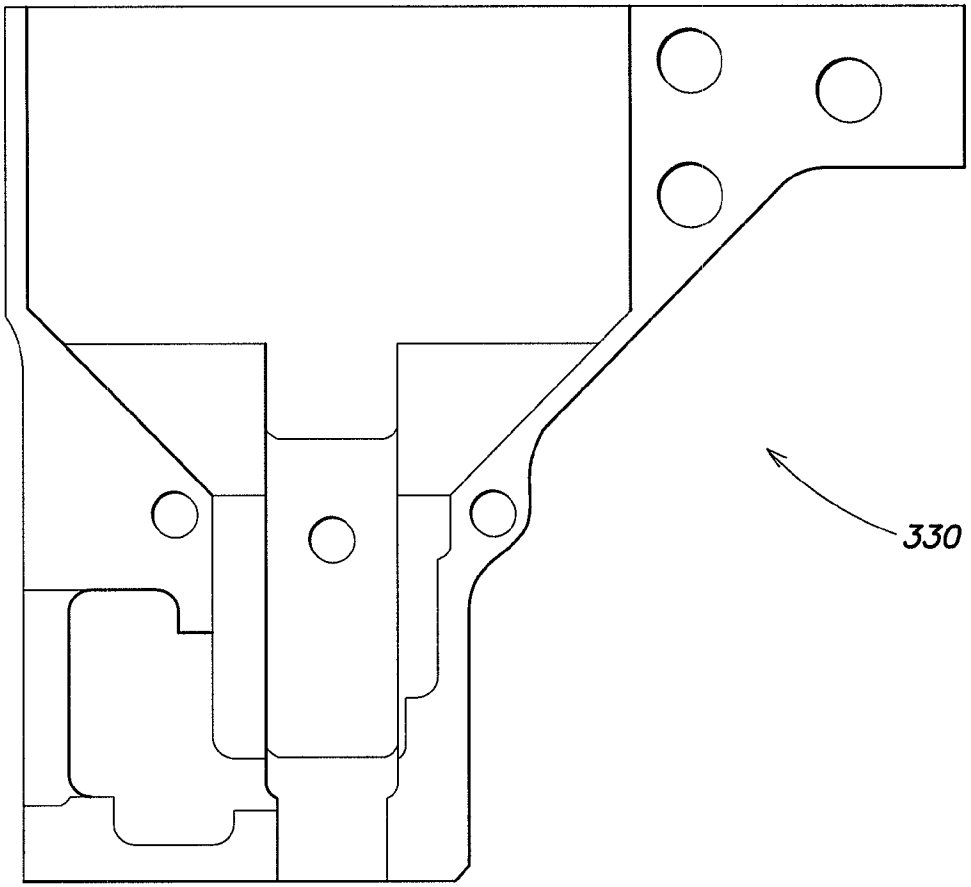
FIG. 30 is a side view of one example of an end horn antenna element, according to aspects of the invention.

According to one embodiment, the antenna array 106 is tapered to further facilitate sidelobe reduction in the beam pattern of the antenna array. In one example, the outer three horn antenna elements 301 at each end of each row of antenna elements are smaller than the remaining antenna elements, which may be substantially identical in size and shape. In embodiments of the antenna array 106 that include dielectric lenses 304, the dielectric lenses 304 associated with these tapered horn antenna elements 301 may be correspondingly smaller than the lenses associated with the remaining antenna elements. This tapering of the antenna array 106 can be seen with reference to FIGS. 24 and 25. As shown in FIGS. 24 and 25, in one example the third dielectric lens 318 from each end of each row of the antenna array 106 is slightly smaller than the interior 26 dielectric lenses 320 of each row. In one example, all of the interior dielectric lenses 320, and corresponding interior horn antenna elements 322 are substantially identical in size. An example of an interior horn antenna element 322 is illustrated in FIG. 27. The third horn antenna elements 324 associated with the third dielectric lenses 318 may be slightly smaller than the interior horn antenna elements 322. An example of a third horn antenna element 324 is illustrated in FIG. 28. Similarly, the second horn antenna element 326 from each end of each row, and optionally its associated second dielectric lens 328, may be slightly smaller than the third horn antenna element 324 and third dielectric lens 318, respectively. One example of a second horn antenna element 326 is illustrated in FIG. 29. Similarly, the end horn antenna element 330 on each end of each row, and optionally its associated end dielectric lens 332, may be slightly smaller than the second horn antenna element 326 and second dielectric lens 328, respectively. An example of an end horn antenna element 330 is illustrated in FIG. 30. In this manner, by decreasing the sizes of the horn antenna elements 301, and the associated optional dielectric lenses 304, at and towards the edges of the antenna array 106, the antenna array is tapered. Careful design of the taper may facilitate sidelobe reduction in the beam pattern of the antenna array 106, as discussed further below.

As discussed above, some embodiments of the tapered antenna array 106 may include any of one to eight rows of 32 antenna elements 308, in one example, horn antenna elements. For example, the antenna array 106 may include a 1×32, 2×32, 3×32, 4×32, 5×32, 6×32, 7×32 or 8×32 array. In some examples, the number of tapered elements may vary depending on the number of rows of antenna elements 308 in the array, and on the number of antenna elements per row. It is to be appreciated that although some currently preferred embodiments use rows of 32 elements, other numbers of elements per row may be used.

As discussed further below, in some applications, such as where the communication system is mounted on an aircraft 132, the antenna array 106 may experience large variations in environmental conditions such as temperature, humidity and pressure. These changing conditions can cause moisture to collect on and in the various components of the antenna array 106, which can have an adverse effect the performance of the antenna array. Accordingly, in one embodiment, horn inserts 382 are placed inside the horn antenna elements 301 to prevent moisture from collecting inside the horn antenna elements. In one embodiment, the horn inserts 382 are made from an extruded polystyrene insulation. In another example, the horn inserts are made of Styrofoam. However, it will be appreciated by those skilled in the art that a variety of other materials may be suitable. In embodiments of the antenna array 106 that include dielectric lenses, the horn inserts 382 are placed inside at least some of the horn antenna elements 301, beneath the dielectric lenses 304.

Figure 31A:
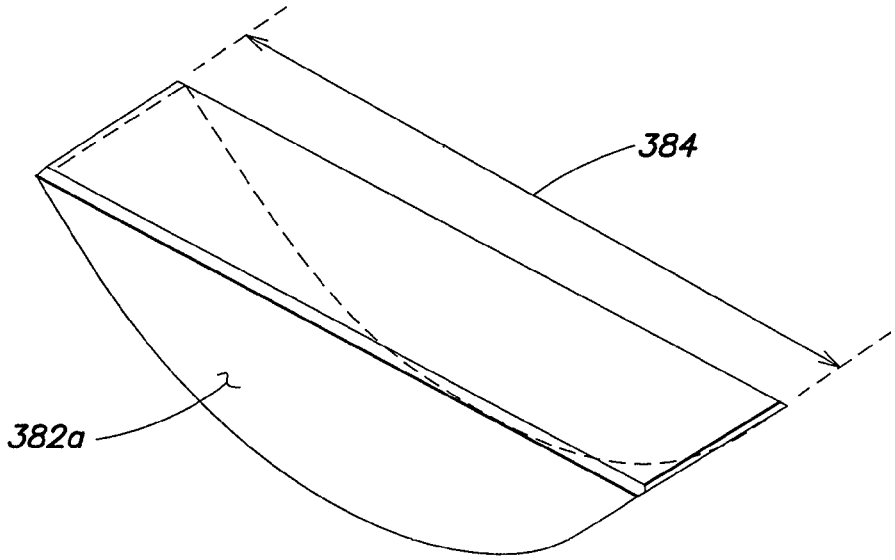
FIG. 31A is an isometric view of one example of a horn insert according to aspects of the invention.
Figure 31B:
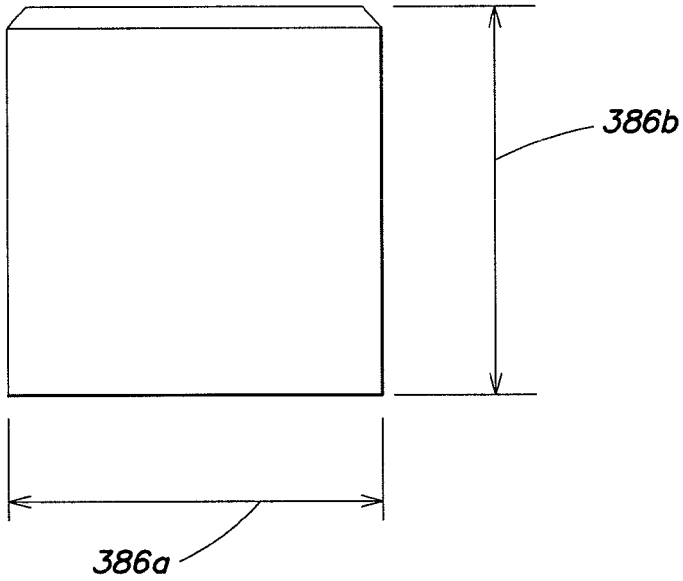
FIG. 31B is an end view of the horn insert of FIG. 31A.
Figure 32A:
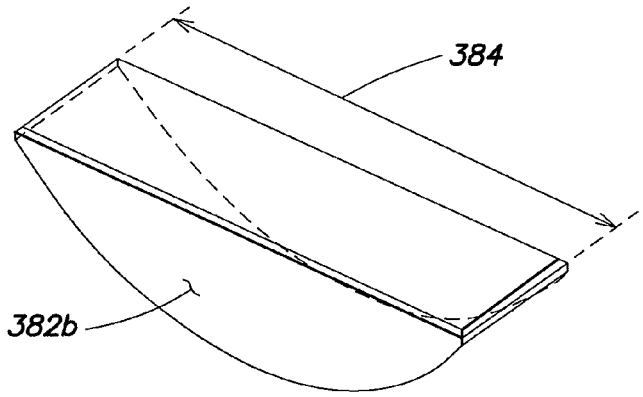
FIGS. 32A-C are isometric views of further examples of horn inserts according to aspects of the invention.
Figure 32B:
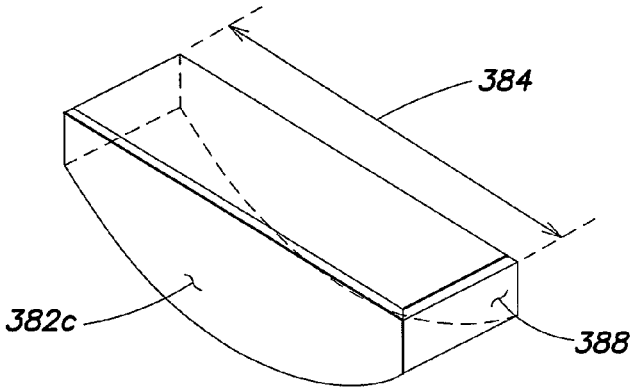
Figure 32C:
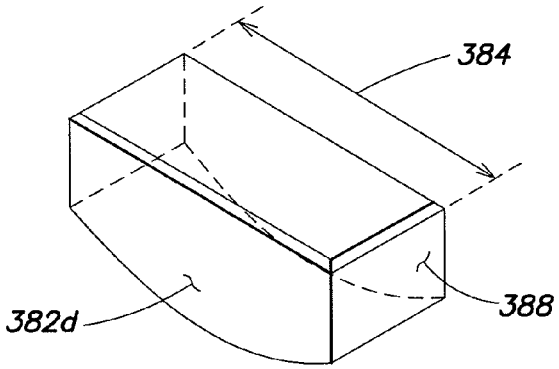

Referring to FIG. 31A, there is illustrated one example of a horn insert 382*a* sized for insertion into an interior horn antenna element 322. In one example, the horn insert 382*a* has a length 384 of approximately 2.899 inches. As illustrated in FIGS. 31A and 31B, in one example, the horn insert 382*a* has a slightly tapered edge, such that the width 386*a* of the horn insert 382*a* is approximately 0.745 inches, with a tolerance of approximately 0.005 inches, whereas the width 386*b* including the tapered edge is approximately 0.790 inches. In one example, the tapered edge of the horn insert 382*a* has an angle of about 45 degrees. It is to be appreciated that the horn inserts 382 for the smaller horn antenna elements 324, 326 and 330 may be appropriately smaller than the horn insert 382*a* for the interior horn antenna element 322, and may also have modified shapes to better fit to the shapes of the corresponding horn antenna elements. For example, referring to FIG. 32A, there is illustrated an example of a horn insert 382*b* sized and shaped to be placed within the third horn antenna element 324. In one example, the horn insert 382*b* has a length 384 of approximately 2.850 inches. FIG. 32B illustrates an example of a horn insert 382*c* sized and shaped to be accommodated by the second horn antenna element 326. In one example, the horn insert 382*c* has a length 384 of approximately 2.300 inches. FIG. 32C illustrates an example of a horn insert 382*d* sized and shaped to be accommodated by the end horn antenna element 330. In one example, the horn insert 382*d* has a length 384 of approximately 1.750 inches. In the examples illustrated in FIGS. 32B and 32C, the horn inserts 382*c* and 382*d* have partial straight edges 388, rather than having a continuously curved surface as do the illustrated examples of horn inserts 382*a* and 382*b*. However, it is to be appreciated that numerous variations on the shapes and sizes of the horn inserts 382 are possible and the invention is not limited to the illustrated examples. In addition, the shapes and sizes of the horn inserts 382 may vary depending on the shapes and sizes of the various antenna elements 308 used in the antenna array 106.

As discussed above, in one embodiment, the antenna array 106 is tapered, having smaller antenna elements 308 near the edges of the array, to reduce sidelobes in the beam pattern of the array. The smaller horn antenna elements 324, 326 and 330 have lower signal amplitude and contribute less than do the interior horn antenna elements 322 to the overall signal received or transmitted by the array. By appropriately sizing these antenna elements 324, 326 and 330 the signal contribution from these elements, and therefore the beam pattern of the antenna array can be adjusted to reduce sidelobes. In embodiments of the antenna array that include dielectric lenses, the dielectric lenses 318, 328 and 332 associated with the smaller antenna elements 324, 326 and 330 may be similarly smaller in size. In addition, as discussed further below, the feed network 302 can be designed to weight the signal contribution from different antenna elements 308 differently, thereby further controlling the beam pattern of the antenna array 106 and reducing sidelobes. In one example, horn inserts 382 may also be constructed to facilitate sidelobe suppression. For example, the horn inserts 382 for some or all of the outer horn antenna elements 324, 326 and 330 may be made from a radar absorbent material (RAM) to further attenuate the signal contribution of these antenna elements. Selected ones of the horn inserts 382 in the interior horn antenna elements 322 may also be made of RAM to further control the beam pattern.

Sidelobe reduction may be advantageous for several reasons including, for example, to improve the gain of the antenna array (having lower sidelobes means that more energy is captured in the main, useful, lobe of the antenna radiation pattern), and to meet certain performance goals and/or regulations (e.g., the FAA may set specifications for sidelobe suppression for applications such as satellite television or radio). For applications in which the antenna array 106 is mounted on a vehicle, such as an aircraft, the effect of the vehicle's movement on the antenna beam pattern may also be taken into account. For example, when the antenna array 106 is mounted on an aircraft 132, the beam pattern should be such that it meets sidelobe specifications (set, for example, by the FAA or other international authorities or regulations) not only when directly aligned with the signal source 110, but also when there is a polarization offset between the antenna array and the signal source due to movement of the aircraft. Thus, any or all of the size, shape, and arrangement (including taper and spacing) of the antenna elements 308, and optionally associated dielectric lenses 304 and/or horn inserts 382, and the arrangement of the feed network (discussed below), may be controlled to facilitate producing a beam pattern that meets sidelobe suppression standards for various orientations (polarization offsets) of the antenna array relative to the signal source or destination.

Referring again to FIG. 24, in another embodiment that uses two parallel rows of antenna elements, the two rows of antenna elements 308 making up the antenna array 106 are slightly offset from one another along the length of the array, rather than being perfectly aligned. In the example illustrated in FIG. 24, it can be seen that the top row of antenna elements 308 is positioned slightly to the left (from the viewpoint of one looking at the face of the antenna array) of the bottom row of antenna elements 308. This positional offset may also facilitate sidelobe reduction in the radiation pattern of the antenna array 106. In one example, the offset is equal to about one half the width of one antenna element 308 in the antenna array 106, as shown in FIG. 24, so as to minimize sidelobes in visible space for the zero degree elevation angle plane.

Figure 33A:
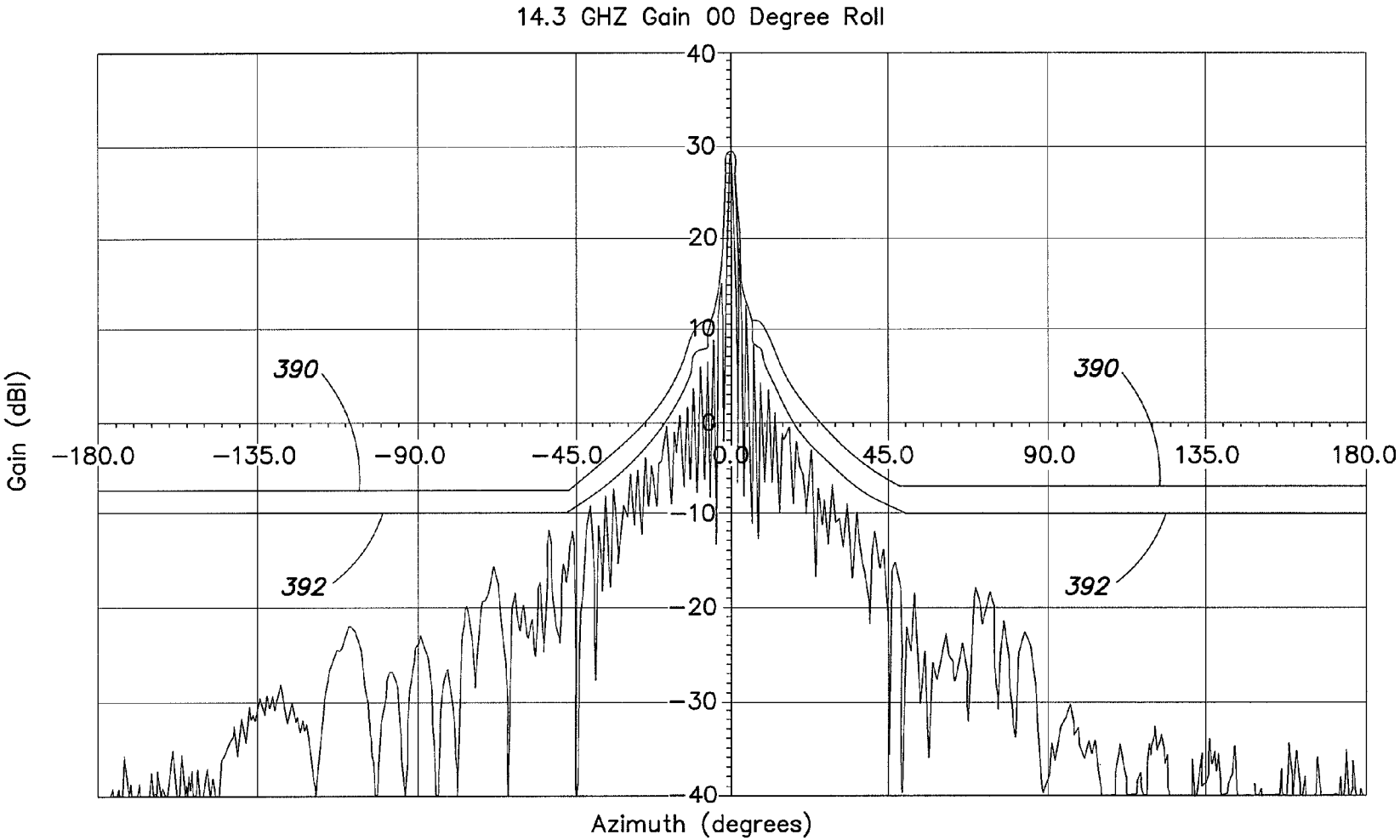
FIG. 33A is an illustration of a beam pattern, for zero degree roll, of one embodiment of the antenna array according to aspects of the invention, the array having an element spacing of about ½ wavelength.
Figure 33B:
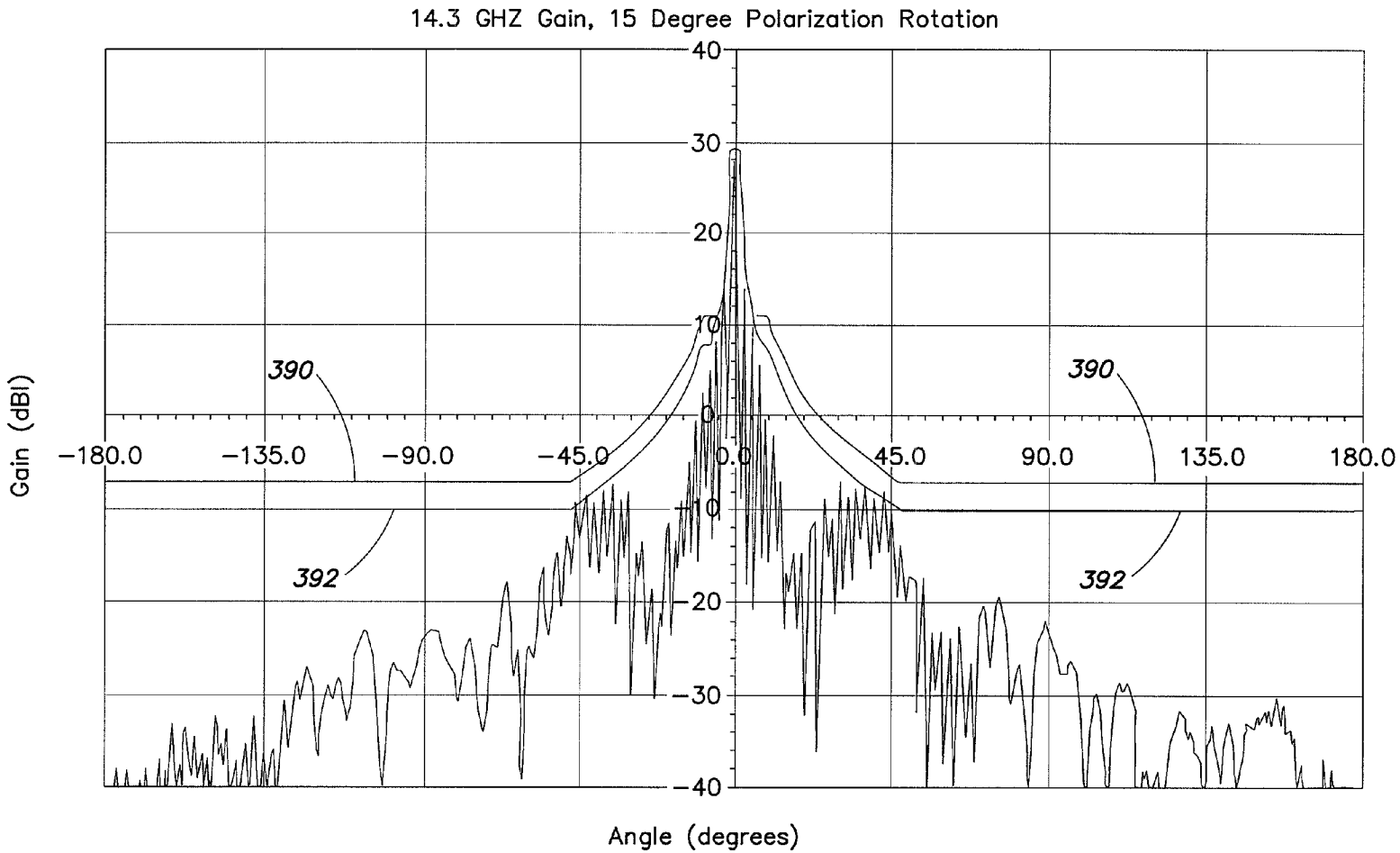
FIG. 33B is an illustration of a beam pattern, for 15 degree roll, of the same embodiment of the antenna array.
Figure 34A:
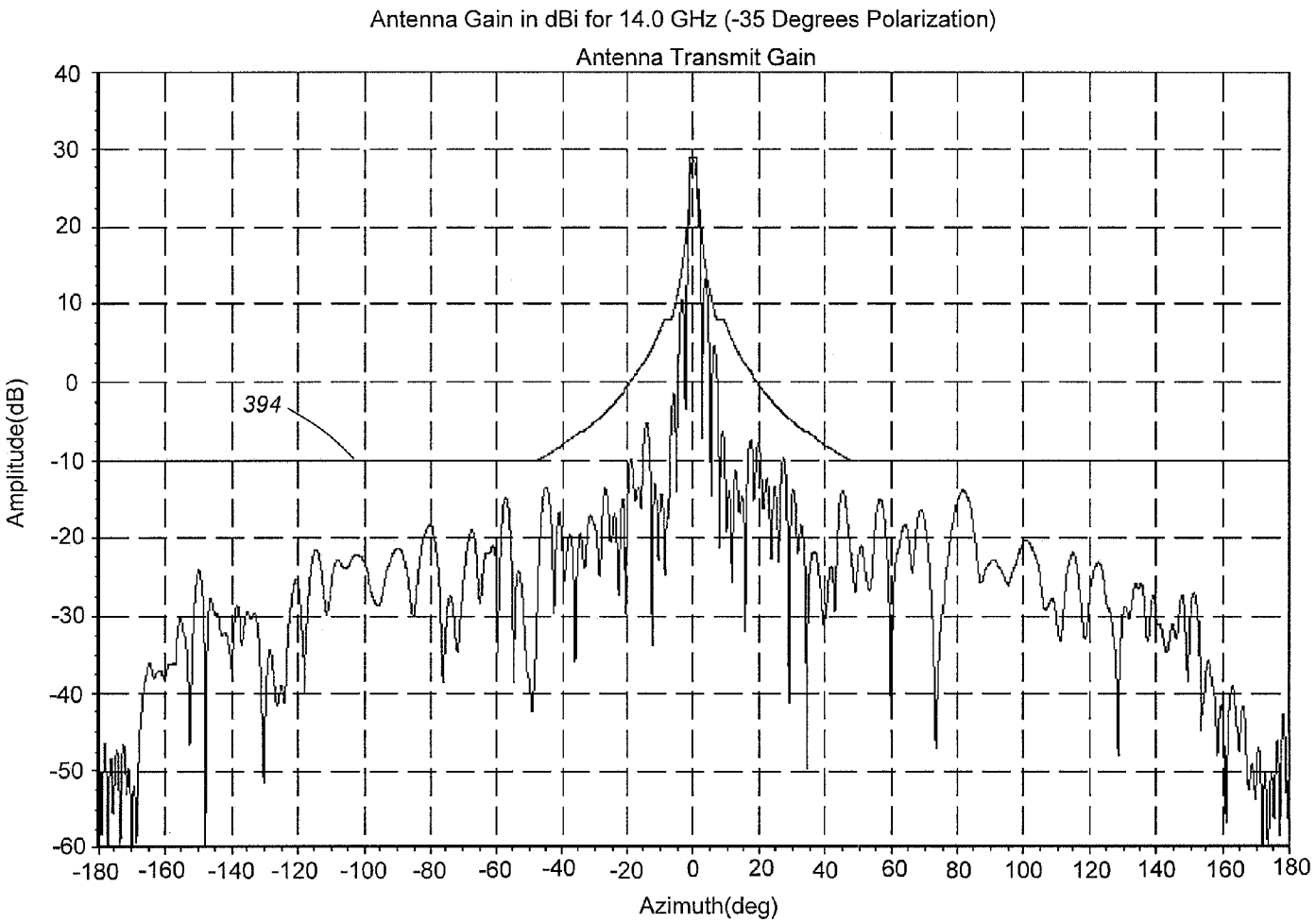
FIGS. 34A-34F are examples of beam patterns corresponding to an embodiment of the antenna array according to aspects of the invention.
Figure 34B:
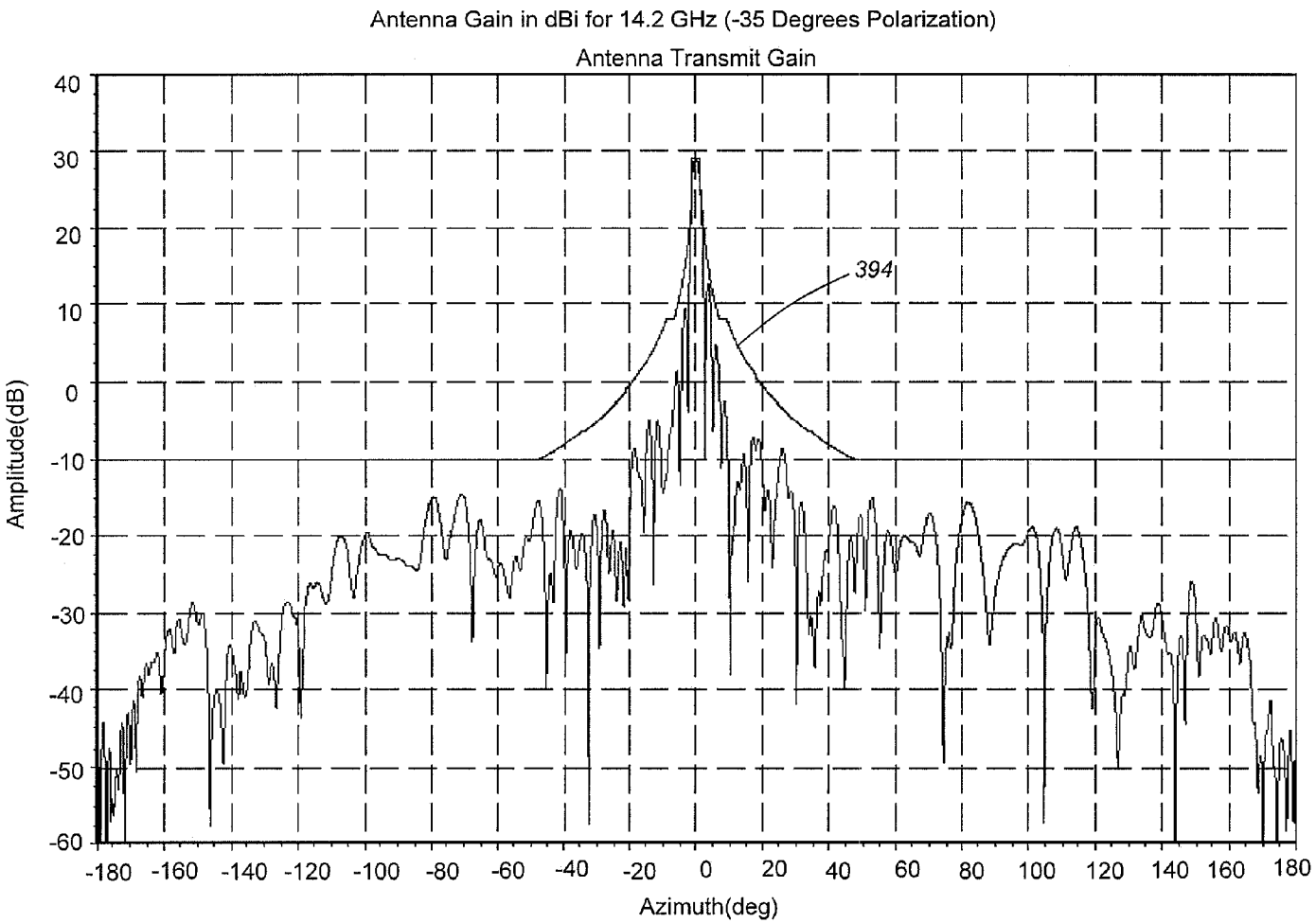
Figure 34C:
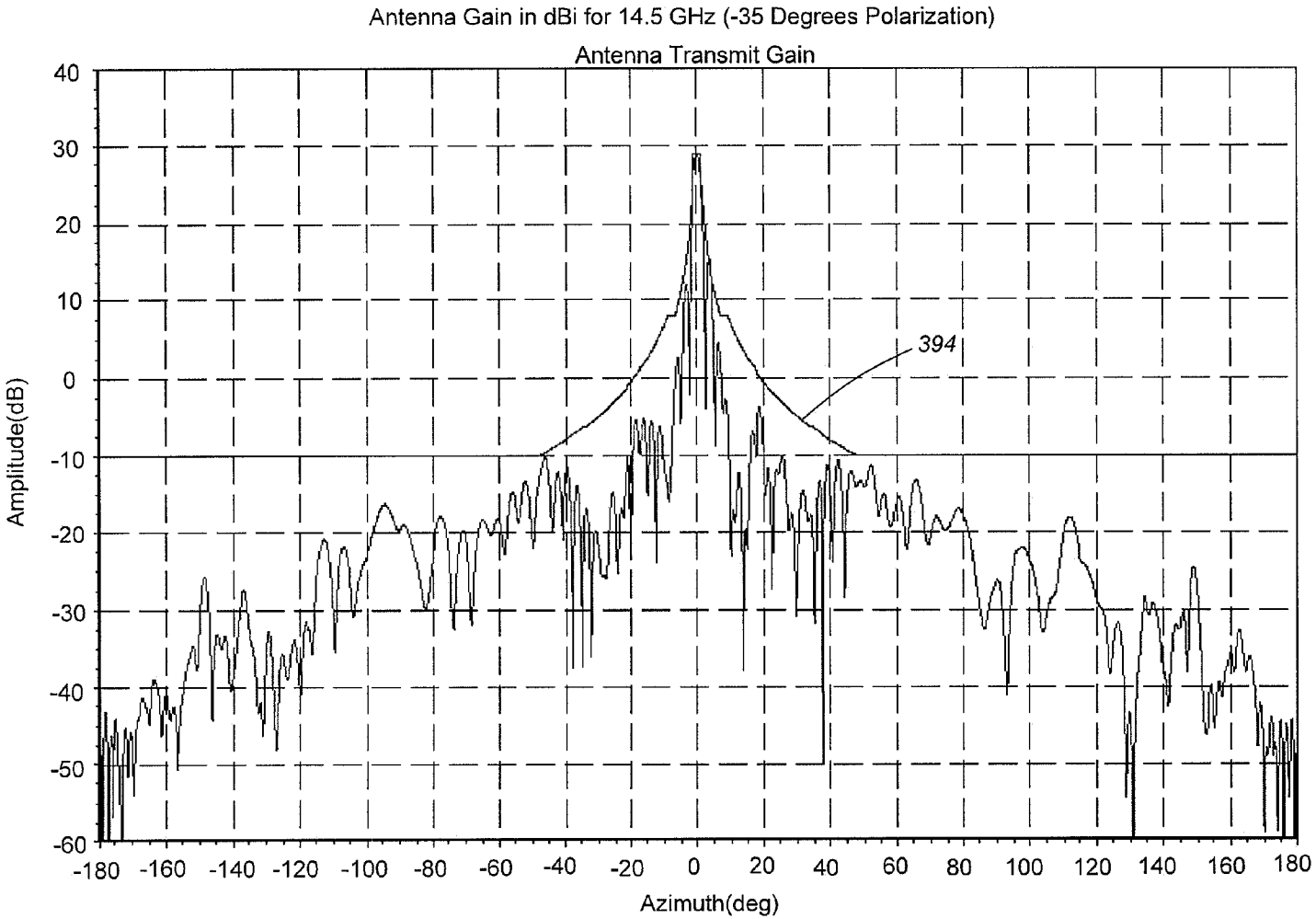
Figure 34D:
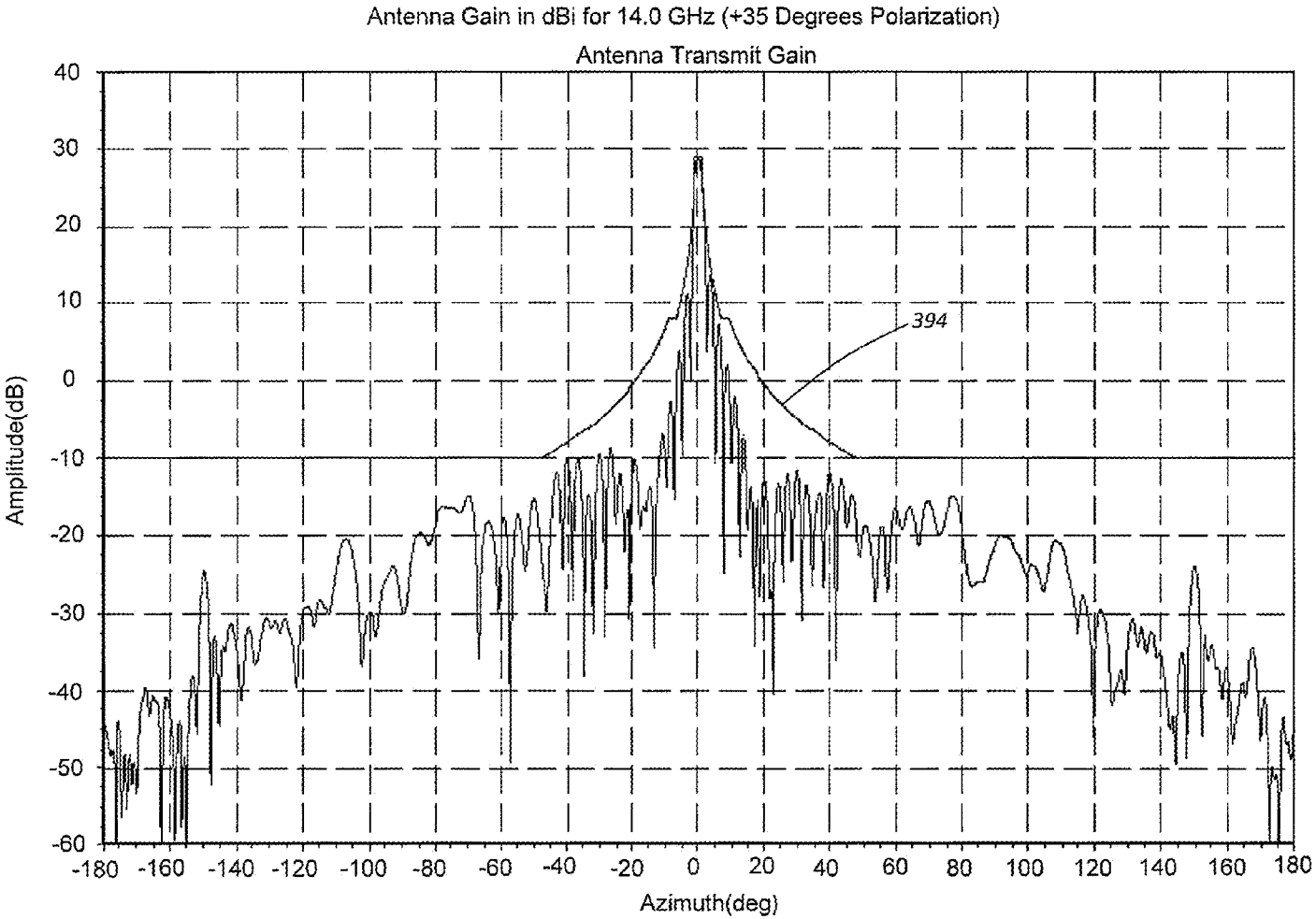
Figure 34E:
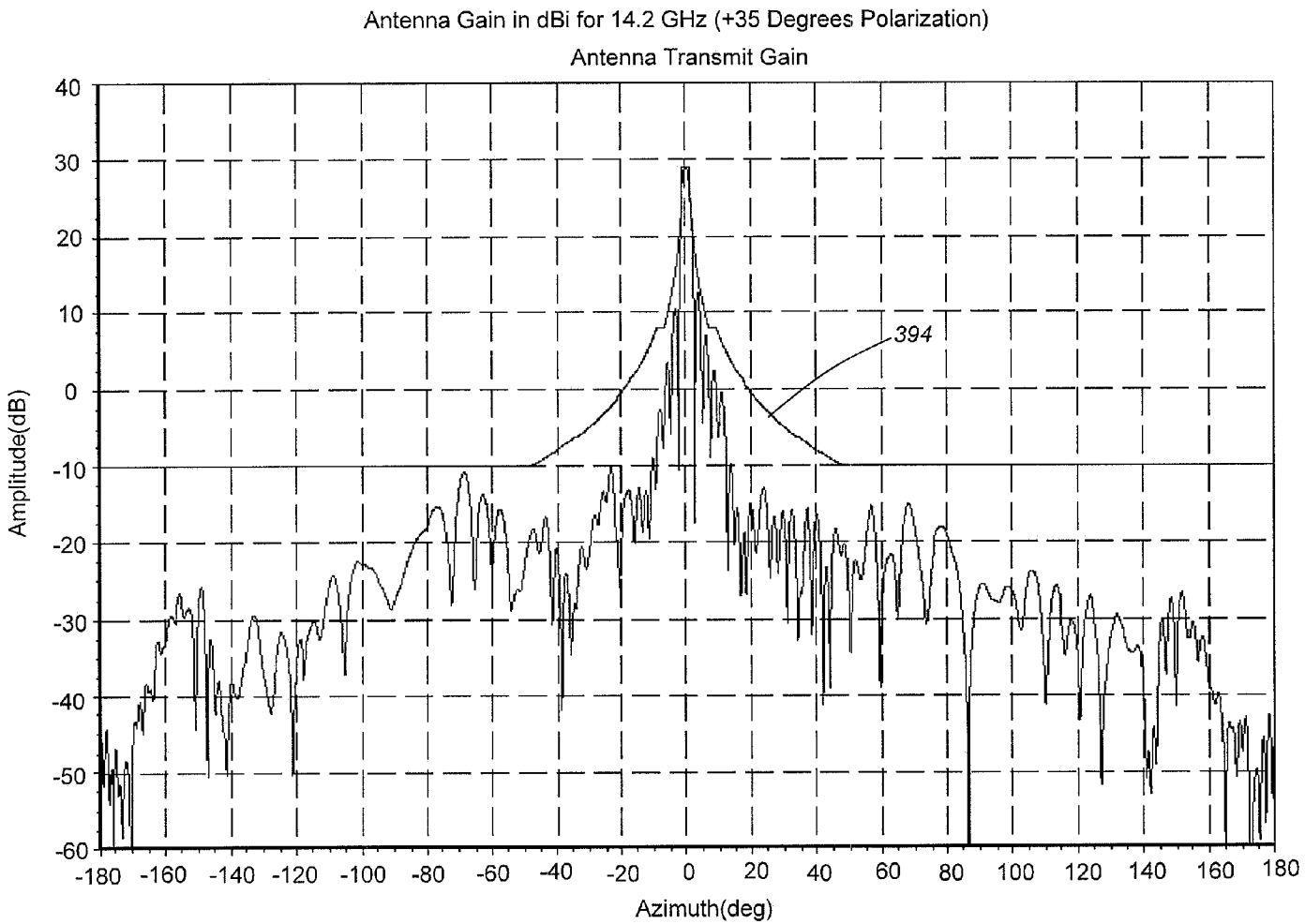
Figure 34F:
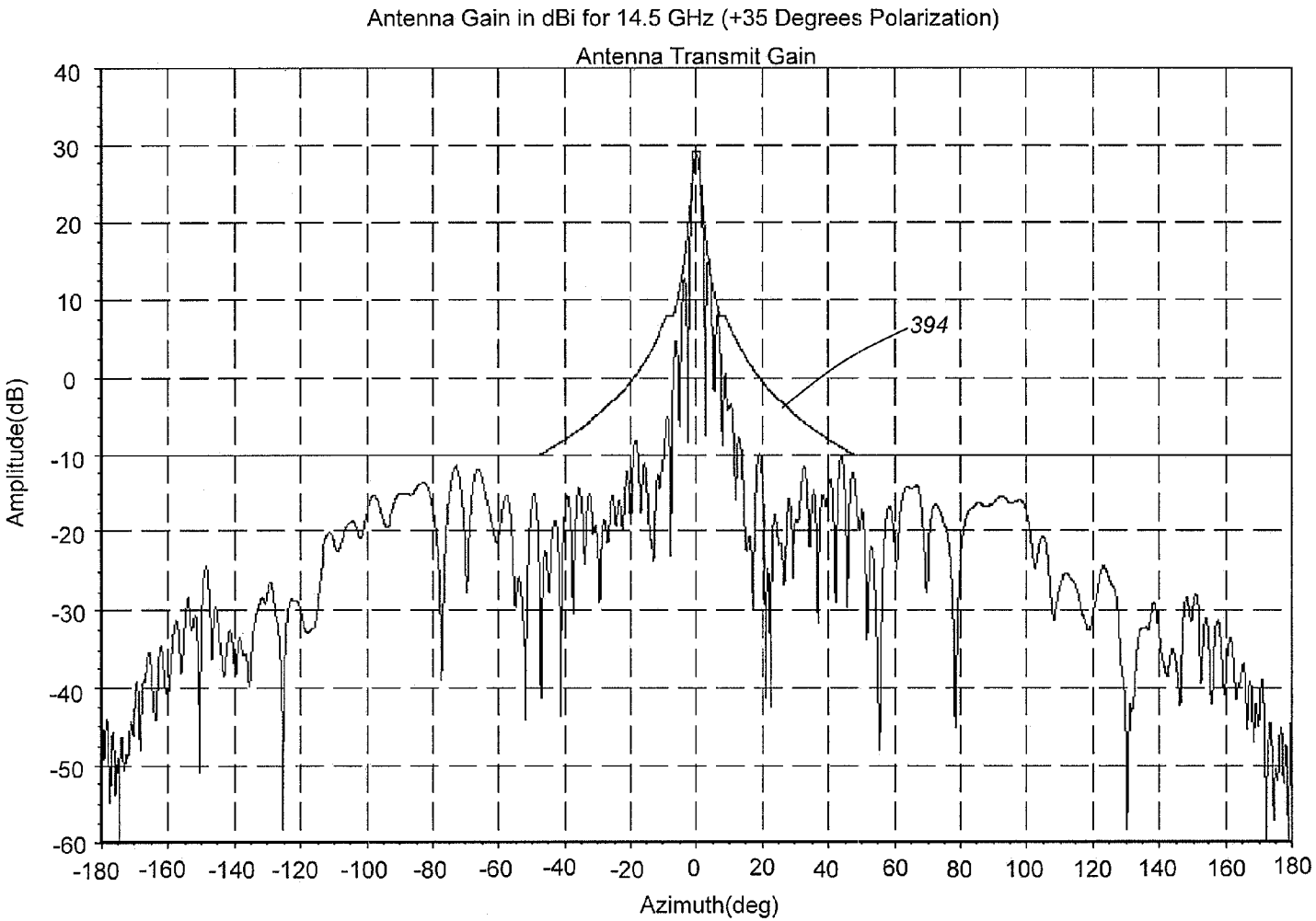
Figure 35A:
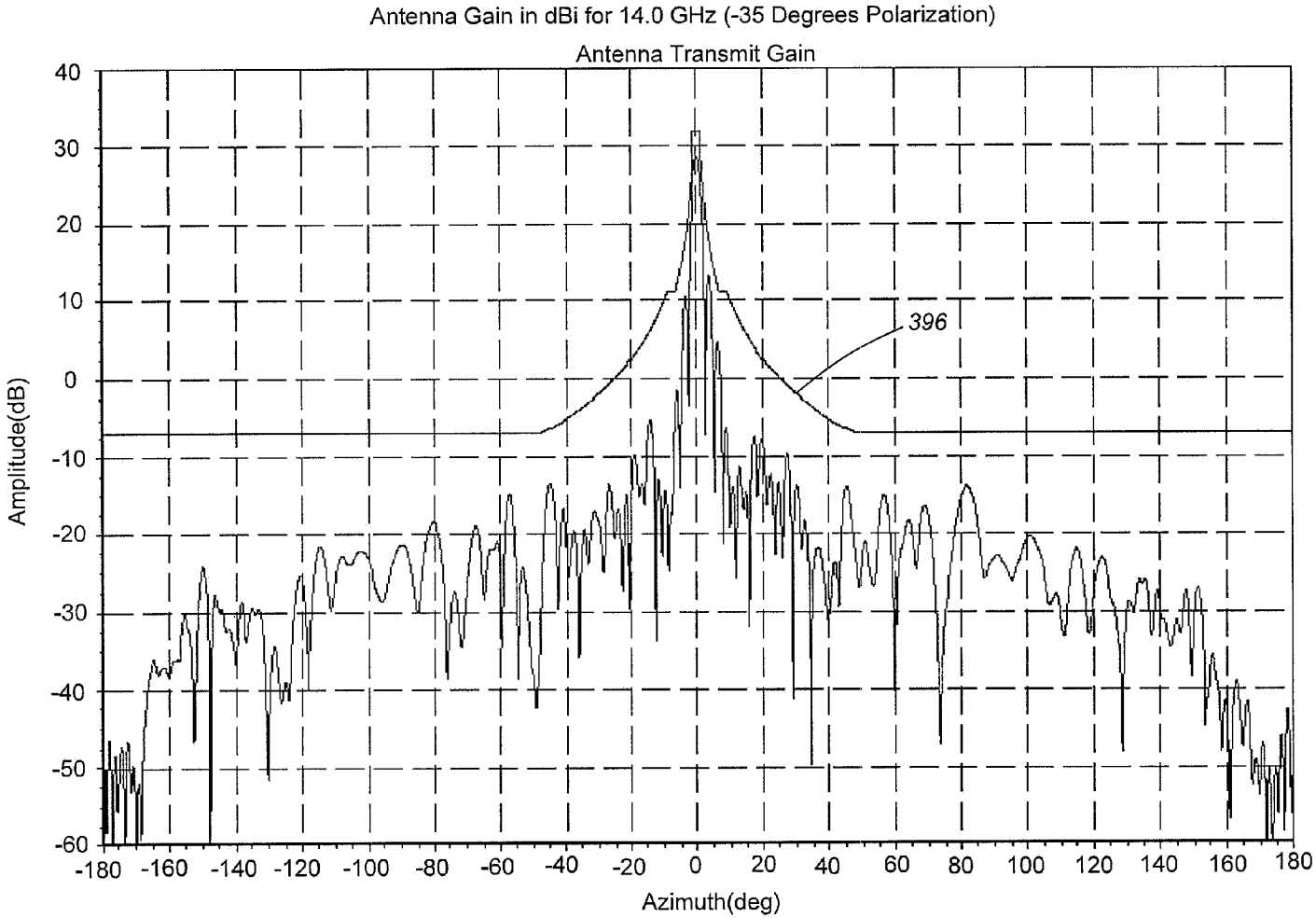
FIGS. 35A-35F are examples of beam patterns corresponding to an embodiment of the antenna array according to aspects of the invention.
Figure 35B:
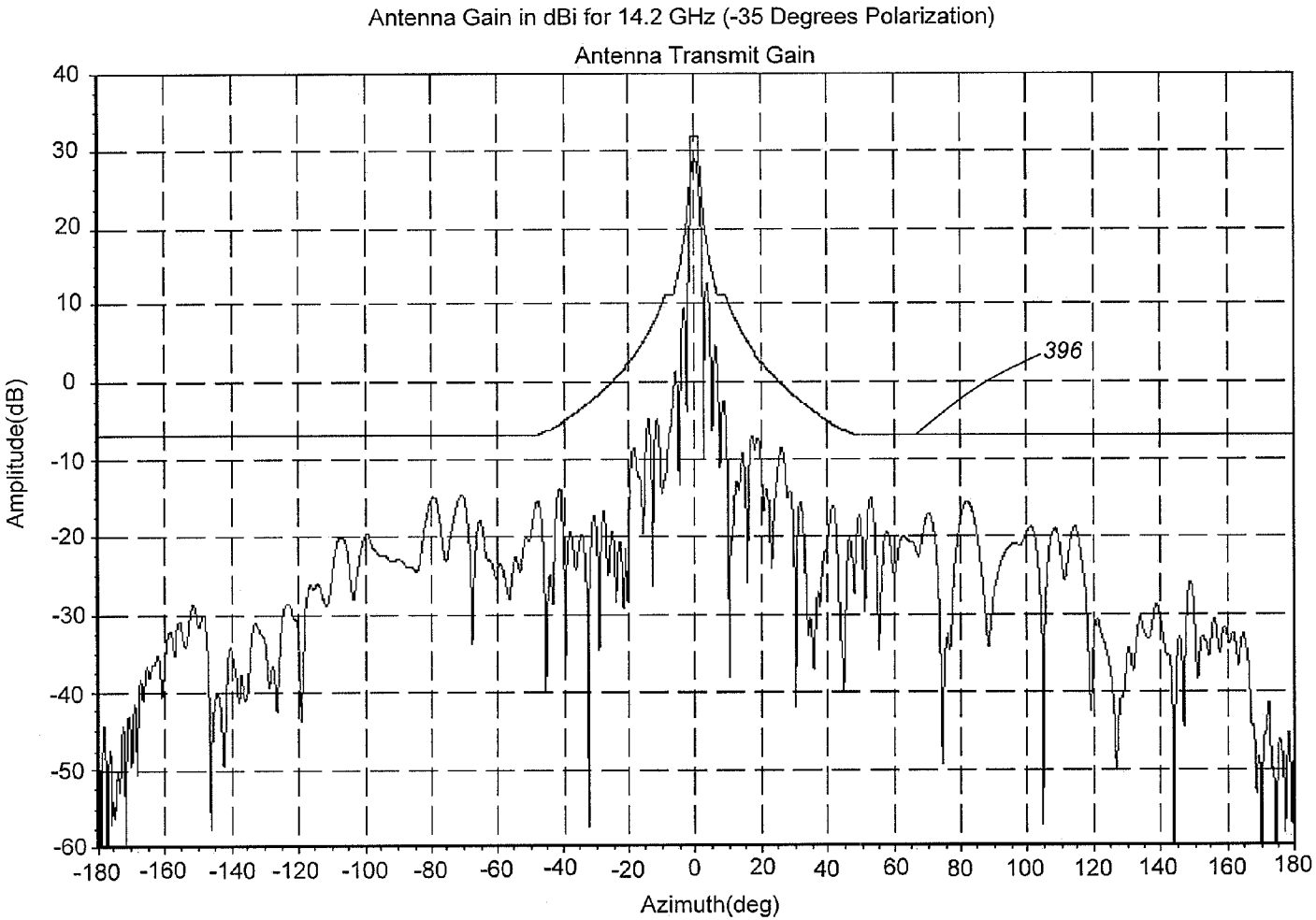
Figure 35C:
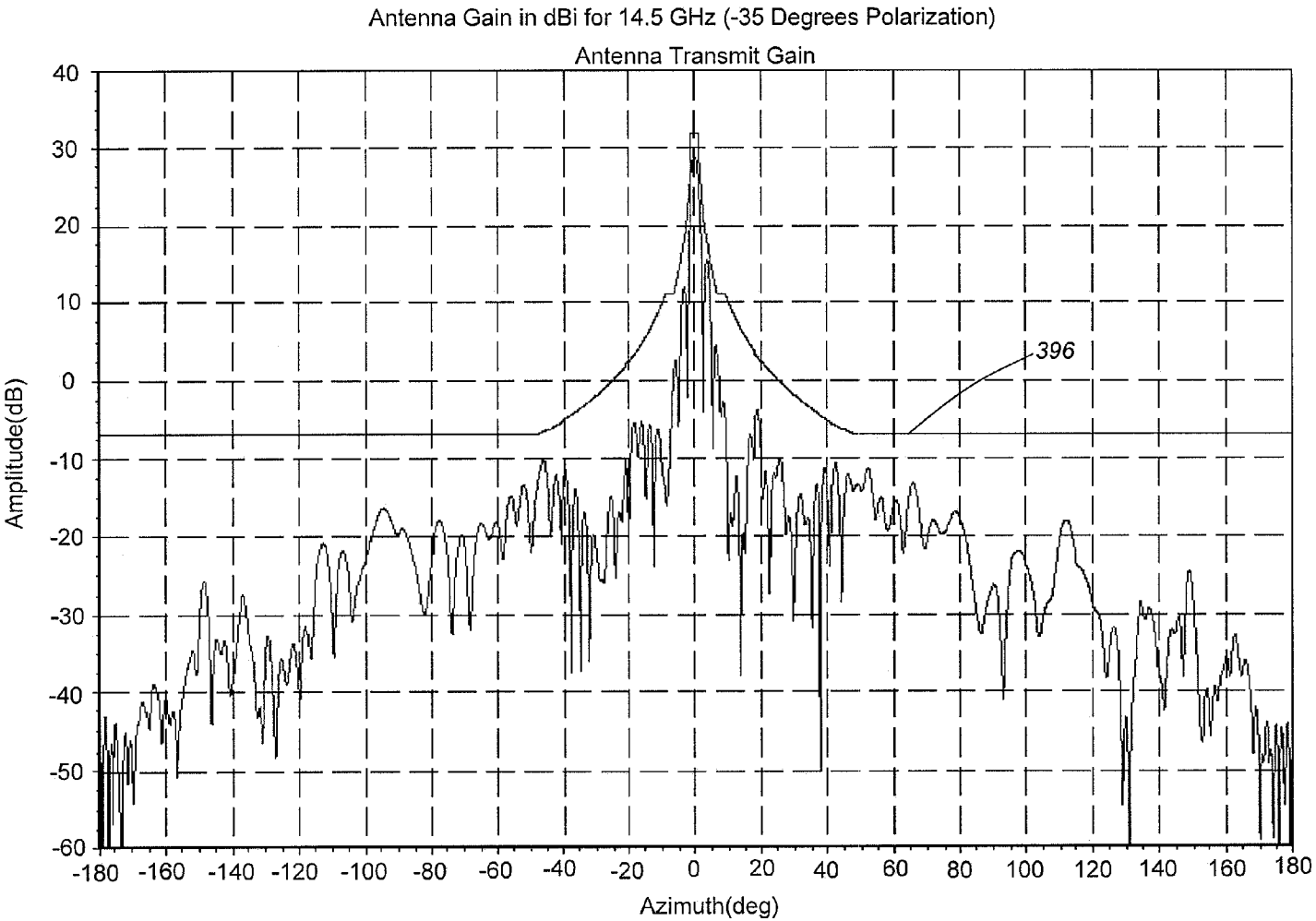
Figure 35D:
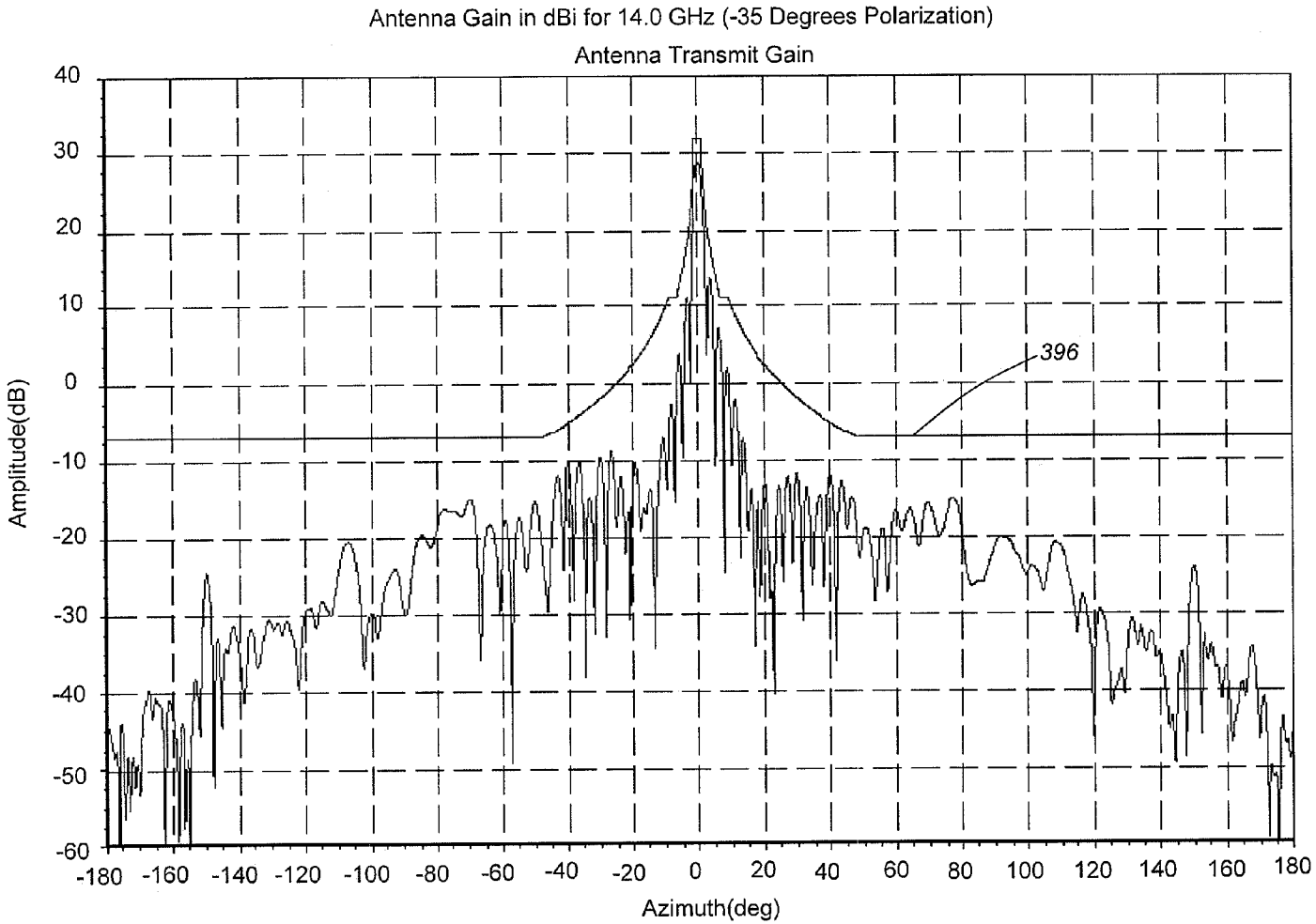
Figure 35E:
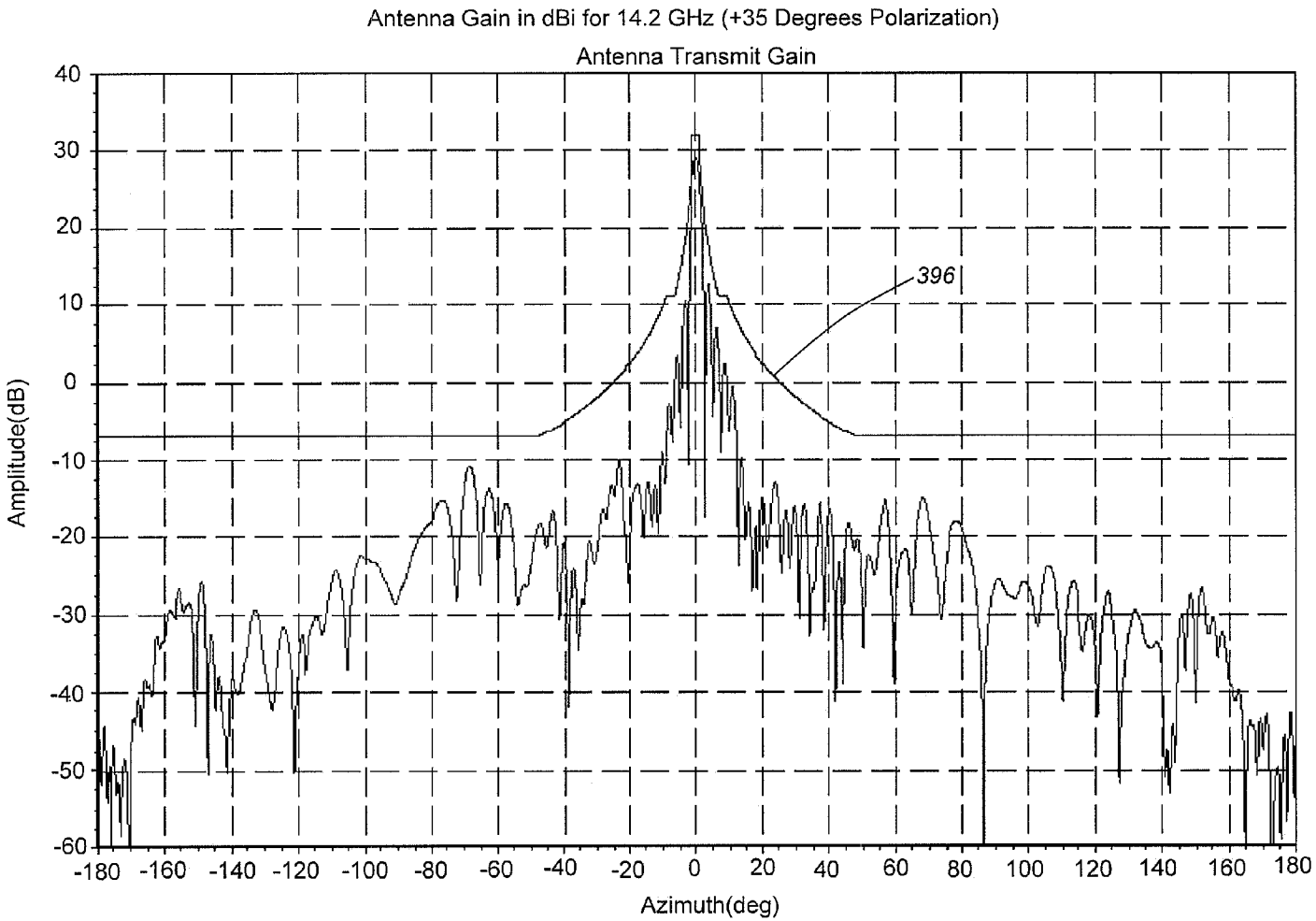
Figure 35F:
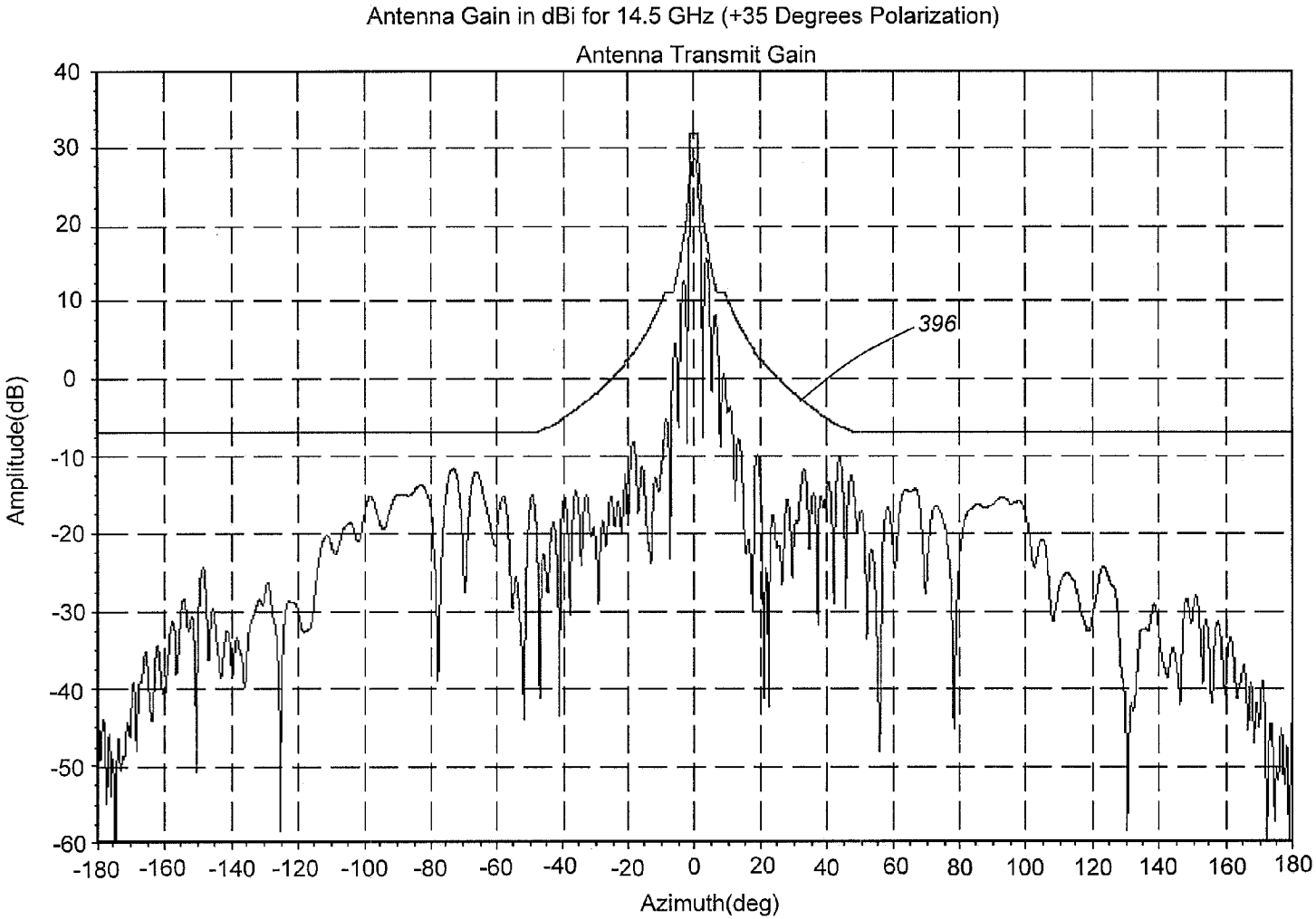

Referring to FIG. 33A, there is illustrated a beam pattern as a plot of simulated antenna gain as a function of azimuth angle for an embodiment of an antenna array, with an approximate half-wavelength antenna element spacing and including the tapering, row offset, RAM horn inserts and feed network biasing discussed above and below. The beam pattern illustrated in FIG. 33A is for an operating frequency of 14.3 GHz and a zero degree "roll" or polarization offset between the signal source 110 and the antenna array 106. Line 390 represents an example of the sidelobe suppression requirement for the antenna array, and line 392 represents a co-polarization requirement. FIG. 33B illustrates the simulated beam pattern for the same antenna array as for FIG. 33A, but with a 15 degree of polarization offset. It can be seen that the beam pattern in FIG. 33B still meets the sidelobe suppression and co-polarization requirements. In one example, by suitably designing the feed network, the antenna element spacing, antenna array row offset and taper, and using RAM horn inserts in the antenna elements towards the edges of the array, the antenna array can be made to have a beam pattern that meets applicable sidelobe suppression requirements for up to about a 35 degree polarization offset.

Additional beam patterns for an embodiment of the antenna array 106 at various frequencies and with varying degrees of polarization offset, up to +35 degrees or −35 degrees, are illustrated in FIGS. 34A-F and FIGS. 35A-F. In FIGS. 34A-F, line 394 represents a specification for co-polarization. As can be seen with reference to FIGS. 34A-F, the antenna array 106 can meet the co-polarization requirement for each of the circumstances (i.e., frequency and polarization degree) illustrated. In FIGS. 35A-F, line 396 represents a specification for sidelobe suppression. As can be seen with reference to FIGS. 35A-F, the antenna array 106 can meet the sidelobe suppression requirement for each of the circumstances (i.e., frequency and degree of polarization) illustrated.

As discussed above, in some embodiments, the antenna array 106 includes dielectric lenses 304 to enhance the gain of the array. According to one embodiment, the dielectric lenses 304 are plano-convex lenses that may be mounted above and/or partially within the horn antenna aperture 310. For the purposes of this specification, a plano-convex lens is defined as a lens having one substantially flat surface and an opposing convex surface. The dielectric lens 304 may be shaped in accordance with known optic principals including, for example, diffraction in accordance with Snell's Law, so that the lens may focus incoming radiation to the feed point 305 of the horn antenna element 301.

Figure 36:
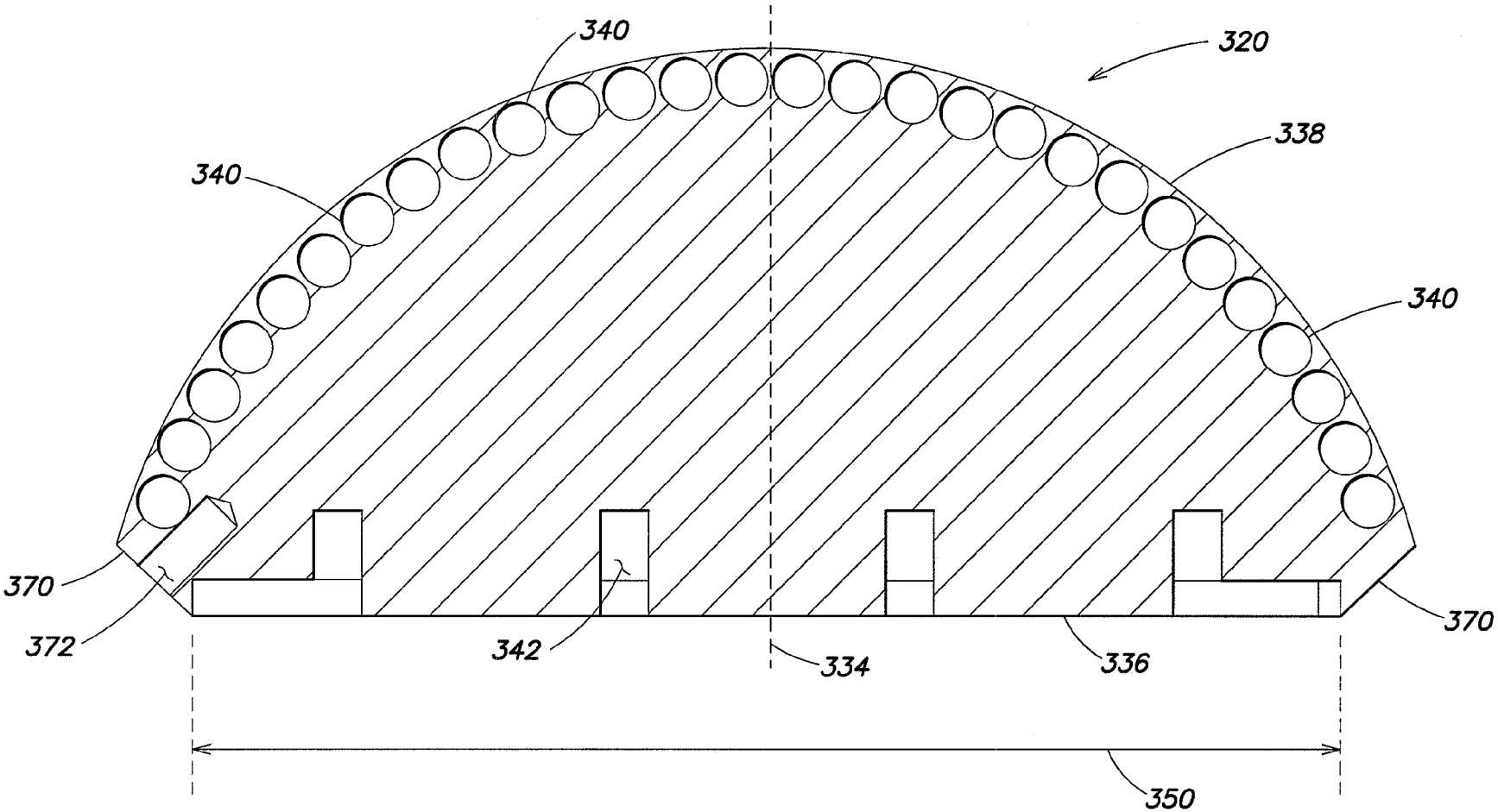
FIG. 36 is a side view of one example of an interior dielectric lens according to aspects of the invention.

Referring to FIG. 36, there is illustrated in side view of one example of an interior dielectric lens 320. In the illustrated example, the interior dielectric lens 304 is a plano-convex lens having a planar surface 336 and an opposing convex surface 338. It may be seen that the convex shape of the dielectric lens 304 results in a greater vertical depth of dielectric material being present in the center 334 (which may be positioned above a center of the corresponding horn aperture 310) compared with the edges of the lens. Thus, a vertically incident signal, such as the first signal 314 (see FIG. 26) may pass through a greater amount of dielectric material than does the second signal 316 incident along the edge 312 sides 313 of the horn antenna element 301. Because electromagnetic signals travel more slowly through dielectric than through air, the shape of the dielectric lens 304 may thus be used to equalize the electrical path length of the first and second incident signals 314, 316. By reducing phase mismatch between signals incident on the horn antenna element 301 from different angles, the dielectric lens 304 may serve to increase the gain of the horn antenna element.

Reflections of the signal incident on the convex surface 338 of the dielectric lens 320 may typically result from an impedance mismatch between the air medium and the lens medium. The characteristic impedance of free space (or dry air) is known to be approximately 377 Ohms. For the dielectric lens 304, the characteristic impedance is inversely proportional to the square root of the dielectric constant of the lens material. Thus, the higher the dielectric constant of the lens material, the greater, in general, the impedance mismatch between the lens and the air. The dielectric constant of the lens material is a characteristic quantity of a given dielectric substance, sometimes called the relative permittivity. In general, the dielectric constant is a complex number, containing a real part that represents the material's reflective surface properties, also referred to as Fresnel reflection coefficients, and an imaginary part that represents the material's radio absorption properties. The closer the permittivity of the lens material is relative to air, the lower the percentage of a received communication signal that is reflected.

The dielectric material of the dielectric lenses 304 may be selected based, at least in part, on a known dielectric constant and loss tangent value of the material. For example, in many applications it may be desirable to reduce or minimize loss in the antenna array 106 and therefore it may be desirable to select a material for the lens having a low loss tangent. Size and weight restrictions on the antenna array 106, at least in part, determine a range for the dielectric constant of the material because, in general, the lower the dielectric constant of the material, the larger the lens may be. In some applications, it may be desirable to manufacture the dielectric lenses 304 from a material having a relatively high dielectric constant in order to reduce the size and weight of the lens. However, reflections resulting from the impedance mismatch between the lens and the air may be undesirable.

Figure 37:
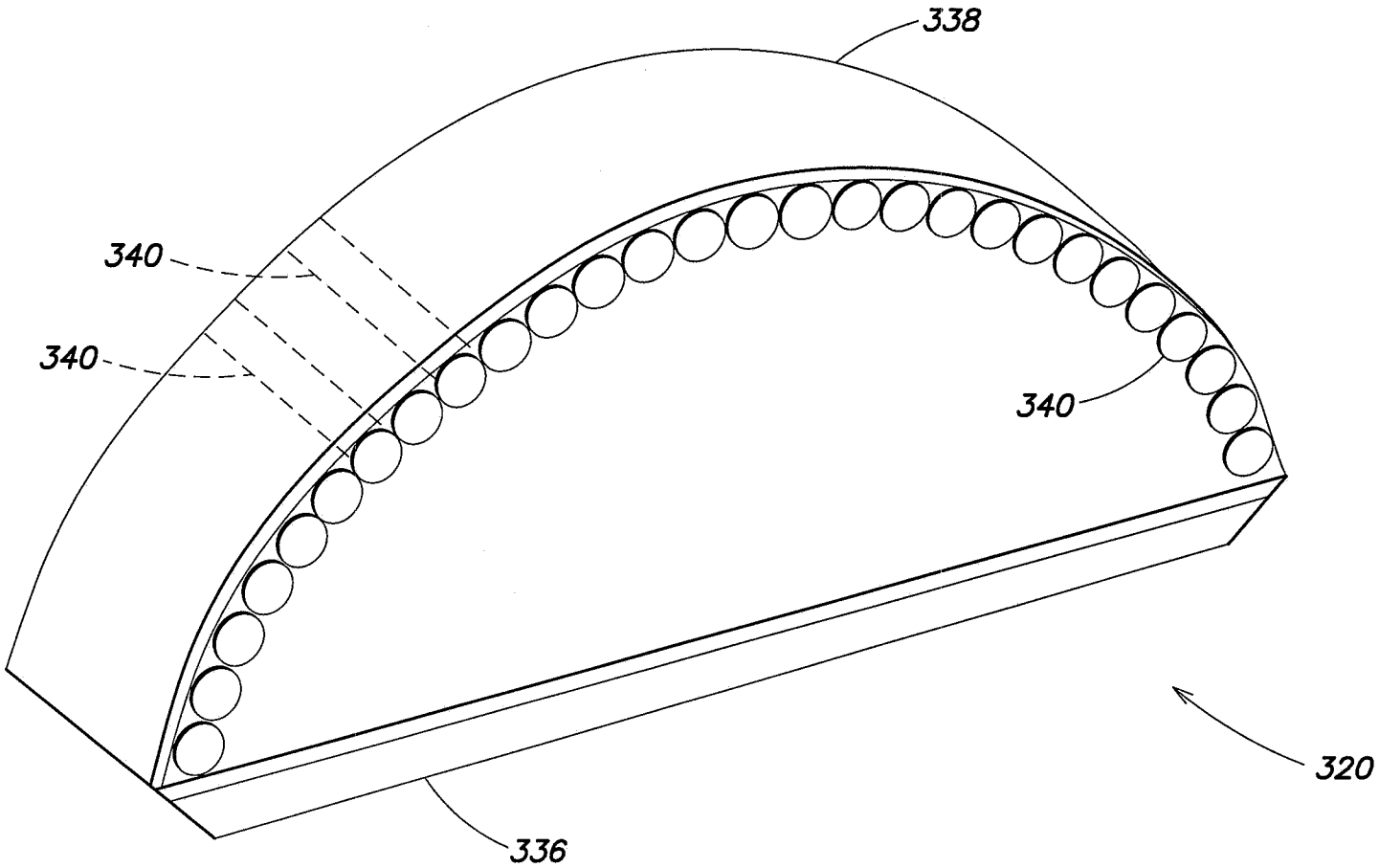
FIG. 37 is a perspective view of the interior dielectric lens of FIG. 36.
Figure 38:
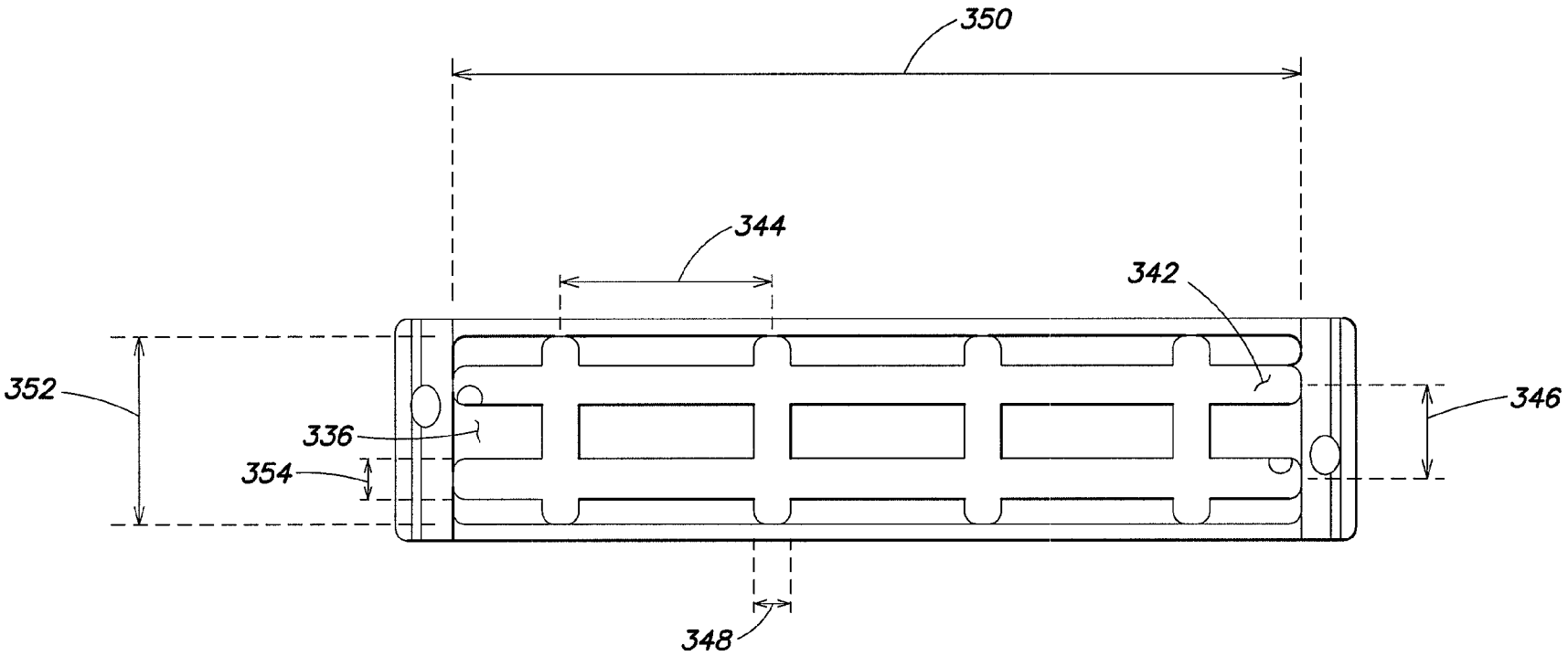
FIG. 38 is a plan view of the planar surface of the dielectric lens of FIG. 36.

Accordingly, in one embodiment, the dielectric lenses 304 have impedance matching features formed in either or both of the convex surface 338 and the planar surface 336. Referring again to FIG. 36, the interior dielectric lens 320 includes impedance matching holes 340 formed just below the interior surface of the convex surface 338. These holes 340 may extend as "tubes" along the depth of the dielectric lens 320, as illustrated in FIG. 37. The holes 340 may improve the impedance match of the dielectric lens 320 to the surrounding air by lowering the effective dielectric constant of the lens at and near the convex surface 338. Improving the impedance match between the dielectric lens 320 and the surrounding air may reduce RF energy reflection at the lens/air interface, thereby maximizing, or at least improving, antenna efficiency. Similarly, impedance matching grooves 342 may be provided in the planar surface 336 of the dielectric lens 320 to reduce the impedance mismatch between the lens and the air in the horn antenna element 301. An example of a pattern of grooves 342 that may be provided in the planar surface 336 of the dielectric lens 320 is illustrated in FIG. 38. Adding impedance matching holes 340 and/or grooves 342 may have the added advantage of reducing the weight of the dielectric lens 320 because less material is used (material is removed to form the holes and/or grooves).

The magnitude of the reflected signal may be significantly reduced by the presence of impedance matching features at the lens surfaces. With the impedance matching holes 340, the reflected signal at the convex surface 338 may be decreased as a function of $\eta_n$, the refractive indices at each boundary, according to equation 1 below:

$$\frac{(\eta_2 - \eta_1)}{(\eta_2 + \eta_1)} \quad (1)$$

A further reduction in the reflected signal may be obtained by optimizing the diameter of the holes 340 such that direct and internally reflected signals add constructively. In one example, the holes 340 are substantially similarly sized and have a diameter of about 0.129 inches.

It is to be appreciated that although the above discussion of the impedance matching features of the dielectric lens referred primarily to the interior dielectric lenses 320, the discussion applies equally to the tapered dielectric lenses 318, 328 and 332. The number of impedance matching holes 340 and/or impedance matching grooves 342 formed in each of the tapered lenses 318, 328 and 332 may vary with respect to the interior dielectric lenses 320 due to the smaller size and altered shape of the tapered lenses 318, 328 and 332. In addition, the "groove pocket" or area of the planar surface 336 in which the impedance matching grooves 342 are formed may be smaller for the smaller lenses, as discussed further below. Referring to FIG. 36. In one example, the dielectric lens 320 has a groove pocket length 350 of about 3.000 inches and a groove pocket width 352 of about 0.650 inches.

Figure 39A:
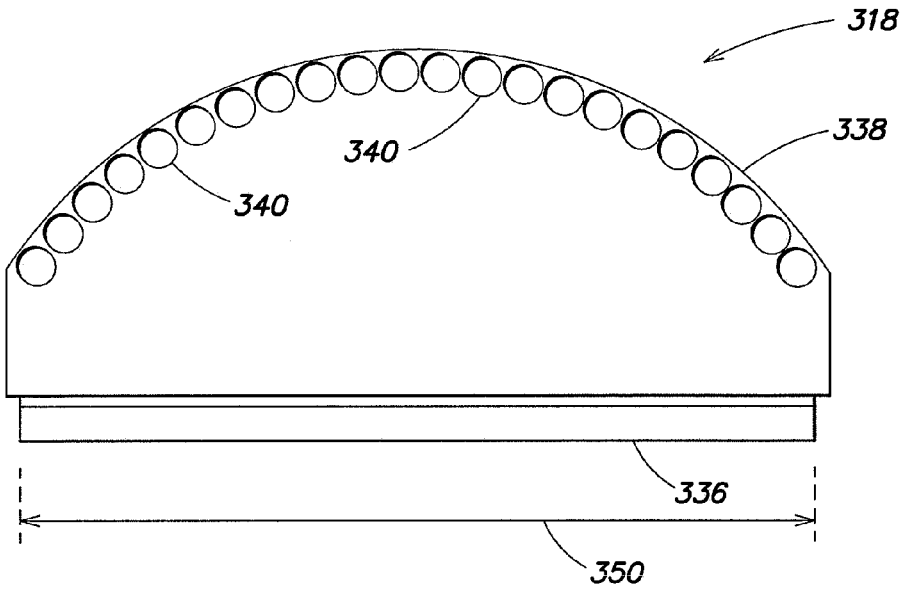
FIG. 39A is a side view of one example of a third dielectric lens according to aspects of the invention.
Figure 39B:
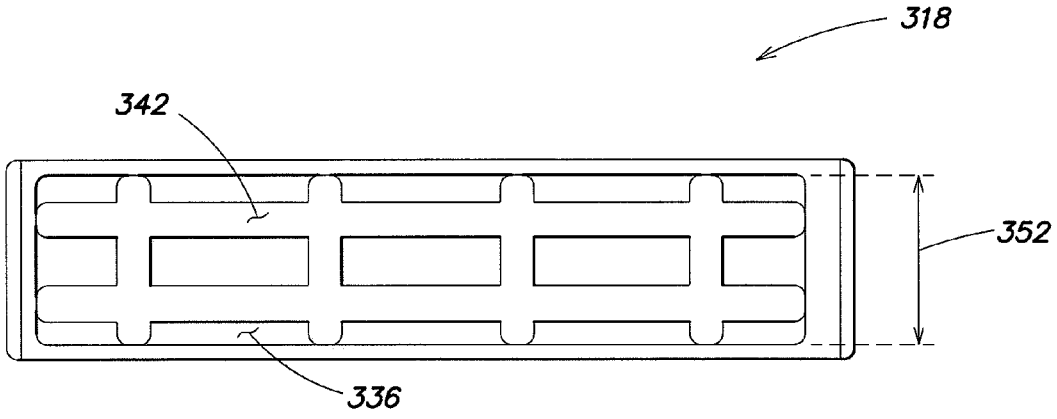
FIG. 39B is a plan view of the planar surface of the third dielectric lens of FIG. 39A.
Figure 40A:
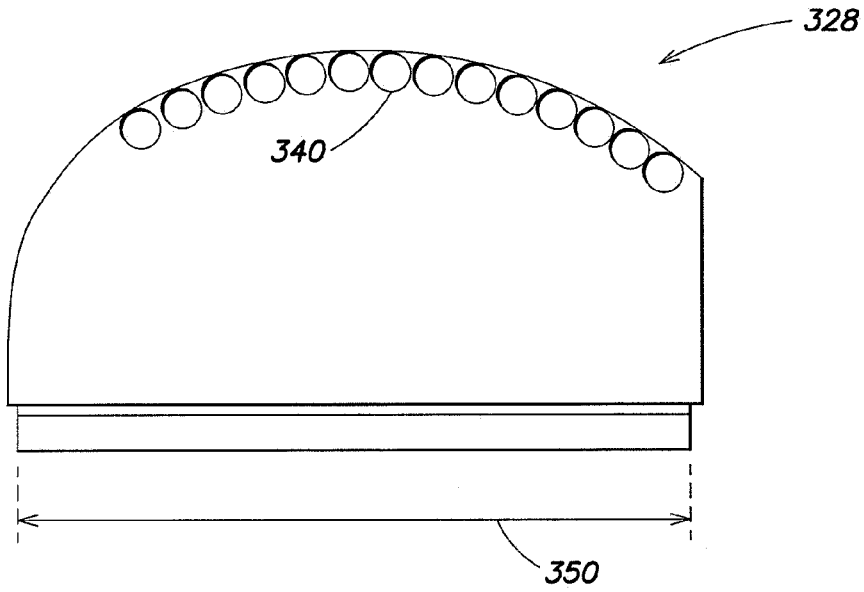
FIG. 40A is a side view of one example of a second dielectric lens according to aspects of the invention.
Figure 40B:
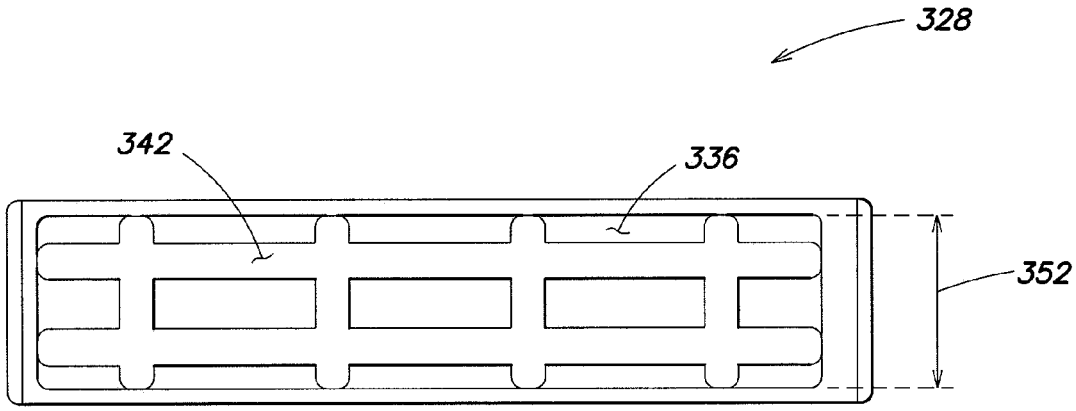
FIG. 40B is a plan view of the planar surface of the second dielectric lens of FIG. 40A.
Figure 41A:
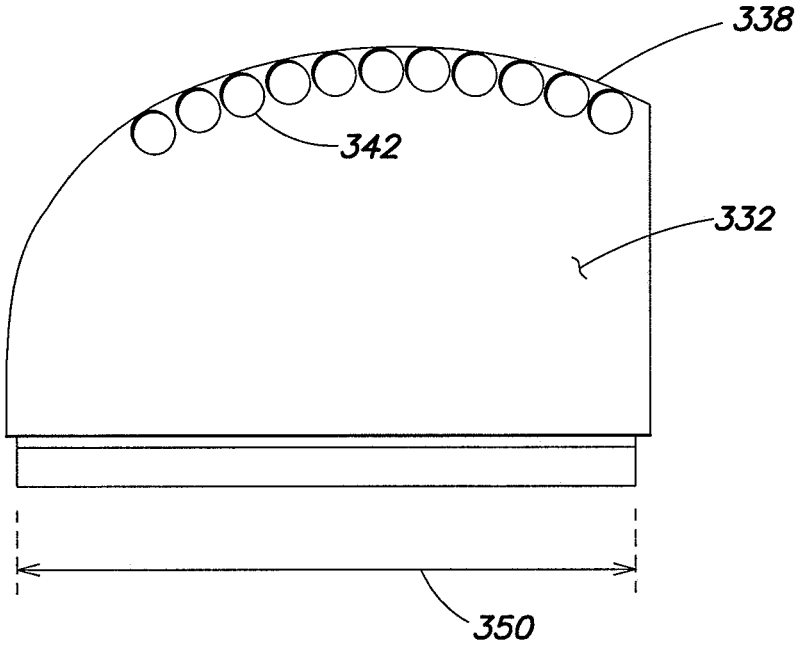
FIG. 41A is a side view of one example of an end dielectric lens according to aspects of the invention.
Figure 41B:
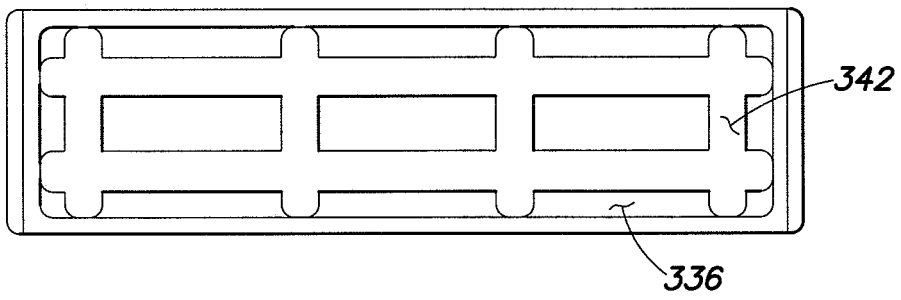
FIG. 41B is a plan view of the planar surface of the end dielectric lens of FIG. 41A.

Referring to FIG. 39A, there is illustrated a side view of one example of a third dielectric lens 318. FIG. 39B illustrates an example of the planar surface 336 of the third dielectric lens 318, showing the impedance matching grooves 342, Because the third dielectric lens 318 is slightly smaller than the interior dielectric lens 320, the groove pocket length 350 may be about 2.750 inches, slightly smaller than that of the interior dielectric lens 320. In one example, the width of the various different horn antenna elements 308 may remain constant although their lengths vary to achieve the tapering. Accordingly, the groove pocket width 352 may remain approximately the same for all the dielectric lenses 318, 320, 328 and 332. FIGS. 40A and 40B illustrate a side view of one example of a second dielectric lens 328 and a corresponding plan view of the planar surface 336 of the second dielectric lens, respectively. In one example, the second dielectric lens 328 may have a groove pocket length 350 of about 2.200 inches. Similarly, FIGS. 41A and 41B respectively illustrate a side view of one example of an end dielectric lens 332 and a corresponding plan view of the planar surface 336 of the end dielectric lens 332. In one example, the end dielectric lens 332 has a groove pocket length 350 of about 1.650 inches.

Referring again to FIG. 38, in one example, the grooves 342 on the planar surface 336 have a "horizontal" center-to-center spacing 344 of about 0.750 inches and a "vertical" center-to-center spacing 346 of about 0.325 inches. The grooves 342 may have a "horizontal" width 348 of about 0.125 inches and a "vertical" width 354 of about 0.135 inches. In one example, the grooves 342 have a depth of about 0.087 inches. These dimensions may be approximately the same for the grooves 342 formed in each of the varying lenses 318, 320, 328 and 332. However, it is to be appreciated that the size and spacing of the grooves 342 may vary with the size of the dielectric lens 304 and the dielectric constant of the material used to make the lenses.

The lenses may be created by, for example, milling a solid block of lens material and thereby forming the convex-plano lenses. The impedance matching holes 340 and/or grooves 342 may be formed by milling, etching, or other processes known to those skilled in the art. It is to be appreciated that the terms "holes" and "grooves" are merely exemplary and are not intended to be limiting in terms of the shape or size of the features.

It is to be appreciated that there are numerous variations for the size, shape and structural features of the dielectric lenses 304 and the invention is not limited to the use of dielectric lenses having the sizes, shapes and structural features of the above-discussed examples. For example, referring to FIG. 42, there is illustrated a side view of an alternate embodiment of a dielectric lens 356 that may be used for some or all of dielectric lenses 304. The dielectric lens 356 is a plano-convex lens having a convex surface 338 and a planar surface 336, as discussed above. In one example, the dielectric lens 356 has impedance matching grooves 358 formed in the external convex surface 338. The grooves 358 may reduce the percentage of dielectric material at the surface of the lens, which effectively reduces the dielectric constant, bringing it closer to that of air. In one example, the dielectric constant may be reduced from about 2.53 to 1.59. The groove walls, being approximately one quarter wavelength thick in one example, act to reduce signal reflection at the lens/air boundary and optimize efficiency. The grooved region thus provides a smaller "step" change in dielectric constant between the air and the remaining lens material, facilitating impedance matching.

The grooves 358 may be formed in many different configurations including, but not limited to, parallel (horizontal or vertical) lines, an array of discrete indentations, a continuous, back and forth line, a series of regularly spaced holes or indentations spaced, for example, every one half wavelength, etc. There may be either an even or odd number of grooves, and the grooves may be regularly or irregularly spaced. In one example, the grooves 358 are evenly spaced, and may be easily machined into the lens material using standard milling techniques and practices. In one example, the grooves may be machines so that they have a substantially identical width, for ease of machining. In another example, each of the grooves 358 has a concave surface feature at a greatest depth of the groove where the groove may taper to a dull point on the inside of the lens structure. As discussed above, in embodiments where the lens 356 is a plano-convex lens, the lens has a greater depth of lens material near the center of the lens as compared with the edges of the lens. Accordingly, in at least one embodiment, the depth of the grooves 358 varies with location on the lens surface. For example, the depth to which each of the grooves is milled may increase the farther a groove is located from the apex, or center 360, of the convex lens surface. In one example, the grooves may penetrate the surface by approximately one quarter-wavelength in depth near the center axis and may be regularly spaced to maintain the coherent summing of the direct and internally reflected signals, becoming successively deeper as the grooves approach the periphery of the lens.

The width of the grooves 358 may be constant or may also vary with location on the lens surface. In one example, the grooves 358 may typically have a width 368 of approximately one tenth of a wavelength (at the center of the operating frequency range) or less. The size of the lens 356 and of the grooves 358 formed in the lens surface may be dependent on the desired operating frequency of the antenna array 106. In one specific example, the dielectric lenses 304 are designed for use in the Ku frequency band (10.70-12.75 GHz), having an appropriate height and length for this frequency band.

Figure 42:
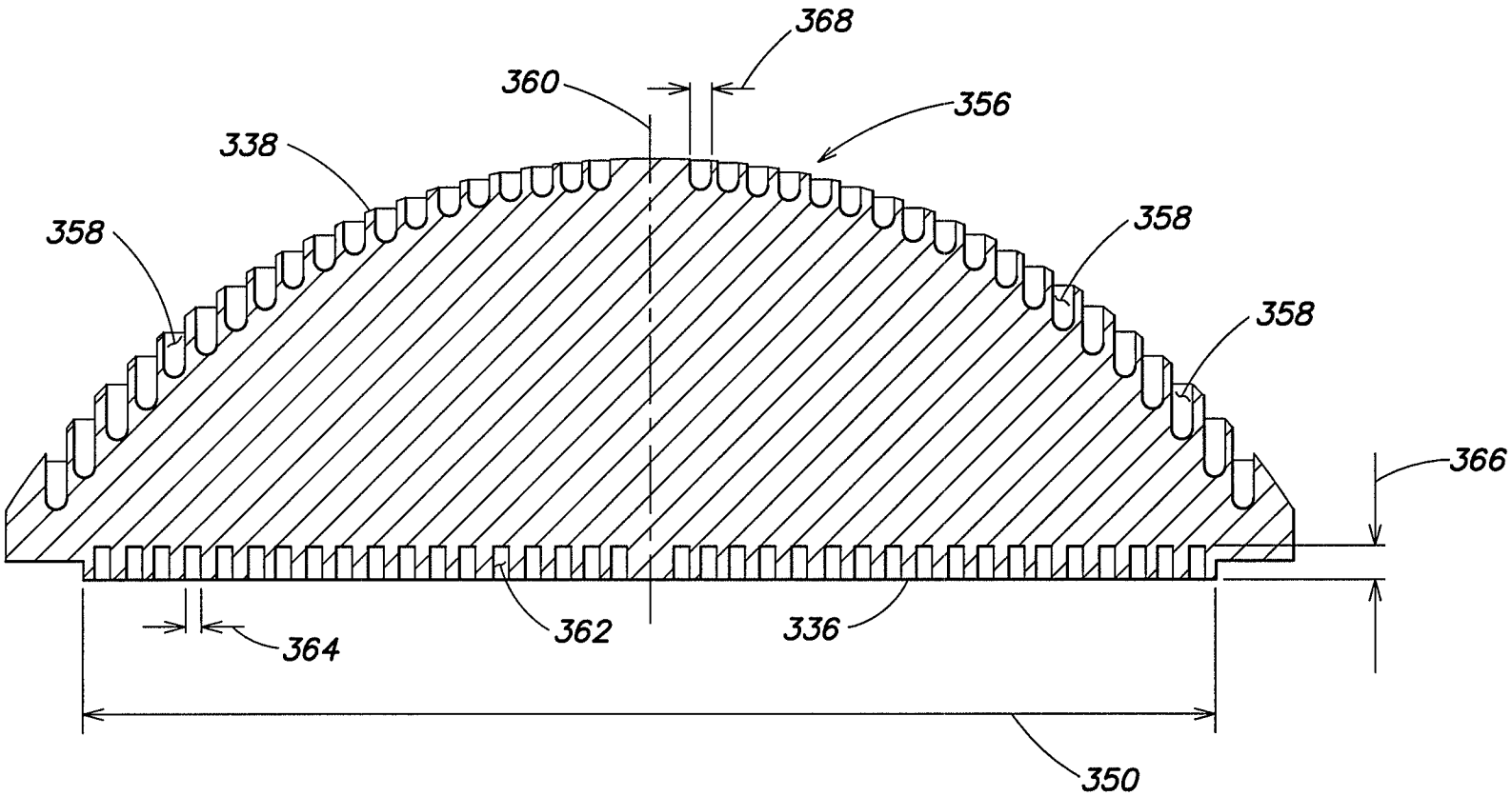
FIG. 42 is a side view of another example of a dielectric lens according to aspects of the invention.

Still referring to FIG. 42, in one embodiment, the dielectric lens 356 has impedance matching grooves 358 and 362 formed on both the convex lens surface 338 and the planar surface 336, respectively. In one example, the grooves 362 are milled into the planar surface 336 as a series of parallel lines or array of indentations, similar to the grooves 358 which are milled into the convex surface 338 of the lens 356. In one example, the grooves 362 are uniform with a constant width 364. However, it is to be understood that the grooves need not be uniform and may have varying widths and depths depending on desired characteristics of the lens 356. Unlike the exterior grooves 358 on the convex surface 338, the grooves 362 on the planar surface 336 may not vary in depth the farther each groove is from the center 360 of the lens 356, but instead all the grooves 362 may have a substantially similar depth 366 and width 364.

In the example illustrated in FIG. 42, the grooves 358 on the convex surface 338 of the dielectric lens 356 are not perfectly aligned with the grooves 362 on the planar surface 336 of the lens, but instead may be offset. For example, every peak on the exterior, convex surface 338 of the lens 356 may be aligned to a trough or valley on the planar surface 336. Conversely, every peak on the planar surface 336 of the lens 356 may be offset by a trough that is milled into the exterior convex surface 338 of the lens. In one example, the grooves 362 may have a width 364 of approximately 0.090 inches. The illustrated example, having grooves 362 on the planar surface 336 and grooves 358 on the convex surface 338 of the lens 356 may reduce the reflected RF energy by approximately 0.23 dB, roughly half of the 0.46 dB reflected by a similarly-sized non-grooved lens made of the same material.

Figure 43:
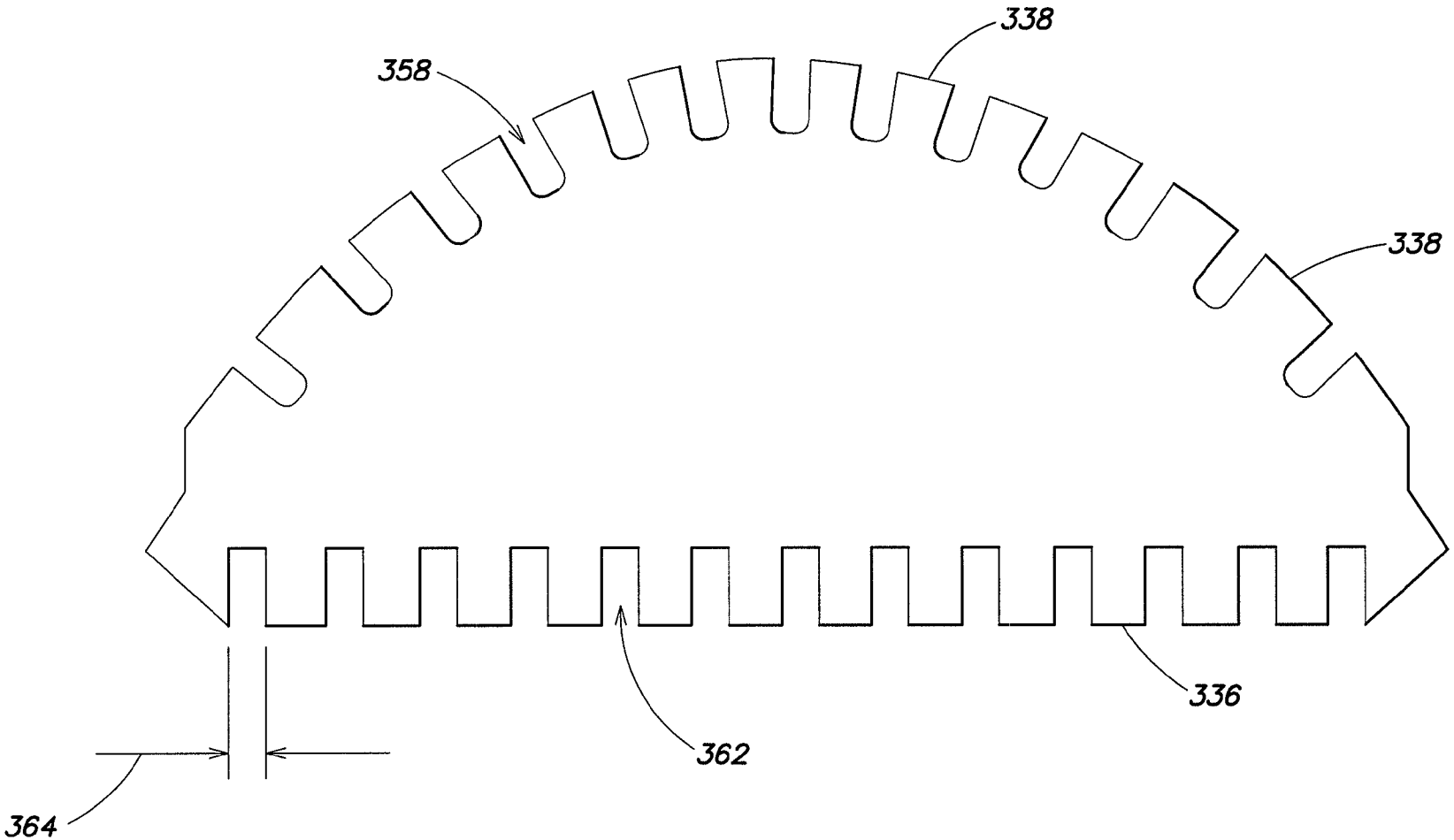
FIG. 43 is a side view of another example of a dielectric lens according to aspects of the invention.

In the example illustrated in FIG. 42, each of the grooves 358 is introduced normal (perpendicular) to the convex surface 338 of the dielectric lens 356. FIG. 43 illustrates an alternate example in which the grooves 358 are formed parallel to each other, and thus at least some of the grooves 358 are introduced at an angle other than perpendicular into the convex surface 338 of the dielectric lens 356. It is to be appreciated that an advantage of the embodiment illustrated in FIG. 43 is that it is easier to provide the grooves 358 in parallel because all of the grooves are cut in parallel planes. In particular, it is easier to manufacture the dielectric lens 356 with parallel grooves 358 because all of the machining is vertical and rotation of the part being machined is not needed.

As discussed above, in many applications, the external sub-system 102, including the antenna array 106, is exposed to environmental conditions such as precipitation and varying humidity. In such environments, it is possible for moisture to collect within the grooves 358 on the convex surface 338 of the dielectric lenses 304 in those embodiments of the lenses in which the grooves are milled (or otherwise fabricated) on the external surface of the lens. Such collection of moisture in the grooves 358 may be highly undesirable as it may degrade the RF performance of the lens, for example, by changing the effective dielectric constant of the lens and adversely affecting the impedance match between the lens and the surrounding air. For example, build-up of water from condensation inside the grooves 358 of the dielectric lens may cause a reduction in signal power of about 2 dB. In addition, particularly in situations where the antenna array 106 is subject to wide temperature variations, any water collected in the grooves 358 can freeze and cause structural problems, such as cracking of the lens, due to expansion of the water when it turns to ice. It may be possible to reduce moisture collection in the external grooves 358 by covering the antenna array 106 with a radome 202 and, in some examples, coating the interior surface of the radome with a material adapted to shed water. One example of a coating material that may be used is fluorothane. However, it is to be appreciated that the invention is not limited to the use of fluorothane and other water-shedding materials may be used instead. However, even when the antenna array is covered with a radome coated with a moisture-shedding material, it may not be possible to completely prevent moisture from collecting in the grooves 358. In addition, dust particles and other material may also collect in the grooves 358, further affecting the RF performance of the lens and adding to environmental wear and tear on the lens. Accordingly, it at least some embodiments, it is presently preferable to provide the impedance matching features on the interior, rather than exterior, surface of the dielectric lens 304. For example, as discussed and illustrated above, the impedance matching holes 340 are provided on the interior of the dielectric lenses 304, such that the exterior convex surface 338 may remain smooth.

According to another embodiment, impedance matching between the dielectric lens 304 and the surrounding air can be achieved by forming the dielectric lens out of two or more dielectric materials having different dielectric constants. For example, the interior portion of the dielectric lens 304 can be made from one material, and another material with a lower dielectric constant can be used in bands along the convex surface 338 and planar surface 336. In this manner, the change in effective dielectric constant from the air to the outer portion of the lens and then to the inner portion of the lens, and back again, may be made more gradual, thereby reducing unwanted reflections. With the use of several materials with gradually decreasing dielectric constants, a dielectric lens 304 with a gradually changing effective dielectric constant can be created. In one example, an adhesive can be used to adhere together the various layers of different materials. In this example, care should be taken to ensure good adhesion between the different layers so as to avoid reflections that may occur as a result of pockets of poor adhesion, or minute spaces, between the different layers. In addition, particularly for applications in which the dielectric lenses 304 are likely to encounter a wide range of temperatures, it may be important to carefully select the different dielectric materials to have similar coefficients of thermal expansion, so as to avoid or minimize stresses on the boundaries between the different materials which could shorten the life of the dielectric lenses 304 and cause degradation in the structural integrity and/or RF performance of the lenses.

As discussed above, the dielectric lenses 304 may be designed to have an optimal combination of weight, dielectric constant, loss tangent, and a refractive index that is stable across a large temperature range. It may also be desirable that the dielectric lenses 304 do not deform or warp as a result of exposure to large temperature ranges or during fabrication. It may also be preferable for the dielectric lenses 304 to absorb only very small amounts, e.g., less than 0.1%, of moisture or water when exposed to humid conditions, such that any absorbed moisture will not adversely affect the combination of dielectric constant, loss tangent, and refractive index of the lens. Furthermore, for affordability, it may be desirable that the dielectric lenses 304 be easily fabricated. In addition, it may be desirable that the lens should be able to maintain its dielectric constant, loss tangent, and a refractive index and chemically resist alkalis, alcohols, aliphatic hydrocarbons and mineral acids.

According to one embodiment, the dielectric lenses 304 are constructed using a certain form of polystyrene that is affordable to make, resistant to physical shock, and can operate across the wide range of the thermal conditions likely to be experienced when the antenna array 106 is mounted on an aircraft. In one example, this material is a rigid form of polystyrene known as crossed-linked polystyrene. Polystyrene formed with high cross linking, for example, 20% or more cross-linking, may be formed into a highly rigid structure whose shape may not be affected by solvents and which also may have a low dielectric constant, low loss tangent, and low index of refraction. In one example, a cross-linked polymer polystyrene may have the following characteristics: a dielectric constant of approximately 2.5, a loss tangent of less than 0.0007, a moisture absorption of less than 0.1%, and low plastic deformation property. Polymers such as polystyrene can be formed with low dielectric loss and may have non-polar or substantially non-polar constituents, and thermoplastic elastomers with thermoplastic and elastomeric polymeric components. The term "non-polar" refers to monomeric units that are free from dipoles or in which the dipoles are substantially vectorially balanced. In these polymeric materials, the dielectric properties are principally a result of electronic polarization effects. For example, a 1% or 2% divinylbenzene and styrene mixture may be polymerized through radical reaction to give a crossed linked polymer that may provide a low-loss dielectric material to form the thermoplastic polymeric component. Polystyrene may be comprised of, for example, the following polar or non-polar monomeric units: styrene, alpha-methylstyrene, olefins, halogenated olefins, sulfones, urethanes, esters, amides, carbonates, imides, acrylonitrile, and co-polymers and mixtures thereof. Non-polar monomeric units such as, for example, styrene and alpha-methylstyrene, and olefins such as propylene and ethylene, and copolymers and mixtures thereof, may also be used. The thermoplastic polymeric component may be selected from polystyrene, poly(alpha-methylstyrene), and polyolefins.

A dielectric lens 304 constructed from a cross-linked polymer polystyrene, such as that described above, may be easily formed using conventional machining operations, and may be grinded to surface accuracies of less than approximately 0.0002 inches. The cross-linked polymer polystyrene may maintain its dielectric constant within 2% down to temperatures exceeding the −70 F, and may also have a chemically resistant material property that is resistant to alkalis, alcohols, aliphatic hydrocarbons and mineral acids.

In one example, the dielectric lens 304 so formed includes an example of the impedance matching features discussed above. In these examples, the dielectric lens 304 may be formed of a combination of a low loss lens material, which may be cross-linked polystyrene and thermosetting resins, for example, cast from monomer sheets & rods. One example of such a material is known as Rexolite®. Rexolite® is a unique cross-linked polystyrene microwave plastic made by C-Lec Plastics, Inc. Rexolite® maintains a dielectric constant of about 2.53 through 500 GHz with extremely low dissipation factors. Rexolite® exhibits no permanent deformation or plastic flow under normal loads. All casting may be stress-free, and may not require stress relieving prior to, during or after machining. During one test, Rexolite® was found to absorb less than 0.08% of moisture after having been immersed in boiling water for 1000 hours, and without significant change in dielectric constant. The tool configurations used to machine Rexolite® may be similar to those used on Acrylic. Rexolite® may thus be machined using standard technology. Due to high resistance to cold flow and inherent freedom from stress, Rexolite® may be easily machined or laser beam cut to very close tolerances, for example, accuracies of approximately 0.0001 can be obtained by grinding. Crazing may be avoided by using sharp tools and avoiding excessive heat during polishing. Rexolite® is chemically resistant to alkalis, alcohols, aliphatic hydrocarbons and mineral acids. In addition, Rexolite® is about 5% lighter than Acrylic and less than half the weight of TFE (Teflon) by volume.

Figure 44A:
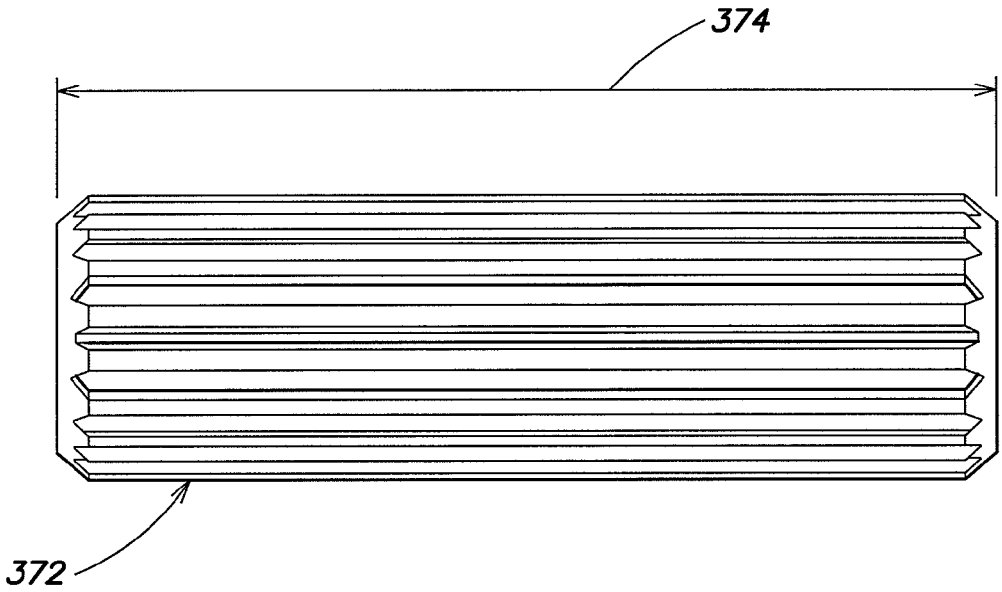
FIG. 44A is a side view of one example of a pin that can be used to fasten the dielectric lens to the antenna element in accordance with aspects of the invention.
Figure 44B:
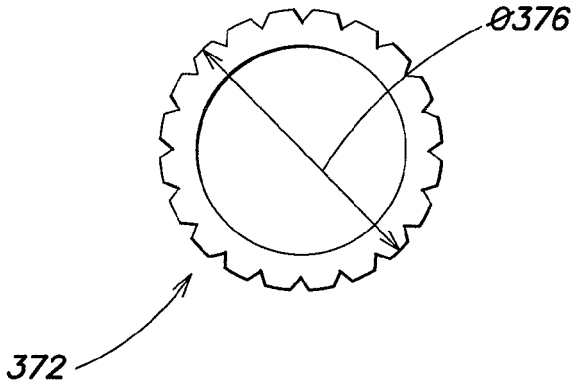
FIG. 44B is a radial cross-sectional view of the pin of FIG. 44A.

As discussed above, the dielectric lenses 304 may be mounted to the horn antenna elements 301 and designed to fit over and at least partially inside the respective horn antenna element. Referring again to FIG. 36, in one embodiment, the dielectric lens 320 has tapered sides 370 to facilitate secure mounting of the lens to the corresponding horn antenna element 322. In one example, the slope of the tapered sides 370 of the interior dielectric lens 320 is approximately the same as the slope of the sides 313 of the interior horn antenna element 382. Such tapered sides 370 may facilitate self-centering of the dielectric lens 320 with respect to the horn antenna element 322. A pin 372 may be used to fasten the interior dielectric lens 320 to the interior horn antenna element 382. An example of a pin 372 that may be used to fasten the dielectric lenses 304 to their respective antenna elements 308 is illustrated in FIGS. 44A and 44B. Referring to FIG. 44A, in one example, the pin 372 has a length 374 of about 0.320 inches, with a tolerance of about 0.030 inches. Referring to FIG. 44B, in one example, the pin 372 has a diameter 376 of about 0.098 inches with a tolerance of about 0.001 inches. In one example, the pin 372 is made of fiberglass. However, it is to be appreciated that a variety of other materials may be suitable.

Referring again to FIGS. 39A, 40A and 41A, in one embodiment, to facilitate mounting of the tapered lenses 318, 328 and 332 to their respective horn antenna elements 324, 326 and 330, the length 350 of the planar surface 336, i.e., the length of the groove pocket discussed above, may be reduced relative to the overall length the lenses by, for example, milling. The reduced footprint of planar surface 336 may allow the lenses 318, 328 and 332 to be partially inserted into the respective horn antenna elements 324, 326 and 330. Pins 372 may be used to fasten the dielectric lenses 318, 328 and 332 to the respective horn antenna elements 324, 326 and 330.

Figure 45A:
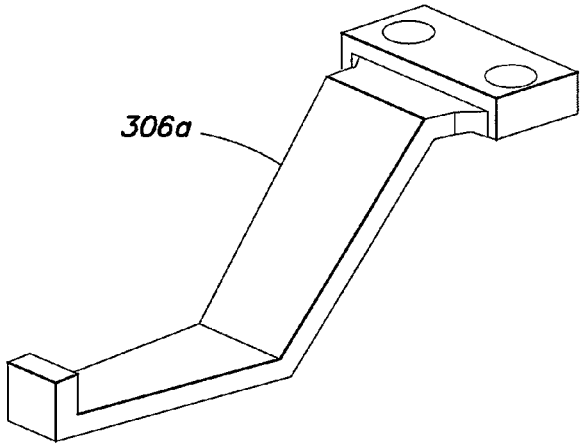
FIGS. 45A-C are perspective views of retaining clips that can be used to fasten the dielectric lenses to the antenna elements in accordance with aspects of the invention.
Figure 45B:
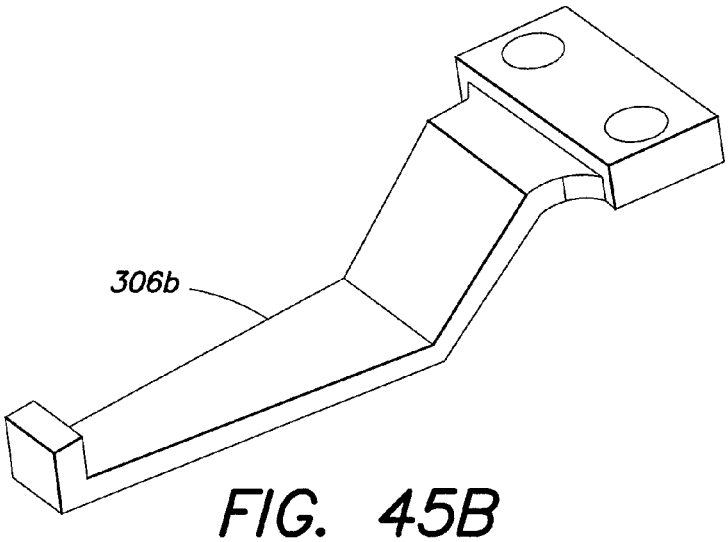
Figure 45C:
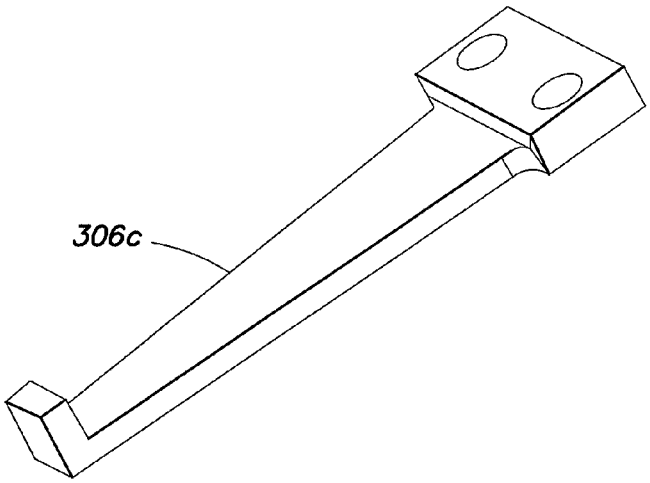
Figure 46:
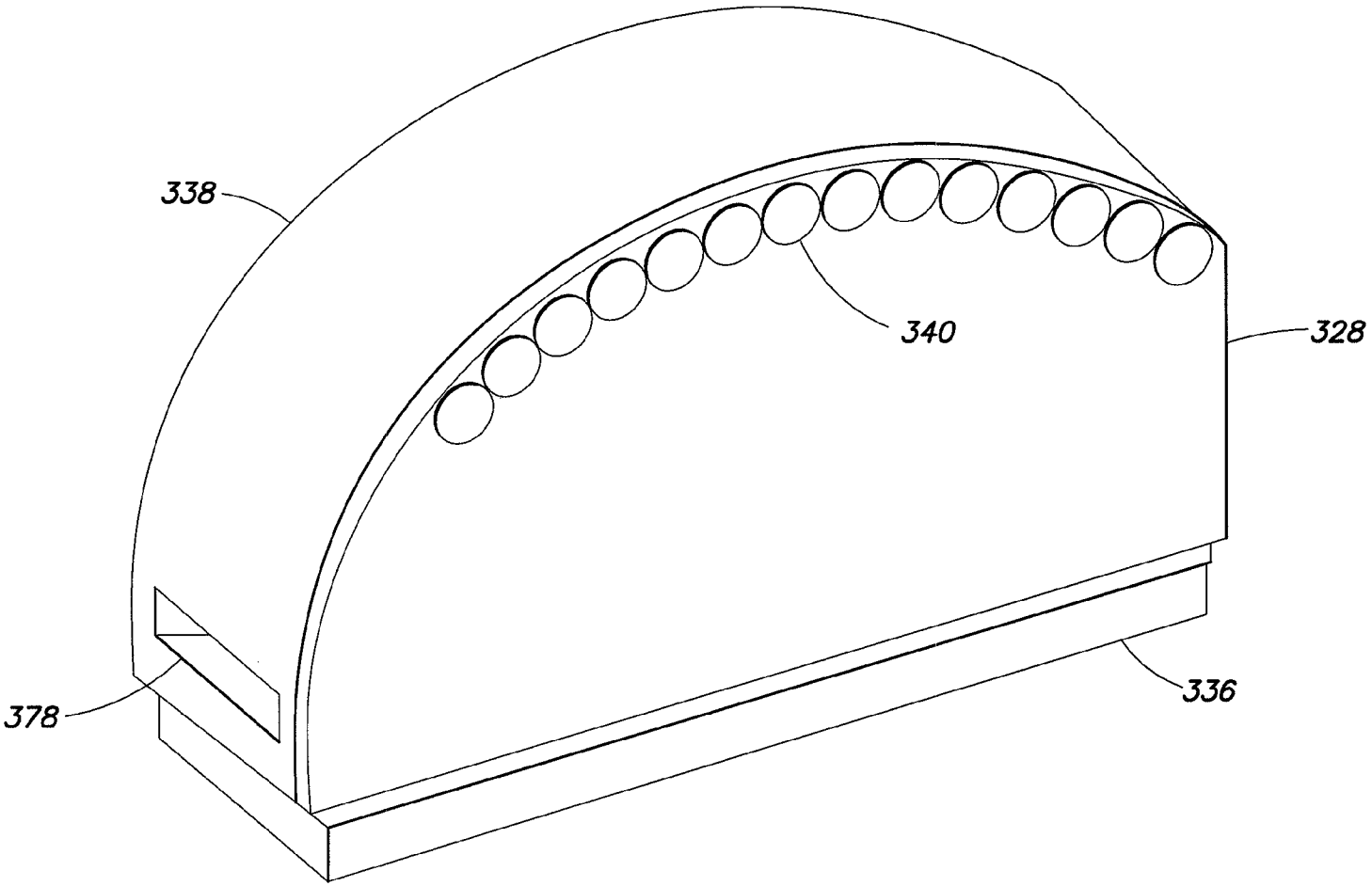
FIG. 46 is a perspective view of one example of a dielectric lens showing a slot for receiving a retaining clip in accordance with aspects of the invention.
Figure 47:
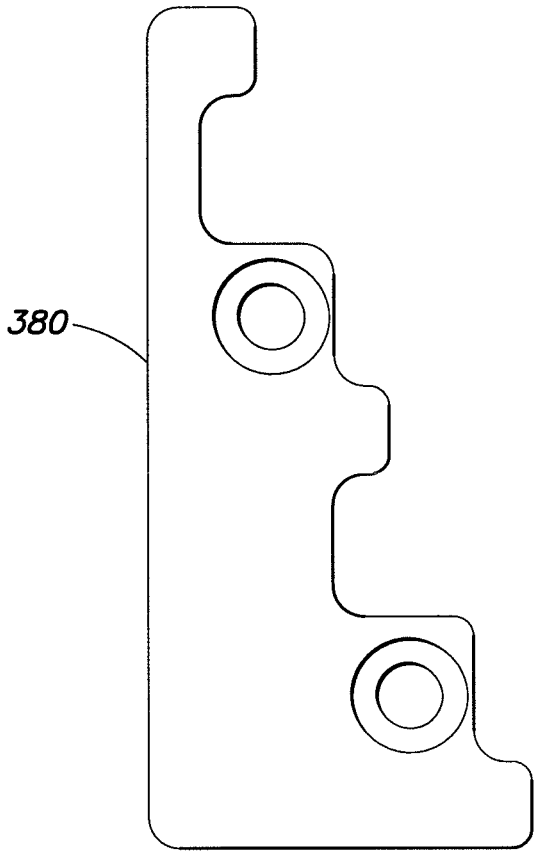
FIG. 47 is a side view of another example of a retaining clip used to secure at least some of the dielectric lenses in the antenna array in accordance with aspects of the invention.

According to one embodiment, retaining clips 306*a*, 306*b* and 306*c* (see FIGS. 4 and 25) are used to fasten the tapered dielectric lenses 318, 328 and 332 to their respective horn antenna elements 324, 326 and 330. In one example, these retaining clips are used in conjunction with the pins 372 to more securely fasten the dielectric lenses 318, 328 and 332 to the horn antenna elements 324, 326 and 330. Alternatively, the retaining clips 306*a*, 306*b* and 306*c* may be used instead of the pins 372. This arrangement may be preferable where the lenses 318, 328 and 332 are small and there may be insufficient room to use a pin 372 without comprising either the structural integrity of the lens or the RF performance of the lens. In addition, it is to be appreciated that various other fastening mechanisms may be suitable to mount the dielectric lenses 304 to the antenna elements 308. FIGS. 45A-C respectively illustrate examples of retaining clips 306*a*, 306*b* and 306*c* that can be used to fasten the dielectric lenses 318, 328 and 332 to the respective horn antenna elements 324, 326 and 330. Referring to FIG. 46, in one example, the dielectric lenses 328 includes a slot 378 to receive the retaining clip 306*b*. Similar slots may be provided on dielectric lenses 318 and 332. Referring again to FIG. 25, in one embodiment, an additional retaining clip 380 is used to further secure the tapered lenses 318, 328 and 332. In the illustrated example, four such retaining clips 380 are used, one at each end of each of the two rows of antenna elements in the antenna array 106. An example of the retaining clip 380 is illustrated in FIG. 47.

In another example, the dielectric lenses 304 are glued into the respective antenna elements 308 using an adhesive. Adhesive fastening may be used alone or in combination with any or all of the pins 372 and retaining clips 306*a*, 306*b*, 306*c* and 380 discussed above. In one example, the pins 372 and/or retaining clips 306*a*, 306*b*, 306*c* and 380 are used as secondary attachment means in conjunction with an adhesive to more securely fasten the dielectric lenses 304 to the respective antenna elements 308. This arrangement may be preferable, for example, where the antenna array 106 is mounted to an aircraft and must meet applicable safety standards.

As discussed above, the antenna array 106 includes a feed network 302 coupled to each of the antenna elements 308, and in one embodiment, the feed network 302 is a waveguide feed network, as illustrated in FIGS. 4, 6, 7 and 25. The feed network 302 operates, when the antenna array 106 is in receive mode, to receive signals from each of the antenna elements 308 and to provide one or more output signals at a feed port that is coupled to the communication system electronics. Similarly, when the antenna array 106 operates in transmit mode, the feed network 302 guides signals provided at the feed port to each of the antenna elements 308 for transmission. Accordingly, it is to be appreciated that although the following discussion will refer primarily to operation in the receiving mode, the components may operate in a similar manner, with signal flow reversed, when the antenna array 106 is operating in the transmit mode. It is also to be appreciated that although the feed network 302 is illustrated as a waveguide feed network, and may be a waveguide feed network in presently preferred embodiments, the feed network may be implemented using any suitable technology, such as printed circuit, coaxial cable, etc., as will be recognized by those skilled in the art.

Figure 48:
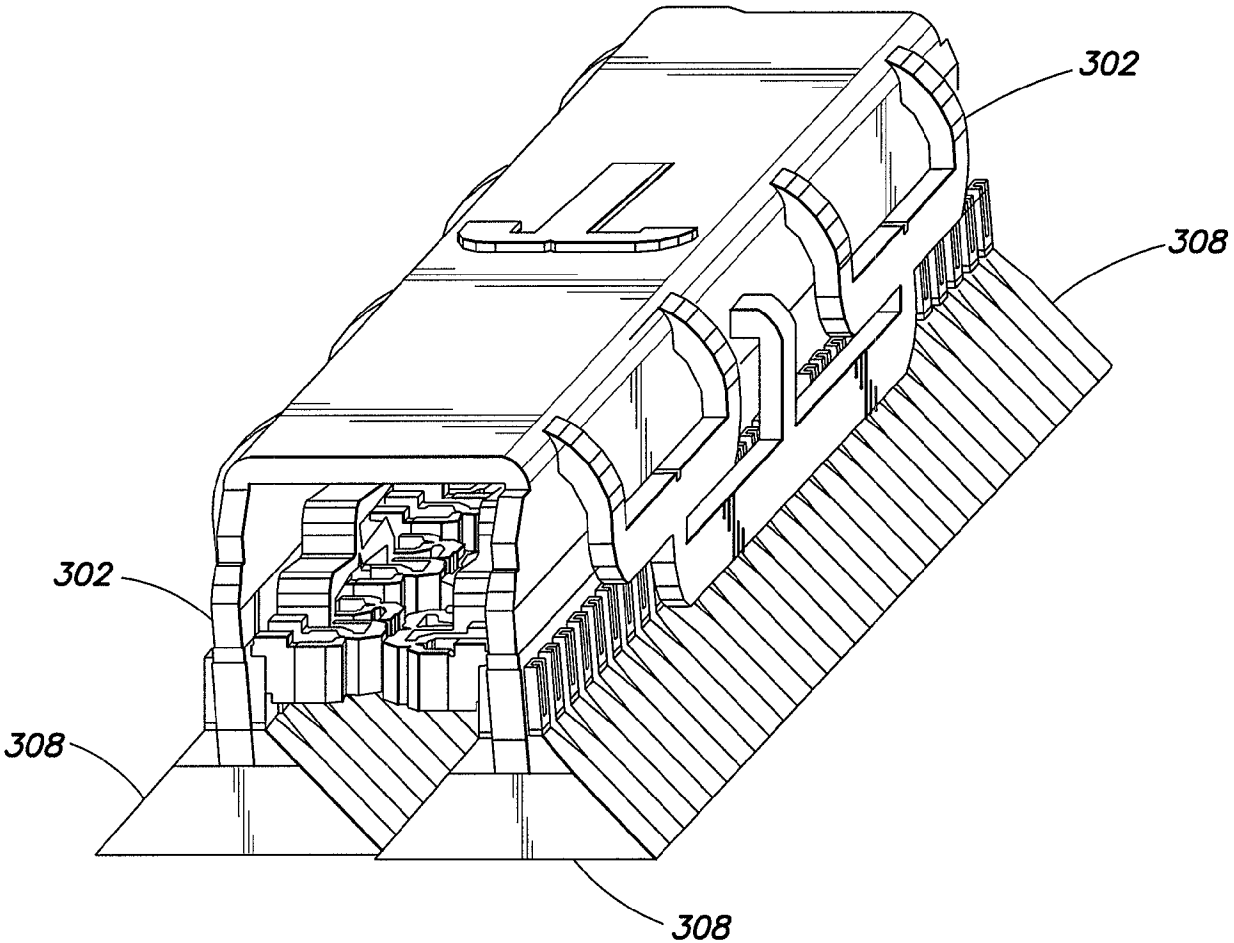
FIG. 48 is a diagram illustrating another example of an antenna array according to aspects of the invention.

According to one embodiment, the waveguide feed network 302 is a compressed, non-conforming (i.e., custom sized and shaped) waveguide feed that has a low profile and is designed to fit within a constrained volume. As discussed above, in some applications, the antenna array 106 will be mounted on a moving vehicle, such as an automobile or aircraft, and it may therefore be desirable for the antenna array to occupy as small a volume as possible, so as to have minimal impact on the aerodynamics of the vehicle and to be easily mountable on the vehicle. Accordingly, the feed network 302 may be shaped and arranged to occupy a reduced volume. In one embodiment, the feed network 302 performs signal summing/splitting in both the E-plane and the H-plane, a feature which contributes to the ability to provide a compressed, low-profile feed network, as discussed further below. In one embodiment, the feed network 302 may be designed to fit behind the rows of antenna elements 308, as illustrated in FIG. 25, such that a polarization converter unit, discussed below, may fit "inside" the antenna array 106. Alternatively, the feed network 302 may be designed to fit between the rows of antenna elements 308, as illustrated in FIG. 48. In either arrangement, or in various other arrangements that may be apparent to those skilled in the art, the feed network 302 may have a compressed, low-profile design.

Figure 49:
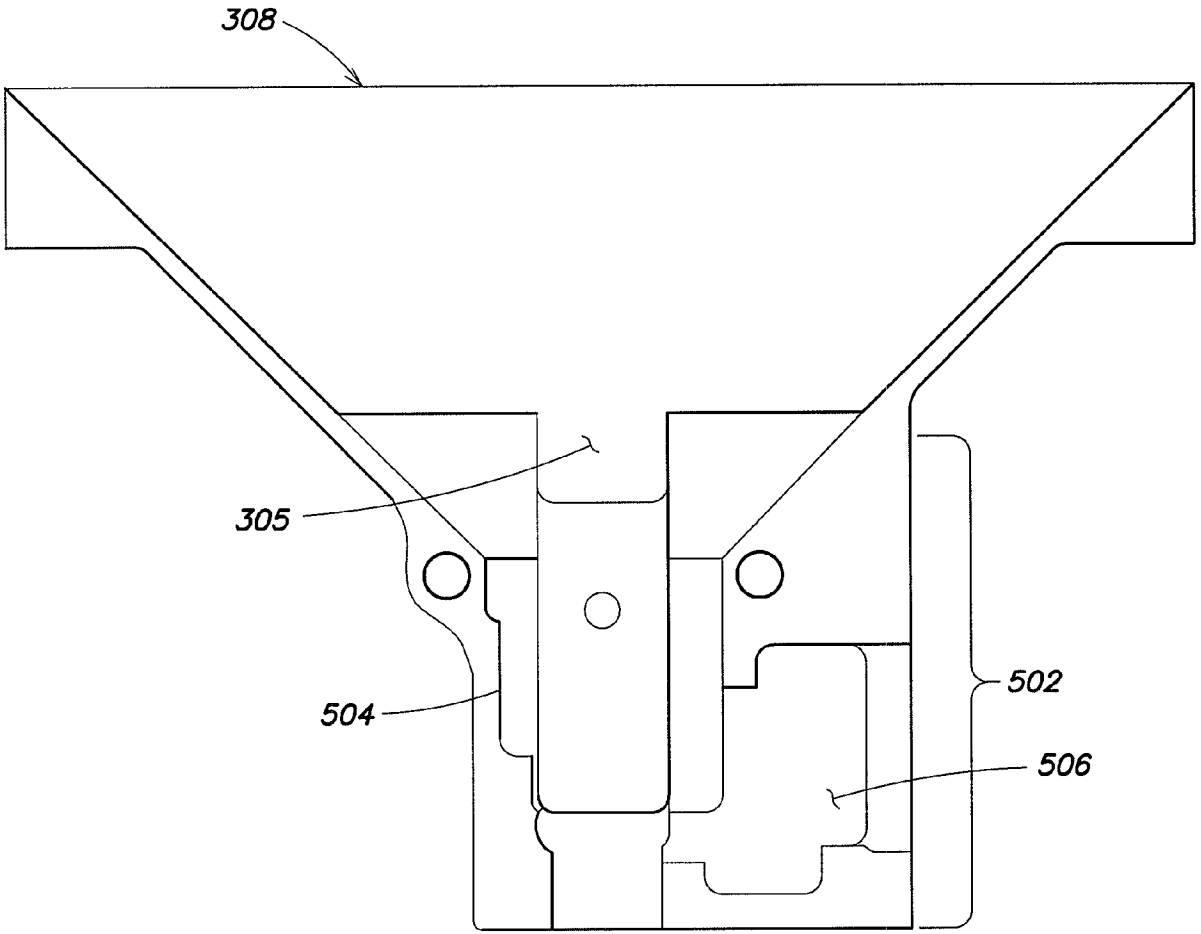
FIG. 49 is an illustration of one example of a horn antenna element with an integrated orthomode transducer according to aspects of the invention.

Referring to FIG. 49, in one embodiment, each antenna element 308 is coupled, at its feed point 305 to an orthomode transducer (OMT) 502. The OMT 502 may provide a coupling interface between the antenna element 308 and the feed network 302, and may also isolate two orthogonal linearly polarized RF signals, as discussed further below. When the antenna array 106 receives a signal, the OMT 502 receives the input signal from the antenna element 308 at a first port and splits the signal into two orthogonal component signals which are provided at second and third ports 504, 506. When the antenna array transmits a signal, the OMT 502 receives the two orthogonally polarized component signals at the second and third ports 504, 506 and combines them to provide at the first port and to the antenna element 308, a signal for transmission. In the illustrated example, the OMT 502 is integrally formed with the antenna element 308. However, it is to be appreciated that the OMT 502 may be formed as a separate component from the antenna element 308 and coupled to the antenna element.

As discussed above, in one embodiment, the OMT 502 splits an RF signal received at the first port into two orthogonal RF component signals. One RF component signal has its E-field parallel to the long axis of the horn (designated here as vertical, V) and the other RF component signal has its E-field parallel to the short axis of the horn (designated here as horizontal, H). These RF component signals are referred to herein as the vertically polarized RF component signal, or vertical component signal (V), and the horizontally polarized RF component signal, or horizontal component signal (H). From these two orthogonal component signals, any transmitted input signal may be reconstructed by vector combining the two component signals.

Figure 50:
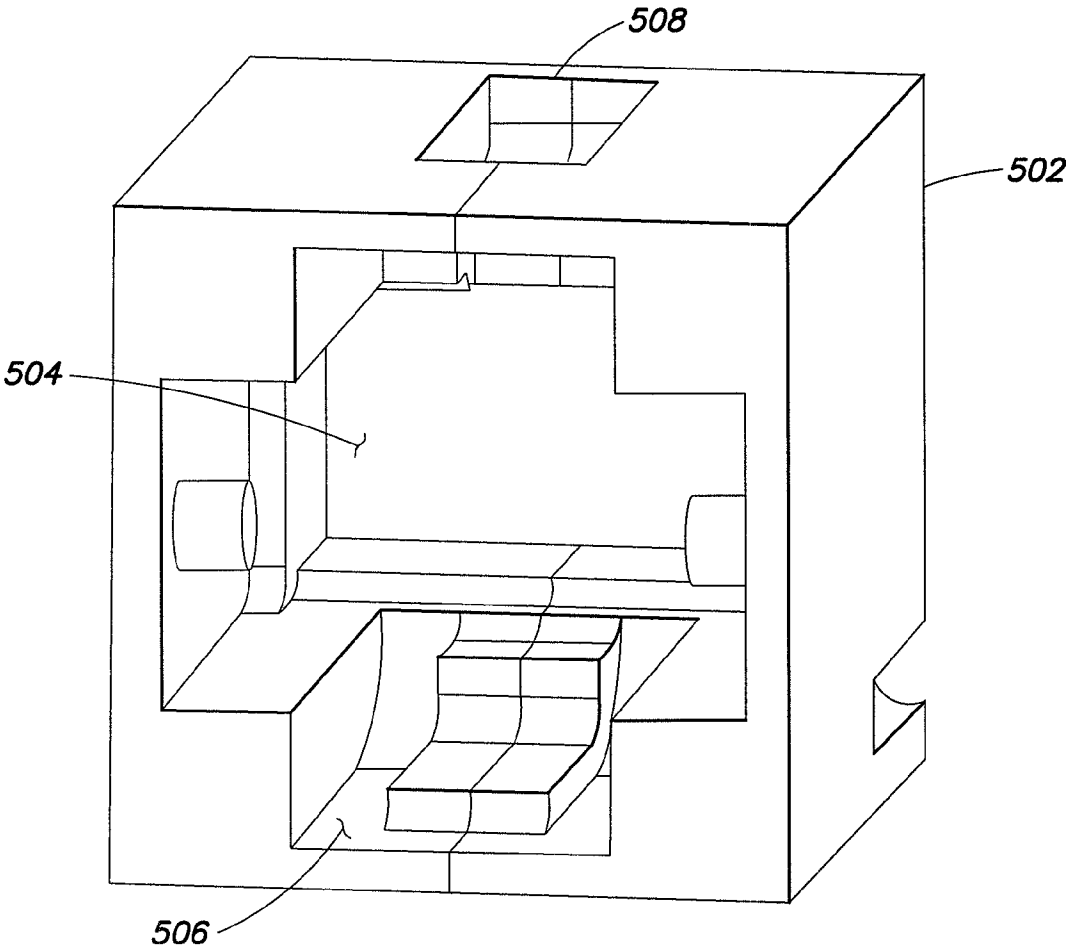
FIG. 50 is a perspective view of one example of an orthomode transducer according to aspects of the invention.

Referring to FIG. 50, there is illustrated an isometric view of one example of a compact, broadband orthomode transducer (OMT) 502. In one example, the OMT 502 is a multi-faceted waveguide OMT that provides for the transmission of orthogonal electromagnetic waves. As discussed above, the OMT 502 includes two rectangular waveguide ports 504, 506 in planes perpendicular to each other, as well as a first rectangular waveguide port 508. Embodied within the waveguide OMT 502 are multi-faceted surfaces that form a plurality of inclined, horizontal, and vertical surfaces that are described in more detail below. For the antenna array 106 operating in the receive mode, port 508 can be considered an input terminal of the OMT 502, and ports 504 and 506 can be considered the output terminals of the OMT 502. In one embodiment, the combination of the multi-faceted surfaces of the OMT 502 are positioned and oriented to propagate simultaneously the horizontally-polarized electric waves, H, and the vertically-polarized waves, V, in the region of port 508, while generating very little reflection of the signals.

Figure 51:
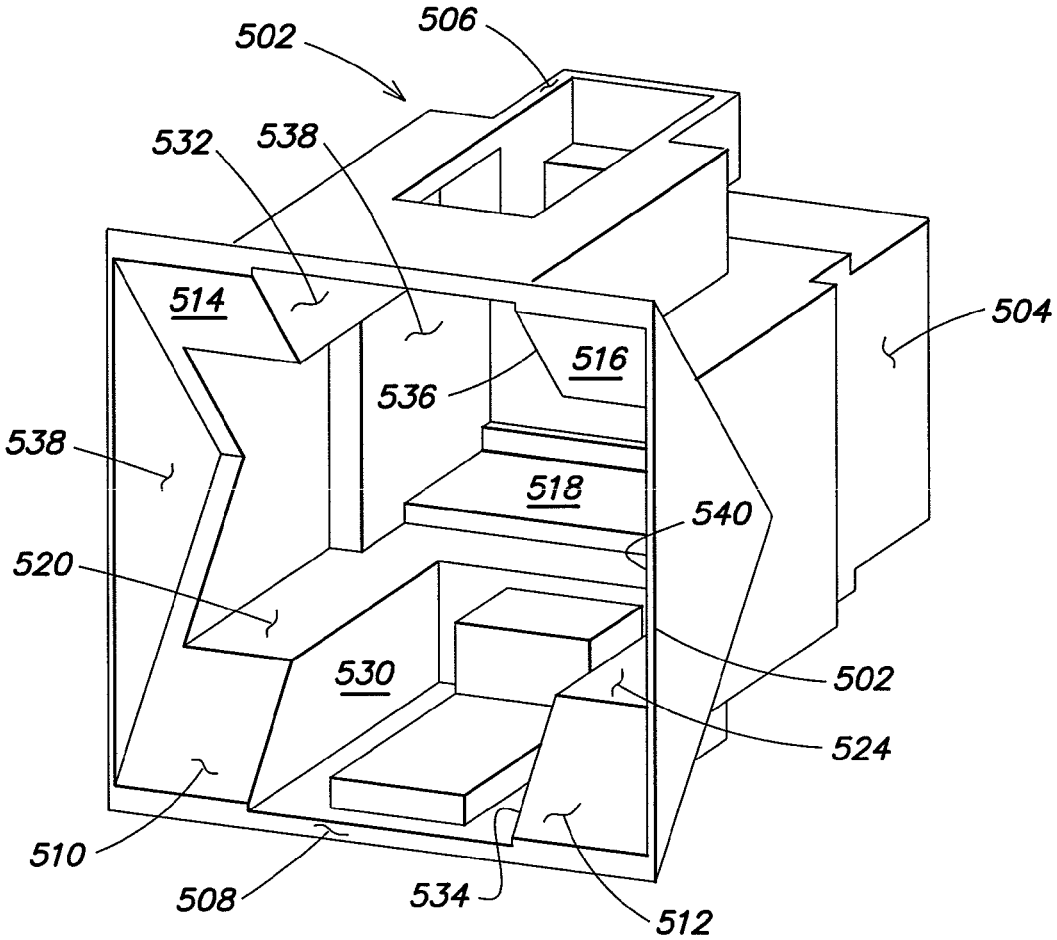
FIG. 51 is a perspective view of another example of an orthomode transducer according to aspects of the invention.

Another example of an OMT 502 is illustrated in FIG. 51. In the example illustrated in FIG. 51, the multi-faceted surfaces include, and are not limited to, the inclines 510 and 512 which are symmetrically positioned on the left and right sides of the vertical centerline of the OMT 502, and inclines 514 and 516 which are each symmetrical to each other and depicted near the square cross-sectional end of the waveguide OMT 502. The incline planes 510 and 514 are each offset 45 degrees from each other forming a ninety degree included angle at their mutual intersection. Likewise, inclines 512 and 516 are each offset 45 degrees from each other forming a ninety degree included angle at their mutual intersection. Inclines 510 and 512 are coplanar, as are inclines 514 and 516, and positioned symmetrically within the OMT 502. In one example, the mutual intersection of the inclines also forms an effective low-loss transition for electromagnetic waves generated from the corresponding antenna element 308. The mutual intersection may also coincide with the feed point 305 of the antenna element 308.

Figure 52:
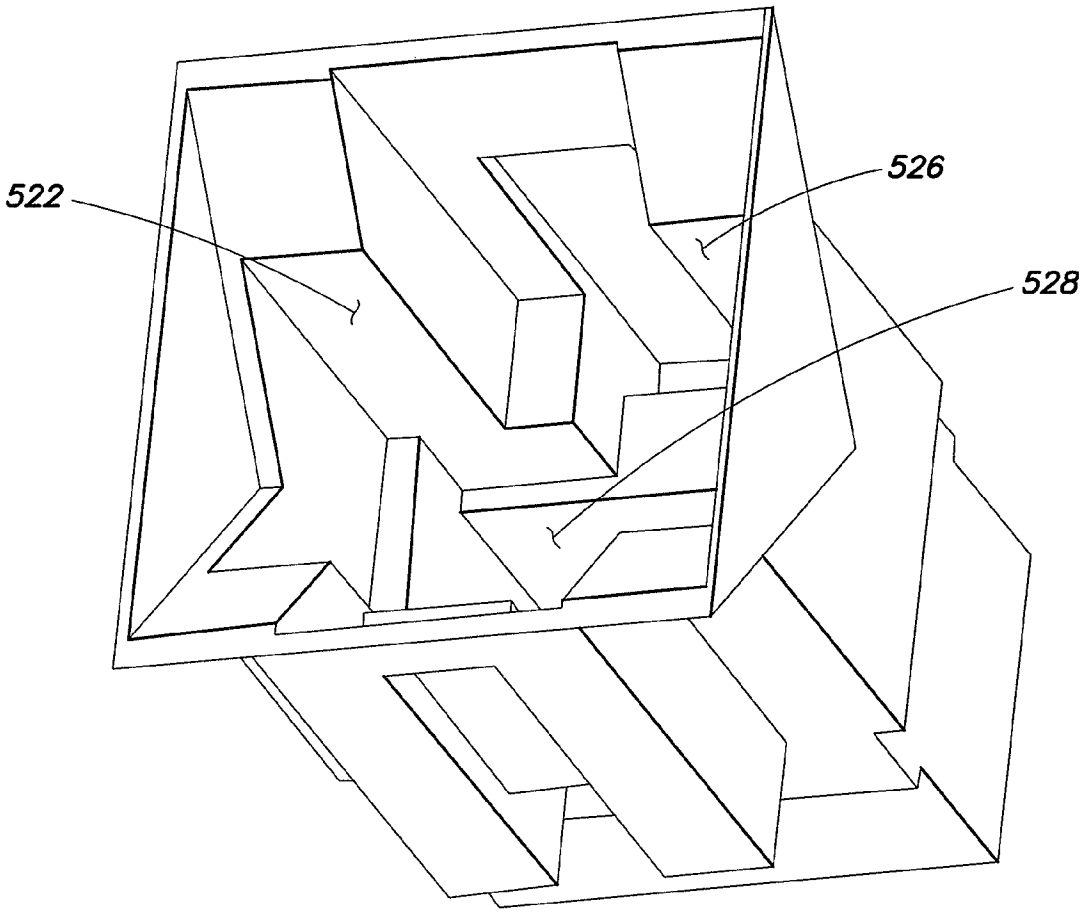
FIG. 52 is another view of the orthomode transducer of FIG. 50.

Referring to FIGS. 51 and 52, in one example, horizontal and vertical electromagnetic waves may enter the terminal 508 of the waveguide OMT 502. The vertically polarized electromagnetic wave, V, propagates through port 508, through a space bounded by the left and right sidewalls of the waveguide OMT 502 and the horizontal surfaces 518, 520, 522, 524, 526 and 528 of the waveguide OMT 502, which form a space designed for the frequency band of use, and are transmitted to port 504. In one example, little or none of the vertically polarized electric wave V is transmitted to port 506 of the OMT 502 due to frequency cut-off effects caused by the metal walls depicted as 530, 532, 534, and 536. The multi-faceted features of the OMT 502 may form an effective waveguide. In one example, the effective waveguide dimensions are approximately 0.600 inches in width and 0.270 inches in height and provide a very low loss transmission for frequencies in the 10.7 GHz to 14.5 GHz band.

Still referring to FIG. 51, in one example, the horizontally polarized electric waves H enter the waveguide OMT 502 through the terminal 508, which is bounded by upper and lower inner walls of the OMT 502 and forms a space bounded between surfaces 530, 532, 534, 536, 538, and 540 of the waveguide OMT 502. Little or none of the horizontally polarized electric wave H may be transmitted to port 504 of the OMT 502 due to frequency cut-off effects caused by the space formed between the walls depicted as 518, 520, 522, 524, 526 and 528. It is to be appreciated that the waveguide type OMT 502 may provide several advantages, including a miniature form factor, and a broadband propagation with low loss. It will further be appreciated by those skilled in the art that variations on the OMT 502 are possible, and the invention is not limited to the illustrated examples.

In one example, the vertically polarized electromagnetic wave V of a basic mode such as TE01 is propagated from the port 508 of the OMT 502, through the waveguide OMT, bypasses the rectangular branching waveguides of 506, and is propagated in a basic mode such as TE01 to the port 504. During the transit of the vertically polarized electromagnetic wave V, each of spaces defined between upper and lower sidewalls of the rectangular branching waveguides in the OMT 502 may be designed so as to be equal to or smaller than a half of the free-space wavelength of the frequency band in use. Thus, the vertically polarized electromagnetic wave V may not propagate into port 506 due to the cut-off effect of those spaces with very low reflection characteristics. Thus, the vertically polarized electromagnetic wave V provided to port 508 may be efficiently transmitted to port 504 and provided at that port as the vertical component signal, while the OMT 502 suppresses the reflection to the port 508 and eliminates propagation to port 506. Similarly, the horizontally-polarized electromagnetic wave H in a basic mode TE10 propagates from port 508 through the OMT 502, bypassing the waveguide branch for port 504, and is provided at port 506 as the horizontal component signal.

It is to be appreciated, as has been discussed above that although the operation of the OMT 502 has been described with respect to the case where the signal flow is such that port 508 is an input terminal, and the ports 504 and 506 are output terminals, the OMT 502 can also be operated such that the ports 504 and 506 are input terminals for orthogonal component signals which are combined and provided at the output terminal, port 508. Further, it is to be appreciated that the OMT 502 may also contain substantially circular or elliptical waveguides and terminations.

According to one embodiment, the feed network 302 includes a first path coupled to the second port 504 of the OMT 502 that guides the vertically polarized component signal, and a second path coupled to the third port 506 of the OMT 502 that guides the horizontally polarized component signal. Each path is coupled to all of the antenna elements 308 in the antenna array 106. Thus, each of the two orthogonally polarized component signals may travel a separate, isolated path from the respective ports 504, 506 of the OMT 502 to a feed port where the signals are fed to the system electronics, as discussed below. For receive mode of the antenna array 106, the feed network 302 receives the vertically and horizontally polarized component signals from each antenna element and sums them along the two feed paths to provide at the feed port one vertically polarized signal and one horizontally polarized signal. For transmit mode of the antenna array 106, the feed network 302 receives a vertically polarized signal at the feed port and splits that signal into the vertical component signals provided at port 504 of each OMT 502. Similarly, the feed network 302 receives a horizontally polarized signal at the feed port and splits it into the horizontal component signals provided at port 506 of each OMT 502. In one example, the two paths are substantially symmetrical, including the same number of bends, T-junctions and other waveguide path elements such that the feed network 302 does not impart a phase imbalance to the vertical and horizontal component signals.

Figure 53:
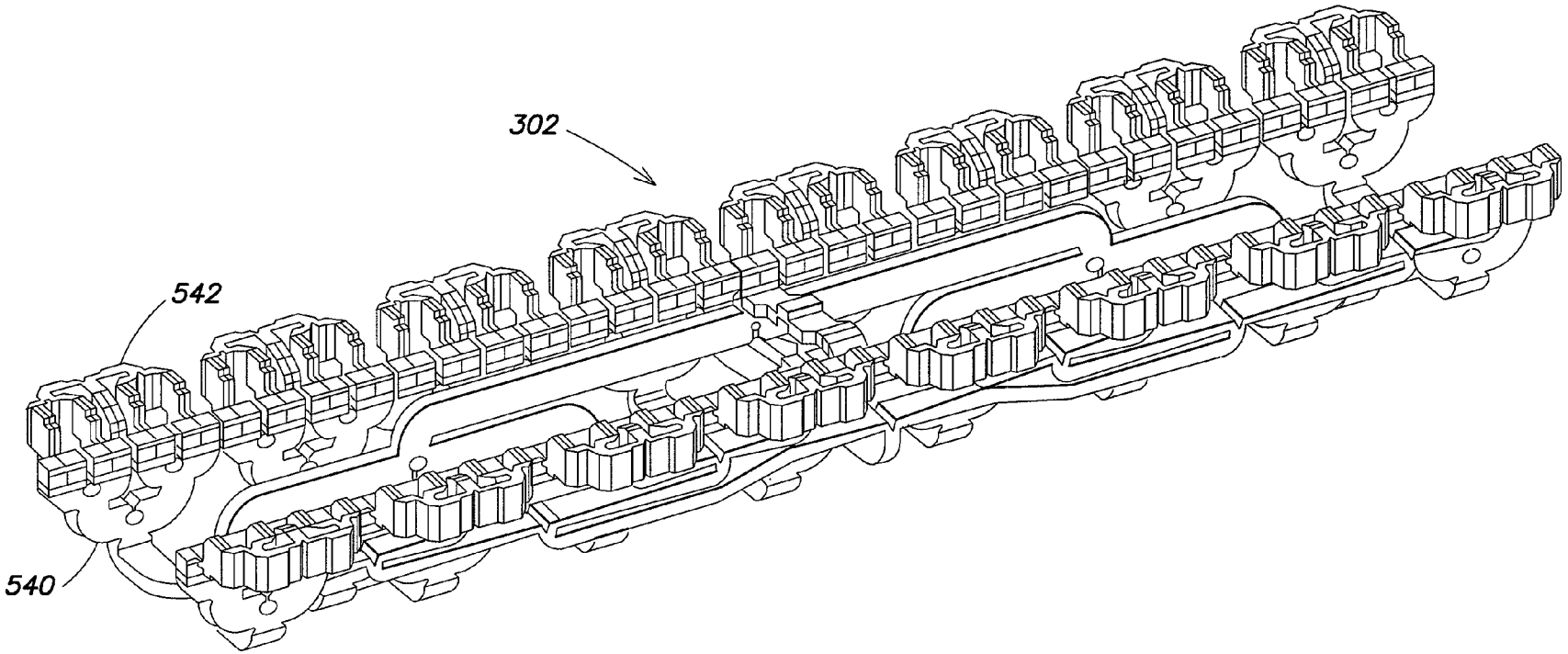
FIG. 53 is a perspective view of one example of a waveguide feed network according to aspects of the invention.

As discussed above, in one embodiment, the feed network 302 includes both a path in which signal summing is done in the E-plane, and a path in which signal summing is done in the H-plane. Summing in both the E-plane and the H-plane allows the feed network to be substantially more compact than a similar feed network in which summing is done only in one plane. In particular, using both the E-plane and H-plane allows the two paths 541, 542 of the feed network to interweave, as shown in FIG. 53, due to the different size and shape of the two paths. Accordingly, the entire feed network 302 may fit within a smaller volume than if the summing for both paths were done in the same plane. In one example, the vertical component signals are fed to and guided by the E-plane path and the horizontal component signals are fed to and guided by the H-plane path. However, it is to be appreciated that the opposite arrangement, namely that the horizontal component signals are guided by the E-plane path and the vertical component signals are guided by the H-plane path, can be implemented. Both the vertical component signal and the horizontal component signal are made up of both E-plane and H-plane fields; therefore, either component signal may be summed in either plane. Accordingly, the two feed paths of the feed network 302 will be referred to herein as the horizontal feed path and the vertical feed path, and it is to be understood that either path may sum/split the signals in either the H-plane or the E-plane.

According to one embodiment, the feed network 302 includes a plurality of E-plane T-junctions and bends to couple all of the antenna elements 308 together in the E-plane path, and a plurality of H-plane T-junctions and bends to couple all of the antenna elements 308 together in the H-plane path. When the antenna array 106 is operating in receive mode, the T-junctions operate to add the component signals (vertical or horizontal) received from each antenna element 308 to provide a single output signal (in each orthogonal polarization) at the feed port. When the antenna array 106 is operating in transmit mode, the T-junctions serve as power-dividers, to split a signal from the single feed port (for each orthogonal component signal) to feed each antenna element 308 in the antenna array 106.

Figure 54A:
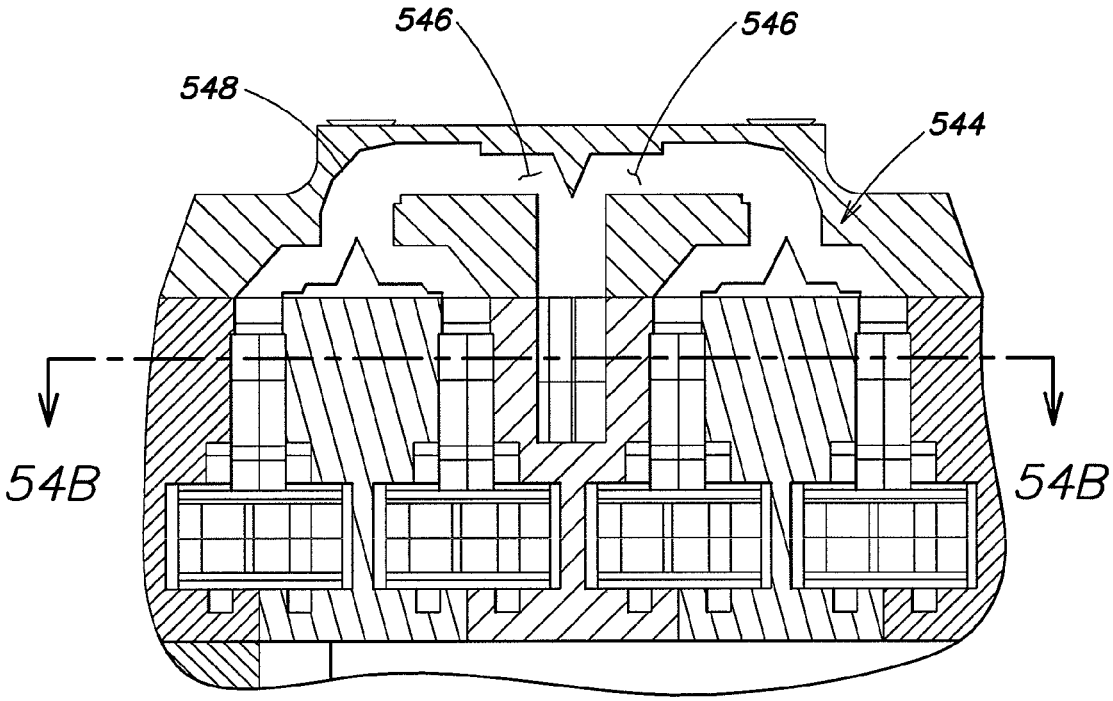
FIG. 54A is an illustration of a portion of one example of a feed network according to aspects of the invention.
Figure 54B:
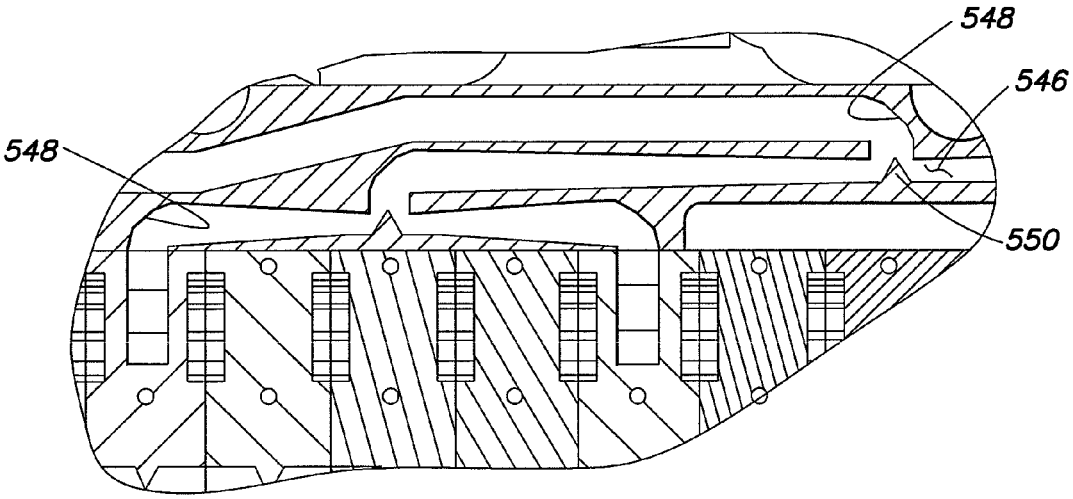
FIG. 54B is a cross-sectional view of the portion of the feed network of FIG. 54A taken along line 54B-54B in FIG. 54A.

Referring to FIG. 54A, there is illustrated one example of a portion of the horizontal feed path showing several waveguide T-junctions and bends. FIG. 54B is a cross-sectional view of the portion of the horizontal feed path taken along line 54B-54B in FIG. 54A. Referring to FIGS. 54A and 54B, in one example, the waveguide T-junctions 544 include narrowed sections 546 (as compared to the width of the remaining sections) that perform a function of impedance matching. The narrowed sections may have higher impedance than the wider sections and may typically be approximately one-quarter wavelength in length. In another example, the waveguide feed network 302 has rounded bends 548, rather than sharp 90 degree bends, which may further allow the feed network 302 to take up less space than if right-angled bends were used, and also may serve to decrease phase distortion of the signal as it passes through the bends. In one example, vertical component signals are summed after going through waveguide step transformers and 90 degree chamfered bends 548 that are all designed for minimal VSWR. Similarly, the horizontal component signals may be summed after going through waveguide step transformers and 90 degree chamfered bends 548 that are all designed for minimal VSWR. As discussed above, in one embodiment, each of the horizontal and vertical feed paths in the feed network 302 has the same number of bends in each direction so that the two component signals receive an equal phase delay from propagation through the feed network 302.

Figure 55:
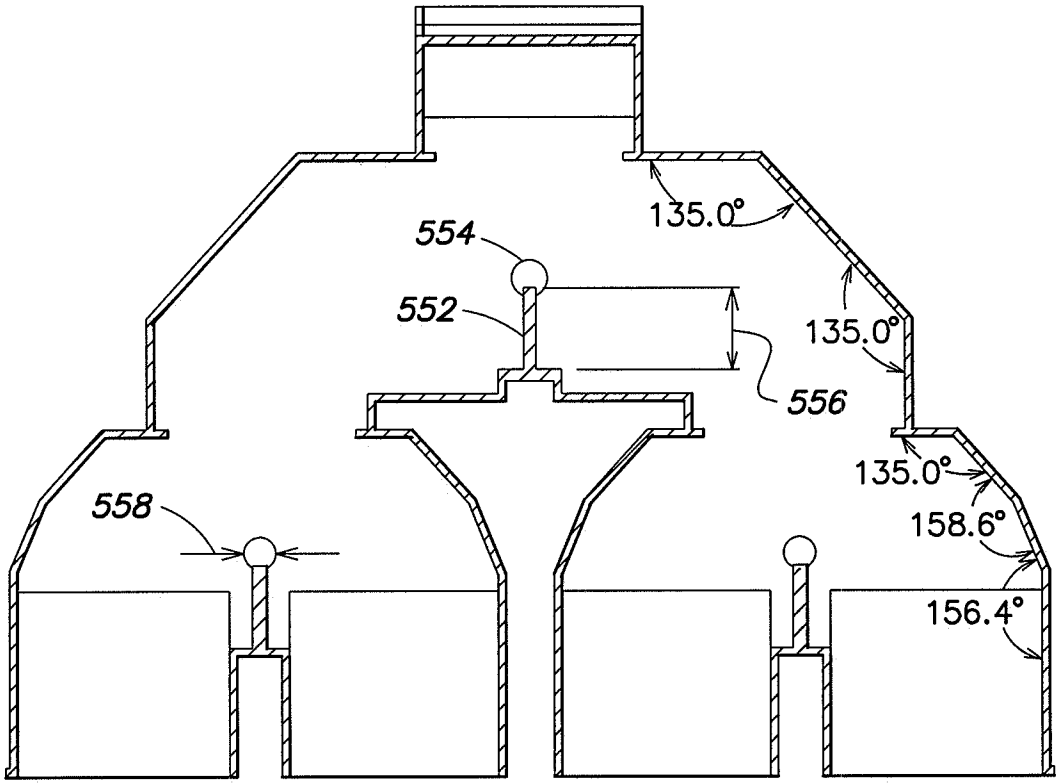
FIG. 55 is a diagram of another example of a portion of a feed network according to aspects of the invention.

According to one embodiment, the waveguide T-junctions include a notch 550 at the cross-point of the T that may serve to decrease phase distortion of the signal as it passes through the T-junction 544. In another embodiment, there is a stepped septum at the center of the H-plane waveguide T-junctions 544. In another embodiment, there is a "V" shaped septum at the center of the E-plane waveguide T-junction 544. For impedance matching, the waveguide short wall dimension on the two inputs to the E-plane T-junction may be approximately ½ the short wall dimension of the output waveguide section. In another example, a short conductive tuning cylinder 552 is provided at the tip of the septum, as illustrated in FIG. 55. The tuning cylinder 552 protrudes into the waveguide, perpendicular to one of the broad walls of the waveguide and, in the illustrated example, terminates in a small "ball" 554. In one example, the tuning cylinder 552 has a length 556 of about 0.214 inches and the "ball" 554 has a diameter 558 of about 0.082 inches. However, it is to be appreciated that these dimensions are exemplary only as the dimensions of all features of the waveguide feed network 302, including those of the tuning cylinder 552 and "ball" 554, may vary depending on the desired operating frequency band of the antenna array 106. Some example angles of curvature of the sections of the waveguide are also illustrated in FIG. 55 and are also exemplary only and not intended to be limiting.

Figure 56:
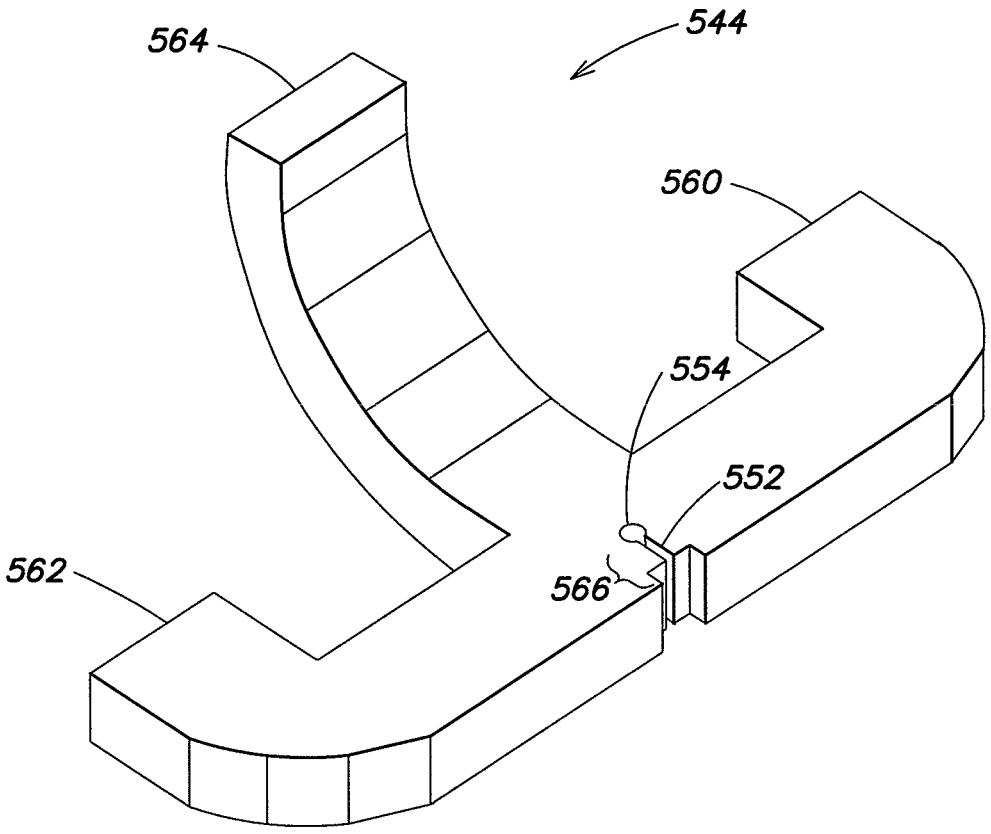
FIG. 56 is a perspective view of one example of a waveguide T-junction according to aspects of the invention.

In one embodiment, the position of the E and H-plane waveguide T-junction septums are located such that they are biased toward either one of the two input ports of the T-junction, so as to create an amplitude balance or imbalance. Referring to FIG. 56, from a summing perspective, the T-junction receives signals at two inputs 560 and 562 and provides a summed signal at output 564. by biasing the T-junction in favor of one input, for example, input 560, the contribution of the signal received at that input 560 may be greater in the summed signal at the output 564 than is the contribution from the signal at the other input 562. This relationship may be give by the following equation:

$$S_{out}=AS_1+BS_2 \quad (2)$$

where $S_1$ and $S_2$ are the signals received at inputs 560 and 562, and A and B are scaling factors determined by the biasing of the T-junction. Biasing of the T-junction 544 may also be achieved using the tuning element 566. If the tuning element 566 is centered in the T-junction 544, as shown in FIG. 56, the scaling factors A and B may be equal, such that the signals at the two inputs 560 and 562 are summed equally. However, by altering the shape and/or location of the tuning element 566, one scaling factor can be made larger than the other, such that the summed output signal $S_{out}$ includes a larger contribution of the signal from the input with the larger scaling factor.

Figure 57:
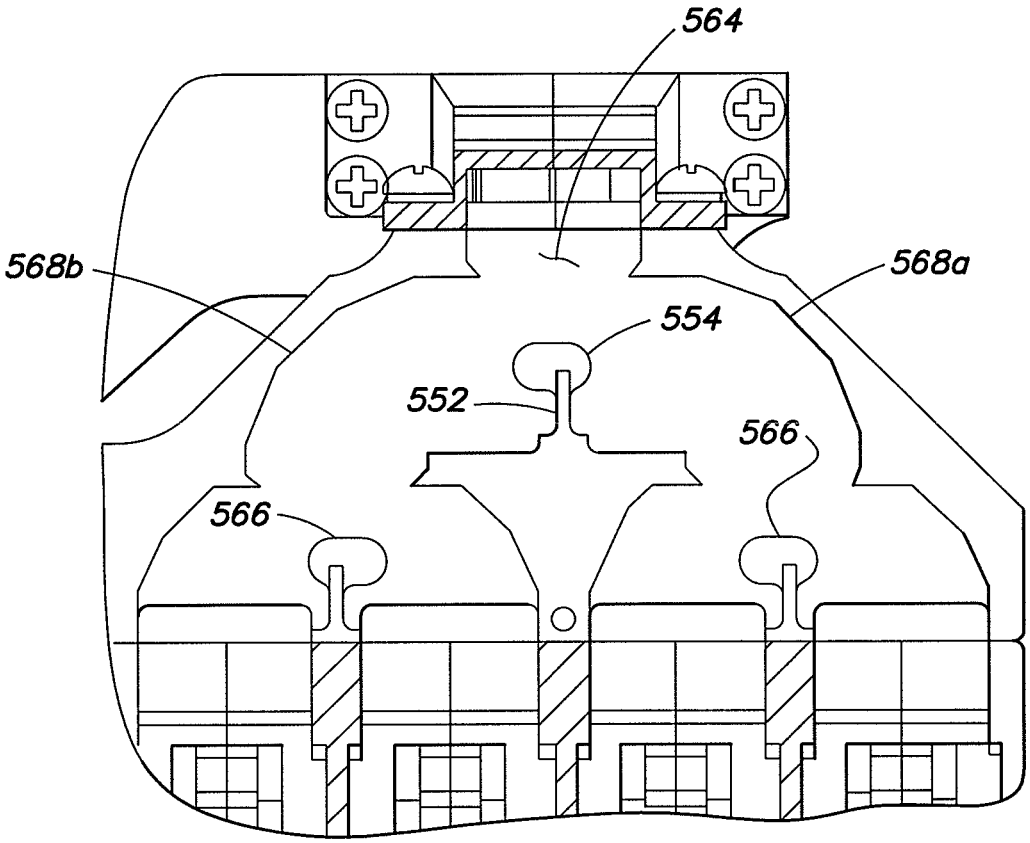
FIG. 57 is a diagram of a portion of another example of a feed network according to aspects of the invention.

For example, referring to FIG. 57, there is illustrated a portion of the feed network 302 showing several T-junctions 544 with biasing tuning elements 566. In the illustrated example, the tuning cylinder 552 is offset to the right of the center of the T-junction, and the "ball" 554 offset from the tuning cylinder 552, such that it has a larger portion to the left side of the tuning cylinder 552 than to the right side. Thus, the scaling factors of the two arms 568*a*, 568*b* of the T-junction 544 are different. By controlling the offset of the tuning cylinder 552 and the shape and offset of the "ball" 554, the contribution of the signal travelling through each arm 568*a*, 568*b* to the summed signal at output 564 can be controlled. In this manner, the contribution of the component signals from each antenna element 308 in the antenna array 106 can be controlled, thereby creating a signal amplitude taper in addition to the physical tapering (i.e., smaller horn antenna elements and associated dielectric lenses) of the array discussed above. This signal amplitude tapering can be controlled to facilitate achieving a desired level of sidelobe suppression, as discussed above. It is to be appreciated that in the transmit mode, when signal flow is reversed, the offset and shape of the tuning elements 566 control the amplitude of the component signals provided to each antenna element 308 in the antenna array 106, and thereby facilitate sidelobe suppression in the transmit beam pattern of the array. Thus, the beam patterns illustrated in FIGS. 33A and 33B, with high sidelobe suppression/reduction, may be achieved by a combination of the size, number and spacing of the antenna elements, the physical tapering of the antenna array, and the design of the feed network 302 to include signal amplitude tapering. An advantage of designing the feed network 302 to contribute to sidelobe suppression includes the fact that further ones of the antenna elements 308 need not be made smaller and therefore, there greater sidelobe suppression may be achieved at a small cost to antenna efficiency.

According to one embodiment, dielectric inserts may be positioned within the feed network 302 at various locations, for example, within the E-plane and/or H-plane T-junctions. The size of the dielectric insert and the dielectric constant of the material used to form the dielectric insert may be selected to improve the RF impedance match and transmission characteristics between the input(s) and output(s) of the waveguide T-junctions. In one example, the dielectric insert may be constructed from Rexolite®. The length and width of the dielectric insert(s) may be selected so that the dielectric insert fits snugly within the waveguide at the desired location. In one example, the dielectric insert may have a plurality of holes formed therein. The holes may serve to lower the effective dielectric constant of the dielectric insert such that a good impedance match may be achieved.

As discussed above, in one embodiment, the feed network 302, in receive mode, sums the vertical and horizontal component signals from each antenna element 308 in the antenna array 106 and provides at the feed port a summed vertically polarized signal and a summed horizontally polarized signal. In one embodiment, the two summed signals are recombined by the system electronics. Alternatively, in another embodiment, the feed network 302 includes a feed orthomode transducer (not shown) at the feed port that combines the two orthogonal summed signals in the same manner discussed above with respect to the OMT 502. In one example, the antenna OMT 502 and feed OMT may be orthogonally fed. Thus, the vertical component signal may receive a first phase delay $\phi_1$ from the antenna OMT 502, a path delay $\phi_p$, and a second phase delay $\phi_2$ from the feed OMT. Similarly, the horizontal component signal may receive a first phase delay $\phi_2$ from the antenna OMT 502, a path delay $\phi_p$, and a second phase delay $\phi_1$ from the feed OMT. Thus, the combination of the two OMTs, orthogonally fed, may cause each of the vertical and horizontal component signals to receive a substantially equal total phase delay, as shown below in equation 3, $$\Phi[(\omega t+\phi_1)+\phi_p+\phi_2]=\Phi[(\omega t+\phi_2)+\phi_p+\phi_1] \quad (3)$$

where $(\omega t+\phi_1)$ and $(\omega t+\phi_2)$ are the vertically and horizontally polarized component signals and which are phase matched at the output port of the feed OMT. It is to be appreciated that although the operation of the OMTs and feed network 302 have been discussed in terms of two orthogonal linearly polarized component signals, the invention is not so limited and the OMTs may alternatively be designed to split an incoming signal into two orthogonal circularly polarized (e.g., left-hand polarized and right-hand polarized) signals (and to recombine these component signals). In this case, the feed network 302 may be designed to guide the two orthogonal circularly polarized signals.

According to another embodiment, the two orthogonally polarized summed component signals from the feed network (V and H) are fed to a first feed OMT having a circular dual mode port. A circular rotary waveguide section may be connected to the circular dual mode port of the first feed OMT. A second feed OMT, also having a circular dual mode port, may be connected to the circular rotary waveguide, such that the second feed OMT may rotate on the axis of the circular dual mode port. Thus, in at least one example, the phase lengths of the V signal and the H signal from the feed network 302 through the circular dual mode port of the first feed OMT are effectively equal. Rotating the second feed OMT effectively creates two linear, orthogonally polarized signals for any slant angle at the output of the second feed OMT. In one example, the feed OMTs and circular rotary waveguide may be located off the antenna array. In this example, a flexible waveguide may be used to connect the final T-junction of the feed network 302 to the first feed OMT so as to accommodate movement of the antenna array.

According to one embodiment, the feed network 302 may be manufactured in component pieces that are then mechanically coupled together. As discussed above, the feed network 302 may comprise a plurality of symmetrical sections, forming a "tree-like" structure to couple each of the antenna elements 308 in the antenna array 106 to a single feed point. Thus, the structure of the feed network 302 may be conducive to separation into elements that can be individually manufactured and then coupled together. In one example, the feed network 302 is manufactured by casting metal into the required sections and then brazing the metal to finish it. The casting and brazing steps may be performed on sections of the feed network at a time, for example, sections that include four antenna elements. These finished pieces may then be coupled together to create the entire feed network 302. In another example, the antenna array, including the feed network 302 and the horn antenna elements 308, is arranged such that it is symmetrical along a center line taken along its length. Accordingly, in this example, the antenna array can be divided along this center line into two symmetrical sections, each of which can individually manufactured (e.g., by casting and brazing) and then coupled together. Dividing the antenna array 106 "longitudinally" may greatly shorten the manufacturing time, even though each of the two sections may be significantly more complex than the smaller four-element or similar sections that arise when the array is split as discussed above.

Satellite (or other communication) signals may be transmitted on two orthogonal wave fronts. This allows the satellite (or other information source) to transmit more information on the same frequencies and rely on polarization diversity to keep the signals from interfering. If the antenna array 106 is directly underneath or on a same meridian as the transmit antenna on the satellite (or other signal source 110), the receive antenna array and the transmit source antenna polarizations may be aligned. However, as discussed above, in some instances there may be a polarization skew between the antenna array 106 and the signal source 110 caused by the relative positions of the signal source 110 and the host platform of the antenna array 106. For example, for applications in which the antenna array 106 is mounted on an aircraft 132, the pitch, roll, yaw and spatial location (e.g., meridian or longitude) of the aircraft may result in a polarization skew f3 between the signal source 110 and the antenna array 106. Accordingly, in one embodiment, the external sub-system 102 includes a polarization converter unit 128 that is adapted to compensate for polarization skew between the information source and the antenna array. The polarization converter unit 128 may use electronic and/or mechanical mechanisms to perform the polarization compensation, as discussed further below. The PCU 128 may receive control signals via the gimbal assembly 108.

According to one embodiment, in a receive mode of the communication system, the antenna array 106 may be adapted to receive incident radiation from the information signal source 110 and may convert the received incident electromagnetic radiation into two orthogonal electromagnetic wave components using the OMT and feed network 302 discussed above. From these two orthogonal electromagnetic wave components, the PCU 128 may reproduce transmitted information from the source whether the polarization of the signals is vertical, horizontal, right hand circular (RHC), left hand circular (LHC), or slant polarization from 0° to 360°. A part of, or the complete, PCU 128 may be part of, or may include, or may be attached to the feed network 302 of the antenna array 106. The PCU 128 may receive the signals from the feed network 302 and provide a set of either linearly (vertical and horizontal) polarized or circularly (right-hand and left-hand) polarized signals. Thus, the antenna array 106 and the PCU 128 provide an RF interface for the external subsystem 102, and may provide at least some of the gain and phase-matching for the system. In one embodiment, the PCU 128 may reduce or eliminate the need for phase-matching for the other RF electronics of the system.

Figure 58:
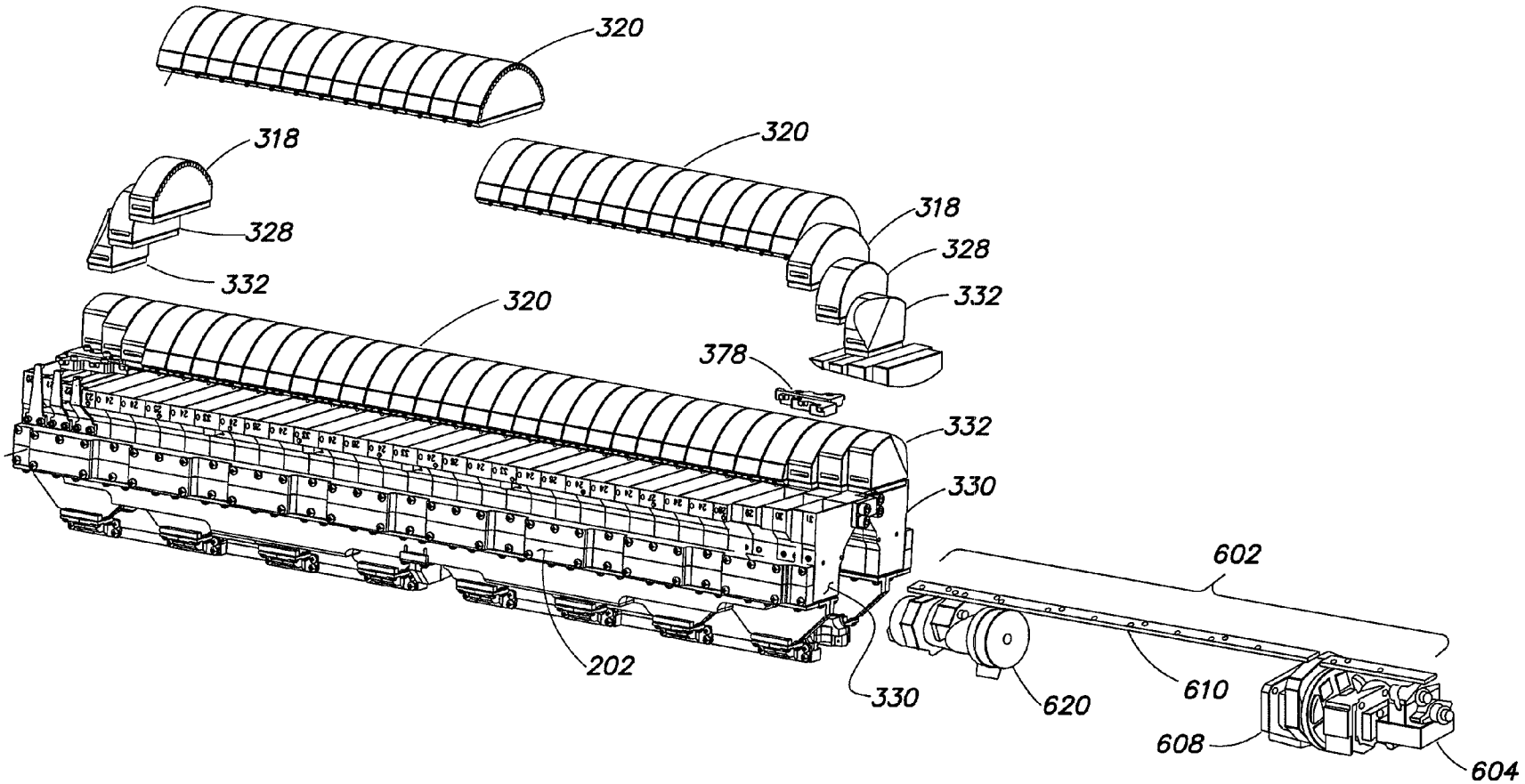
FIG. 58 is partial exploded view of one example of an antenna array including a polarization converter unit according to aspects of the invention.

Referring to FIG. 58, there is illustrated one example of the antenna array 106 including a polarization converter unit (PCU) 602 coupled thereto. As discussed above, in the illustrated example, the antenna array 106 is arranged such that PCU 602 fits "inside" the array. This arrangement may be advantageous in terms of maintaining a relatively small footprint and volume of the external sub-system 102; however, it is to be appreciated that the invention is not limited to the arrangement illustrated in FIG. 58, and the PCU 602 may be located in any suitable location on the external sub-system 102. In addition, in other embodiments, polarization skew compensation may be done purely electronically. Accordingly, the internal sub-system 104 may include electronics (circuitry and/or software) adapted to compensate for polarization skew f3 between the antenna array 106 and the signal source 110, and optionally also for any polarization skew between the vertical and horizontal component signals. In one example, the polarization converter unit 602, or other signal processing electronics, may be adapted to accommodate either or both of linearly polarized signals and circularly polarized signals.

According to one embodiment, the PCU 602 may provide the polarization-corrected signal to a low noise amplifier 604 which amplifies the signal and feeds it to the internal sub-system 104. As discussed above, the bulk of the signal processing and control electronics of the communications system may be included in the internal sub-system 104 and housed within the host platform so as to protect it from environmental conditions. However, as known to those skilled in the art, in many applications it is desirable to have the low noise amplifier 604 as close to the antenna feed as possible for signal-to-noise considerations. Accordingly, in one embodiment, the low noise amplifier 604 is part of the external sub-system 102. In the example illustrated in the FIG. 58, the low noise amplifier is mounted to the PCU 602 such that it may receive the polarization-corrected signal from the PCU 602 directly, or over a very short path. The amplified signal from the low noise amplifier 604 may then be fed to the internal sub-system 104, as discussed further below.

Figure 59:
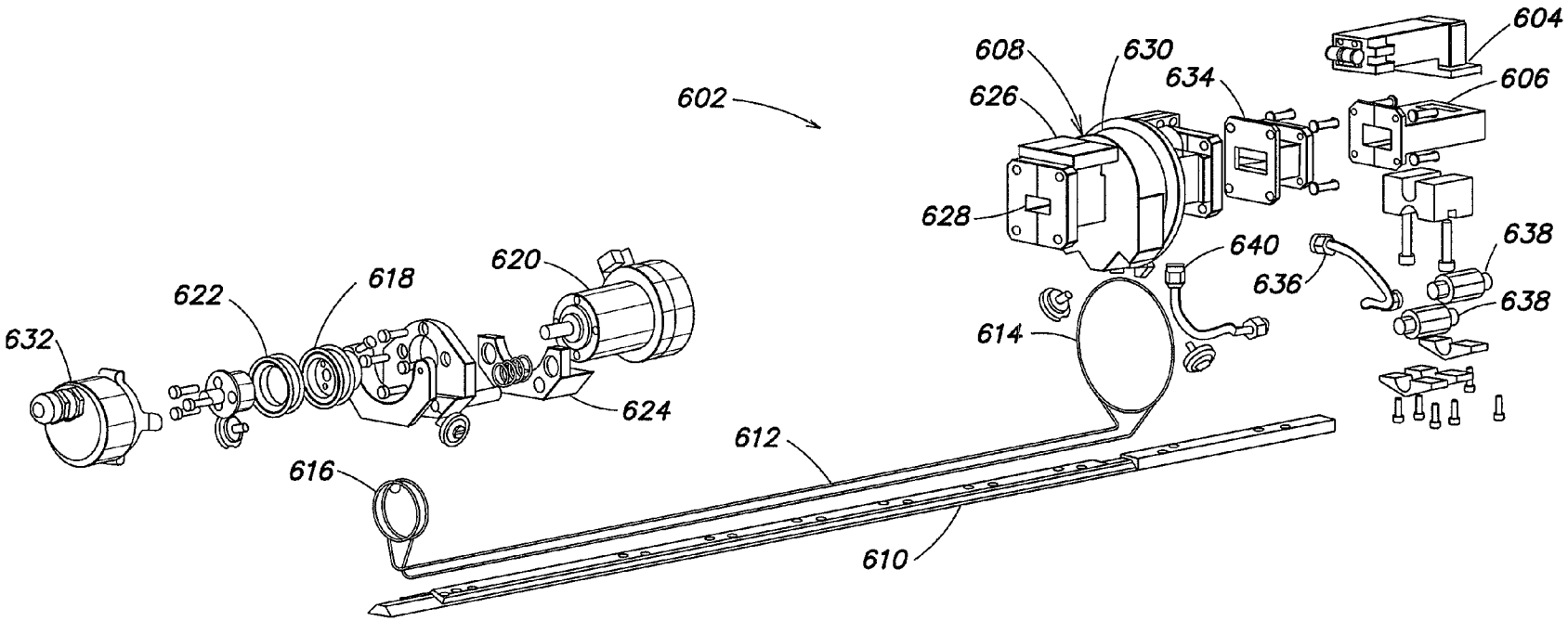
FIG. 59 is a partial exploded view of one example of a polarization converter unit according to aspects of the invention.

Referring to FIG. 59, there is illustrated an exploded view of one example of a polarization converter unit (PCU) 602. As discussed above, the low noise amplifier (LNA) 604 may be mounted to the PCU 602. Accordingly, the PCU 602 may include a mount 606 for the low noise amplifier 604. In the illustrated example, the LNA 604 is a waveguide-based LNA, and the LNA mount 606 is a waveguide section that receives the polarization-corrected signal from the PCU 602 and feeds it to the waveguide-based LNA.

According to one embodiment, the PCU 602 includes a rotary orthomode transducer (OMT) 608 that is responsible for the polarization skew correction, as discussed further below. The rotary OMT 608 is mounted to a spine 610 along which runs a cable 612 for the PCU drive. On end 614 of the cable 612 is coupled to the rotary OMT 608, and the other end 616 is coupled to a master pulley 618. A motor 620 supplies the power to drive the master pulley 618 and pulley 622 to rotate the rotary OMT 608 using the cable 612. The motor 620 may be supported by a motor mount 624. In one embodiment, the two summed component signals, vertical and horizontal, from the feed point of the antenna array 106 are fed to first and second waveguide ports 626, 628 of the rotary OMT 608. The two waveguide ports 626, 628 are coupled to rotatable section 630 of the rotary OMT 608. The rotatable section 630 rotates the received electromagnetic fields to compensate for polarization skew β between the signal source 110 and the antenna array 106. A polarization encoder 632 may be used to determine a degree of rotation of the rotary OMT 608, corresponding to a desired polarization correction factor. In one example, the PCU 602 receives control signals from the antenna control unit 112 (see FIG. 1) that determine the required degree of rotation needed to correct for a measured/detected polarization skew. The resultant, polarization-corrected signal is fed via a waveguide section 634 to the low noise amplifier 604. In one example, the PCU 602 is rotatable up to approximately 270 degrees in either direction (clockwise or anti-clockwise).

As discussed above and in more detail below, in one example, polarization skew compensation can be performed electronically. However, compensating for polarization skew β mechanically, using an embodiment of the PCU 602 discussed above, may have several advantages. For example, mechanical polarization skew compensation does not suffer from efficiency losses associated with converting an RF signal into an electronic signal (to be processed to compensate for the polarization skew) and back into an RF signal. In addition, the mechanical PCU 602 may be capable of handling very high power signals, particularly useful for compensating for polarization skew when the antenna array 106 is transmitting, whereas the electronics that may perform electronic polarization skew may require that the signals be relatively low power.

Figure 60:
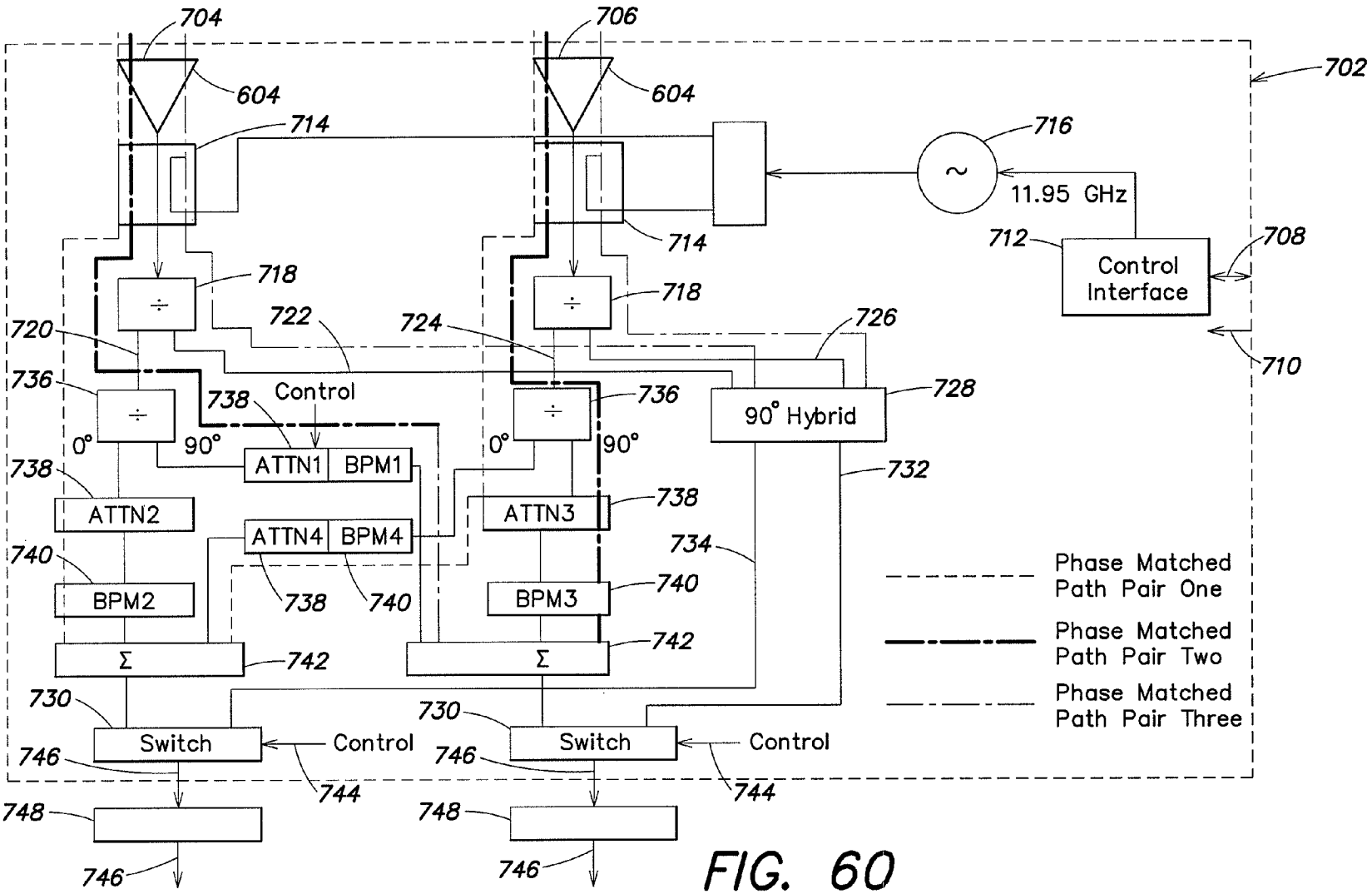
FIG. 60 is a functional block diagram of another example of a polarization converter unit according to aspects of the invention'

Referring to FIG. 60, there is illustrated a functional block diagram of another example of a polarization converter unit 702 which is configured to electronically compensate for polarization skew, and optionally also phase matching between the two orthogonal signals received from the feed network. The PCU 702 may receive first and second orthogonal component signals, from the feed network 302 on lines 704 and 706 and may convert these guided waves into linearly polarized (vertical and horizontal) or circularly polarized (left hand or right hand) signals that represent a transmitted waveform from the signal source 110. In one example, the first and second component signals may be in frequency ranges of approximately 10.7 GHz-12.75 GHz and 14.0 GHz-14.5 GHz. According to one example, the PCU 702 is adapted to compensate for any polarization skew β between the information signal source 110 and the antenna array 106. The PCU 702 may be controlled by the gimbal assembly 108, and may receive control signals on lines 708 via a control interface 712, from the gimbal assembly 108 that enable it to correctly compensate for the polarization skew. The PCU 702 may also receive power from the gimbal assembly 108 via line(s) 710.

In one embodiment, the first and second component signals on lines 704 and 706 may be amplified by low noise amplifiers 604 that may be coupled to the ports of the feed network 302 by a waveguide feed connection. The low noise amplifiers are coupled to directional couplers 714 via, for example, semi-rigid cables. The coupled port of the directional couplers 714 is connected to a local oscillator 716. The local oscillator 716 may be controlled, through the control interface 712, by the gimbal assembly 108. In one example, the local oscillator 716 may have a center operating frequency of approximately 11.95 GHz.

As shown in FIG. 60, the through port of the directional couplers 714 are coupled to power dividers 718 that divide the respective component signals in half (by energy), thereby providing four PCU signals. For clarity, the PCU signals will be referred to as follows: the first component signal (which is, for example, horizontally polarized) is considered to have been split to provide a first PCU signal on line 720 and a second PCU signal on line 722; the second component signal (which is, for example, vertically polarized) is considered to have been split to provide a third PCU signal on line 724 and a fourth PCU signal on line 726. Thus, half of each component signal (vertical and horizontal) is sent to circular polarization electronics and the other half is sent to linear polarization electronics.

Considering the path for circular polarization, lines 722 and 726 provide the second and fourth PCU signals to a 90° hybrid coupler 728. The 90° hybrid coupler 728 thus receives a vertically polarized signal (the fourth PCU signal) and a horizontally polarized signal (the second PCU signal) and combines them, with a phase difference of 90°, to create right and left hand circularly polarized resultant signals. The right and left hand circularly polarized resultant signals are coupled to switches 730 via lines 732 and 734, respectively. The PCU therefore can provide right and/or left hand circularly polarized signals from the vertically and horizontally polarized signals received from the antenna array 106.

Still referring to FIG. 60, from the dividers 718, the first and third PCU signals are provided on lines 720 and 724 to second dividers 736 which divide each of the first and third PCU signals in half again, thus creating four signal paths. The four signal paths are identical and will thus be described once. The divided signal is sent from the second divider 736 to an attenuator 738 and then to a bi-phase modulator (BPM) 740. For linear polarization, the polarization slant, or skew angle, may be set by the amount of attenuation that is set in each path. Zero and 180 degree phase settings may be used to generate the tilt direction, i.e., slant right or slant left. The amount of attenuation is used to determine the amount of orthogonal polarization that is present in the output signal. The attenuator values may be established as a function of polarization skew β according to the equation 5:

$$A=10*\log((\tan(\beta))^2$$

The value of the polarization skew β may be provided via the control interface 712. For example, if the input polarizations are vertical and horizontal (from the antenna array) and a vertical output polarization (from the PCU) is desired, no attenuation may be applied to the vertical path and a maximum attenuation, e.g., 30 dB, may be applied to the horizontal path. The orthogonal output port may have the inverse attenuations applied to generate a horizontal output signal. To generate a slant polarization of 45 degrees, no attenuation may be applied to either path and a 180 degree phase shift may be applied to one of the inputs to create the orthogonal 45 degree output. Varying slant polarizations may be generated by adjusting the attenuation values applied to the two paths and combining the signals. The BPM 740 may be used to offset any phase changes in the signals that may occur as a result of the attenuation. The BPM 740 is also used to change the phase of orthogonal signals so that the signals add in phase. The summers 742 are used to recombine the signals that were divided by second dividers 736 to provide two linearly polarized resultant signals that are coupled to the switches 730.

In one embodiment, the switches 730 are controlled, via lines 744, by the control interface 712 to select between the linearly or circularly polarized pairs of resultant signals. Thus, the PCU 702 may provide at its outputs, on lines 746, a pair of either linearly (with any desired slant angle) or circularly polarized PCU output signals. According to one example, the PCU 702 may include, or be coupled to, equalizers 748. The equalizers 748 may serve to compensate for variations in cable loss as a function of frequency—i.e., the RF loss associated with many cables may vary with frequency and thus the equalizer may be used to reduce such variations resulting in a more uniform signal strength over the operating frequency range of the system.

The PCU 702 may also provide phase-matching between the vertically and horizontally polarized or left and right hand circularly polarized component signals. The purpose of the phase matching is to optimize the received signal. The phase matching increases the amplitude of received signal since the signals received from both antennas are summed in phase. The phase matching also reduces the effect of unwanted cross-polarized transmitted signals on the desired signal by causing greater cross-polarization rejection. Thus, the PCU 702 may provide output component signals on lines 746 that are phase-matched. The phase-matching may be done during a calibration process by setting phase sits with a least significant bit (LSB) of, for example, 2.8°. Thus, the PCU 702 may act as a phase correction device to reduce or eliminate any phase mismatch between the two component signals.

According to one embodiment, the PCU 702 may provide all of the gain and phase matching required for the system, thus eliminating the need for expensive and inaccurate phase and amplitude calibration during system installation. According to one example, the PCU 128 may operate for signals in the frequency ranges of approximately 10.7 GHz to approximately 12.75 GHz and 14.0 GHz to 14.5 GHz, for receive and transmit. In one example, the PCU 128 may provide a noise figure of 0.7 dB to 0.8 dB over these frequency ranges, which may be significantly lower than many commercial receivers. The noise figure is achieved through careful selection of components, and by impedance matching all or most of the components, over the operating frequency band. Thus, polarization skew compensation, and optionally also phase balancing/matching, may be performed by the PCU 128, either mechanically using an embodiment of the PCU 602 discussed above or electronically using an embodiment of the PCU 702. A combination of electronic and mechanically polarization compensation can also be implemented.

Referring again to FIG. 59, in one embodiment using the PCU 602, for receive operation of the antenna array 106, the output of the rotary OMT 608 is coupled to the low noise amplifier 604. The amplified signal from the low noise amplifier 604 may be fed via cable 636 to a rotary joint 638 that couples the external sub-system 102 to the internal sub-system 104. For transmit operation of the antenna array 106, a signal to be transmitted by the antenna array may be fed via another rotary joint 638 and cable 640 directly to the rotary OMT 608. In one example, the rotary joints 638 are single channel rotary joints. The rotary joints 638 may be coupled to RF coaxial cables and/or flexible waveguide on the internal sub-system 104 side. The rotary joints 638 may accommodate rotation of the antenna array 106 in azimuth.

Figure 61:
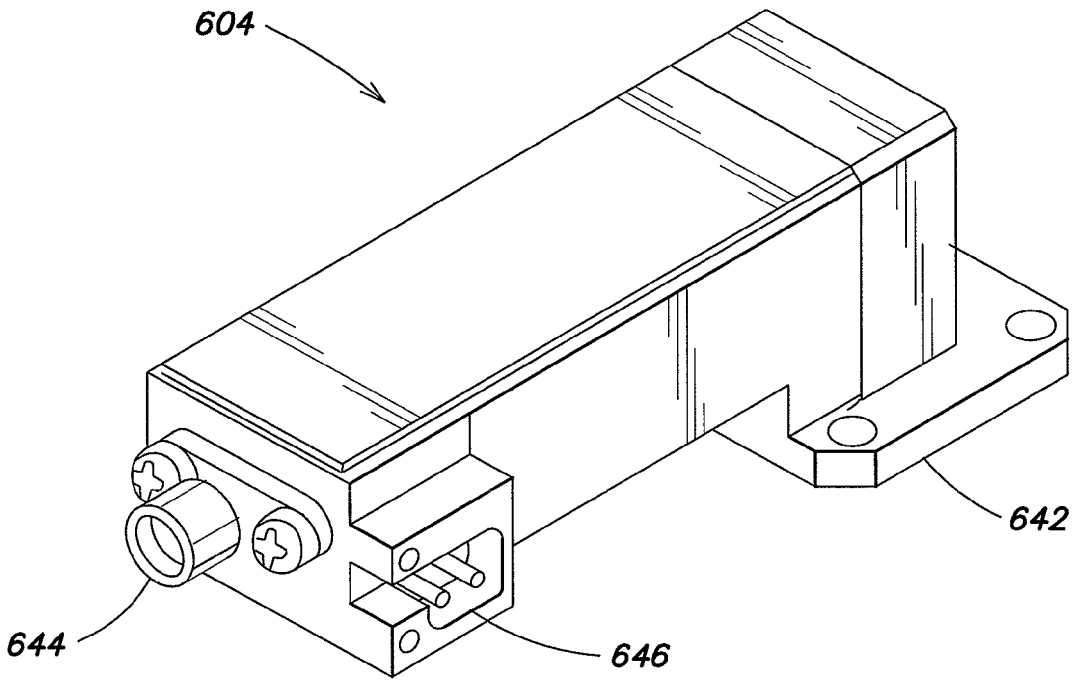
FIG. 61 is a perspective view of one example of a low noise amplifier according to aspects of the invention.

Referring to FIG. 61, there is illustrated an example of a low noise amplifier 604. The low noise amplifier 604 includes a waveguide port 642 that may be coupled to the rotary OMT 608. An output port 644 may be coupled to the cable 636 to take the amplified signal to the internal sub-system 104, as discussed above. In one example, the output port 644 is a coaxial port designed to mate with a coaxial cable. Power may be supplied to the low noise amplifier 604 (e.g., via the internal sub-system 104) through a power connector 646.

Referring again to FIG. 1, in receive mode, the signal received and processed (e.g., passed through the waveguide feed network 302, adjusted by the PCU 602 to compensate for polarization skew β, and amplified by the low noise amplifier 604) by the external sub-system 102 is fed to the internal sub-system 104. The following discussion of the operation of the internal sub-system 104 may refer primarily to the antenna array 106 receiving a signal from the signal source 110; however, those skilled in the art will recognize that any component may operate for reverse signal flow when the antenna array 106 is transmitting a signal.

Figure 62:
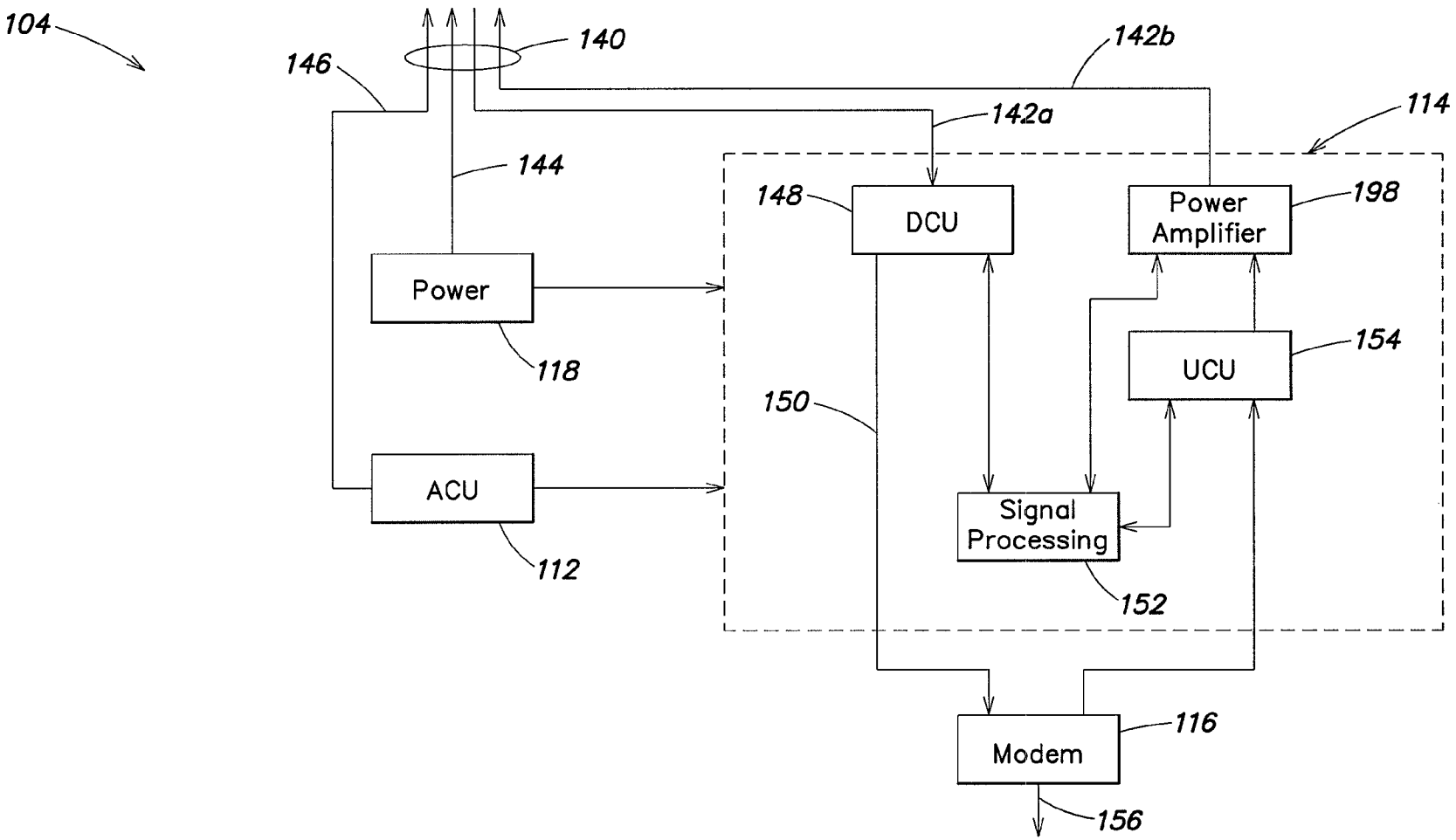
FIG. 62 is a functional block diagram of one example of an internal sub-system according to aspects of the invention.

Referring to FIG. 62, there is illustrated a block diagram of one example of an internal sub-system 104. As discussed above, the internal sub-system may include an antenna control unit 112 that provides control signals to some or all of the components of the internal and external sub-systems 104, 102, respectively. A high power transceiver 114 may receive the amplified signal from the low noise amplifier 604; that signal being referred to herein as the "received signal," and process the received signal as discussed further below. The high power transceiver may also receive a signal to be transmitted by the antenna array 106 from the modem 116, process that signal, and output a "transmit signal." The received signal and the transmit signal pass between the internal sub-system 104 and the external sub-system 102 via a connector 140. It is to be appreciated that the connector 140 may include the rotary joint(s) 446 as well as any intervening cables and other components between the rotary joint(s) 446 and the internal sub-system electronics. As illustrated in FIG. 62, in addition to the received and transmit signals on lines 142*a* and 142*b*, respectively, the connector 140 may also pass power (on line 144) from the power supply 118 and control signals (on line 146) from the antenna control unit 112 to components of the external sub-system 102.

According to one embodiment, the internal sub-system 104 comprises a down-converter unit (DCU) 148 that may receive input signals, e.g. the linearly or circularly polarized signals via the connector 140 and may provide output signals, e.g. linearly or circularly polarized signals, on lines 150, at a lower frequency than the frequency of the input signals received. The DCU 148 will be described in more detail below. The signals on line 150 may be processed by signal processing electronics 152. Similarly, in the transmit path, the internal sub-system 104 may include an up-converter unit 154. The transmit signal may be received by the internal sub-system 104 via connector 156 from a signal source, such as, for example, a passenger or user interface, processed by the signal processing electronics 152 and up-converted to the transmit frequency by the up-converter unit 154. As will be recognized by those skilled in the art, the up-converter unit 154 may operate in a similar manner to the down-converter unit 148, for example, by mixing the transmit signal with a local oscillator signal to change the frequency of the data signal, as discussed further below.

As discussed above, signals may be transmitted and/or received by the antenna array 106 over a wide range of frequencies extending up to several Gigahertz. For example, the vertical and horizontal component signals may be in frequency ranges of approximately 10.7 GHz-12.75 GHz or 14.0 GHz-14.5 GHz. Therefore, in some applications, particularly where the antenna array 106 may be receiving and/or transmitting at very high frequencies, it may be preferable to perform the down-conversion or up-conversion using two local oscillators. Accordingly, in at least one embodiment, the internal sub-system 104 may optionally include a second local oscillator to converts the signal of interest to a frequency useable by the modem 116. It is to be appreciated that the signal processing may occur before any down or up conversion, in between different down/up conversion stages, or after all down/up conversion has been performed. In receive mode, the down-converted and processed signals may be supplied via modem 116 and connector 156 to the passenger interfaces (e.g., seatback displays) for access by passengers associated with the host vehicle. Similarly, in transmit mode, the signals to be processed, up-converted and transmitted may be received from the passenger interface(s) via connector 156.

Figure 63:
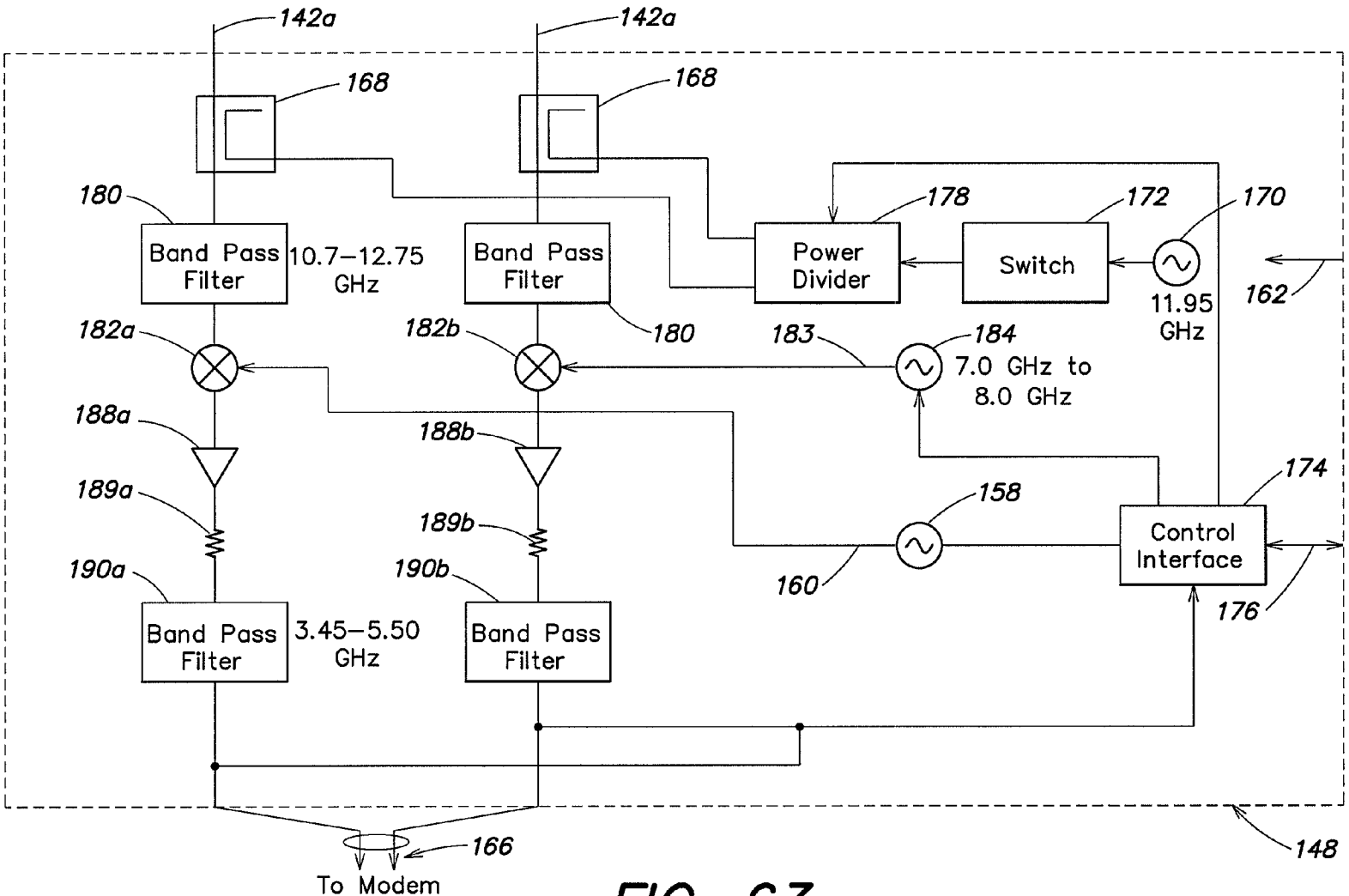
FIG. 63 is a functional block diagram of one example of a down-converter unit according to aspects of the invention.

Referring to FIG. 63, there is illustrated a functional block diagram of one embodiment of a down-converter unit (DCU) 148. It is to be appreciated that FIG. 63 is only intended to represent the functional implementation of the DCU 148, and not necessarily the physical implementation. Furthermore, the up-converter unit 154 and down-converter unit 148 may be implemented with a similar structure, as would be appreciated by those skilled in the art. In one example, the DCU 148 is constructed to take an RF signal, for example, in a frequency range of 10.7 GHz to 12.75 GHz and down-convert the 10.7 GHz to 11.7 GHz portion of the band to an intermediate frequency (IF) signal, for example, in a frequency range of 0.95 GHz to 1.95 GHz. A second local oscillator 158 is used to convert the 11.7 GHz to 12.75 GHz portion of the band to an IF of 1.1 GHz to 2.15 GHz.

Still referring to FIG. 63, according to one embodiment, the DCU 148 receives power from the power supply 118 (see FIG. 1) via line 162. According to one embodiment, DCU 148 receives an RF signal on line(s) 142*a* and may provide output IF signals on line(s) 166. As discussed above, the RF signal may supplied from the external sub-system 102 (e.g., from the low noise amplifier 604) via connector 140. In one example, directional couplers 168 are used to inject a built-in-test signal from local oscillator 170. A switch 172 that may be controlled, via a control interface 174, by the antenna control unit 112 (which provides control signals on line(s) 176 to the control interface 174) is used to control when the built-in-test signal is injected. A power divider 178 may be used to split a single signal from the local oscillator 170 and provide it to both paths. The through ports of the directional couplers 168 may be coupled to bandpass filters 180 that may be used to filter the received signals to remove any unwanted signal harmonics. As discussed above, the received signal may be split into two bands that are down-converted using the two local oscillators; therefore, as shown in FIG. 48, the DCU 148 may include two bandpass filters 180 to split the received signal into the two bands. The filtered signals may then be fed to mixers 182*a*, 182*b*. The mixer 182*a* may mix the signal with a local oscillator tone received on line 183 from local oscillator 184 to down-convert the first portion of the band to IF frequencies. Similarly, the second mixer 182*b* may mix the signal with a local oscillator tone received on line 160 from the second local oscillator 158 to down-convert the second portion of the band to IF frequencies. In one example, the second local oscillator 184 may be able to tune in frequency from 7 GHz to 8 GHz, thus allowing a wide range of operating and IF frequencies. Amplifiers 188 and/or attenuators 189 may be used to balance the IF signals. Filters 190 may be used to minimize undesired mixer products that may be present in the IF signals before the IF signals are provided on output lines 166.

Thus, the internal sub-system 104 may receive data, communication or other signals to be transmitted by the antenna array 106 from, for example, passenger interfaces within the host vehicle, may process these signals, and provide the transmit signal via connector 140 to the external subs-system 102. In the external sub-system 102, the polarization converter unit 602 may compensate for polarization skew 13 between the antenna array 106 and the desired destination of the transmit signal. The feed network 302 of the antenna array 106 may split the transmit signal into two orthogonally polarized component signals that are each split among all antenna elements 308 in the antenna array 106. Each antenna element 308 may include an OMT 502 that recombines the two orthogonal component signals into a signal that is transmitted by the antenna element 308. Similarly, the antenna array 106 may receive an information signal from a signal source via each antenna element 308 in the array. The feed network 302 may split the signal received at each antenna element 308 into two orthogonal component signals and sum the component signals, in each polarization, from all antenna elements to produce two orthogonal summed signals. These summed signals may be corrected for polarization skew 13 between the signal source 110 and the antenna array 106 and recombined into a received signal that is amplified by a low noise amplifier and passed, via connector 140 to the internal sub-system 104. In the internal sub-system 104, the received signal may be processed (e.g., down-converted) and supplied via connector 156 to passenger interfaces in the host vehicle.

Figure 64:
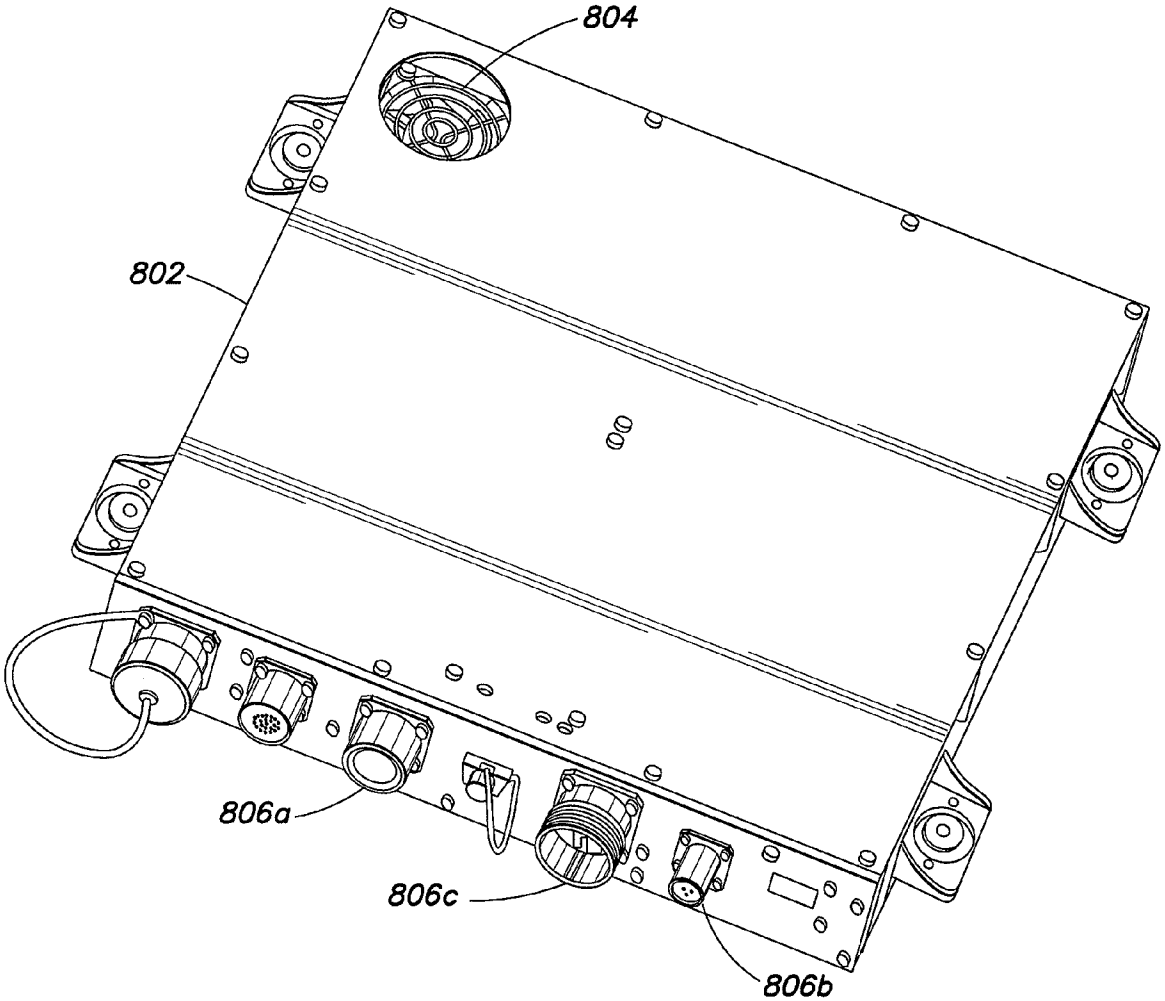
FIG. 64 is a perspective view of one example of a housing for the internal sub-system according to aspects of the invention.

According to one embodiment, the internal sub-system is contained within a housing that is mounted in the interior of the host vehicle. An example of such a housing 802 is illustrated in FIG. 64. As discussed above, in some applications, particularly where the communication system is used on an aircraft, the exterior of the vehicle may be subjected to wide variations in temperature, pressure and humidity. Subjecting electronic components to such varying conditions may significantly shorten the life of the electronic components. By placing the electronic components within the vehicle, the components are protected from the potentially harsh environment outside of the vehicle. In addition, it may be easier to implement more effective thermal control of the components. Furthermore, locating the electronics inside the vehicle may allow easy access to the electronics for maintenance, repair and replacement. In one embodiment, the mounting bracket 214 may allow for ease of installation and removal of the external sub-system 102. The connector 140, which may include a rotary joint 446 as discussed above, may penetrate the surface of the host vehicle to allow cables to travel between the external sub-system 102 and the interior of the host vehicle. Thus, signals such as the information, control and power signals, may be provided to and from the external sub-system 102 and the internal sub-system 104.

Referring to FIG. 64, in one example, the housing 802 is a small, thin box that may be designed to fit between the airframe and insulation of the aircraft. The housing 802 may include a fan 804 to cool the electronic components inside the housing. To facilitate thermal control of the electronics, airflow may be directed over the housing 802 to cool the housing and electronics therein. The housing may include connectors 806*a* and 806*b* to receive power from the host vehicle's power supply, and connector 806*c* (e.g., an Ethernet connector) to receive communications signals, for example, from passenger interfaces in the host vehicle.

Figure 65:
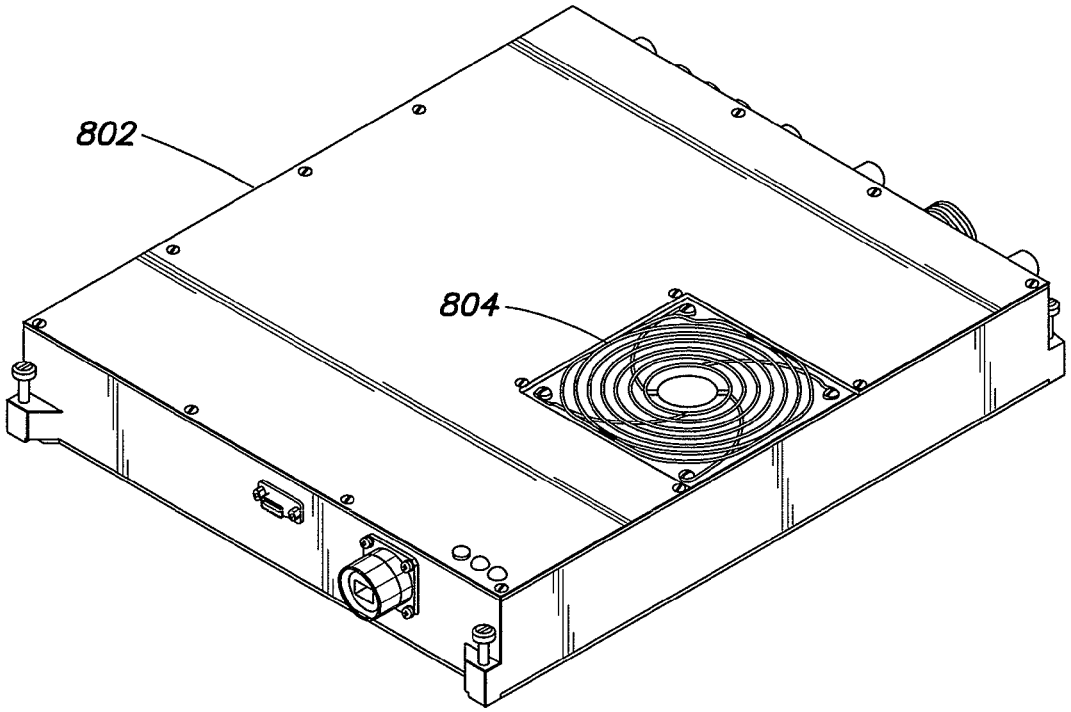
FIG. 65 is a perspective view of another example of a housing for the high power transceiver and other components of the internal sub-system according to aspects of the invention.
Figure 66:
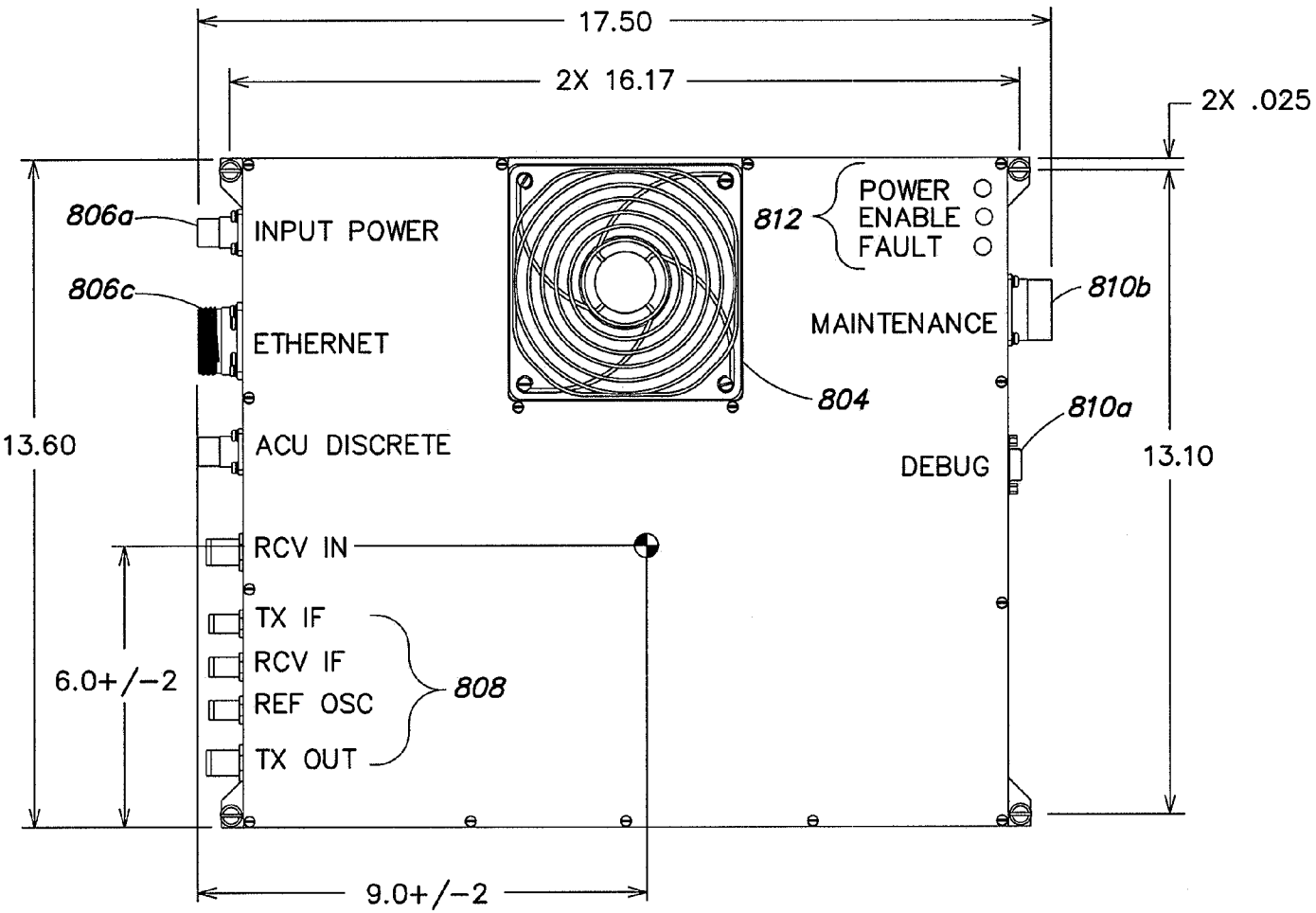
FIG. 66 is a plan view of the housing of FIG. 65.
Figure 67B:
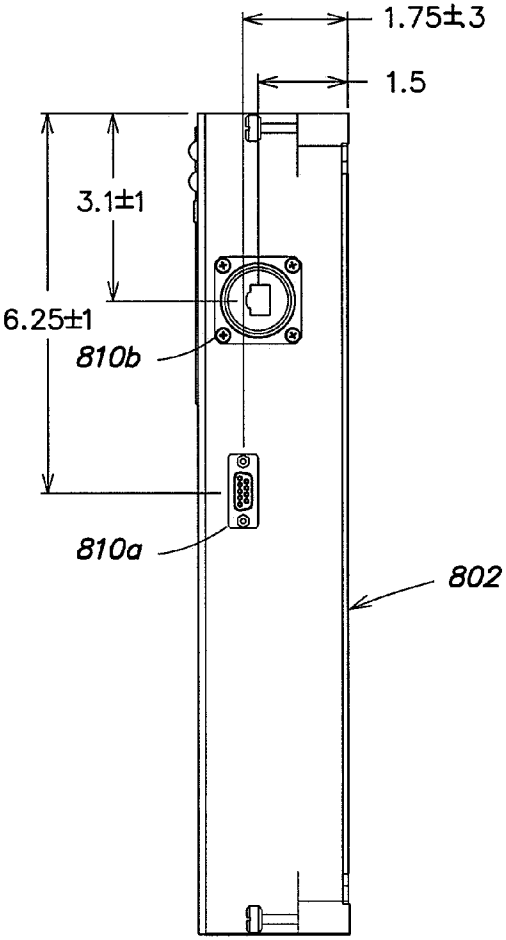
FIG. 67B is an end view of another side of the housing of FIG. 65.
Figure 67A:
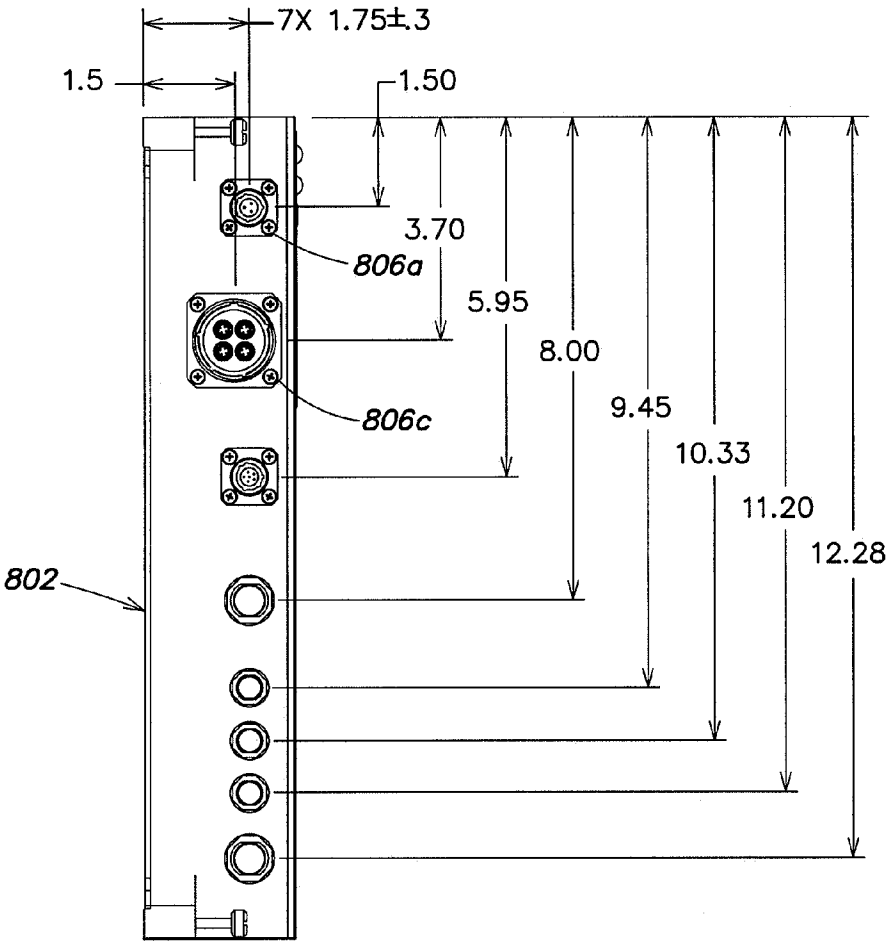
FIG. 67A is an end view of one side of the housing of FIG. 65.

Referring to FIG. 65, there is illustrated another example of the housing 802. FIG. 66 illustrates a plan view of the top of the housing 802 of FIG. 65. Additional connectors 808 may be supplied to receive signals from the external sub-system 102 and to provide signals to the external sub-system. In addition, in one example, connectors 810*a*, 810*b* are provided for maintenance/debug functionality. Example dimensions, in inches, for aspects of the housing 802 are provided in FIG. 66. FIGS. 67A and 67B are side views of the housing 802 of FIG. 65 and illustrate additional example dimensions. However, it is to be appreciated that these dimensions are examples only and that the housing 802 may be differently sized depending on, for example, the size and/or number of components to be housed and the location in which the housing is to be installed.

Figure 68:
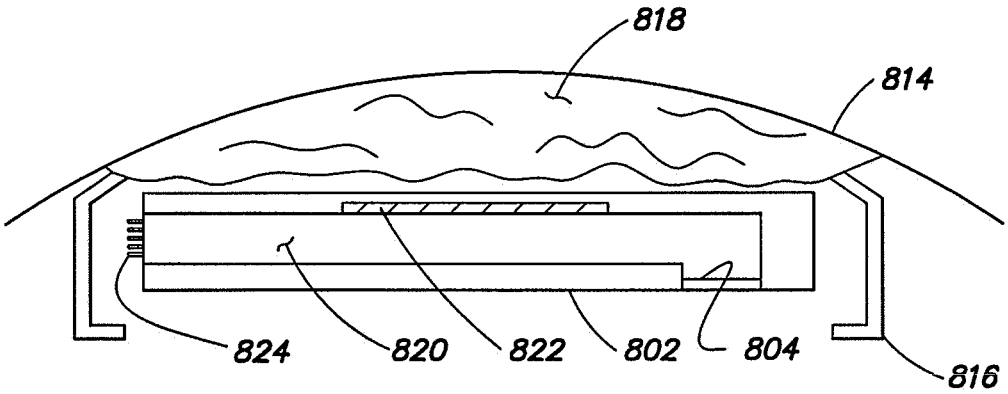
FIG. 68 is a diagram of a portion of the interior of aircraft illustrating an example of a mounting location of another example of a housing for the high power transceiver and other components of the internal sub-system according to aspects of the invention.

Referring to FIG. 68, there is illustrated a simplified cutaway portion of an aircraft fuselage, showing installation of an example of the housing 802 underneath the aircraft skin 814. The interior of the aircraft, below the skin 814 of the airframe, includes channels 816. Insulation 818 is also provided under the skin 814. In one example, the housing 802 is installed in a channel 816, adjacent the insulation 818. According to one embodiment, the housing includes a metal plenum chamber 820. Cooling air is drawn from the aircraft 132 into the plenum chamber by the fan 804. A circuit card 822 which includes electronics for the high power transceiver 114, and optionally other internal sub-system components, is located outside the plenum chamber 820, inside the housing 802, for example, mounted to an outside surface of the plenum chamber. Thus, cooling of the circuit card 822 may be achieved by drawing cooling air into the plenum chamber and cooling the circuit card by conduction through the metal plenum chamber surface. The plenum chamber 820 may include cooling fins 824 disposed along at least on surface of the plenum chamber. By containing the aircraft air within the plenum chamber, and dirt or other contaminant particles in the air are prevented from coming into contact with the circuit card 822. Additionally, if the circuit card 822, or other electronics located inside the housing 802, but outside the plenum chamber 820, overheat or present a fire hazard, the fire, smoke or fumes are contained within the metal housing 802 and cannot escape into the aircraft because the fan is sealed off from the interior of the housing that is outside of the plenum chamber. Thus, the housing is "self-extinguishing" and greatly reduces any electrical, thermal, explosion, radiation, or other hazard that may otherwise be presented by locating the high power transceiver (and other electronics) within the aircraft 132.

Referring again to FIG. 66, in one example, the internal sub-system includes a fault indicator 812 to indicate when there is a malfunction in the internal sub-system 104. For example, the fault indicator may include a bi-color (e.g., white and black) flag, with one color being visible through the housing 802 at any given time. A first color (e.g., white) may indicate that the internal sub-system 104 is functioning within normal parameters, whereas the second color (e.g., black) may indicate a fault. In one example, the fault indicator is mechanically (e.g., magnetically) actuated such that it may operate even when power is not supplied to the internal sub-system 104.

As illustrated in FIGS. 1 and 62, in one embodiment, the high power transceiver 114, which may include a power amplifier (not shown) used in the transmit chain, is within the internal sub-system 104. It has been found that when the power amplifier is connected to the antenna array 106 via a cable, such as coaxial cable, significant loss can occur when the power amplifier is relatively far from the antenna array (i.e., the cable connecting them is long). However, as discussed above, in many applications it may be highly preferable to have the system electronics, including the power amplifier, inside the host vehicle (i.e., as part of the internal sub-system 104), which may result in a significant distance between the power amplifier and the antenna array 106. To address the issue of loss in the connection between the power amplifier and the antenna array 106, in one embodiment, the connector 140 includes a flexible waveguide that carries the transmit signal from the internal sub-system 104 (e.g., from the power amplifier) to the rotary joint 446. Flexible waveguide may be used to absorb connection tolerances and allow more flexibility in the placement of the waveguide and/or the internal sub-system housing 802. Waveguide is a low loss transmission medium. It has been found that by using a flexible waveguide connection, there is negligible degradation in the system performance resulting from the power amplifier being relatively far from the antenna array 106. In one example, a filter, such as a bandpass filter, is incorporated into the flexible waveguide connection element to filter out unwanted frequency components from the transmit signal. Thus, a single, easily replaceable element that includes both filtering components and transmission line for connecting the high power transceiver 114 to the antenna array 106 may be provided. Accordingly, replacing this single element may allow changing the bandpass filter, and thus making changes to the frequency band of operation of the system, without a need to change the internal sub-system 104. In addition, because the waveguide is a lower loss transmission medium than coaxial cable, the transmit signal may be lower power (because it experiences less loss on the path to the antenna array), thereby reducing the power consumption of the communications system. In addition, it is to be appreciated that a similar flexible waveguide connection element, optionally including filtering components, may be used in the receive chain to couple the transceiver 114 to the rotary joint 446 connecting to the low noise amplifier 604.

As discussed above, in some embodiments, the signal source 110 is a satellite and the communications system is mounted on an aircraft 132. According to aspects and embodiments, an important design consideration for an aircraft-mountable antenna system is to prevent interference to adjacent satellites. Where the aircraft location and flight profile might impact the quality of service, the quality of service goals may be addressed through satellite selection. Embodiments of the antenna system and service offered therewith may prove extremely attractive and commercially viable. Similarly, although several aspects and features are discussed with respect to an aircraft-mounted satellite communications system, they may apply similarly to a communications system mounted on another type of vehicle or one that receives signals from a terrestrial source or other vehicle, rather than from a satellite.

The pointing accuracy of the antenna array 106 (i.e., how accurately the antenna array can be aimed at the signal source 110 or signal destination) may be a critical performance metric for the communications system. Pointing accuracy may be important both to prevent interference with neighboring satellites to the target satellite as well as to ensure good quality of service of the communications system. However, particularly where the communications system is mounted on a vehicle, such as aircraft 132, there are numerous conditions (e.g., shape and available mounting locations, environmental factors and mechanical tolerances) that can adversely affect the pointing accuracy if not accounted for. Accordingly, in one embodiment, a calibration procedure is used to correct for mechanical tolerances in the antenna array and structural tolerances in the host vehicle, and to automatically detect and adjust for replacement of components, as discussed further below. In one example, the calibration procedure may account for positional offsets and biases in the external subsystem relative to the vehicle's navigational system. The following discussion will assume that the vehicle is an aircraft, and refer to the aircraft's inertial navigation system 122; however, it is to be appreciated that the calibration procedure may be applied regardless of the type of vehicle on which the system is installed.

There are a number of degrees of freedom for an antenna array 106 with respect to pointing and alignment with a desired target satellite, including the antenna array alignment, the azimuth rotation axis of the antenna array, the elevation rotation axis of the antenna array and the polarization rotation axis of the antenna array. All satellite antennas must be oriented in azimuth, elevation, and polarization to point at the desired satellite. According to one embodiment, the antenna array 106 has a non-circular aperture with a beam pattern that is wider in elevation and therefore, it may be necessary to align the aperture with the target satellite orbital arc to prevent the contribution of the wider elevation beam pattern from causing interference with an adjacent satellite. In order to prevent the wider beam pattern in elevation from interfering with adjacent satellites, the major axis of the antenna may be aligned with the tangent to the geosynchronous arc at the target satellite point, to the extent required to meet specified off-axis EIRP (effective isotropic radiated power) criteria. Tangential alignment of the antenna array aperture with the orbital arc of the target satellite is referred to as antenna alignment or aperture alignment. In addition, the polarization of the feed should be aligned with the polarization of the satellite to prevent cross-polarization interference.

Since the orientation of the aperture of the antenna array 106 is fixed with respect to the fuselage of the aircraft on which it is mounted by the gimbal assembly 108, the antenna alignment will vary as the aircraft experiences orientation changes in pitch, roll and yaw during flight. Thus, in embodiments of the antenna system in which the antenna has a non-circular antenna aperture, independent consideration of the polarization axis and the alignment of the antenna aperture may be necessitated. Although the term "misorientation" is sometimes used to address errors in the aperture major axis orientation alignment with the geosynchronous satellite arc, this document will refer to this degree-of-freedom as aperture alignment, with a value of zero indicating perfect alignment (zero mis-orientation). Pointing error is limited to the angular difference between the main beam of the antenna and the true direction of the target satellite.

All four antenna axes (azimuth, elevation, polarization and major axis orientation) are impacted both by location (latitude and longitude) and orientation (roll, pitch, and heading) of the antenna mount. As the aircraft location (latitude and longitude) and position (roll, pitch, and heading) vary throughout the flight profile, the antenna control unit may drive and monitor the antenna in these axes to maintain accurate pointing of the antenna main beam towards the satellite and prevent adjacent satellite interference.

As discussed above, the antenna array 106 can be rotated in azimuth about the aircraft's yaw axis to point the main beam of the antenna array at the target satellite. Similarly, the antenna array 106 can be rotated in elevation to point the main beam toward the satellite of interest. Errors in the pointing of the azimuth and elevation axes are referred to as "pointing error." As the aircraft orientation and position vary throughout the flight profile, the antenna control unit 112 may drive the antenna array 106 to maintain accurate pointing of the main beam of the antenna array at the target satellite. In typical circumstances, the aircraft may spend the large majority of its flight profile in straight and level flight. Accordingly, pointing error in the azimuth rotation axis may be the primary contributor to potential interference with adjacent satellites. Pointing error in the elevation rotation axis may couple with antenna alignment error to also contribute to potential interference with adjacent satellites. For example, if the antenna array 106 has an alignment error of zero degrees, any elevation axis pointing error is substantially perpendicular to the target satellite orbital arc and therefore may not contribute to interference with adjacent satellites. According to one example, aspects and embodiments of the calibration and/or tracking procedures discussed below account for pointing error and antenna alignment to reduce interference with adjacent satellites and improve quality of service of the communication system.

In addition, as discussed above, the polarization converter unit 128 may be used to compensate for polarization skew between the antenna array and the target satellite. For example, the linear polarization of the signal transmitted by (or received by) the antenna array 106 may be rotated clockwise or counter-clockwise about the main beam pointing vector using the polarization converter unit 128. In conventional dish antenna systems, polarization compensation is executed by rotating the linear feed horn on the mount structure in front of the dish. On conventional non-circular ground-mounted dish antennas the polarization rotation axis is fixed in alignment to the reflector such that polarization compensation and aperture alignment are identical with pointing corrections implemented by physical rotation of the elliptical reflector and attached feed horn. By contrast, according to one embodiment, antenna aperture alignment and polarization compensation are independent functions, with the polarization axis being driven by the antenna control unit 112 (using the polarization converter unit 128) to maintain beam alignment with the target satellite, while the antenna aperture alignment is a function of aircraft orientation (pitch, roll and heading) and location (latitude and longitude), as discussed further below.

According to one embodiment, the major axis of the aperture of the antenna 106 is fixed relative to the yaw axis of the aircraft 132, therefore the antenna alignment is a direct function of the aircraft orientation (pitch, roll, and heading) and will vary as the aircraft experiences geographical and orientation changes during flight. In one example, since the ACU 112 may not be able to drive this axis, this angle is calculated and monitored in order to prevent transmission in situations where the elevation antenna pattern would cause adjacent satellite interference, as discussed further below.

Figure 69A:
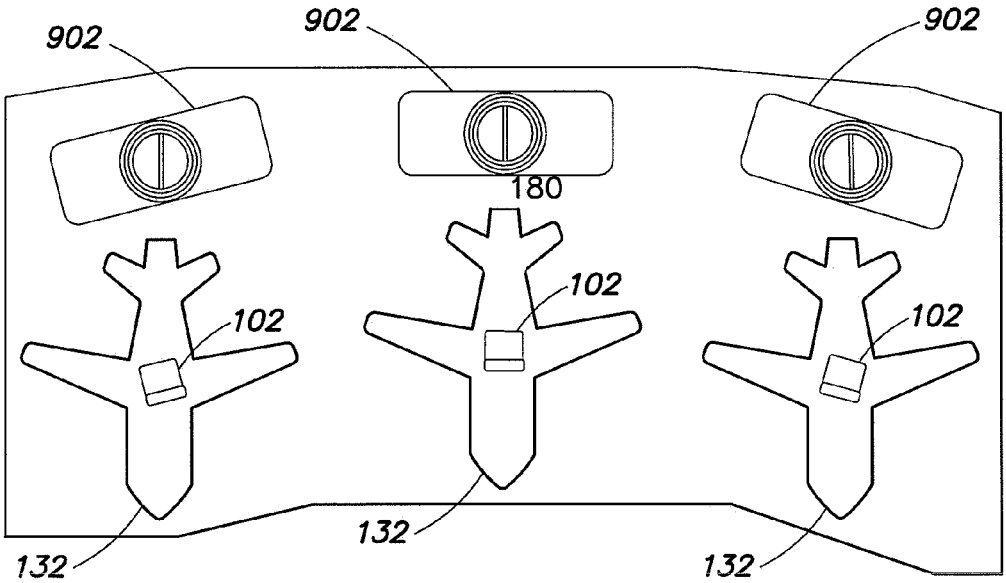
FIG. 69A is an illustration of aircraft movement from the point of view of a satellite signal source according to aspects of the invention.
Figure 69B:
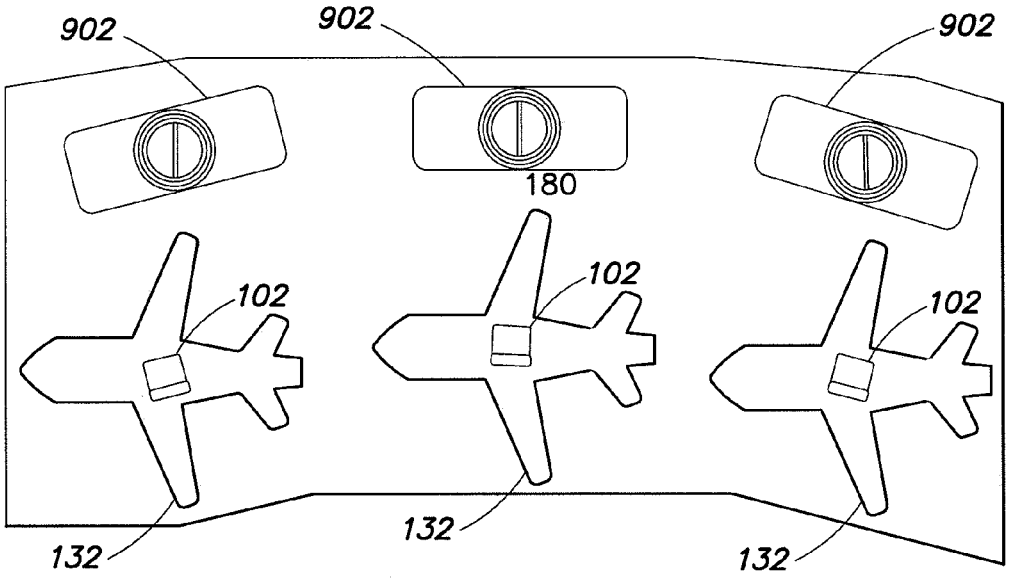
FIG. 69B is another illustration of aircraft movement from the point of view of a satellite signal source according to aspects of the invention.

FIGS. 69A and 69B illustrate the impact of aircraft location (latitude and longitude) and orientation (pitch, roll, and heading) on the above-mentioned antenna axes. For a fixed orientation (pitch, roll and heading), as the aircraft position changes the antenna may be rotated in all three movable axes. FIGS. 69A and 69B illustrated how the alignment of the major axis of the antenna varies as the aircraft longitude varies from the satellite longitude. For any given position, changes in the aircraft orientation may require correction to the three movable antenna axes. It is also noted that while the alignment varies, the antenna polarization orientation with the satellite is maintained, as represented by symbol 902.

According to one embodiment, normal flight operations are defined to be conditions where pitch, roll, and heading vary at rates up to 7 degrees per second simultaneously for all three axes, up to 8.5 degrees per second simultaneously on two axes and 12 degrees per second on a single axis. These values were established by evaluating data collected from actual flight operations, including recorded ARINC data profiles from aircraft operations during taxi, take-off, climb-out, low- and high-speed holding patterns, descent, landing, and taxi. These profiles include turns with very high bank angles up to 40 degrees (well in excess of the bank angle encountered in normal operations) and pitch-up angles to 17 degrees, and turn rates of up to 8 degrees per second, roll rates of up to 13 degrees per second, and pitch rates of up to 4 degrees per second. For example, one airline presently considers it "very rare" for an aircraft to exceed 15 degrees of bank during the cruise stage of flight. To the extent that a bank of up to 30 degrees would be encountered during normal flight, it would typically occur shortly after take-off in areas where topographical conditions would require terrain avoidance.

According to one embodiment, the antenna system has the following characteristics: The ability to correct for aircraft pitch, roll, and yaw sufficient to prevent adjacent satellite interference; the degree of pointing accuracy required to prevent adjacent satellite interference; and the capability to shut down transmission within 100 milliseconds of exceeding 0.5 degrees of pointing error, as discussed further below.

According to one embodiment, a factor that may be considered when considering the ability of the antenna system to achieve a specified pointing accuracy is the accuracy of the airline-installed inertial navigation system 122. In one example, the inertial navigation system 122 is a Honeywell Laser-Ring-Gyro-based Air Data Inertial Reference Unit. The current ARINC characteristic for this style of unit lists absolute accuracies for Roll and pitch at 0.1 degrees and for heading at 0.4 degrees. According to one embodiment, the antenna system does not rely on the inertial navigation system 122 data alone for absolute accuracy, but rather a variety of measurements which together provide the required pointing accuracy. These provide compensation for long-term errors that negatively affect the absolute accuracy of the inertial navigation system 122.

Figure 70:
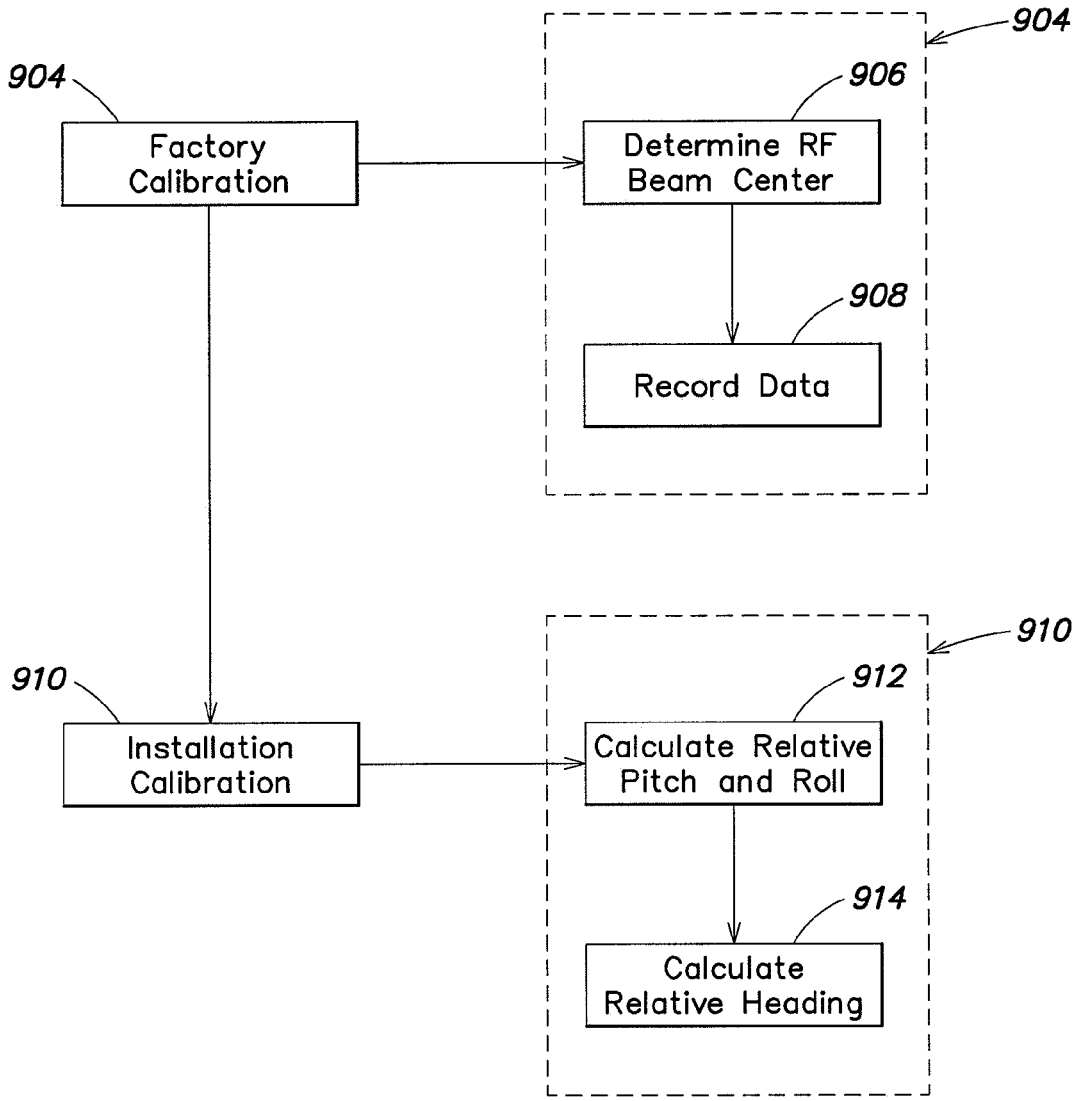
FIG. 70 is a flow diagram illustrating one example of a calibration process according to aspects of the invention.

Referring to FIG. 70, there is illustrated a flow diagram of one example of a calibration procedure. A first stage in the calibration procedure may include a factory calibration stage 904. This stage 904 may be performed before the communication system is installed on a vehicle. In one example, the antenna array 106 includes with one or more position encoders (also referred to as "tilt sensors"), mounted directly on the antenna array, that sense a pointing position of the antenna array in azimuth and elevation. The position encoders may allow a direct measurement of the gravity vector when the aircraft is stationary and on the ground. In one example, the position encoders provide data representative of the pitch and roll of the antenna array 106. The position encoders may be calibrated over angle and temperature in the factory to provide pitch and roll measurements accurate to within, for example, about 0.05 degrees. In one example, a position of the antenna array 106 relative to the mounting feet of the gimbal assembly 108 is established to accuracies of at least 0.01 degrees, independent of drive train compliance by placing the position encoders at the antenna load. In one example, the antenna axis trajectory is updated at a 10 ms rate, while the antenna position with respect to the trajectory is monitored at rates exceeding 1 ms. In one example, trajectory compliance has been measured at under 0.05 degrees.

During operation of the system, information from the position encoders may be fed back to the antenna control unit 112 (See FIG. 1) to assist the antenna control unit 112 in providing control signals to the motors (and associated motor drives) to point the antenna array 106 at a desired angle in azimuth and elevation. Therefore, in one embodiment, the factory calibration stage 904 includes a procedure to locate the RF center of the antenna array 106 relative to the locations of the position encoders (step 906). This procedure may account for any offset in position between the RF center of the antenna array 106 and the location of the encoders, allowing the encoders to be located at any convenient location on the array. In addition, variations in the position encoder data over temperature may also be calibrated. The calculated offsets may be stored (step 908) in the memory device 130 (See FIG. 1) that may be accessed by the antenna control unit 112 during further calibration and/or operation of the communication system. In one example, the information stored in the memory device 130 includes the position encoder calibration data (e.g., temperature variations etc.), mechanical calibration and correction data (e.g., offset between antenna array and position encoders), as discussed above, as well as normal operating parameters and limits, and (optionally) serial number and/or part number data for the external sub-system 102 as a whole or for individual components thereof (e.g., for the antenna array 106 or PCU 602). Mechanical calibration data may accounts for all geometric variables between the RF center of the antenna array 106 and the mounting and gimbal assemblies. The serial number and/or part number information may be used for automatic detection of (and correction for) part replacement, as discussed further below. Data storage in the memory device 130 allows individual characteristics of each external sub-system 102 to be determined and stored during factory manufacture and calibration step 904.

In one embodiment, the communication system includes two memory devices, one memory device 130 located in the external sub-system 102 and the other in the internal sub-system 104. The memory device 130 in the external sub-system 102 is referred to herein as the antenna memory 130, and the memory device in the internal sub-system is referred to herein as the antenna control memory. In one example, the antenna memory is part of the gimbal measurement unit 460 discussed above. It is to be appreciated that the antenna control memory may be incorporated as part of the antenna control unit 112 or may be a separate device (not shown in FIG. 1) communicatively coupled to the antenna control unit 112. The memories may be any type of suitable electronic memory including, but not limited to, random access memory or flash memory, as known to those skilled in the art. The antenna memory 130 and the antenna control memory may be communicatively coupled to one another to allow data transfer between the two memories. This data sharing between the antenna memory 130 and the antenna control memory may provide a complete data set for the communication system which may be used, for example, to detect and execute initial installation calibration procedures (discussed below), to detect replacement of various components of the communication system or of external components (such as the aircraft's inertial navigation system), and to recalculate system data set items as required by part replacements, as discussed further below.

In one embodiment, the calibration data, such as the offsets calculated above, may be stored in both the antenna memory 130 and the antenna control memory. Any changes or updates to the calibration memory may similarly be stored in both memories. This dual-memory structure may provide several advantages, including redundancy of the data (i.e., if one memory is damaged, the data will not be lost as it is also stored in the second memory) and the ability to "swap out" either the external or internal sub-systems (or components thereof) and replace them with new/updated components without having to redo the factory calibration. For example, if the internal sub-system were to be replaced, the new antenna control memory may download the calibration data stored in the antenna memory 130, thereby avoiding the need to recalibrate the system.

Referring again to FIG. 70, after factory calibration 904, the communications system may be installed on the host vehicle. Thus, a second stage of calibration may include an installation calibration 910. As discussed further below, the installation calibration procedure 910 may account for offsets and tolerances between the mounted antenna array 106 and the aircraft's inertial navigation system 122 and make installation of the external sub-system far simpler than conventional procedures.

Generally vehicles, including aircraft, do not have large flat surfaces upon which the external sub-system 102 can be mounted, but rather the surfaces may have some slant or curvature. Accordingly, when the external sub-system is mounted on such a surface, there will be some offset of the antenna array from level. Furthermore, given that it may be unlikely that the antenna array will be mounted very close to the aircraft's inertial navigation system sensors, there may also be an offset between the antenna array 106 and the inertial navigation system 122. The installation calibration procedure 910 may account for these offsets, as discussed further below. Conventional installation procedures may allow the external sub-system 102 may be accurately placed to within a few tenths of a degree to the know biases of the aircraft's inertial navigation system 122. However, if not compensated for, even this few tenths of a degree can cause the antenna array to not point at the satellite accurately enough for the onboard receivers to lock on the signal using only a pointing calculation, and thus may result in loss of signal for the passenger. Furthermore, accurate placement of the external sub-system 102 on the vehicle may be difficult and time-consuming. It may therefore be preferable to use an installation calibration procedure 910 that obviates the need for accurate placement of the external sub-system on the vehicle.

As discussed above, the external sub-system 102 may include one or more position encoders that may sense a pitch and roll of the antenna array 106 once it is installed on the vehicle. In one example, the pitch and roll of the antenna array may be calculated relative to the pitch and roll of the on-board inertial navigational system 122 (step 912). In one example, step 912 includes using on-board parameters to measure offsets between the antenna array frame-of-reference (measured by the position encoders and corrected using the stored factory calibration data) and the aircraft frame-of reference (measured using the inertial navigation system 122). This allows determination of pitch and roll offsets without time-consuming manual calibration and removes aircraft manufacturing tolerances. In addition, because all pitch and roll offsets can be accounted for by the calibration, there is no need to accurately place the external sub-system 102 on the aircraft. Rather, the error between the antenna array alignment and inertial navigational system alignment is simply stored in memory devices and compensated for by the antenna control unit 112 when it supplies pointing control signals to the antenna array 106. Thus, the installation calibration 910 may greatly improve the ease of installation of the system.

The aircraft's inertial navigation system 122 may typically have built-in accuracies as well as mechanical tolerances that arise from its installation. For example, a Laser-Ring-Gyro-based inertial navigation system available from Honeywell Corporation has absolute accuracies for roll and pitch at 0.1 degrees and for heading at 0.4 degrees.

Some factors which contribute to the absolute accuracy of the inertial navigation system 122 include latency, long-term drift, repeatability, and installation accuracy. Signal latency is a large contributor to orientation accuracy. Data has indicated that the maximum transport delay for heading is about 110 milliseconds (ms) while that for pitch and roll is about 50 ms. During a standard-rate turn of the aircraft of 3 degrees per second, this would amounts to 0.330 degrees in heading. Laboratory characterization of several flight-line inertial navigation units has shown that this latency value is very consistent at rates of turn from 3 to over 30 degrees per second, with a variation in latency of less than about 2 ms from unit to unit. In one example, latency correction in the antenna control unit 112 may reduce the relative error to less than 0.07 degrees. In another example, the processing used to correct for latency is also used to correct for latency in the processing and motor control loop, such that the actual antenna pointing vector does not lag the desired pointing vector.

Even with advanced filters, the inertial navigation unit 122 may experience a roughly 90-minute Schuler-cycle variance in the heading output, plus a 24 hour cyclic variation when stationary. In one example, the worst-case measured variation rate was 0.0008 degrees over 15 minutes and a total 24-hour peak-to-peak variation of 0.12 degrees. Each time an inertial navigation unit 122 is turned on and goes through its alignment process, the resultant orientation may change slightly. Variations, or lack thereof, in the orientation are referred to as repeatability of the unit. In one example, the worst-case measured heading peak variation was 0.035 degrees while the worst-case roll peak variation was 0.0325, and the worst case peak pitch variation was 0.0225 degrees. Conventional installation procedures require an installation accuracy of the inertial navigation unit of about 0.2 degrees for each axis. Using embodiments of the installation and calibration procedures disclosed herein, this installation accuracy requirement may be relaxed to several degrees, as discussed further below. These various errors and tolerances may significantly impact the absolute accuracy of the aircraft orientation provided by the inertial navigation system 122, even though the relative accuracy of the inertial navigation system remains high. In addition, as discussed further below, slow drift components may further negatively impact the accuracy of the inertial navigation system data. However, contrary to conventional systems, embodiments of the communication system do not rely on the inertial navigation data alone for absolute accuracy, but rather a variety of measurements which together provide the desired pointing accuracy. In one embodiment, neither the orientation of the aircraft's internal navigation system 122 nor the orientation of the antenna array 106 are assumed to be accurate, but instead are measured during the installation calibration, and optionally every time the system is powered up, so that effects of misalignment can be accounted for during the pointing process. In addition, drift terms in the inertial navigation system data may be compensated for, further improving the systemic pointing accuracy.

As discussed above, position encoders on the external subsystem 102 provide measured pitch and roll data which, as part of the calibration procedure, may be combined with data from the inertial navigation system 122 to calculate the frame of reference difference between the inertial navigation system and the antenna array 106, independent of whether this offset is caused by alignment errors and mechanical tolerances of the inertial navigation system installation or of the antenna array installation. In one example, at installation, and optionally every time the system is powered up on the ground, the true pointing vector to the satellite may be determined by a tracking subsystem. This vector may be combined with the pitch and roll frame-of-reference offsets to establish the true orientation of the antenna array 106 and of the inertial navigation system 122. As discussed above, this data may be verified and updated whenever the aircraft is stationary on the ground because the position encoders can measure a gravity vector when the aircraft is stationary on the ground. Accordingly, this data may be used to automatically correct for repeatability variations in the inertial navigation system 122.

Conventional antenna alignment processes are typically only performed during initial antenna system installation and are done by manual processes. Conventional manual processes usually do not have the ability to input delta roll, delta pitch and delta yaw numbers, so the manual process requires the use of shims. These shims are small sheets of filler material, for example aluminum shims, that are positioned between the attachment base of the antenna and the aircraft, for example, to force the antenna system coordinates to agree with the navigation system coordinates. However, the use of shims requires the removal of the radome, the placement of shims and the reinstallation of the radome. This is a very time consuming and dangerous approach. Only a limited number of people are authorized to work on top of the aircraft and it requires a significant amount of staging. Once the alignment is completed the radome has to be reattached and the radome seal cured for several hours. This manual alignment process can be very time-consuming and difficult. By contrast, the automatic installation calibration procedure 910 may be performed quickly and easily without the need to move the antenna array.

Referring again to FIG. 70, after the pitch and roll offsets have been calculated by comparing the (corrected) data from the position encoders and data from the inertial navigation system 122, and stored (step 912), the heading offset may be calculated using a satellite signal lock (step 914). In one example, step 914 may include instructing the antenna control unit 112 to point the antenna array 106 at a known satellite to check heading alignment of the antenna array 106 with the navigational system 122. When this alignment check is requested, the antenna control unit 112 may initially use the inertial navigation data to point at the chosen satellite. Initially, i.e., when the antenna array 106 has not been aligned or calibrated for heading offsets, the system may start scanning the area to look for a peak received signal. The peak may be determined when the system has located the highest signal strength. The error between the antenna's pointing heading (determined using the position encoders, for example) and the heading indicated by the navigational system may be calculated and recorded in the memory devices, as discussed above. Because the pitch and roll offsets may already have been determined (step 912) and compensated for, the heading offset may be calculated using a single satellite.

Thus, the installation calibration procedure 910 may be used to easily and automatically account for any bias or offset between the antenna array 106 and the aircraft's inertial navigational system 122. This allows the antenna control unit 112 (See FIG. 1) to receive navigational information from the inertial navigational system 122 of the vehicle and use the navigational information to accurately point the antenna array 106, without errors resulting from offset between the inertial navigational system 122 and the antenna array 106. According to one embodiment, installation calibration procedure 910 may be implemented with software running on or under control of the antenna control unit 112. The installation calibration data may also be stored in both the antenna memory 130 and the antenna control memory.

As discussed above, in one embodiment, the communication system is capable of automatically detecting replacement of various system components and adjusting for this replacement through the communication between the antenna memory 130 and the antenna control memory. In one example, at power-up, each of the antenna memory 130 and the antenna control memory may query the other to determine whether either memory device is new, using the shared and locally stored data. By comparing the existing data with any new data provided by the new memory device, the system can automatically calculate compensations for the potentially different tolerances and parameters of the new component identified by the new memory device. At each power-up, the system may determine whether conditions exist to re-evaluate the current calibration offsets. If such conditions exist, then the system may evaluate whether the current offsets remain valid. This provides for detection and correction of any airframe changes including replacement of the inertial navigation system 122. In addition, tracking updates during flight may address any slow drift from the inertial navigation system 122 and/or airframe mechanical changes as might be caused by hull pressurization and temperature effects.

According to one example, it has been found that the contribution of aircraft fuselage flex to pointing error is very small. This is because fuselage flex occurs primarily in the pitch axis which has almost no effect on pointing accuracy in the geosynchronous satellite orbital arc. In the yaw direction which may contribute to pointing error in the geosynchronous satellite orbital arc, aircraft flex is extremely limited. In one example, instrumented tail-mounted antenna array installations have recorded maximum measured flex contributions on the order of about 0.05 degrees. Accordingly, in one embodiment, the contribution of airframe flex is considered to be in the measurement noise.

According to aspects and embodiment, the above-discussed procedure may provide excellent antenna alignment. According to one embodiment, polarization rotation axis and antenna aperture alignment are separate. The aircraft location (latitude, longitude) and orientation (pitch, poll, and heading) are both used to calculate the antenna alignment, in one example, at a 10 millisecond rate. According to one example, when the calculated antenna alignment angle exceeds ±25 degrees with respect to the geosynchronous satellite arc for any reason, transmission is inhibited. This worst-case impact on alignment peaks only over a small range of heading angles. While some maneuvers may necessitate momentary blanking of transmissions, embodiments of the communications system are completely tolerant of such transmission blanking, simply pausing the connected session with no further consequence to any user. Further, for the public's use of the system, which may be limited to altitudes above 10,000 feet by FAA regulations, only a small number of relevant maneuvers occur in the course of a typical flight, meaning any inconvenience will be minor in comparison with the benefit provided.

In some applications, even after precise calibration, navigational data alone may be insufficient to keep the antenna array locked to a desired source within acceptable tolerance levels. Therefore, according to one embodiment, the antenna control unit 112 may implement a tracking algorithm that may use both navigational data and signal feedback data to track a signal source. The tracking algorithm may always be looking for the strongest satellite signal, thus if the inertial navigation data is slow, the tracking algorithm may take over to find the optimum pointing angle. When the inertial navigation data is accurate and up to date, the system may use the inertial data to compute its azimuth and elevation angles since this data will coincide with the peak of the beam. This is because the inertial navigation system coordinates may accurately point the antenna, without measurable error, at the intended satellite; that is, predicted look angles and optimum look angles will be identical. When the inertial navigation data is not accurate the tracking software may be used to maintain the pointing as it inherently can "correct" differences between the calculated look angles and optimum look angles up to about 5 degrees.

In one embodiment, the antenna array may be controlled to locate a peak of a desired signal from the information source. The antenna array may then be "dithered" about the signal peak to determine the beam width of the source signal (relative to the beam width of the antenna array). In one example, the tracking algorithm perturbs the antenna pointing vector by small known amounts and uses the resulting measurements to drive the antenna towards the actual peak. For example, the antenna control unit 112 may monitor the amplitude of the received signal may use the amplitude of the received signal to determine the optimum azimuth and elevation pointing angle by discretely repositioning the antenna from its calculated position to slight offset positions and determining if the signal received strength is optimized, and if not repositioning the antenna orientation in the optimized direction, and so forth. In one example, each tracking cycle update typically perturbs the antenna pointing vector from the current center point for a total of 2 seconds to validate and verify pointing accuracy. This subsystem maintains the pointing vector within +/−0.1 degrees of the actual peak, providing direct feedback of the actual satellite pointing vector as offset from the expected satellite pointing vector. All slow-drift pointing error contributions may be nulled by the tracking process, including passenger and freight loading, pressurization, and temperature effects.

As known to those experienced in the art, geometric calculations can be easily used to determine look angles to geostationary satellites from known coordinates, including those from aircraft. By locating and tracking three satellites, triangulation data can be used to further refine any biases between the antenna array look directions and the navigational system data. The refined error may then be stored in the antenna control memory and antenna memory 130 and used to facilitate accurate tracking of a desired signal source 110 during operation of the system.

Referring again to FIG. 62, in one example to implement the tracking algorithm, the antenna control unit 112 may sample the received signal from, for example, the DCU 148 (on line 166), although it is to be appreciated that the antenna control unit 112 may alternatively sample the signal from the signal processing electronics 152 or a second DCU (not shown). Thus, although the following discussion will refer to the signal from the DCU 148 being sampled, it is to be appreciated that the invention is not so limited. According to one embodiment, the control interface 174 of the DCU 148 may sample the signal on line 166 and may provide a signal to the antenna control unit 112 via line 176. It is to be appreciated that the sampling may require components such as, for example, directional couplers, an RF detector and analog-to-digital converter (not shown) to take the IF signal from lines 166 and convert it to information to be supplied to the antenna control unit 112. The antenna control unit 112 may use the amplitude of the sampled signal to adjust the pointing angle of the antenna array, similar to the dithering discussed above as part of a continuing calibration procedure. The tracking/in-flight calibration procedure may also be used to update offsets in-flight to address in-flight changes and slow drift of aircraft components.

In one example, the offsets may be maintained between tracking cycle updates with update cycles executed at a tunable period and whenever the aircraft completes a dynamic maneuver. This may ensure that all long-term drift elements to the pointing vector are removed from the pointing process while minimizing the potential impact of the typically +/−0.2 degree perturbation on the pointing error margin. In one example, the same feed is used for both the transmit and receive signal and no active phase shifting components are used. Accordingly, the offset between the transmit beam and receive beam is not a factor. Tracking may be performed in cooperation with the modem 116 to ensure the correct satellite is being used.

According to one embodiment, during normal flight operations the transmit frequency needs to be offset by the expected Doppler frequency change caused by the relative velocity of the aircraft 132 to the satellite. In one example, this phenomenon is addressed by calculating the Doppler shift caused by the relative velocity of the aircraft to the satellite. Onboard the aircraft, the system provides the velocity of the aircraft in three dimensional space. From that relative velocity the frequency can be calculated and the modem 116 on the aircraft is configured to compensate or adjust for the Doppler offset. As a result of the Doppler correction a 10 MHz reference signal that is normally created from the signal may be corrupted and therefore no longer useable. Accordingly, in one example, a separate, compensated 10 MHz signal is created that is used as the frequency reference for the whole system.

According to one embodiment, fault handling functions may serve to monitor pointing accuracy compliance, and any fault detected may result in direct inhibition of transmission through shutdown of the output power amplifier. In one example, shutdown is implemented via a discrete line to the high power transceiver 114, eliminating latency and preventing communications or software faults from preventing the shutdown. In one example, the system may validate that any pointing error is less than 0.2 degrees prior to allowing signal transmission to resume.

Mis-pointing faults can have various causes, including, for example, power loss, mechanical drive train failure, loss of motor control, loss of RF signal measurement, and inertial navigation system, or system data, failure. In one example, both input AC power and internal DC power are monitored for voltage and current. Any out of bound events may result in transmission shutdown. In another example, if AC power is lost to the antenna control unit 112 for more than a specified time period, e.g., over 50 milliseconds, transmission may be disabled. Mechanical failure is characterized by loss of continuity or impairment between the drive motor and the antenna load. In one example, since the antenna position is measured by the position encoders at the antenna and not at the motor, such a failure results in position errors being detected by the antenna control unit 112.

In another example, the antenna control unit 112 maintains a connection to the modem 116 in order to monitor RF signal level. Errors in this communication link may inhibit transmission. This measurement by the modem may prevent the antenna array from tracking or enabling transmission when pointed at an incorrect satellite. All data from the inertial navigation system 122 may be validated and monitored for errors. Loss of the data stream for any of the aircraft orientation labels may inhibit transmission. Some installations may allow for fallback and cross-verification between multiple inertial navigation data sources. To detect whether the inertial navigation system 122 is generating false data, the RF level may be monitored for a short-term drop indicating a pointing error of over 0.5 degrees. In addition, if the tracking subsystem detects a deviation indicating a pointing error of over 0.2 degrees, transmission may be disabled.

According to one embodiment, any faults detected will result in signal transmission shutdown, including failure of the antenna array 106 to follow the proscribed trajectory within tolerance, failure of the feedback signals measuring the antenna position, and failure of the motor feedback signals from the motor. In one example, all of these signals are monitored at rates better than 1 millisecond. Any faults in communications to the gimbal assembly may also result in transmission shut down. In one example, communications are monitored at a 10 millisecond rate. In one example, during normal aircraft dynamics, nearly all of the fault detection functions will be triggered long before a pointing error of 0.5 degrees can be achieved. In this manner, interference with satellites adjacent the target satellite may be avoided. Furthermore, in one example, transmission will be disabled before the antenna array is slewed to the new target satellite. The system may require that the new satellite signal be locked and pointing verified to less than 0.2 degrees by the tracking subsystem prior to transmission resumption, thereby also avoiding interference with adjacent satellites. In addition, as discussed above with reference to FIGS. 33A-35F, the antenna array 106 may be designed to reduce unwanted sidelobes in the beam pattern, which may further reduce the risk of interference with adjacent satellites. In one example, the system does not interfere with adjacent satellites even with a polarization angle, or mis-alignment, of up to about 35 degrees and a pointing error of up to about 0.4 degrees.

Having thus described several aspects of at least one embodiment, it is to be appreciated various alterations, modifications, and improvements will readily occur to those skilled in the art. Such alterations, modifications, and improvements are intended to be part of this disclosure and are intended to be within the scope of the invention. Accordingly, the foregoing description and drawings are by way of example only.

The invention claimed is:

1. An antenna array comprising:

a plurality of horn antenna elements arranged in at least one row of horn antenna elements extending from a first end of the antenna array to a second end of the antenna array, each horn antenna element of the plurality of horn antenna elements configured to receive an information signal and to provide the information signal at a feed point of the horn antenna element; and a waveguide feed network coupling the plurality of horn antenna elements to a common array feed point, the waveguide feed network configured to sum the information signals from the plurality of horn antenna elements to provide a summed signal at the common array feed point; wherein a center-to-center horn spacing between adjacent ones of the plurality of antenna elements in the at least one row is approximately equal to one wavelength at substantially a highest transmit frequency of the antenna array; and wherein each row of horn antenna elements comprises 32 horn antenna elements;

wherein each row of horn antenna elements includes an interior horn antenna element, a third horn antenna element, a second horn antenna element, and an end horn antenna element;

wherein the third horn antenna element is smaller than the interior horn antenna element and is located closer to the first end of the antenna array than the interior horn antenna element;

wherein the second horn antenna element is smaller than the third horn antenna element and is located adjacent to the third horn antenna element and closer to the first end of the antenna array than the third horn antenna element; and wherein the end horn antenna element is smaller than the second horn antenna element and is located adjacent to the second horn antenna element and at the first end of the antenna array.

2. The antenna array as claimed in claim 1, wherein the plurality of horn antenna elements are arranged in two parallel rows, and wherein the two parallel rows are offset from one another along the length of the antenna array by one half the width of one of the plurality of horn antenna elements.

3. The antenna array as claimed in claim 1, further comprising a corresponding plurality of dielectric lenses, each dielectric lens of the plurality of dielectric lenses being coupled to a respective horn antenna element of the plurality of horn antenna elements.

4. The antenna array as claimed in claim 3, wherein the plurality of dielectric lenses elements includes an interior dielectric lens, a third dielectric lens, a second dielectric lens, and an end dielectric lens;

wherein the interior dielectric lens is coupled to the interior horn antenna element;

wherein the third dielectric lens is smaller than the interior dielectric lens and is coupled to the third horn antenna element;

wherein the second dielectric lens is smaller than the third dielectric lens and is coupled to the second horn antenna element; and wherein the end dielectric lens is smaller than the second dielectric lens and is coupled to the end horn antenna element.

5. The antenna array as claimed in claim 1, further comprising a plurality of horn inserts, each one of the plurality of horn inserts being located within a respective one of the plurality of horn antenna elements.

6. The antenna array as claimed in claim 5, wherein the horn inserts located within the end horn antenna element and the second horn antenna elements are made of a radar absorbent material.

7. The antenna array as claimed in claim 1, further comprising:

a corresponding plurality of orthomode transducers, each respective orthomode transducer coupled to a respective horn antenna element and configured to split the information signal into a first component signal and second component signal, the first and second component signals being orthogonally polarized; and wherein the waveguide feed network couples the plurality of orthomode transducers to the common array feed point, the waveguide feed network configured to sum the component signals from each orthomode transducer to provide the summed signal at the common array feed point.

8. The antenna array as claimed in claim 7, wherein the waveguide feed network comprises a first path to guide the first component signal and a second path to guide the second component signal;

wherein the first path sums in the E-plane the first component signals received from each orthomode transducer;

wherein the second path sums in the H-plane the second component signals received from each orthomode transducer;

wherein the waveguide feed network is configured to provide at the common array feed point a first summed component signal and a second summed component signal; and wherein the summed signal comprises the first summed component signal and the second summed component signal.

9. The antenna array as claimed in claim 8, wherein the plurality of orthomode transducers comprises a first orthomode transducer coupled to a first horn antenna element and a orthomode transducer coupled to a second horn antenna element;

wherein the first path of the waveguide feed network includes an E-plane waveguide T-junction having a first input configured to receive the first component signal from the first orthomode transducer and a second input configured to receive the first component signal from the second orthomode transducer, and an output configured to provide an output signal corresponding to a weighted sum of the two first component signals; and wherein the waveguide T-junction comprises a tuning element configured to bias the waveguide T-junction to produce the weighted sum of the two first component signals.

10. The antenna array as claimed in claim 9, wherein the second path of the waveguide feed network comprises an H-plane waveguide T-junction having a first input configured to receive the second component signal from the first orthomode transducer and a second input configured to receive the second component signal from the second orthomode transducer, and an output configured to provide an output signal corresponding to a weighted sum of the two second component signals.

11. The antenna array as claimed in claim 9, wherein each of the E-plane waveguide T-junction and the H-plane waveguide T-junction includes impedance matching portions at each of the respective first and second inputs.

12. The antenna array as claimed in claim 8, wherein the first and second paths of the waveguide feed network comprises a same number of bends.

13. The antenna array as claimed in claim 7, wherein the waveguide feed network comprises a first path to guide the first component signal and a second path to guide the second component signal;

wherein the first path sums the plurality of first component signals received from the plurality of orthomode transducers to provide a first summed component signal at the common array feed point; and wherein the second path sums the plurality of second component signals received from the plurality of orthomode transducers to provide a second summed component signal at the common array feed point.

14. The antenna array as claimed in claim 13, wherein the first path of the waveguide feed network comprises at least one first E-plane element configured to sum the plurality of first component signals in the E-plane and at least one first H-plane element configured to sum the plurality of first component signals in the H-plane; and wherein the second path of the waveguide feed network comprises at least one second E-plane element configured to sum the plurality of second component signals in the E-plane and at least one second H-plane element configured to sum the plurality of second component signals in the H-plane.

15. The antenna array as claimed in claim 7, further comprising a polarization converter unit coupled to the common feed point, the polarization converter unit configured to compensate for polarization skew between the antenna array and the signal source.

16. The antenna array as claimed in claim 15, wherein the polarization converter unit comprises:

a rotary orthomode transducer configured to receive the first and second summed component signals and to provide a polarization-corrected output signal;

a drive system coupled to the rotary orthomode transducer configured to receive a control signal representative of a desired degree of rotation of the rotary orthomode transducer to provide the polarization-corrected output signal; and a motor configured to provide power to the drive system to rotate the rotary orthomode transducer to the desired degree of rotation.

17. The antenna array as claimed in claim 16, further comprising a low noise amplifier coupled to the rotary orthomode transducer and configured to receive and amplify the polarization-corrected output signal.

18. The antenna array as claimed in claim 15, wherein the plurality of antenna elements and the waveguide feed network are arranged to provide a cavity between the feed waveguide network and the plurality of antenna elements; and wherein the polarization converter unit is mounted at least partially within the cavity.

19. The antenna array as claimed in claim 15, wherein the polarization converter unit comprises electronic circuitry configured to compensate for the polarization skew between the antenna array and the signal source.

20. The antenna array as claimed in claim 3, wherein each dielectric lens of the plurality of dielectric lenses is a plano-convex lens having a planar side and an opposing convex side;

wherein each dielectric lens comprises a plurality of impedance matching features formed proximate an interior surface of the convex side; and wherein an exterior surface of the convex side is smooth.

21. The antenna array as claimed in claim 20, wherein the plurality of impedance matching features includes a plurality of hollow tubes.

22. The antenna array as claimed in claim 21, wherein each dielectric lens further comprises a second plurality of impedance matching grooves extending from a surface of the planar side into an interior of the dielectric lens.

23. The antenna array as claimed in claim 3, wherein the plurality of dielectric lenses comprise a cross-linked polystyrene material.

24. The antenna array as claimed in claim 1, wherein the plurality of horn antenna elements are arranged in N parallel rows of horn antenna elements, wherein N is an integer in the range from 1 to 8.

25. The antenna array as claimed in claim 24, wherein N is selected from the group consisting of 1, 2, 4 and 8.

26. The antenna array as claimed in claim 1, wherein the waveguide feed network is configured to weight a signal contribution of each of the information signals from the plurality of horn antenna elements to the summed signal to control a beam pattern of the antenna array.

27. The antenna array as claimed in claim 1, wherein the plurality of horn antenna elements includes a first horn antenna element configured to provide a first antenna output signal and a second horn antenna element configured to provide a second antenna output signal;

wherein the waveguide feed network includes a waveguide T-junction having a first input configured to receive the first antenna output signal, a second input configured to receive the second antenna output signal, and an output configured to provide an output signal corresponding to a weighted sum of the first and second antenna output signals; and wherein the waveguide T-junction comprises a tuning element configured to bias the waveguide T-junction to produce the weighted sum of the first and second antenna output signals.

28. The antenna array as claimed in claim 27, wherein the waveguide T-junction comprises a septum disposed approximately centrally between the first and second inputs.

29. The antenna array as claimed in claim 28, wherein the tuning element comprises a tuning cylinder located at a tip of the septum and protruding into the waveguide T-junction.

30. The antenna array as claimed in claim 27, wherein the tuning element is offset relative to a center of the waveguide T-junction to bias the waveguide T-junction.

31. An antenna array comprising:

a plurality of horn antenna elements arranged in N parallel rows extending from a first end of the antenna array to a second end of the antenna array, each row comprising 32 horn antenna elements, each horn antenna element configured to receive an information signal and to provide at a feed point of the horn antenna element an antenna output signal;

a corresponding plurality of orthomode transducers, each respective orthomode transducer coupled to a respective horn antenna element of the plurality of horn antenna elements and configured to split the respective antenna output signal into a first component signal and second component signal such that the plurality of orthomode transducers provides a corresponding plurality of first component signals and a corresponding plurality of second component signals;

a waveguide feed network coupling the plurality of horn antenna elements to a common array feed point, the waveguide feed network comprising a first path to guide the first component signal and a second path to guide the second component signal, the first and second paths comprising a same number of bends in each direction, wherein the first path of the waveguide feed network sums the plurality of first component signals received from the plurality of orthomode transducers to provide a first summed component signal at the common array feed point, and wherein the second path of the waveguide feed network sums the plurality of second component signals received from the plurality of orthomode transducers to provide a second summed component signal at the common array feed point; and a polarization converter unit coupled to the common array feed point and configured to receive the first and second summed component signals and to compensate for polarization skew between the antenna array and a source of the information signal;

wherein N is an integer selected from the group consisting of 1, 2, 4 and 8;

wherein the waveguide feed network includes both E-plane summing elements and H-plane summing elements, and wherein the E-plane and H-plane summing elements are configured to provide weight an amplitude contribution of each of the first component signals to the first summed component signal, and to weight an amplitude contribution of each of the second component signals to the second summed component signal, to provide an amplitude taper across the plurality of horn antenna elements of the antenna array.

32. The antenna array as claimed in claim 31, wherein, for each row of the N rows of 32 horn antenna elements, the horn antenna elements are grouped into 16 pairs of adjacent horn antenna elements; and wherein the waveguide feed network includes, in each of the first and second paths, a summing element for each pair of adjacent horn antenna elements, the summing element being one of an E-plane summing element and an H-plane summing element.

* * * * *